US011944878B2

(12) United States Patent
Beach et al.

(10) Patent No.: US 11,944,878 B2
(45) Date of Patent: Apr. 2, 2024

(54) GOLF CLUB

(71) Applicant: Taylor Made Golf Company, Inc., Carlsbad, CA (US)

(72) Inventors: Todd P. Beach, Encinitas, CA (US); John Francis Lorentzen, El Cajon, CA (US); Bing-Ling Chao, San Diego, CA (US); Mark Vincent Greaney, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/825,820

(22) Filed: May 26, 2022

(65) Prior Publication Data

US 2022/0370866 A1 Nov. 24, 2022

Related U.S. Application Data

(63) Continuation of application No. 17/064,528, filed on Oct. 6, 2020, now Pat. No. 11,369,846, which is a (Continued)

(51) Int. Cl.
*A63B 53/04* (2015.01)

(52) U.S. Cl.
CPC ..... *A63B 53/0466* (2013.01); *A63B 53/0408* (2020.08); *A63B 53/0412* (2020.08); *A63B 53/0433* (2020.08); *A63B 2053/0491* (2013.01)

(58) Field of Classification Search
CPC ..... A63B 53/0408; A63B 53/0412; A63B 2053/0491; A63B 60/02
See application file for complete search history.

(56) References Cited

U.S. PATENT DOCUMENTS 782,955 A 2/1905 Emens
796,802 A 8/1905 Brown
(Continued)

FOREIGN PATENT DOCUMENTS

DE 9012884 9/1990
EP 0446935 9/1991
(Continued)

OTHER PUBLICATIONS

Callaway Golf, World's Straightest Driver: FT-i Driver downloaded from www.callawaygolf.com/ft%2Di/driver.aspx?lang=en on Apr. 5, 2007.

(Continued)

*Primary Examiner* — John E Simms, Jr.
(74) *Attorney, Agent, or Firm* — Klarquist Sparkman, LLP

(57) ABSTRACT

A golf club head includes a club body including a crown, a sole, a skirt disposed between and connecting the crown and the sole and a face portion connected to a front end of the club body. The face portion includes a geometric center defining the origin of a coordinate system when the golf club head is ideally positioned, the coordinate system including an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis. The golf club head defines a center of gravity CG, the CG being a distance $CG_Y$ from the origin as measured along the y-axis and a distance $CG_Z$ from the origin as measured along the z-axis.

54 Claims, 55 Drawing Sheets

Related U.S. Application Data continuation of application No. 16/410,249, filed on May 13, 2019, now Pat. No. 10,828,540, which is a continuation of application No. 16/102,293, filed on Aug. 13, 2018, now Pat. No. 10,569,145, which is a continuation of application No. 15/838,682, filed on Dec. 12, 2017, now Pat. No. 10,226,671, which is a continuation of application No. 14/144,105, filed on Dec. 30, 2013, now Pat. No. 9,861,864.

(60) Provisional application No. 61/909,964, filed on Nov. 27, 2013.

(56) References Cited

U.S. PATENT DOCUMENTS

| | | | |
|---|---|---|---|
| 1,133,129 | A | 3/1915 | Govan |
| 1,454,267 | A | 5/1923 | Challis et al. |
| D63,284 | S | 11/1923 | Challis |
| 1,518,316 | A | 12/1924 | Ellingham |
| 1,526,438 | A | 2/1925 | Scott |
| 1,538,312 | A | 5/1925 | Beat |
| 1,592,463 | A | 7/1926 | Marker |
| 1,623,523 | A | 4/1927 | Bourke |
| 1,650,183 | A | 11/1927 | Brooks |
| 1,658,581 | A | 2/1928 | Tobia |
| 1,704,119 | A | 3/1929 | Buhrke |
| 1,890,538 | A | 12/1932 | Hadden |
| 1,895,417 | A | 1/1933 | Lard |
| 1,946,134 | A | 2/1934 | Dyce |
| 2,020,679 | A | 11/1935 | Fitzpatrick |
| 2,083,189 | A | 6/1937 | Crooker |
| D107,007 | S | 11/1937 | Cashmore |
| 2,214,356 | A | 9/1940 | Wettlaufer |
| 2,219,670 | A | 10/1940 | Wettlaufer |
| 2,225,930 | A | 12/1940 | Sexton |
| 2,225,931 | A | 12/1940 | Sexton |
| 2,360,364 | A | 10/1944 | Reach |
| 2,460,435 | A | 2/1949 | Schaffer |
| 2,464,850 | A | 3/1949 | Crawshaw |
| 3,064,980 | A | 11/1962 | Steiner |
| 3,085,804 | A | 4/1963 | Pieper |
| 3,166,320 | A | 1/1965 | Onions |
| 3,266,805 | A | 8/1966 | Bulla |
| 3,424,459 | A | 1/1969 | Evancho |
| 3,466,047 | A | 9/1969 | Rodia et al. |
| 3,468,544 | A | 9/1969 | Antonious |
| 3,486,755 | A | 12/1969 | Hodge |
| 3,524,646 | A | 8/1970 | Wheeler |
| 3,556,533 | A | 1/1971 | Hollis |
| 3,589,731 | A | 6/1971 | Chancellor |
| 3,606,327 | A | 9/1971 | Gorman |
| 3,610,630 | A | 10/1971 | Glover |
| 3,652,094 | A | 3/1972 | Glover |
| 3,692,306 | A | 9/1972 | Glover |
| 3,743,297 | A | 7/1973 | Dennis |
| 3,815,921 | A | 6/1974 | Turner |
| 3,829,092 | A | 8/1974 | Arkin |
| 3,836,153 | A | 9/1974 | Dance, Jr. |
| 3,840,231 | A | 10/1974 | Moore |
| 3,848,737 | A | 11/1974 | Kenon |
| 3,891,212 | A | 6/1975 | Hill |
| 3,893,670 | A | 7/1975 | Franchi |
| 3,893,672 | A | 7/1975 | Schonher |
| 3,897,066 | A | 7/1975 | Belmont |
| 3,937,474 | A | 2/1976 | Jepson et al. |
| 3,976,299 | A | 8/1976 | Lawrence et al. |
| 3,979,122 | A | 9/1976 | Belmont |
| 3,979,123 | A | 9/1976 | Belmont |
| 3,985,363 | A | 10/1976 | Jepson et al. |
| 3,997,170 | A | 12/1976 | Goldberg |
| 4,008,896 | A | 2/1977 | Gordos |
| 4,043,563 | A | 8/1977 | Churchward |
| 4,052,075 | A | 10/1977 | Daly |
| 4,065,133 | A | 12/1977 | Gordos |
| 4,076,254 | A | 2/1978 | Nygren |
| 4,077,633 | A | 3/1978 | Studen |
| 4,085,934 | A | 4/1978 | Churchward |
| 4,121,832 | A | 10/1978 | Ebbing |
| 4,139,196 | A | 2/1979 | Riley |
| 4,147,349 | A | 4/1979 | Jeghers |
| 4,165,076 | A | 8/1979 | Cella |
| 4,193,601 | A | 3/1980 | Reid, Jr. et al. |
| 4,214,754 | A | 7/1980 | Zebelean |
| D256,709 | S | 9/1980 | Reid, Jr. et al. |
| 4,247,105 | A | 1/1981 | Jeghers |
| 4,253,666 | A | 3/1981 | Murphy |
| D259,698 | S | 6/1981 | MacNeill |
| 4,306,721 | A | 12/1981 | Doyle |
| D265,112 | S | 6/1982 | Lyons |
| 4,340,227 | A | 7/1982 | Dopkowski |
| 4,340,229 | A | 7/1982 | Stuff, Jr. |
| 4,398,965 | A | 8/1983 | Campau |
| 4,411,430 | A | 10/1983 | Dian |
| 4,423,874 | A | 1/1984 | Stuff, Jr. |
| 4,431,192 | A | 2/1984 | Stuff, Jr. |
| 4,432,549 | A | 2/1984 | Zebelean |
| 4,438,931 | A | 3/1984 | Motomiya |
| 4,471,961 | A | 9/1984 | Masghati et al. |
| 4,498,673 | A | 2/1985 | Swanson |
| 4,506,888 | A | 3/1985 | Nardozzi, Jr. |
| 4,527,799 | A | 7/1985 | Solheim |
| 4,530,505 | A | 7/1985 | Stuff |
| 4,545,580 | A | 10/1985 | Tomita et al. |
| D284,346 | S | 6/1986 | Masters |
| 4,592,552 | A | 6/1986 | Garber |
| 4,602,787 | A | 7/1986 | Sugioka et al. |
| 4,607,846 | A | 8/1986 | Perkins |
| 4,618,149 | A | 10/1986 | Maxel |
| 4,630,826 | A | 12/1986 | Nishigaki et al. |
| 4,664,382 | A | 5/1987 | Palmer et al. |
| 4,712,798 | A | 12/1987 | Preato |
| 4,730,830 | A | 3/1988 | Tilley |
| 4,740,345 | A | 4/1988 | Nagasaki et al. |
| 4,754,974 | A | 7/1988 | Kobayashi |
| 4,754,977 | A | 7/1988 | Sahm |
| 4,787,636 | A | 11/1988 | Honma |
| 4,792,139 | A | 12/1988 | Nagasaki et al. |
| 4,793,616 | A | 12/1988 | Fernandez |
| 4,795,159 | A | 1/1989 | Nagamoto |
| 4,798,383 | A | 1/1989 | Nagasaki et al. |
| 4,809,978 | A | 3/1989 | Yamaguchi et al. |
| 4,848,747 | A | 7/1989 | Fujimura et al. |
| 4,852,782 | A | 8/1989 | Wu et al. |
| 4,854,582 | A | 8/1989 | Yamada |
| 4,867,457 | A | 9/1989 | Lowe |
| 4,867,458 | A | 9/1989 | Sumikawa et al. |
| 4,869,507 | A | 9/1989 | Sahm |
| 4,881,739 | A | 11/1989 | Garcia |
| 4,884,812 | A | 12/1989 | Nagasaki et al. |
| 4,895,367 | A | 1/1990 | Kajita et al. |
| 4,895,368 | A | 1/1990 | Geiger |
| 4,895,371 | A | 1/1990 | Bushner |
| 4,900,379 | A | 2/1990 | Chapman |
| 4,919,428 | A | 4/1990 | Perkins |
| 4,928,972 | A | 5/1990 | Nakanishi et al. |
| 4,943,059 | A | 7/1990 | Morell |
| 4,948,132 | A | 8/1990 | Wharton |
| 4,962,932 | A | 10/1990 | Anderson |
| 4,964,640 | A | 10/1990 | Nakanishi et al. |
| 4,995,609 | A | 2/1991 | Parente et al. |
| 5,000,454 | A | 3/1991 | Soda |
| 5,016,882 | A | 5/1991 | Fujimura et al. |
| D318,087 | S | 7/1991 | Helmstetter |
| 5,039,098 | A | 8/1991 | Pelz |
| 5,050,879 | A | 9/1991 | Sun et al. |
| 5,054,784 | A | 10/1991 | Collins |
| 5,058,895 | A | 10/1991 | Igarashi |
| 5,078,397 | A | 1/1992 | Aizawa |
| 5,092,599 | A | 3/1992 | Okumoto et al. |
| 5,116,054 | A | 5/1992 | Johnson |
| 5,133,553 | A | 7/1992 | Divnick |
| 5,176,384 | A | 1/1993 | Sata et al. |
| 5,178,394 | A | 1/1993 | Tanampai |

(56) References Cited

U.S. PATENT DOCUMENTS 5,190,289 A 3/1993 Nagai et al.
5,193,810 A 3/1993 Antonious
5,221,086 A 6/1993 Antonious
5,244,210 A 9/1993 Au
5,253,869 A 10/1993 Dingle et al.
5,255,914 A 10/1993 Schroder
5,255,919 A 10/1993 Johnson
5,271,621 A 12/1993 Lo
D343,558 S 1/1994 Latraverse et al.
5,275,408 A 1/1994 Desbiolles et al.
5,280,923 A 1/1994 Lu
5,301,944 A 4/1994 Koehler
5,310,185 A 5/1994 Viollaz et al.
5,312,106 A 5/1994 Cook
5,316,305 A 5/1994 McCabe
5,318,297 A 6/1994 Davis et al.
5,320,005 A 6/1994 Hsiao
5,328,176 A 7/1994 Lo
D349,543 S 8/1994 MacDougall
5,340,106 A 8/1994 Ravaris
5,346,216 A 9/1994 Aizawa
5,377,986 A 1/1995 Viollaz et al.
5,385,348 A 1/1995 Wargo
5,410,798 A 5/1995 Lo
5,417,419 A 5/1995 Anderson et al.
5,421,577 A 6/1995 Kobayashi
5,425,538 A 6/1995 Vincent et al.
5,429,365 A 7/1995 McKeighen
5,431,396 A 7/1995 Shieh
5,433,422 A 7/1995 Walker
5,435,558 A 7/1995 Iriarte
5,439,222 A 8/1995 Kranenberg
5,441,274 A 8/1995 Clay
5,447,309 A 9/1995 Vincent
5,447,311 A 9/1995 Viollaz et al.
5,465,970 A 11/1995 Adams et al.
D365,615 S 12/1995 Shimatani
5,472,201 A 12/1995 Aizawa et al.
5,482,280 A 1/1996 Yamawaki
5,511,786 A 4/1996 Antonious
5,513,844 A 5/1996 Ashcraft et al.
5,518,243 A 5/1996 Redman
5,524,331 A 6/1996 Pond
5,533,725 A 7/1996 Reynolds, Jr.
5,533,730 A 7/1996 Ruvang
5,540,435 A 7/1996 Kawasaki
5,542,666 A 8/1996 Chou
5,547,188 A 8/1996 Dumontier et al.
5,558,332 A 9/1996 Cook
D375,130 S 10/1996 Hlinka et al.
5,571,053 A 11/1996 Lane
5,588,921 A 12/1996 Parsick
D378,770 S 4/1997 Hlinka et al.
5,620,379 A 4/1997 Borys
5,624,331 A 4/1997 Lo et al.
5,626,528 A 5/1997 Toulon
5,629,475 A 5/1997 Chastonay
5,632,694 A 5/1997 Lee
5,632,695 A 5/1997 Hlinka et al.
5,653,645 A 8/1997 Baumann
5,669,827 A 9/1997 Nagamoto
5,672,120 A 9/1997 Ramirez et al.
5,683,309 A 11/1997 Reimers
5,688,188 A 11/1997 Chappell
5,695,412 A 12/1997 Cook
5,700,208 A 12/1997 Nelms
5,702,310 A 12/1997 Wozny
5,709,613 A 1/1998 Sheraw
5,718,641 A 2/1998 Lin
D392,526 S 3/1998 Nicely
5,722,901 A 3/1998 Barron et al.
5,743,813 A 4/1998 Chen et al.
5,746,553 A 5/1998 Engwall
5,746,664 A 5/1998 Reynolds, Jr.
5,749,790 A 5/1998 Van Alen, II et al.
5,755,627 A 5/1998 Yamazaki et al.
5,759,114 A 6/1998 Bluto et al.
5,766,094 A 6/1998 Mahaffey et al.
5,769,737 A 6/1998 Holladay et al.
5,776,011 A 7/1998 Su et al.
5,785,608 A 7/1998 Collins
5,797,807 A 8/1998 Moore
5,807,186 A 9/1998 Chen
RE35,931 E 10/1998 Schroder et al.
5,827,131 A 10/1998 Mahaffey et al.
RE35,955 E 11/1998 Lu
D401,650 S 11/1998 Burrows
5,839,973 A 11/1998 Jackson
5,851,155 A 12/1998 Wood et al.
5,851,160 A 12/1998 Rugge et al.
5,863,260 A 1/1999 Butler, Jr. et al.
5,876,293 A 3/1999 Musty
5,885,166 A 3/1999 Shiraishi
5,890,971 A 4/1999 Shiraishi
D409,463 S 5/1999 McMullin
5,906,549 A 5/1999 Kubica
5,908,356 A 6/1999 Nagamoto
5,911,638 A 6/1999 Parente et al.
D412,547 S 8/1999 Fong
5,931,742 A 8/1999 Nishimura et al.
5,935,019 A 8/1999 Yamamoto
5,935,020 A * 8/1999 Stites ..... A63B 60/00 473/345
5,941,782 A 8/1999 Cook
5,947,840 A 9/1999 Ryan
5,951,411 A 9/1999 Wood et al.
5,954,595 A 9/1999 Antonious
5,967,903 A 10/1999 Cheng
5,967,905 A 10/1999 Nakahara et al.
5,985,197 A 11/1999 Nelson et al.
5,997,415 A 12/1999 Wood
6,001,029 A 12/1999 Kobayashi
6,015,354 A 1/2000 Ahn et al.
6,019,686 A 2/2000 Gray
6,023,891 A 2/2000 Robertson et al.
6,027,416 A 2/2000 Schmidt et al.
6,032,677 A 3/2000 Blechman et al.
6,033,319 A 3/2000 Farrar
6,039,659 A 3/2000 Hamm
6,048,278 A 4/2000 Meyer et al.
6,056,649 A 5/2000 Imai
6,071,200 A 6/2000 Song
6,074,308 A 6/2000 Domas
6,083,115 A 7/2000 King
6,089,994 A 7/2000 Sun
6,093,113 A 7/2000 Mertens
6,110,055 A 8/2000 Wilson
6,120,384 A 9/2000 Drake
6,123,627 A 9/2000 Antonious
6,139,445 A 10/2000 Werner et al.
6,149,533 A 11/2000 Finn
6,152,833 A 11/2000 Werner et al.
6,162,133 A 12/2000 Peterson
6,165,081 A 12/2000 Chou
6,168,537 B1 1/2001 Ezawa
6,193,614 B1 2/2001 Sasamoto et al.
6,238,303 B1 5/2001 Fite
6,244,974 B1 6/2001 Hanberry, Jr.
6,248,024 B1 6/2001 Nelson et al.
6,248,025 B1 6/2001 Murphy et al.
6,251,028 B1 6/2001 Jackson
6,254,494 B1 * 7/2001 Hasebe ..... A63B 53/04 473/345
6,270,422 B1 8/2001 Fisher
6,270,425 B1 8/2001 Dyer
6,273,828 B1 8/2001 Wood et al.
6,277,032 B1 8/2001 Smith
6,287,214 B1 9/2001 Satoh
6,299,547 B1 10/2001 Kosmatka
6,319,150 B1 11/2001 Werner et al.
6,334,817 B1 1/2002 Ezawa et al.
6,338,683 B1 1/2002 Kosmatka
6,344,002 B1 2/2002 Kajita
6,348,014 B1 2/2002 Chiu

(56) References Cited

U.S. PATENT DOCUMENTS

| | | | |
|---|---|---|---|
| 6,352,483 | B1 | 3/2002 | Okoshi |
| 6,354,962 | B1 | 3/2002 | Galloway et al. |
| 6,364,789 | B1 | 4/2002 | Kosmatka |
| 6,368,230 | B1 | 4/2002 | Helmstetter et al. |
| 6,368,234 | B1 | 4/2002 | Galloway |
| 6,371,865 | B1 | 4/2002 | Magliulo |
| 6,371,866 | B1 | 4/2002 | Rivera |
| 6,383,090 | B1 | 5/2002 | O'Doherty et al. |
| 6,390,933 | B1 | 5/2002 | Galloway |
| 6,402,639 | B1 | 6/2002 | Iwata et al. |
| 6,406,378 | B1 | 6/2002 | Murphy et al. |
| 6,406,381 | B2 | 6/2002 | Murphy et al. |
| 6,409,612 | B1 | 6/2002 | Evans et al. |
| 6,425,832 | B2 | 7/2002 | Cackett et al. |
| 6,428,427 | B1 | 8/2002 | Kosmatka |
| 6,435,980 | B1 | 8/2002 | Reyes et al. |
| 6,436,142 | B1 | 8/2002 | Paes et al. |
| 6,440,008 | B2 | 8/2002 | Murphy et al. |
| 6,440,009 | B1 | 8/2002 | Guibaud et al. |
| 6,447,404 | B1 | 9/2002 | Wilbur |
| 6,458,042 | B1 | 10/2002 | Chen |
| 6,464,598 | B1 | 10/2002 | Miller |
| 6,471,604 | B2 | 10/2002 | Hocknell et al. |
| 6,475,100 | B1 | 11/2002 | Helmstetter et al. |
| 6,478,691 | B2 | 11/2002 | Okoshi |
| 6,491,592 | B2 | 12/2002 | Cackett et al. |
| 6,514,154 | B1 | 2/2003 | Finn |
| 6,524,197 | B2 | 2/2003 | Boone |
| 6,527,649 | B1 | 3/2003 | Neher et al. |
| 6,530,847 | B1 | 3/2003 | Antonious |
| 6,530,848 | B2 | 3/2003 | Gillig |
| 6,547,673 | B2 | 4/2003 | Roark |
| 6,547,676 | B2 | 4/2003 | Cackett et al. |
| 6,565,452 | B2 | 5/2003 | Helmstetter et al. |
| 6,572,489 | B2 | 6/2003 | Miyamoto et al. |
| 6,575,843 | B2 | 6/2003 | McCabe |
| 6,575,845 | B2 | 6/2003 | Galloway et al. |
| 6,582,323 | B2 | 6/2003 | Soracco et al. |
| 6,602,149 | B1 | 8/2003 | Jacobson |
| 6,605,007 | B1 | 8/2003 | Bissonnette et al. |
| 6,607,452 | B2 | 8/2003 | Helmstetter et al. |
| D479,867 | S | 9/2003 | Saliba et al. |
| 6,612,938 | B2 | 9/2003 | Murphy et al. |
| 6,620,053 | B2 | 9/2003 | Tseng |
| 6,634,957 | B2 | 10/2003 | Tseng |
| D482,420 | S | 11/2003 | Burrows |
| 6,641,487 | B1 | 11/2003 | Hamburger |
| 6,648,773 | B1 | 11/2003 | Evans |
| 6,669,571 | B1 | 12/2003 | Cameron et al. |
| 6,669,573 | B2 | 12/2003 | Wood et al. |
| 6,669,577 | B1 | 12/2003 | Hocknell et al. |
| 6,669,578 | B1 | 12/2003 | Evans |
| 6,669,580 | B1 | 12/2003 | Cackett et al. |
| 6,676,536 | B1 | 1/2004 | Jacobson |
| 6,723,002 | B1 | 4/2004 | Barlow |
| 6,723,007 | B1 | 4/2004 | Chao |
| 6,739,982 | B2 | 5/2004 | Murphy et al. |
| 6,739,983 | B2 | 5/2004 | Helmstetter et al. |
| 6,743,118 | B1 | 6/2004 | Soracco |
| 6,746,341 | B1 | 6/2004 | Hamric, Jr. et al. |
| 6,758,763 | B2 | 7/2004 | Murphy et al. |
| 6,764,413 | B2 | 7/2004 | Ho |
| 6,769,994 | B2 | 8/2004 | Boone |
| 6,769,996 | B2 | 8/2004 | Tseng |
| 6,773,359 | B1 | 8/2004 | Lee |
| 6,773,360 | B2 | 8/2004 | Willett et al. |
| 6,776,723 | B2 | 8/2004 | Bliss et al. |
| RE38,605 | E | 9/2004 | Kubica et al. |
| 6,789,304 | B2 | 9/2004 | Kouno |
| 6,800,038 | B2 | 10/2004 | Willett et al. |
| 6,824,475 | B2 | 11/2004 | Burnett et al. |
| D501,903 | S | 2/2005 | Tanaka |
| 6,849,002 | B2 | 2/2005 | Rice |
| 6,855,068 | B2 | 2/2005 | Antonious |
| 6,857,969 | B2 | 2/2005 | Rice |
| 6,860,818 | B2 | 3/2005 | Mahaffey et al. |
| 6,860,823 | B2 | 3/2005 | Lee |
| 6,860,824 | B2 | 3/2005 | Evans |
| 6,875,129 | B2 | 4/2005 | Erickson et al. |
| 6,881,159 | B2 | 4/2005 | Galloway et al. |
| 6,890,269 | B2 | 5/2005 | Burrows |
| 6,899,636 | B2 | 5/2005 | Finn |
| 6,904,663 | B2 | 6/2005 | Willett et al. |
| 6,926,616 | B1 | 8/2005 | Kusumoto et al. |
| 6,926,619 | B2 | 8/2005 | Helmstetter et al. |
| 6,939,247 | B1 | 9/2005 | Schweigert et al. |
| 6,955,612 | B2 | 10/2005 | Lu |
| 6,960,142 | B2 | 11/2005 | Bissonnette et al. |
| 6,964,617 | B2 | 11/2005 | Williams |
| 6,966,847 | B2 | 11/2005 | Lenhof et al. |
| 6,974,393 | B2 | 12/2005 | Caldwell et al. |
| 6,988,960 | B2 | 1/2006 | Mahaffey et al. |
| 6,991,558 | B2 | 1/2006 | Beach et al. |
| D515,643 | S | 2/2006 | Ortiz |
| 6,997,818 | B2 | 2/2006 | Kouno |
| 6,997,820 | B2 | 2/2006 | Willett et al. |
| 7,004,849 | B2 | 2/2006 | Cameron |
| 7,004,852 | B2 | 2/2006 | Billings |
| 7,014,569 | B1 | 3/2006 | Figgers |
| 7,025,692 | B2 | 4/2006 | Erickson et al. |
| 7,025,695 | B2 | 4/2006 | Mitsuba |
| 7,029,403 | B2 | 4/2006 | Rice et al. |
| D522,601 | S | 6/2006 | Schweigert |
| 7,066,832 | B2 | 6/2006 | Willett et al. |
| 7,082,665 | B2 | 8/2006 | Deshmukh et al. |
| 7,083,529 | B2 | 8/2006 | Cackett et al. |
| 7,115,046 | B1 | 10/2006 | Evans |
| 7,140,974 | B2 | 11/2006 | Chao et al. |
| 7,153,220 | B2 | 12/2006 | Lo |
| 7,163,468 | B2 | 1/2007 | Gibbs et al. |
| 7,163,470 | B2 | 1/2007 | Galloway et al. |
| 7,166,038 | B2 | 1/2007 | Williams et al. |
| 7,166,040 | B2 | 1/2007 | Hoffman et al. |
| 7,169,058 | B1 | 1/2007 | Fagan |
| 7,169,060 | B2 | 1/2007 | Stevens et al. |
| D537,495 | S | 2/2007 | Schweigert |
| 7,186,190 | B1 | 3/2007 | Beach et al. |
| 7,189,165 | B2 | 3/2007 | Yamamoto |
| 7,189,169 | B2 | 3/2007 | Billings |
| 7,198,575 | B2 | 4/2007 | Beach et al. |
| D543,600 | S | 5/2007 | Oldknow |
| 7,214,143 | B2 | 5/2007 | Deshmukh |
| 7,223,180 | B2 | 5/2007 | Willett et al. |
| D544,939 | S | 6/2007 | Radcliffe et al. |
| 7,241,229 | B2 | 7/2007 | Poynoŕ |
| D549,792 | S | 8/2007 | Parise |
| 7,252,600 | B2 | 8/2007 | Murphy et al. |
| 7,255,654 | B2 | 8/2007 | Murphy et al. |
| D550,318 | S | 9/2007 | Oldknow |
| 7,267,620 | B2 | 9/2007 | Chao et al. |
| 7,273,421 | B2 | 9/2007 | Knuth |
| D552,198 | S | 10/2007 | Schweigert |
| 7,278,927 | B2 | 10/2007 | Gibbs et al. |
| D554,720 | S | 11/2007 | Barez et al. |
| 7,294,064 | B2 | 11/2007 | Tsurumaki et al. |
| 7,300,359 | B2 | 11/2007 | Hocknell et al. |
| D561,856 | S | 2/2008 | Barez et al. |
| 7,326,126 | B2 | 2/2008 | Holt et al. |
| 7,335,113 | B2 | 2/2008 | Hocknell et al. |
| D564,611 | S | 3/2008 | Llewellyn |
| 7,344,449 | B2 | 3/2008 | Hocknell et al. |
| D567,891 | S | 4/2008 | Serrano et al. |
| 7,367,899 | B2 | 5/2008 | Rice et al. |
| 7,390,266 | B2 | 6/2008 | Gwon |
| D572,791 | S | 7/2008 | Jertson et al. |
| 7,402,112 | B2 | 7/2008 | Galloway |
| D576,699 | S | 9/2008 | Pergande et al. |
| D577,404 | S | 9/2008 | Oldknow et al. |
| 7,427,239 | B2 | 9/2008 | Hocknell et al. |
| 7,448,963 | B2 | 11/2008 | Beach et al. |
| 7,465,239 | B2 | 12/2008 | Hocknell et al. |
| 7,476,160 | B2 | 1/2009 | Hocknell et al. |
| 7,491,136 | B2 | 2/2009 | Deng |
| D588,217 | S | 3/2009 | Jertson et al. |

(56) References Cited

U.S. PATENT DOCUMENTS

D588,661 S 3/2009 Lee
D588,662 S 3/2009 Lee
D588,663 S 3/2009 Lee
D588,664 S 3/2009 Lee
D589,103 S 3/2009 Kohno
D588,659 S 8/2009 Jertson et al.
D598,510 S 8/2009 Barez et al.
D603,919 S 11/2009 Gray et al.
D604,376 S 11/2009 Darley et al.
7,628,712 B2 12/2009 Chao et al.
7,674,187 B2 3/2010 Cackett et al.
7,674,189 B2 3/2010 Beach et al.
D614,711 S 4/2010 Harbert et al.
7,699,717 B2 4/2010 Morris et al.
D618,748 S 6/2010 Oldknow
7,731,603 B2 6/2010 Beach et al.
D619,668 S 7/2010 Nunez et al.
D622,338 S 8/2010 Kohno
D622,795 S 8/2010 Furutate
7,766,765 B2 8/2010 Oyama
7,771,291 B1 8/2010 Willett et al.
D627,842 S 11/2010 Gray et al.
D627,843 S 11/2010 Kuan et al.
7,874,936 B2 1/2011 Chao
7,887,431 B2 2/2011 Beach et al.
7,927,229 B2 4/2011 Jertson et al.
8,012,038 B1 * 9/2011 Beach ..... A63B 53/0466 473/345
8,012,039 B2 9/2011 Greaney et al.
8,083,609 B2 12/2011 Burnett et al.
8,088,021 B2 1/2012 Albertsen et al.
8,133,135 B2 3/2012 Stites et al.
8,187,115 B2 5/2012 Bennett et al.
D686,679 S 7/2013 Greensmith et al.
8,496,544 B2 7/2013 Curtis et al.
8,523,705 B2 9/2013 Breier et al.
8,529,368 B2 9/2013 Rice et al.
D692,077 S 10/2013 Greensmith et al.
D696,366 S 12/2013 Milo et al.
D696,367 S 12/2013 Taylor et al.
D697,152 S 1/2014 Harbert et al.
8,663,029 B2 3/2014 Beach et al.
8,858,359 B2 10/2014 Willett et al.
8,888,607 B2 11/2014 Harbert et al.
9,044,653 B2 6/2015 Wahl et al.
D767,065 S 9/2016 Asazuma
D767,704 S 9/2016 Asazuma
9,861,864 B2 1/2018 Beach et al.
10,556,158 B1 2/2020 Harbert et al.
10,569,145 B2 2/2020 Beach et al.
10,773,135 B1 9/2020 Hoffman et al.
11,305,163 B2 4/2022 Johnson et al.
2001/0007835 A1 7/2001 Baron
2001/0049310 A1 12/2001 Cheng et al.
2002/0022535 A1 2/2002 Takeda
2002/0037773 A1 3/2002 Wood et al.
2002/0049095 A1 4/2002 Galloway et al.
2002/0072434 A1 6/2002 Yabu
2002/0082115 A1 6/2002 Reyes et al.
2002/0137576 A1 9/2002 Dammen
2002/0160854 A1 * 10/2002 Beach ..... A63B 53/0466 473/345
2002/0169034 A1 11/2002 Hocknell et al.
2002/0183130 A1 12/2002 Pacinella
2002/0183134 A1 12/2002 Allen et al.
2002/0187852 A1 12/2002 Kosmatka
2003/0008723 A1 1/2003 Goodman
2003/0013542 A1 1/2003 Burnett et al.
2003/0114239 A1 6/2003 Mase
2003/0130059 A1 7/2003 Billings
2003/0220154 A1 11/2003 Anelli
2003/0148822 A1 12/2003 Knuth
2003/0232663 A1 * 12/2003 Bliss ..... A63B 53/04 473/345
2004/0018886 A1 1/2004 Burrows
2004/0018887 A1 1/2004 Burrows
2004/0063515 A1 4/2004 Boone
2004/0087388 A1 5/2004 Beach et al.
2004/0157678 A1 8/2004 Kohno
2004/0162156 A1 8/2004 Kohno
2004/0192463 A1 9/2004 Tsurumaki et al.
2004/0235584 A1 11/2004 Chao et al.
2004/0242343 A1 12/2004 Chao
2005/0003903 A1 1/2005 Galloway
2005/0009622 A1 1/2005 Antonious
2005/0020382 A1 * 1/2005 Yamagishi ..... A63B 53/0466 473/345
2005/0049067 A1 3/2005 Hsu
2005/0049072 A1 3/2005 Burrows
2005/0059508 A1 3/2005 Burnett et al.
2005/0079923 A1 4/2005 Droppleman
2005/0085315 A1 4/2005 Wahl et al.
2005/0192117 A1 9/2005 Knuth
2005/0239575 A1 10/2005 Chao et al.
2006/0009305 A1 1/2006 Lindsay
2006/0058112 A1 3/2006 Haralason et al.
2006/0058114 A1 * 3/2006 Evans ..... A63B 60/00 473/345
2006/0094535 A1 5/2006 Cameron
2006/0116218 A1 6/2006 Burnett et al.
2006/0154747 A1 7/2006 Beach et al.
2006/0178228 A1 8/2006 DiMarco
2006/0258481 A1 11/2006 Oyama
2006/0281581 A1 12/2006 Yamamoto
2006/0287125 A1 12/2006 Hocknell et al.
2007/0099719 A1 5/2007 Halleck et al.
2007/0105647 A1 5/2007 Beach et al.
2007/0105648 A1 5/2007 Beach et al.
2007/0105649 A1 5/2007 Beach et al.
2007/0105650 A1 * 5/2007 Beach ..... A63B 53/0466 473/336
2007/0105651 A1 5/2007 Beach et al.
2007/0105652 A1 5/2007 Beach et al.
2007/0105653 A1 5/2007 Beach et al.
2007/0105654 A1 5/2007 Beach et al.
2007/0105655 A1 5/2007 Beach et al.
2007/0105657 A1 5/2007 Hirano
2007/0117645 A1 5/2007 Nakashima
2007/0219016 A1 9/2007 Deshmukh
2007/0254746 A1 11/2007 Poynor
2007/0265106 A1 11/2007 Burrows
2007/0275792 A1 11/2007 Horacek et al.
2008/0039234 A1 2/2008 Williams et al.
2008/0058114 A1 3/2008 Hocknell et al.
2008/0076590 A1 3/2008 Hsu
2008/0119301 A1 5/2008 Holt et al.
2008/0132356 A1 6/2008 Chao et al.
2008/0139334 A1 6/2008 Willett et al.
2008/0146374 A1 6/2008 Beach et al.
2008/0171612 A1 7/2008 Serrano et al.
2008/0254908 A1 10/2008 Bennett et al.
2008/0261717 A1 10/2008 Hoffman et al.
2008/0280693 A1 11/2008 Chai
2008/0280698 A1 11/2008 Hoffman et al.
2008/0300068 A1 12/2008 Chao
2009/0011848 A1 1/2009 Thomas et al.
2009/0011849 A1 1/2009 Thomas et al.
2009/0011850 A1 1/2009 Stites et al.
2009/0062029 A1 3/2009 Stites et al.
2009/0088269 A1 * 4/2009 Beach ..... A63B 60/00 473/346
2009/0088271 A1 4/2009 Beach et al.
2009/0118034 A1 5/2009 Yokota
2009/0124411 A1 5/2009 Rae et al.
2009/0137338 A1 5/2009 Kajita
2009/0143167 A1 6/2009 Evans
2009/0149275 A1 6/2009 Rae et al.
2009/0163289 A1 6/2009 Chao
2009/0163291 A1 6/2009 Chao
2009/0163296 A1 6/2009 Chao
2009/0170632 A1 7/2009 Beach et al.
2009/0191980 A1 7/2009 Greaney et al.
2009/0221381 A1 9/2009 Breier et al.
2009/0239677 A1 9/2009 DeShiell et al.

(56) References Cited

U.S. PATENT DOCUMENTS

| | | | | |
|---|---|---|---|---|
| 2010/0016095 | A1* | 1/2010 | Burnett | A63B 53/0466 473/345 |
| 2010/0016097 | A1 | 1/2010 | Albertsen et al. | |
| 2011/0014992 | A1 | 1/2011 | Morrissey | |
| 2011/0152000 | A1 | 6/2011 | Sargent et al. | |
| 2011/0250986 | A1 | 10/2011 | Schweigert | |
| 2011/0294599 | A1 | 12/2011 | Albertsen et al. | |
| 2012/0071267 | A1 | 3/2012 | Burnett et al. | |
| 2012/0071268 | A1 | 3/2012 | Albertsen et al. | |
| 2012/0077616 | A1 | 3/2012 | Stites | |
| 2012/0122601 | A1 | 5/2012 | Beach et al. | |
| 2012/0135821 | A1 | 5/2012 | Boyd et al. | |
| 2012/0172146 | A1 | 7/2012 | Greaney | |
| 2012/0202615 | A1 | 8/2012 | Beach et al. | |
| 2012/0270675 | A1 | 10/2012 | Matsunaga | |
| 2012/0289361 | A1* | 11/2012 | Beach | A63B 53/0466 473/335 |
| 2012/0316007 | A1 | 12/2012 | Burnett et al. | |
| 2013/0059678 | A1* | 3/2013 | Stites | A63B 53/06 473/345 |
| 2013/0116062 | A1* | 5/2013 | Zimmerman | A63B 53/02 473/307 |
| 2013/0123040 | A1 | 5/2013 | Willett et al. | |
| 2013/0172103 | A1 | 7/2013 | Greensmith et al. | |
| 2014/0080622 | A1 | 3/2014 | Sargent et al. | |
| 2014/0256461 | A1 | 9/2014 | Beach et al. | |
| 2014/0274457 | A1 | 9/2014 | Beach et al. | |
| 2014/0274464 | A1 | 9/2014 | Schweigert et al. | |
| 2015/0038260 | A1 | 2/2015 | Hayashi | |
| 2015/0094166 | A1 | 4/2015 | Taylor et al. | |
| 2015/0148149 | A1 | 5/2015 | Beach et al. | |
| 2015/0367189 | A1 | 12/2015 | Boggs | |
| 2016/0096082 | A1 | 4/2016 | Boggs et al. | |
| 2016/0310809 | A1 | 10/2016 | Boggs | |
| 2017/0036078 | A1 | 2/2017 | Serrano et al. | |
| 2017/0128789 | A1 | 5/2017 | Wada et al. | |
| 2017/0072277 | A1 | 9/2017 | Mata et al. | |
| 2018/0140916 | A1 | 5/2018 | Sillies | |
| 2018/0169486 | A1 | 6/2018 | Wester et al. | |
| 2018/0345099 | A1 | 12/2018 | Harbert et al. | |
| 2019/0201754 | A1 | 7/2019 | Hoffman et al. | |
| 2019/0262671 | A1 | 8/2019 | Beach et al. | |
| 2020/0086188 | A1 | 3/2020 | Nakamura | |
| 2020/0139208 | A1* | 5/2020 | Johnson | A63B 53/0466 |
| 2020/0197769 | A1 | 6/2020 | Stokke et al. | |
| 2020/0215397 | A1 | 7/2020 | Parsons et al. | |
| 2020/0324177 | A1 | 10/2020 | Harbert et al. | |
| 2021/0001186 | A1 | 1/2021 | Munson | |
| 2021/0086041 | A1 | 3/2021 | Sargent et al. | |

FOREIGN PATENT DOCUMENTS

| | | |
|---|---|---|
| EP | 1001175 | 5/2000 |
| EP | 1172189 | 1/2002 |
| GB | 194823 | 12/1921 |
| GB | 1201648 | 8/1970 |
| GB | 2207358 | 2/1989 |
| GB | 2225725 | 6/1990 |
| GB | 2241173 | 8/1991 |
| GB | 2268412 | 1/1994 |
| JP | 60-15145 | 1/1985 |
| JP | 01314583 | 12/1989 |
| JP | 01314779 | 12/1989 |
| JP | 02005979 | 1/1990 |
| JP | 02191475 | 7/1990 |
| JP | 4156869 | 5/1992 |
| JP | 05076628 | 3/1993 |
| JP | 05237207 | 9/1993 |
| JP | 05-317465 | 12/1993 |
| JP | 06007485 | 1/1994 |
| JP | 06015016 | 1/1994 |
| JP | 6-23071 | 2/1994 |
| JP | 06-126004 | 5/1994 |
| JP | 06-165842 | 6/1994 |
| JP | 6-205858 | 7/1994 |
| JP | H06190088 | 7/1994 |
| JP | 6-304271 | 11/1994 |
| JP | 08071187 | 3/1996 |
| JP | 08215354 | 8/1996 |
| JP | 08280855 | 10/1996 |
| JP | 8318008 | 12/1996 |
| JP | 09-028844 | 2/1997 |
| JP | 9164227 | 6/1997 |
| JP | 09-176347 | 7/1997 |
| JP | 09-308717 | 12/1997 |
| JP | 09-327534 | 12/1997 |
| JP | 10-234902 | 9/1998 |
| JP | 10-277187 | 10/1998 |
| JP | H10263118 | 10/1998 |
| JP | H11114102 | 4/1999 |
| JP | 11-137734 | 5/1999 |
| JP | H11155982 | 6/1999 |
| JP | 11290488 | 10/1999 |
| JP | 2000005349 | 1/2000 |
| JP | 2001062652 | 3/2001 |
| JP | 2001-170229 | 6/2001 |
| JP | 2001276285 | 10/2001 |
| JP | 2002-052099 | 2/2002 |
| JP | 2002136625 | 5/2002 |
| JP | 2003-062131 | 3/2003 |
| JP | 2003135632 | 5/2003 |
| JP | 2003210621 | 7/2003 |
| JP | 2003524487 | 8/2003 |
| JP | 2003320061 | 11/2003 |
| JP | 2004174224 | 6/2004 |
| JP | 2004222911 | 8/2004 |
| JP | 2004232397 | 8/2004 |
| JP | 2004261451 | 9/2004 |
| JP | 2004265992 | 9/2004 |
| JP | 2004267438 | 9/2004 |
| JP | 2004271516 | 9/2004 |
| JP | 2004313762 | 11/2004 |
| JP | 2004329544 | 11/2004 |
| JP | 2004-351173 | 12/2004 |
| JP | 2004344664 | 12/2004 |
| JP | 2004351054 | 12/2004 |
| JP | 2005073736 | 3/2005 |
| JP | 2005111172 | 4/2005 |
| JP | 2005137494 | 6/2005 |
| JP | 2005137788 | 6/2005 |
| JP | 2006-042951 | 2/2006 |
| JP | 2006034906 | 2/2006 |
| JP | 4177414 | 8/2008 |
| JP | 2008194495 | 8/2008 |
| JP | 2008272274 | 11/2008 |
| JP | 2008272496 | 11/2008 |
| JP | 2009112800 | 5/2009 |
| JP | 2009136608 | 6/2009 |
| TW | 139608 | 8/1990 |
| WO | WO88/02642 | 4/1988 |
| WO | WO93/00968 | 1/1993 |
| WO | WO01/66199 | 9/2001 |
| WO | WO02/062501 | 8/2002 |
| WO | WO03/061773 | 7/2003 |
| WO | WO2004/009186 | 1/2004 |
| WO | WO2004/065083 | 8/2004 |
| WO | WO2005/009543 | 2/2005 |
| WO | WO2005/028038 | 3/2005 |
| WO | WO2006/018929 | 2/2006 |
| WO | WO2006/055386 | 5/2006 |

OTHER PUBLICATIONS

Ellis, Jeffrey B., *The Clubmaker's Art: Antique Golf Clubs and Their History, Second Edition Revised and Expanded*, vol. II, 2007, p. 485.

International Searching Authority (USPTO), International Search Report and Written Opinion for International Application No. PCT/US 09/49742, dated Aug. 27, 2009, 11 pages.

International Searching Authority (USPTO), International Search Report and Written Opinion for International Application No. PCT/US2009/049418, dated Aug. 26, 2009, 10 pages.

(56) References Cited

OTHER PUBLICATIONS

"Invalidity Search Report for Japanese Registered Patent No. 4128970," 4 pp. (dated Nov. 29, 2013).
Jackson, Jeff, The Modern Guide to Golf Clubmaking, Ohio: Dynacraft Golf Products, Inc., copyright 1994, p. 237.
"Mickey Finn T-Bar Putter—The Mickey Finn Golf Putter," Oct. 20, 2004 (http://www.mickeyfinngolf.com/Default/asp) (1 page).
"Charles A. "Mickey" Finn, Mickey Finn Tom Clancy The Cardinal of the Kremlin," Oct. 20, 2004 (http://www.mickeyfinngolf.com/mickeyfinngolf.asp) (2 pages).
"Mickey Finn M-2 T-Bar Putter & Mickey Finn M-3 T-Bar Putter," Oct. 20, 2004 (http://www.mickeyfinngolf.com/putters.asp) (3 pages).
Nike Golf, Sasquatch 460, downloaded from www.nike.com/nikegolf/index.htm on Apr. 5, 2007.
Nike Golf, Sasquatch Sumo Squared Driver, downloaded from www.nike.com/nikegolf/index.htm on Apr. 5, 2007.
Office Action for related Japan Application No. 2014-235213, dated Aug. 23, 2018, 5 pages.
Taylor Made '94/'95 Products—Mid Tour; Mid Tour GF (1 page).
Taylor Made Golf Company Inc., R7 460 Drivers, downloaded from www.taylormadegolf.com/product_detail.asp?pID=14section=overview on Apr. 5, 2007.
Titleist 907D1, downloaded from www.tees2greens.com/forum/Uploads/Images/7ade3521-192b-4611-870b-395d.jpg on Feb. 1, 2007.

* cited by examiner

-18° ORIENTATION

0° ORIENTATION

+18° ORIENTATION

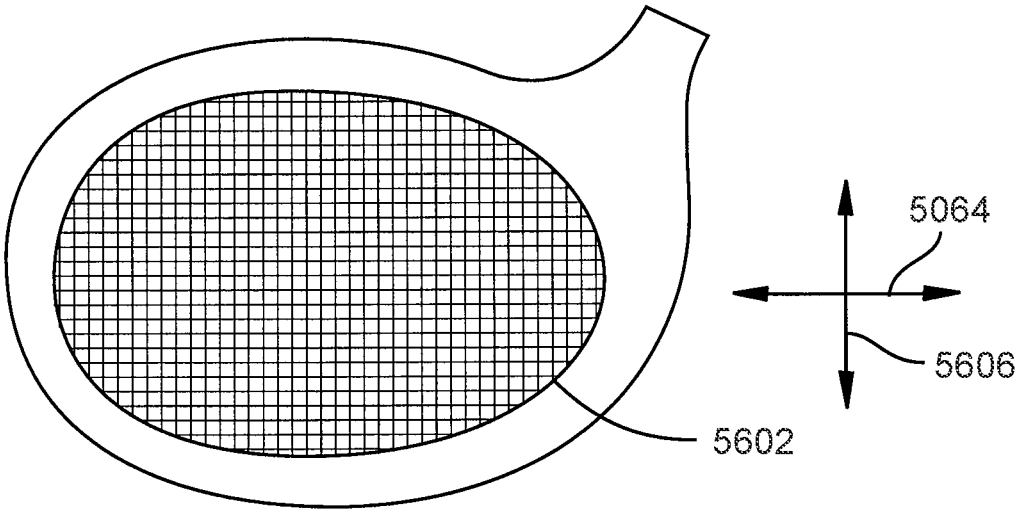
FIG. 50
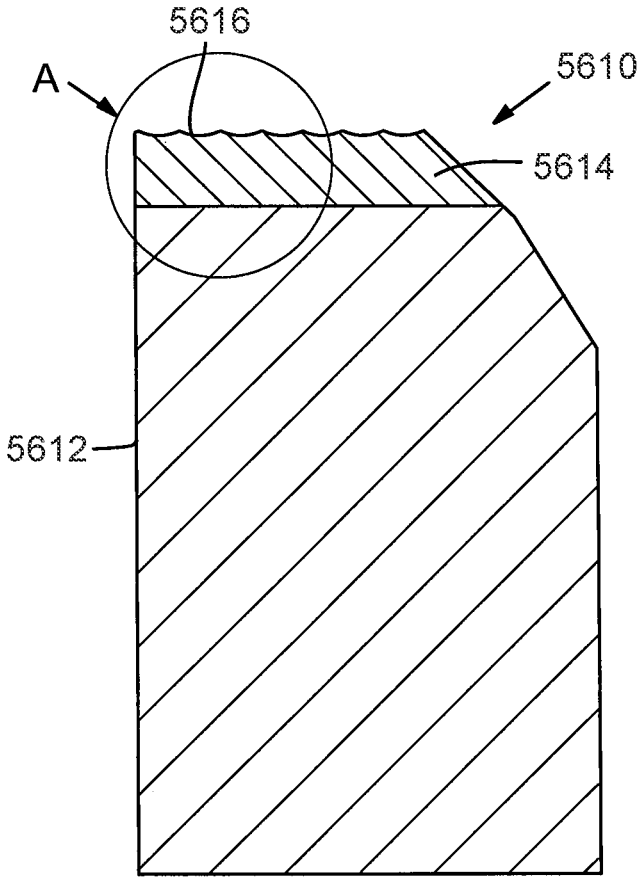
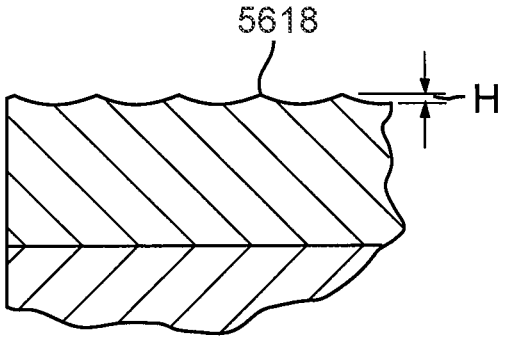
FIG. 52
FIG. 51

| | Golf Club Head | | | |
|---|---|---|---|---|
| | 6002 | 6100 | 6200 | 6300 |
| Mass (g) | 200.0 | 202.8 | 204.4 | 202.3 |
| Volume (cc) | 458 | 454 | 454 | 453 |
| CGx (mm) | 1.8 | 2.0 | 2.3 | 3.3 |
| CGy (mm) | 37.1 | 37.9 | 36.7 | 37.4 |
| CGz (mm) | -3.26 | -4.67 | -4.65 | -0.09 |
| Ixx (kg·mm²) | 339 | 337 | 333 | 336 |
| Izz (kg·mm²) | 528 | 498 | 495 | 536 |
| Loft (deg) | 9.5 | 9.5 | 10.1 | 9.5 |
| Lie (deg) | 58 | 58 | 58 | 58 |
| Bulge Radius (mm) | 304.8 | 304.8 | 304.8 | 304.8 |
| Roll Radius (mm) | 304.8 | 304.8 | 304.8 | 304.8 |
| Face Height (mm) | 58.6 | 59.6 | 56.8 | 57.2 |
| Face Width (mm) | 90.6 | 90.6 | 92.3 | 90.6 |
| Face Area (mm²) | 3929 | 4098 | 4100 | 3929 |
| Head Height (mm) | 60.7 | 62.2 | 61.5 | 59.0 |
| Head Width (mm) | 60.7 | 62.2 | 61.5 | 59.0 |
| Head Depth (mm) | 115.0 | 110.7 | 113.5 | 117.2 |

FIG. 89

| | | 6400A | 6400B | 6400C | 6400D | 6400E | 6400F | 6400G |
|---|---|---|---|---|---|---|---|---|
| Volume (cc) | | 460 | 460 | 460 | 460 | 460 | 460 | 460 |
| Ixx (kg·mm²) | | 427 | 427 | 427 | 427 | 525 | 525 | 525 |
| Izz (kg·mm²) | | 645 | 593 | 447 | 511 | 702 | 600 | 549 |
| Ixx / Izz | | 0.66 | 0.72 | 0.96 | 0.84 | 0.75 | 0.88 | 0.96 |
| Total Head Mass (g) | | 203 | 203 | 203 | 203 | 203 | 203 | 203 |
| CM1 | Mass (g) | 36.5 | 36.5 | 36.5 | 36.5 | 27.7 | 27.7 | 27.7 |
| | X (mm) | 52.5 | 50 | 10 | 35 | 52.5 | 35 | 0 |
| | Y (mm) | 10 | 10 | 10 | 10 | 10 | 10 | 10 |
| | Z (mm) | 25.5 | 25.5 | 25.5 | 25.5 | 25.5 | 25.5 | 25.5 |
| CM2 | Mass (g) | 36.5 | 36.5 | 36.5 | 36.5 | 27.7 | 27.7 | 27.7 |
| | X (mm) | -52.5 | -40 | 0 | -25 | -52.5 | -25 | 0 |
| | Y (mm) | 10 | 10 | 10 | 10 | 10 | 10 | 10 |
| | Z (mm) | 25.5 | 25.5 | 25.5 | 25.5 | 25.5 | 25.5 | 25.5 |
| CM3 | Mass (g) | 23.9 | 23.9 | 23.9 | 23.9 | 41.5 | 41.5 | 41.5 |
| | X (mm) | 0 | 0 | 0 | 0 | 0 | 0 | 0 |
| | Y (mm) | 114.3 | 114.3 | 114.3 | 114.3 | 114.3 | 114.3 | 114.3 |
| | Z (mm) | -20 | -20 | -20 | -20 | -20 | -20 | -20 |

FIG. 90

GOLF CLUB

CROSS-REFERENCE TO RELATED APPLICATIONS

This application is a continuation of U.S. patent application Ser. No. 17/064,528, filed Oct. 6, 2020, now U.S. Pat. No. 11,369,846, issued Jun. 28, 2022, entitled "GOLF CLUB," which is a continuation of U.S. patent application Ser. No. 16/410,249, filed May 13, 2019, now U.S. Pat. No. 10,828,540, issued Nov. 10, 2020, entitled "GOLF CLUB," which is a continuation of U.S. patent application Ser. No. 16/102,293, filed Aug. 13, 2018, now U.S. Pat. No. 10,569,145, issued Feb. 25, 2020, entitled "GOLF CLUB," which is a continuation of U.S. patent application Ser. No. 15/838,682, filed Dec. 12, 2017, now U.S. Pat. No. 10,226,671, issued Mar. 12, 2019, entitled "GOLF CLUB," which is a continuation of U.S. patent application Ser. No. 14/144,105, filed Dec. 30, 2013, now U.S. Pat. No. 9,861,864, issued Jan. 9, 2018, entitled "GOLF CLUB," which claims priority to U.S. Provisional Application No. 61/909,964, entitled "GOLF CLUB," filed Nov. 27, 2013, all of which are hereby specifically incorporated by reference herein in their entirety.

This application references U.S. patent application Ser. No. 13/839,727, entitled "GOLF CLUB WITH COEFFICIENT OF RESTITUTION FEATURE," filed Mar. 15, 2013, which is incorporated by reference herein in its entirety and with specific reference to discussion of center of gravity location and the resulting effects on club performance. This application also references U.S. Pat. No. 7,731,603, entitled "GOLF CLUB HEAD," filed Sep. 27, 2007, which is incorporated by reference herein in its entirety and with specific reference to discussion of moment of inertia. This application also references U.S. Pat. No. 7,887,431, entitled "GOLF CLUB," filed Dec. 30, 2008, which is incorporated by reference herein in its entirety and with specific reference to discussion of adjustable loft technology described therein. This application also references U.S. patent application Ser. No. 13/718,107, entitled "HIGH VOLUME AERODYNAMIC GOLF CLUB HEAD," filed Dec. 18, 2012, which is incorporated by reference herein in its entirety and with specific reference to discussion of aerodynamic golf club heads. This application also references U.S. Pat. No. 7,874,936, entitled "COMPOSITE ARTICLES AND METHODS FOR MAKING THE SAME," filed Dec. 19, 2007, which is incorporated by reference herein in its entirety and with specific reference to discussion of composite face technology.

FIELD

This disclosure relates to wood-type golf clubs. Particularly, this disclosure relates to wood-type golf club heads with low center of gravity.

BACKGROUND

As described with reference to U.S. patent application Ser. No. 13/839,727, entitled "GOLF CLUB WITH COEFFICIENT OF RESTITUTION FEATURE," filed Mar. 15, 2013—incorporated by reference herein—there is benefit associated with locating the center of gravity (CG) of the golf club head proximal to the face and low in the golf club head. In certain types of heads, it may still be the most desirable design to locate the CG of the golf club head as low as possible regardless of its location within the golf club head. However, in many situations, a low and forward CG location may provide some benefits not seen in prior designs or in comparable designs without a low and forward CG.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads have lofts of 13 degrees or greater, and, more usually, 15 degrees or greater. In general, driver type golf club heads have lofts of 12 degrees or less, and, more usually, of 10.5 degrees or less. In general, fairway wood type golf club heads have a length from leading edge to trailing edge of 73-97 mm. Various definitions distinguish a fairway wood type golf club head from a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Driver type golf club heads of the current disclosure may be 12 degrees or less in various embodiments or 10.5 degrees or less in various embodiments.

With the ever-increasing popularity and competitiveness of golf, substantial effort and resources are currently being expended to improve golf clubs so that increasingly more golfers can have more enjoyment and more success at playing golf. Much of this improvement activity has been in the realms of sophisticated materials and club-head engineering. For example, modern "wood-type" golf clubs (notably, "drivers," "fairway woods," and "utility clubs"), with their sophisticated shafts and non-wooden club-heads, bear little resemblance to the "wood" drivers, low-loft long-irons, and higher numbered fairway woods used years ago. These modern wood-type clubs are generally called "metal-woods."

An exemplary metal-wood golf club such as a fairway wood or driver typically includes a hollow shaft having a lower end to which the club-head is attached. Most modern versions of these club-heads are made, at least in part, of a light-weight but strong metal such as titanium alloy. The club-head comprises a body to which a strike plate (also called a face plate) is attached or integrally formed. The strike plate defines a front surface or strike face that actually contacts the golf ball.

The current ability to fashion metal-wood club-heads of strong, light-weight metals and other materials has allowed the club-heads to be made hollow. Use of materials of high strength and high fracture toughness has also allowed club-head walls to be made thinner, which has allowed increases in club-head size, compared to earlier club-heads. Larger club-heads tend to provide a larger "sweet spot" on the strike plate and to have higher club-head inertia, thereby making the club-heads more "forgiving" than smaller club-heads. Characteristics such as size of the sweet spot are determined by many variables including the shape profile, size, and thickness of the strike plate as well as the location of the center of gravity (CG) of the club-head.

The distribution of mass around the club-head typically is characterized by parameters such as rotational moment of inertia (MOI) and CG location. Club-heads typically have multiple rotational MOIs, each associated with a respective Cartesian reference axis (x, y, z) of the club-head. A rotational MOI is a measure of the club-head's resistance to angular acceleration (twisting or rotation) about the respective reference axis. The rotational MOIs are related to, inter alia, the distribution of mass in the club-head with respect to the respective reference axes. Each of the rotational MOIs desirably is maximized as much as practicable to provide the club-head with more forgiveness.

Another factor in modern club-head design is the face plate. Impact of the face plate with the golf ball results in some rearward instantaneous deflection of the face plate. This deflection and the subsequent recoil of the face plate are expressed as the club-head's coefficient of restitution (COR). A thinner face plate deflects more at impact with a golf ball and potentially can impart more energy and thus a higher rebound velocity to the struck ball than a thicker or more rigid face plate. Because of the importance of this effect, the COR of clubs is limited under United States Golf Association (USGA) rules.

Regarding the total mass of the club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the club-head to address performance issues, for example.

Some current approaches to reducing structural mass of a club-head are directed to making at least a portion of the club-head of an alternative material. Whereas the bodies and face plates of most current metal-woods are made of titanium alloy, several "hybrid" club-heads are available that are made, at least in part, of components formed from both graphite/epoxy-composite (or another suitable composite material) and a metal alloy. For example, in one group of these hybrid club-heads a portion of the body is made of carbon-fiber (graphite)/epoxy composite and a titanium alloy is used as the primary face-plate material. Other club-heads are made entirely of one or more composite materials. Graphite composites have a density of approximately 1.5 g/cm$^3$, compared to titanium alloy which has a density of 4.5 g/cm$^3$, which offers tantalizing prospects of providing more discretionary mass in the club-head.

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers is substantial, e.g., fifty or more. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition.

Conventional processes by which fiber-resin composites are fabricated into club-head components utilize high (and sometimes constant) pressure and temperature to cure the resin portion in a minimal period of time. The processes desirably yield components that are, or nearly are, "net-shape," by which is meant that the components as formed have their desired final configurations and dimensions. Making a component at or near net-shape tends to reduce cycle time for making the components and to reduce finishing costs. Unfortunately, at least three main defects are associated with components made in this conventional fashion: (a) the components exhibit a high incidence of composite porosity (voids formed by trapped air bubbles or as a result of the released gases during a chemical reaction); (b) a relatively high loss of resin occurs during fabrication of the components; and (c) the fiber layers tend to have "wavy" fibers instead of straight fibers. Whereas some of these defects may not cause significant adverse effects on the service performance of the components when the components are subjected to simple (and static) tension, compression, and/or bending, component performance typically will be drastically reduced whenever these components are subjected to complex loads, such as dynamic and repetitive loads (i.e., repetitive impact and consequent fatigue).

Manufacturers of metal wood golf club-heads have more recently attempted to manipulate the performance of their club heads by designing what is generically termed a variable face thickness profile for the striking face. It is known to fabricate a variable-thickness composite striking plate by first forming a lay-up of prepreg plies, as described above, and then adding additional "partial" layers or plies that are smaller than the overall size of the plate in the areas where additional thickness is desired (referred to as the "partial ply" method). For example, to form a projection on the rear surface of a composite plate, a series of annular plies, gradually decreasing in size, are added to the lay-up of prepreg plies.

Unfortunately, variable-thickness composite plates manufactured using the partial ply method are susceptible to a high incidence of composite porosity because air bubbles tend to remain at the edges of the partial plies (within the impact zone of the plate). Moreover, the reinforcing fibers in the prepreg plies are ineffective at their ends. The ends of the fibers of the partial plies within the impact zone are stress concentrations, which can lead to premature delamination and/or cracking. Furthermore, the partial plies can inhibit the steady outward flow of resin during the curing process, leading to resin-rich regions in the plate. Resin-rich regions tend to reduce the efficacy of the fiber reinforcement, particularly since the force resulting from golf-ball impact is generally transverse to the orientation of the fibers of the fiber reinforcement.

Typically, conventional CNC machining is used during the manufacture of composite face plates, such as for trimming a cured part. Because the tool applies a lateral cutting force to the part (against the peripheral edge of the part), it has been found that such trimming can pull fibers or portions thereof out of their plies and/or induce horizontal cracks on the peripheral edge of the part. As can be appreciated, these defects can cause premature delamination and/or other failure of the part.

While durability limits the application of non-metals in striking plates, even durable plastics and composites exhibit some additional deficiencies. Typical metallic striking plates include a fine ground striking surface (and for iron-type golf clubs may include a series of horizontal grooves) that tends to promote a preferred ball spin in play under wet conditions. This fine ground surface appears to provide a relief volume for water present at a striking surface/ball impact area so that impact under wet conditions produces a ball trajectory and shot characteristics similar to those obtained under dry conditions. While non-metals suitable for striking plates are durable, these materials generally do not provide a durable roughened, grooved, or textured striking surface such as provided by conventional clubs and that is needed to maintain club performance under various playing conditions. Accordingly, improved striking plates, striking surfaces, and golf clubs that include such striking plates and surfaces and associated methods are needed.

Golf club head manufacturers and designers are constantly looking for ways to improve golf club head performance, which includes the forgiveness and playability of the golf club head, while having an aesthetic appearance. Generally, "forgiveness" can be defined as the ability of a golf club head to compensate for mishits, i.e., hits resulting from striking the golf ball at a less than an ideal impact location on the golf club head. Similarly, "playability" can be defined generally as the ease in which a golfer having any of various skill levels can use the golf club head for producing quality golf shots.

Golf club head performance can be directly affected by the moments of inertia of the club head. A moment of inertia is the measure of a club head's resistance to twisting upon impact with a golf ball. Generally, the higher the moments of inertia of a golf club head, the less the golf club head twists at impact with a golf ball, particularly during "off-center" impacts with a golf ball. The less a golf club head twists, the greater the forgiveness of the golf club head and the greater the probability of hitting a straight golf shot. In some instances, a golf club head with high moments of inertia may also result in an increased ball speed upon impact with the golf club head, which generally translates into increased golf shot distance.

In general, the moment of inertia of a mass about a given axis is proportional to the square of the distance of the mass away from the axis. In other words, the greater is the distance of a mass away from a given axis, the greater is the moment of inertia of the mass about the given axis. To reduce ball speed-loss on off-center golf shots, golf club head designers and manufacturers have sought to increase the moment of inertia about a golf club head z-axis extending vertically through the golf club head center of gravity, i.e., Izz. By increasing the distance of the outer periphery of the golf club head from the vertical axis, e.g., the further the golf club head extends outward away from the vertical axis, the greater the moment of inertia (Izz), and the lesser the golf club head twists about the vertical axis upon impact with a golf ball and the greater the forgiveness of the golf club head.

United States Golf Association (US GA) regulations and constraints on golf club head shapes, sizes and other characteristics tend to limit the moments of inertia achievable by a golf club head. For example, the highest moment of inertia (Izz) allowable by the USGA is currently 5,900 $g \cdot cm^2$ (590 $kg \cdot mm^2$).

Because of increased demand by golfers to hit straighter and longer golf shots, golf club manufacturers recently have produced golf club heads that increasingly approach the maximum allowed moment of inertia (Izz). Although golf club heads with high moments of inertia (Izz) may provide greater left-to-right shot shape forgiveness, such benefits are contingent upon the golfer being able to adequately square up the club face prior to impacting the golf ball. For example, if the golf club head face is too open on impact with a golf ball, the ball will have a tendency to fade or slice. The harder it is to rotate the golf club head during a swing, the more difficult it is to square the golf club head prior to impact with a golf ball and the greater the tendency to hit errant golf shots. Often, the bulkiness or size of a golf club head can negatively affect the ability of a golfer to rotate the golf club head into proper impact position. In other words, because the mass of bulkier golf club heads is distributed further away from the hosel and shaft, the moment of inertia about the shaft is increased making it harder it is to rotate the golf club head about the shaft during a swing.

Conventional golf club heads approaching the maximum allowable moment of inertia (Izz), tend to be bulkier than club heads with lower moments of inertia due to the outward extend of the periphery of the golf club head. Although the bulkiness of the golf club heads may provide a higher moment of inertia (Izz) for greater forgiveness, such benefits tend to diminish as the bulkiness of the golf club head makes it harder for a golfer to square up the golf club head. In other words, the high forgiveness of the golf club head can be negated by the inability of the golfer to square the club face due to the bulkiness of the golf club head.

SUMMARY

A golf club head includes a club body including a crown, a sole, a skirt disposed between and connecting the crown and the sole and a face portion connected to a front end of the club body. The face portion includes a geometric center defining the origin of a coordinate system when the golf club head is ideally positioned, the coordinate system including an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis. The golf club head defines a center of gravity CG, the CG being a distance $CG_Y$ from the origin as measured along the y-axis and a distance $CG_Z$ from the origin as measured along the z-axis.

Some disclosed examples pertain to composite articles, and in particular a composite face plate for a golf club-head, and methods for making the same. In certain embodiments, a composite face plate for a club-head is formed with a cross-sectional profile having a varying thickness. The face plate comprises a lay-up of multiple, composite prepreg plies. The face plate can include additional components, such as an outer polymeric or metal layer (also referred to as a cap) covering the outer surface of the lay-up and forming the striking surface of the face plate. In other embodiments, the outer surface of the lay-up can be the striking surface that contacts a golf ball upon impact with the face plate.

In order to vary the thickness of the lay-up, some of the prepreg plies comprise elongated strips of prepreg material arranged in a cross-cross, overlapping pattern so as to add thickness to the composite lay-up in one or more regions where the strips overlap each other. The strips of prepreg plies can be arranged relative to each other in a predetermined manner to achieve a desired cross-sectional profile for the face plate. For example, in one embodiment, the strips can be arranged in one or more clusters having a central region where the strips overlap each other. The lay-up has a projection or bump formed by the central overlapping region of the strips and desirably centered on the sweet spot of the face plate. A relatively thinner peripheral portion of the lay-up surrounds the projection. In another embodiment, the lay-up can include strips of prepreg plies that are arranged to form an annular projection surrounding a relatively thinner central region of the face plate, thereby forming a cross-sectional profile that is reminiscent of a "volcano."

The strips of prepreg material desirably extend continuously across the finished composite part; that is, the ends of the strips are at the peripheral edge of the finished composite part. In this manner, the longitudinally extending reinforcing fibers of the strips also extend continuously across the finished composite part such that the ends of the fibers are at the periphery of the part. In addition, the lay-up can initially be formed as an "oversized" part in which the reinforcing fibers of the prepreg material extend into a peripheral sacrificial portion of the lay-up. Consequently, the curing process for the lay-up can be controlled to shift defects into the sacrificial portion of the lay-up, which subsequently can be removed to provide a finished part with little or no defects. Moreover, the durability of the finished part is increased because the free ends of the fibers are at the periphery of the finished part, away from the impact zone.

The sacrificial portion desirably is trimmed from the lay-up using water-jet cutting. In water-jet cutting, the cutting force is applied in a direction perpendicular to the prepreg plies (in a direction normal to the front and rear surfaces of the lay-up), which minimizes damage to the reinforcing fibers.

In one representative embodiment, a golf club-head comprises a body having a crown, a heel, a toe, and a sole, and defining a front opening. The head also includes a variable-thickness face insert closing the front opening of the body. The insert comprises a lay-up of multiple, composite prepreg plies, wherein at least a portion of the plies comprise a plurality of elongated prepreg strips arranged in a criss-cross pattern defining an overlapping region where the strips overlap each other. The lay-up has a first thickness at a location spaced from the overlapping region and a second thickness at the overlapping region, the second thickness being greater than the first thickness.

In another representative embodiment, a golf club-head comprises a body having a crown, a heel, a toe, and a sole, and defining a front opening. The head also includes a variable-thickness face insert closing the front opening of the body. The insert comprises a lay-up of multiple, composite prepreg plies, the lay-up having a front surface, a peripheral edge surrounding the front surface, and a width. At least a portion of the plies comprise elongated strips that are narrower than the width of the lay-up and extend continuously across the front surface. The strips are arranged within the lay-up so as to define a cross-sectional profile having a varying thickness.

In another representative embodiment, a composite face plate for a club-head of a golf club comprises a composite lay-up comprising multiple prepreg layers, each prepreg layer comprising at least one resin-impregnated layer of longitudinally extending fibers at a respective orientation. The lay-up has an outer peripheral edge defining an overall size and shape of the lay-up. At least a portion of the layers comprise a plurality of composite panels, each panel comprising a set of one or more prepreg layers, each prepreg layer in the panels having a size and shape that is the same as the overall size and shape of the lay-up. Another portion of the layers comprise a plurality of sets of elongated strips, the sets of strips being interspersed between the panels within the lay-up. The strips extend continuously from respective first locations on the peripheral edge to respective second locations on the peripheral edge and define one or more areas of increased thickness of the lay-up where the strips overlap within the lay-up.

In another representative embodiment, a method for making a composite face plate for a club-head of a golf club comprises forming a lay-up of multiple prepreg composite plies, a portion of the plies comprising elongated strips arranged in a criss-cross pattern defining one or more areas of increased thickness in the lay-up where one or more of the strips overlap each other. The method can further include at least partially curing the lay-up, and shaping the at least partially cured lay-up to form a part having specified dimensions and shape for use as a face plate or part of a face plate for a club-head.

In still another representative embodiment, a method for making a composite face plate for a club-head of a golf club comprises forming a lay-up of multiple prepreg plies, each prepreg ply comprising at least one layer of reinforcing fibers impregnated with a resin. The method can further include at least partially curing the lay-up, and water-jet cutting the at least partially cured lay-up to form a composite part having specified dimensions and shape for use as a face plate or part of a face plate in a club-head.

In some examples, golf club heads comprise a club body and a striking plate secured to the club body. The striking plate includes a face plate and a cover plate secured to the face plate and defining a striking surface, wherein the striking surface includes a plurality of scoreline indentations. In some examples, an adhesive layer secures the cover plate to the face plate. In other alternative embodiments, the scoreline indentations are at least partially filled with a pigment selected to contrast with an appearance of an impact area of the striking surface and the cover plate is metallic and has a thickness between about 0.25 mm and 0.35 mm. In further examples, the scoreline indentations are between about 0.05 and 0.09 mm deep. In other representative examples, a ratio of a scoreline indentation width to a cover plate thickness is between about 2.5 and 3.5, and the face plate is formed of a titanium alloy. In some examples, the scoreline indentations include transition regions having radii of between about 0.2 mm and 0.6 mm, and the cover plate includes a rim configured to extend around a perimeter of the face plate. According to some embodiments, the face plate is a composite face plate and the club body is a wood-type club body.

Cover plates for a golf club face plate comprise a titanium alloy sheet having bulge and roll curvatures, and including a plurality of scoreline indentations. A scoreline indentation depth D is between about 0.05 mm and 0.12 mm, and a titanium alloy sheet thickness T is between about 0.20 mm and 0.40 mm.

In further examples, golf club heads comprise a club body and a striking plate secured to the club body. The striking plate includes a metallic cover having a plurality of impact resistant scoreline indentations situated on a striking surface. In some examples, the metallic cover is between about 0.2 mm and 1.0 mm thick and the scoreline indentations have depths between about 0.1 mm and 0.02 mm. In further examples, the scoreline indentations have a depth D and the metallic cover has a thickness T such that a ratio D/T is between about 0.15 and 0.30 or between about 0.20 and 0.25. In additional examples, the face plate is a variable thickness face plate.

Methods comprise selecting a metallic cover sheet and trimming the metallic cover sheet so as to conform to a golf club face plate. The metallic cover sheet provides a striking surface for a golf club. A plurality of scoreline indentations are defined in the striking surface, wherein the metallic cover sheet has a thickness T between about 0.1 mm and 0.5 mm, and the scoreline indentations have a depth D such that a ratio D/T is between about 0.1 and 0.4. In additional examples, a rim is formed on the cover sheet and is configured to cover a perimeter of the face plate. In typical examples, the metallic sheet is a titanium alloy sheet and is trimmed after formation of the scoreline indentations. In some examples, the scoreline indentations are formed in an impact area of the striking surface or outside of an impact area of the striking surface.

According to some examples, golf club heads (wood-type or iron-type) comprise a club body and a striking plate secured to the club body. The striking plate includes a composite face plate having a front surface and a polymer cover layer secured to the front surface of the face plate, the polymer cover layer having a textured striking surface. In some embodiments, a thickness of the cover layer is between about 0.1 mm and about 2.0 mm or about 0.2 mm and 1.2 mm, or the thickness of the cover layer is about 0.4 mm. In further examples, the striking face of the composite face plate has an effective Shore D hardness of at least about 75, 80, or 85. In additional representative examples, the textured striking surface has one or more of a mean surface roughness between about 1 μm and 10 μm, a mean surface feature frequency of at least about 2/mm, or a surface profile kurtosis greater than about 1.5, 1.75, or 2.0. In additional embodiments, the textured striking surface has a mean surface roughness of less than about 4.5 μm, a mean surface feature frequency of at least about 3/mm, and a surface profile kurtosis greater than about 2 as measured in a top-to-bottom direction, a toe-to-heel direction, or along both directions. In some examples, the striking surface is textured along a top-to-bottom direction or a toe-to-heel direction only. In other examples, the striking surface is textured along an axis that is tilted with respect to a toe-to-heel and a top-to-bottom direction.

Methods comprise providing a face plate for a golf club and a cover layer for a front surface of the face plate. A striking surface of the cover layer is patterned so as to provide a roughened or textured striking surface. According to some examples, the roughened striking surface is patterned to include a periodic array of surface features that provide a mean roughness less than about 5 μm and a mean surface feature frequency along at least one axis substantially parallel to the striking surface of at least 2/mm. In other examples, the striking surface of the cover layer is patterned with a mold. In further examples, the striking surface is patterned by pressing a fabric against the cover layer, and subsequently removing the fabric. In a representative example, the cover layer is formed of a thermoplastic and the fabric is applied as the cover layer is formed.

Golf club heads comprise a face plate having a front surface and a control layer situated on the front surface of the face plate, wherein the control layer has a striking surface having a surface roughness configured to provide a ball spin of about 2500 rpm, 3000 rpm, or 3500 rpm under wet conditions. In some examples, the control layer is a polymer layer. In further examples, the control layer is a polymer layer having a thickness of between about 0.3 mm and 0.5 mm, and the surface roughness of the striking surface is substantially periodic along at least one axis that is substantially parallel to the striking surface. In a representative examples, the striking surface of the face plate has a Shore D hardness of at least about 75, 80, or more preferably, at least about 85. The polymer layer can be a thermoset or thermoplastic material. In representative examples, the polymer layer is a SURLYN ionomer or similar material, or a urethane, preferably a non-yellowing urethane.

Described herein are embodiments of a golf club head with less bulk than some conventional high moment of inertia golf club heads but providing increased forgiveness due to a cooperative combination of moments of inertia about respective axes of the golf club head.

According to one embodiment, a golf club head comprises a body and a face. The body can define an interior cavity and comprise a sole positioned at a bottom portion of the golf club head, a crown positioned at a top portion, and a skirt positioned around a periphery between the sole and crown. The body can have a forward portion and a rearward portion. The face can be positioned at the forward portion of the body and have an ideal impact location that defines a golf club head origin. The head origin can include an x-axis tangential to the face and generally parallel to the ground when the head is ideally positioned, a y-axis generally perpendicular to the x-axis and generally parallel to the ground when the head is ideally positioned, and a z-axis perpendicular to both the x-axis and y-axis. The golf club head can have a moment of inertia about a golf club head center of gravity z-axis generally parallel to the head origin z-axis greater than approximately 500 $kg \cdot mm^2$. Further, the ratio of a moment of inertia about a golf club head center of gravity x-axis generally parallel to the origin x-axis to the moment of inertia about the golf club head center of gravity z-axis (Ixx/Izz) is greater than approximately 0.6.

In some implementations, the ratio Ixx/Izz is greater than approximately 0.7. In other implementations, the ratio Ixx/Izz is greater than approximately 0.8. The moment of inertia about the golf club head center of gravity x-axis can be between approximately 330 $kg \cdot mm^2$ and approximately 550 $kg \cdot mm^2$.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

FIGS. 50-52 illustrate another representative striking plate that includes a cover layer having a roughened striking surface.

FIG. 89 is a chart showing various golf club head characteristics of the first, second, third and fourth golf club head embodiments.

FIG. 90 is a chart showing various golf club head characteristics of several configurations of the fifth golf club head embodiment.

DETAILED DESCRIPTION

Figure 1A:
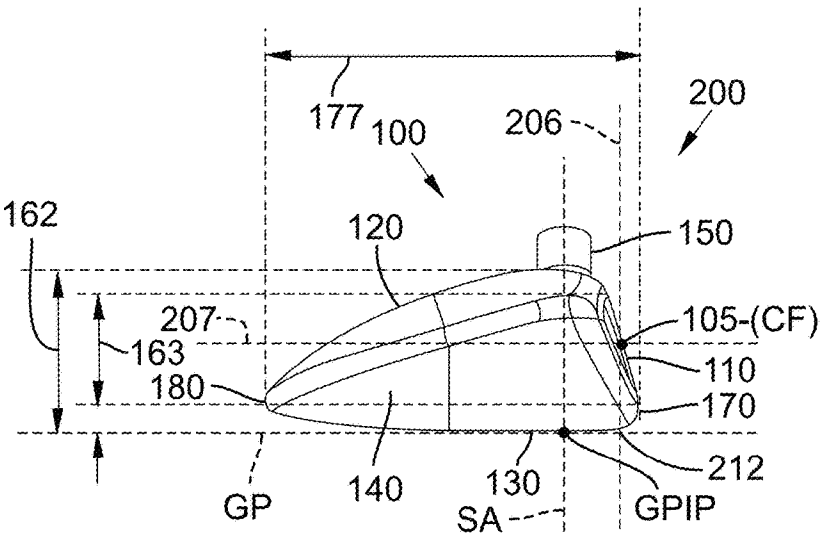
FIG. 1A is a toe side view of a golf club head for reference.

Disclosed is a golf club and a golf club head as well as associated methods, systems, devices, and various apparatus. It would be understood by one of skill in the art that the disclosed golf club heads are described in but a few exemplary embodiments among many. No particular terminology or description should be considered limiting on the disclosure or the scope of any claims issuing therefrom.

Low and forward center of gravity in a wood-type golf club head is advantageous for any of a variety of reasons. The combination of high launch and low spin is particularly desirable from wood-type golf club heads. Low and forward center of gravity location in wood-type golf club heads aids in achieving the ideal launch conditions by reducing spin and increasing launch angle. In certain situations, however, low and forward center of gravity can reduce the moment of inertia of a golf club head if a substantial portion of the mass is concentrated in one region of the golf club head. As described in U.S. Pat. No. 7,731,603, filed Sep. 27, 2007, entitled "GOLF CLUB HEAD," increasing moment of inertia can be beneficial to improve stability of the golf club head for off-center contact. For example, when a substantial portion of the mass of the golf club head is located low and forward, the center of gravity of the golf club head can be moved substantially. However, moment of inertia is a function of mass and the square of the distance from the mass to the axis about which the moment of inertia is measured. As the distance between the mass and the axis of the moment of inertia changes, the moment of inertia of the body changes quadratically. However, as mass becomes concentrated in one location, it is more likely that the center of gravity approaches that localized mass. As such, golf club heads with mass concentrated in one area can have particularly low moments of inertia in some cases.

Particularly low moments of inertia can be detrimental in some cases. Especially with respect to poor strikes and/or off-center strikes, low moment of inertia of the golf club head can lead to twisting of the golf club head. With respect to moment of inertia along an axis passing through the center of gravity, parallel to the ground, and parallel to a line that would be tangent to the face (hereinafter the "center of gravity x-axis"), low moment of inertia can change flight properties for off-center strikes. In the current discussion, when the center of gravity is particularly low and forward in the golf club head, strikes that are substantially above the center of gravity lead to a relatively large moment arm and potential for twisting. If the moment of inertia of the golf club head about the center of gravity x-axis (hereinafter the "$I_{xx}$") is particularly low, high twisting can result in energy being lost in twisting rather than being transferred to the golf ball to create distance. As such, although low and forward center of gravity is beneficial for creating better launch conditions, poor implementation may result in a particularly unforgiving golf club head in certain circumstances.

A low and forward center of gravity location in the golf club head results in favorable flight conditions because the low and forward center of gravity location results in a projection of the center of gravity normal to a tangent face plane (see discussion of tangent face plane and center of gravity projection as described in U.S. patent application Ser. No. 13/839,727, entitled "Golf Club," filed Mar. 15, 2013, which is incorporated herein by reference in its entirety). During impact with the ball, the center of gravity projection determines the vertical gear effect that results in higher or lower spin and launch angle. Although moving the center of gravity low in the golf club head results in a lower center of gravity projection, due to the loft of the golf club head, moving the center of gravity forward also can provide a lower projection of the center of gravity. The combination of low and forward center of gravity is a very efficient way to achieve low center of gravity projection. However, forward center of gravity can cause the $I_{XX}$ to become undesirably low. Mass distributions which achieve low CG projection without detrimental effect on moment of inertia in general—and $I_{xx}$, specifically—would be most beneficial to achieve both favorable flight conditions and more forgiveness on off center hits. A parameter that helps describe to the effectiveness of the center of gravity projection is the ratio of $CG_Z$ (the vertical distance of the center of gravity as measured from the center face along the z-axis) to $CG_Y$ (the distance of the center of gravity as measured rearward from the center face along the y-axis). As the $CG_Z/CG_Y$ ratio becomes more negative, the center of gravity projection would typically become lower, resulting in improved flight conditions.

As such, the current disclosure aims to provide a golf club head having the benefits of a large negative number for $CG_Z/CG_Y$ (indicating a low CG projection) without substantially reducing the forgiveness of the golf club head for off-center—particularly, above-center—strikes (indicating a higher $I_{xx}$). To achieve the desired results, weight may be distributed in the golf club head in a way that promotes the best arrangement of mass to achieve increased $I_{xx}$, but the mass is placed to promote a substantially large negative number for $CG_Z/CG_Y$.

For general reference, a golf club head 100 is seen with reference to FIGS. 1A-1D. One embodiment of a golf club head 100 is disclosed and described in with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208 (shown in FIG. 1B). Each axis 206, 207, 208 is orthogonal to each other axis 206, 207, 208. The golf club head 100 includes a leading edge 170 and a trailing edge 180. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

Figure 1B:
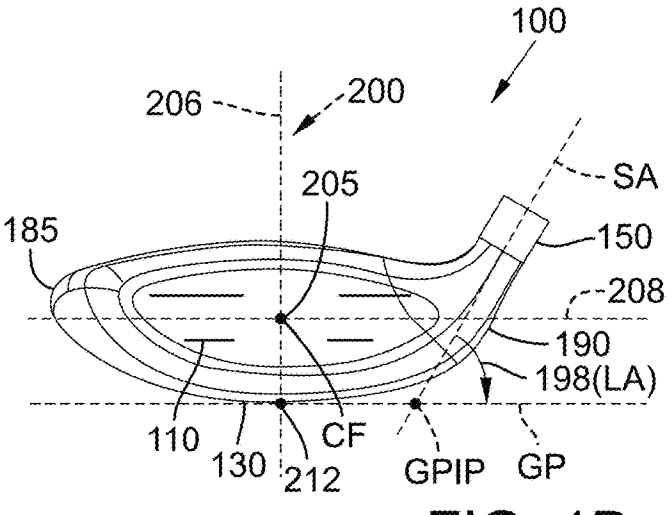
FIG. 1B is a face side view of the golf club head of FIG. 1A.
Figure 1C:
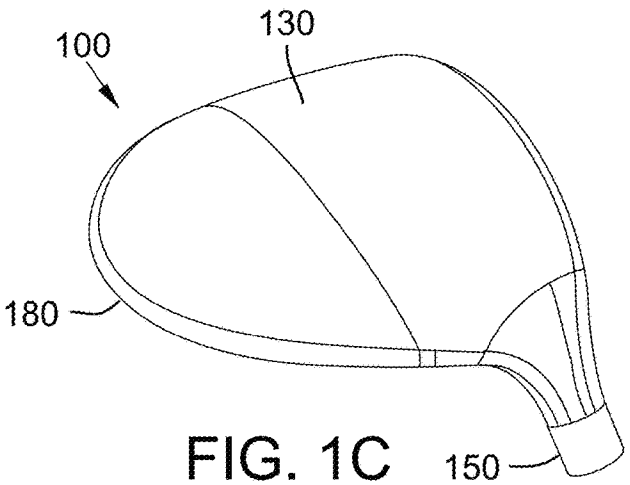
FIG. 1C is a perspective view of the golf club head of FIG. 1A.
Figure 1D:
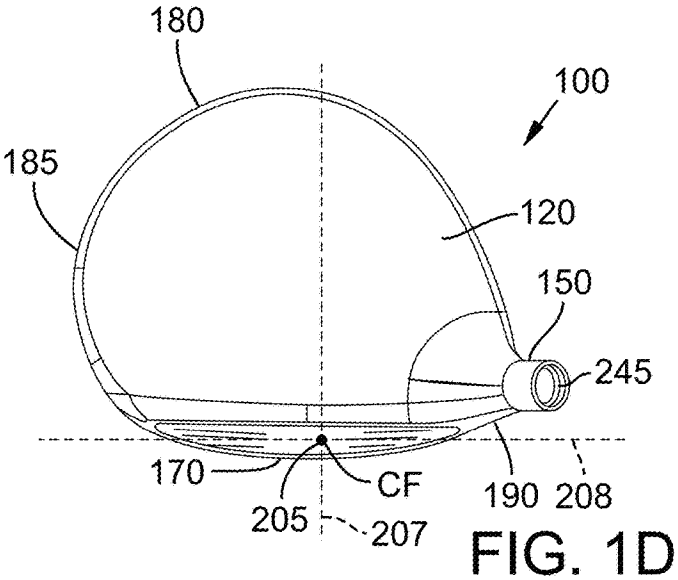
FIG. 1D is a top side view of the golf club head of FIG. 1A.

As seen with reference to FIG. 1B, the x-axis 208 is parallel to a ground plane (GP) onto which the golf club head 100 may be properly soled—arranged so that the sole 130 is in contact with the GP in the desired arrangement of the golf club head 100. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used as a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP. The top view seen in FIG. 1D shows another view of the golf club head 100. The shaft bore 245 can be seen defined in the hosel 150.

Referring back to FIG. 1A, a crown height 162 is shown and measured as the height from the GP to the highest point of the crown 120 as measured parallel to the z-axis 206. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In various embodiments, the effective face position height 164 may be 2-6 mm. In various embodiments, the effect face position height 164 may be 0-10 mm. A distance 177 of the golf club head 100 as measured in the direction of the y-axis 207 is seen as well with reference to FIG. 1A. The distance 177 is a measurement of the length from the leading edge 170 to the trailing edge 180. The distance 177 may be dependent on the loft of the golf club head in various embodiments.

For the sake of the disclosure, portions and references disclosed above will remain consistent through the various embodiments of the disclosure unless modified. One of skill in the art would understand that references pertaining to one embodiment may be included with the various other embodiments.

One embodiment of a golf club head 1000 of the current disclosure is included and described in FIGS. 2A-2D. The golf club head 1000 includes a mass element 1010 located in the sole 130 of the golf club head 1000. The mass element 1010 is located proximate to the forward/center of the golf club head in the current embodiment but may be split as heel-toe weights or may be in various other arrangements. A distance 177 of the golf club head 1000 is about 110.8 mm in the current embodiment. In various embodiments, the distance 177 may be highly variant, from under 90 mm to greater than 140 mm. A sole feature 1020 is included as an extended portion of the body of the golf club head 1000. The sole feature 1020 provides a location of additional mass to help lower center of gravity and provide increased moment of inertia. The sole feature 1020 adds about 5-15 cubic centimeters of volume to the golf club head 1000 in various embodiments. In the current embodiment, the sole feature 1020 adds about 9.2 cc of volume to the golf club head 1000.

In the view of FIGS. 2A-2D (and all remaining figures of the current disclosure), the golf club head is set up to be ideally positioned according to USGA procedure-specifically, with the face square at normal address position, with the shaft axis aligned in a neutral position (parallel to the x-z plane), and with a lie angle of about 60 degrees, regardless of the lie specified for the particular embodiment. The mass element 1010 of the current embodiment is 33.6 grams, although varying mass elements may be utilized in varying embodiments. The sole feature 1020 is makes up about 20.5 grams of mass, although widely variant mass may be utilized in varying embodiments. The sole feature 1020 of the current embodiment is entirely titanium, and in various embodiments may include various materials including lead, steel, tungsten, aluminum, and various other materials of varying densities. It would be understood by one of ordinary skill in the art that the various mass elements and mass features of the various embodiments of the current disclosure may be of various materials, including those mentioned above, and the various materials and configurations may be interchangeable between the various embodiments to achieve ideal playing conditions.

Figure 2A:
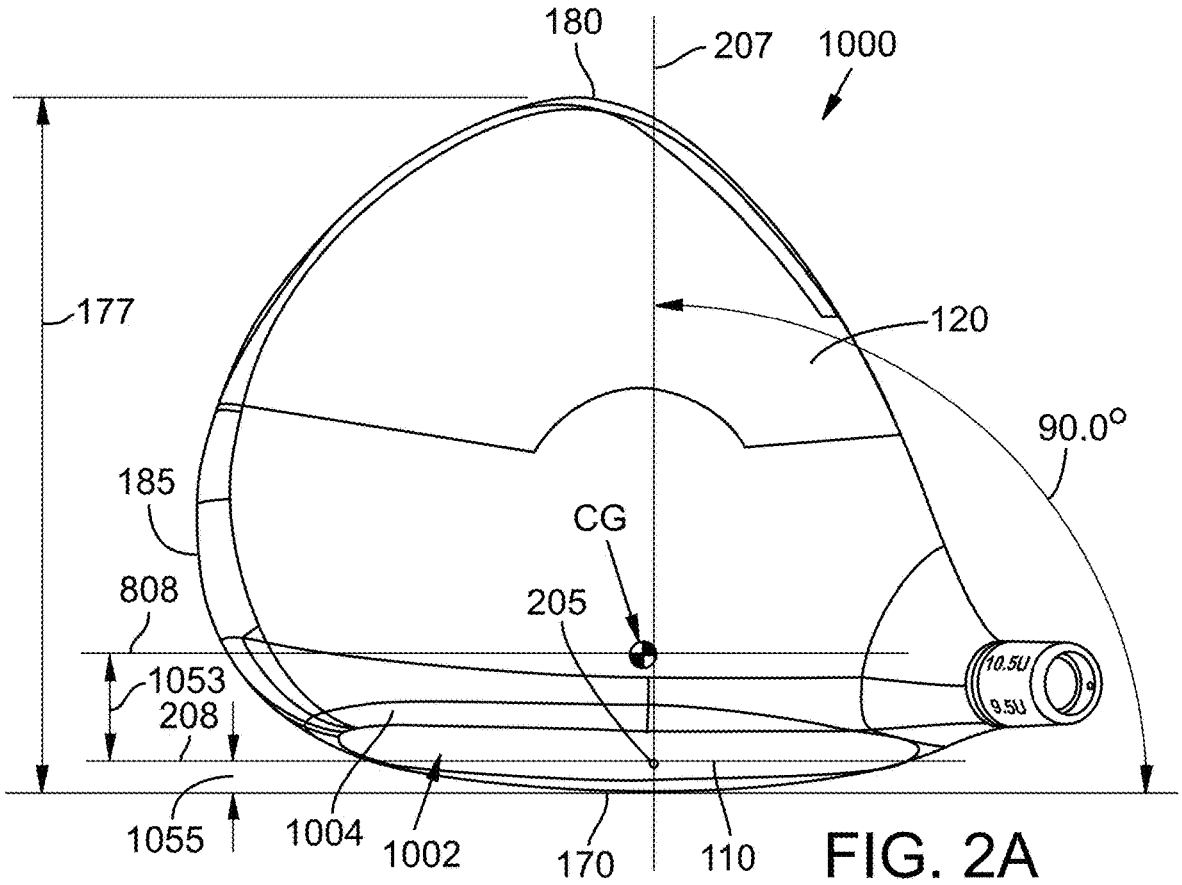
FIG. 2A is a top side view of a golf club head in accord with one embodiment of the current disclosure.

With specific reference to FIG. 2A the golf club head 1000 of the current embodiment includes a face insert 1002 that includes the face 110 and an interface portion 1004 interfacing with the crown 120 and a small portion of the toe 185. In various embodiments, the face insert 1002 may be various shapes, sizes, and materials. In various embodiments, face inserts may interface with portions of the face 110 of the golf club head 1000 only or may interface with portions outside of the face 110 depending on the design. In the current embodiment, the face insert is a composite material as described in U.S. Pat. No. 7,874,936, entitled "COMPOSITE ARTICLES AND METHODS FOR MAKING THE SAME," filed Dec. 19, 2007. Various materials may be used, including various metals, composites, ceramics, and various organic materials. In the current embodiment, the face insert 1002 is composite material such that mass in the face 110 of the golf club head 1000 can be relocated to other portions as desired or so that the golf club head 1000 can be made of especially low mass. In various embodiments, the mass of the golf club head 1000 is reduced by a mass savings of 10-20 grams. In the current embodiment, a mass savings of 10 grams is seen as compared to a comparable golf club head 1000 of the same embodiment with a metallic face insert 1002. As indicated previously, the distance 177 of the golf club head is about 110.8 mm in the current embodiment but may vary in various embodiments and as will be seen elsewhere in this disclosure. In the current embodiment, the golf club head 1000 is of a volume of about 455-464 cubic centimeters (CCs). A distance 1055 between the origin 205 and the leading edge 170 as measured in the direction of the y-axis 207 is seen in the current view. For golf club head 1000, the distance is about 3.6 mm.

Figure 2B:
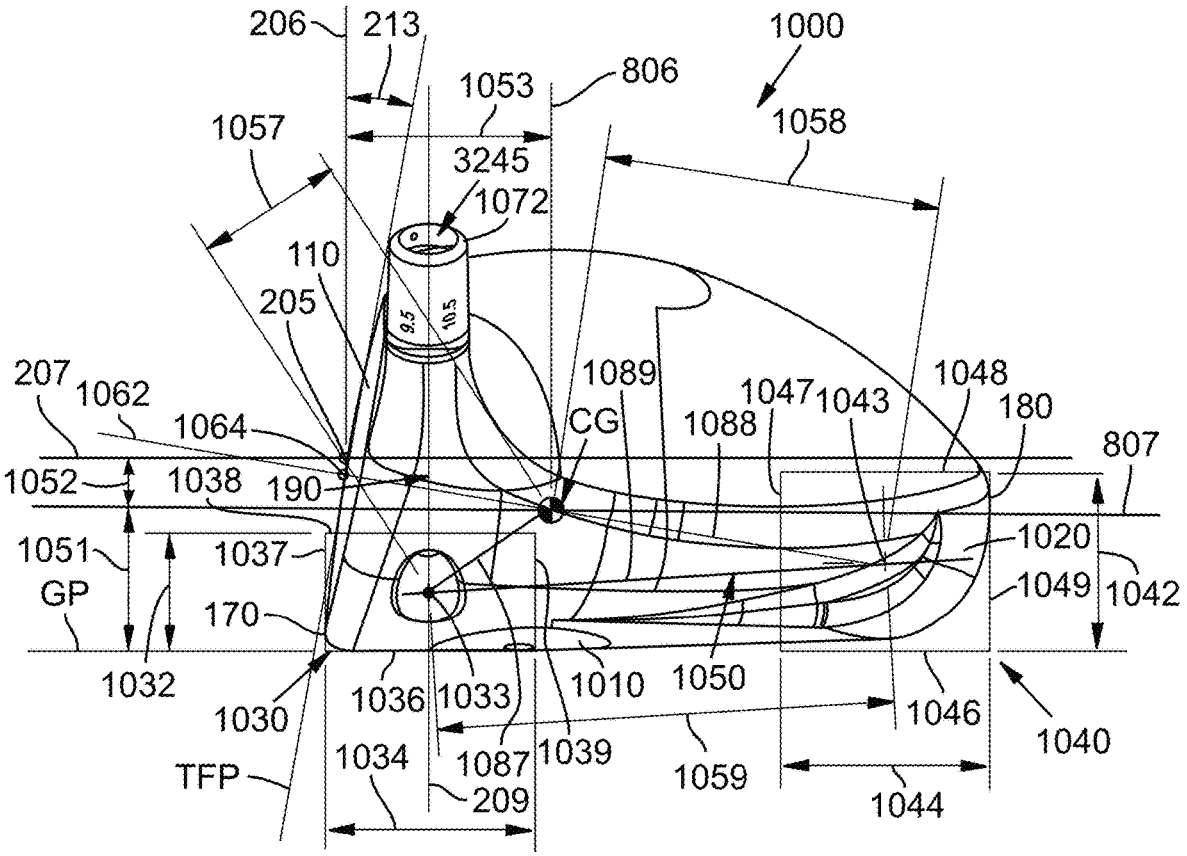
FIG. 2B is a heel side view of the golf club head of FIG. 2A.

As seen with specific reference to FIG. 2B, a forward mass box 1030 and a rearward mass box 1040 are seen drawn for reference only. The mass boxes 1030, 1040 are not features of the golf club head 1000 and are shown for reference to illustrate various features of the golf club head 1000. The view of FIG. 2B shows the heel 190. As such, the view of FIG. 2B shows the view of the y-z plane, or the plane formed by the y-axis 207 and the z-axis 206. As such, distances of the various mass boxes 1030, 1040 as described herein are measured as projected onto the y-z plane.

Each mass box 1030, 1040 represents a defined zone of mass allocation for analysis and comparison of the golf club head 1000 and the various golf club heads of the current. In the current embodiment, each mass box 1030, 1040 is rectangular in shape, although in various embodiments mass definition zones may be of various shapes.

The forward mass box 1030 has a first dimension 1032 as measured parallel to the z-axis 206 and a second dimension 1034 as measured parallel to the y-axis 207. In the current embodiment, the first dimension 1032 is measured from the GP. In the current embodiment, the first dimension 1032 measures a distance of the mass box 1030 from a first side 1036 to a third side 1038 and the second dimension 1034 measures a distance of the mass box 1030 from a second side 1037 to a fourth side 1039. The forward mass box 1030 includes the first side 1036 being coincident with the GP. The second side 1037 is parallel to the z-axis 206 and is tangent to the leading edge 170 such that the forward mass box 1030 encompasses a region that is defined as the lowest and most forward portions of the golf club head 1000. The forward mass box 1030 includes a geometric center point 1033. One of skill in the art would understand that the geometric center point 1033 of the forward mass box 1030 is a point located one-half the first dimension 1032 from the first side 1036 and the third side 1038 and one-half the second dimension 1034 from the second side 1037 and the fourth side 1039. In the current embodiment, the first dimension 1032 is about 20 mm and the second dimension 1034 is about 35 mm. In various embodiments, it may be of value to characterize the mass distribution in various golf club heads in terms of different geometric shapes or different sized zones of mass allocation, and one of skill in the art would understand that the mass boxes 1030, 1040 of the current disclosure should not be considered limiting on the scope of this disclosure or any claims issuing therefrom.

The rearward mass box 1040 has a first dimension 1042 as measured parallel to the z-axis 206 and a second dimension 1044 as measured parallel to the y-axis 207. In the current embodiment, the first dimension 1042 is measured from the GP. In the current embodiment, the first dimension 1042 measures a distance of the mass box 1040 from a first side 1046 to a third side 1048 and the second dimension 1044 measures a distance of the mass box 1040 from a second side 1047 to a fourth side 1049. The rearward mass box 1040 includes the first side 1046 being coincident with the GP. The fourth side 1049 is parallel to the z-axis 206 and is tangent to the trailing edge 180 such that the rearward mass box 1040 encompasses a region that is defined as the lowest and most rearward portions of the golf club head 1000. The rearward mass box 1040 includes a geometric center point 1043. One of skill in the art would understand that the geometric center point 1043 of the rearward mass box 1040 is a point located one-half the first dimension 1042 from the first side 1046 and the third side 1048 and one-half the second dimension 1044 from the second side 1047 and the fourth side 1049. In the current embodiment, the first dimension 1042 is about 30 mm and the second dimension 1044 is about 35 mm. In various embodiments, it may be of value to characterize the mass distribution in various golf club heads in terms of different geometric shapes or different sized zones of mass allocation, and one of skill in the art would understand that the mass boxes 1030, 1040 of the current disclosure should not be considered limiting on the scope of this disclosure or any claims issuing therefrom.

The mass boxes 1030, 1040 illustrate an area of the golf club head 1000 inside which mass is measured to provide a representation of the effectiveness of mass distribution in the golf club head 1000. The forward mass box 1030 is projected through the golf club head 1000 in direction parallel to x-axis 208 (shown in FIG. 1D) and parallel to the GP and captures all mass drawn inside the forward mass box 1030. The rearward mass box 1040 is projected through the golf club head 1000 in direction parallel to x-axis 208 (shown in FIG. 1D) and parallel to the GP and captures all mass drawn inside the rearward mass box 1040.

In the current embodiment, the forward mass box 1030 encompasses 55.2 grams and the rearward mass box 1040 encompasses 30.1 grams, although varying embodiments may include various mass elements. Additional mass of the golf club head 1000 is 125.2 grams outside of the mass boxes 1030, 1040.

A center of gravity (CG) of the golf club head 1000 is seen as annotated in the golf club head 1000. The overall club head CG includes all components of the club head as shown, including any weights or attachments mounted or otherwise connected or attached to the club body. The CG is located a distance 1051 from the ground plane as measured parallel to the z-axis 206. The distance 1051 is also termed $\Delta_Z$ in various embodiments and may be referred to as such throughout the current disclosure. The CG is located a distance 1052 from the origin 205 as measured parallel to the z-axis 206. The distance 1052 is also termed $CG_Z$ in various embodiments and may be referred to as such throughout the current disclosure. $CG_Z$ is measured with positive upwards and negative downwards, with the origin 205 defining the point of 0.0 mm. In the current embodiment, the $CG_Z$ location is −8.8 mm, which means that the CG is located 8.8 mm below center face as measured perpendicularly to the ground plane. The CG is located a distance 1053 from the origin 205 as measured parallel to the y-axis 207. The distance 1053 is also termed $CG_Y$ in various embodiments and may be referred to as such throughout the current disclosure. In the current embodiment, the distance 1051 is 24.2 mm, the distance 1052 is −8.8 mm, and the distance 1053 is 33.3 mm.

A first vector distance 1057 defines a distance as measured in the y-z plane from the geometric center point 1033 of the forward mass box 1030 to the CG. In the current embodiment, the first vector distance 1057 is about 24.5 mm. A second vector distance 1058 defines a distance as measured in the y-z plane from the CG to the geometric center point 1043 of the rearward mass box 1040. In the current embodiment, the second vector distance 1058 is about 56.2 mm. A third vector distance 1059 defines a distance as measured in the y-z plane from the geometric center point 1033 of the forward mass box 1030 to the geometric center point 1043 of the rearward mass box 1040. In the current embodiment, the third vector distance 1059 is about 76.3 mm.

As can be seen, the locations of the CG, the geometric center point 1033, and the geometric center point 1043 form a vector triangle 1050 describing the relationships of the various features. The vector triangle 1050 is for reference and does not appear as a physical feature of the golf club head 1000. As will be discussed in more detail later in this disclosure, the vector triangle 1050 may be utilized to determine the effectiveness of a particular design in improving performance characteristics of the of the golf club heads of the current disclosure. The vector triangle 1050 includes a first leg 1087 corresponding to the distance 1057, a second leg 1088 corresponding to the distance 1058, and a third leg 1089 corresponding to the third distance 1059.

A tangent face plane TFP can be seen in the view of FIG. 2B as well. The TFP is a plane tangent to the face 110 at the origin 205 (at CF). The TFP 235 approximates a plane for the face 110, even though the face 110 is curved at a roll radius and a bulge radius. The TFP is angled at an angle 213 with respect to the z-axis 206. The angle 213 in the current embodiment is the same as a loft angle of the golf club head as would be understood by one of ordinary skill in the art. A shaft plane z-axis 209 is seen and is coincident (from the current view) with the SA. In various embodiments, the shaft plane z-axis 209 is a projection of the SA onto the y-z plane. For the current embodiment, the SA is entirely within a plane that is parallel to an x-z plane—a plane formed by the x-axis 208 and the z-axis 206. As such, in the current embodiment, the shaft plane z-axis 209 is parallel to the z-axis 206. In some embodiments, the SA will not be in a plane parallel to the plane formed by the x-axis 208 and the z-axis 206.

A CG projection line 1062 shows the projection of the CG onto the TFP at a CG projection point 1064. CG projection point 1064 describes the location of the CG as projected onto the TFP at a 90° angle. As such, the CG projection point 1064 allows for description of the CG in relation to the center face (CF) point at the origin 205. The CG projection point 1064 of the current embodiment is offset from the CF 205. The offset of the CG projection point 1064 from the CF 205 may be measured along the TFP in various embodiments or parallel to the z-axis in various embodiments. In the current embodiment, the offset distance of the CG projection point 1064 from the CF 205 is about −2.3 mm, meaning that the CG projects about 2.3 mm below center face.

In various embodiments, the dimensions and locations of features disclosed herein may be used to define various ratios, areas, and dimensional relationships—along with, inter alia, various other dimensions of the golf club head 1000—to help define the effectiveness of weight distribution at achieving goals of the design.

The CG defines the origin of a CG coordinate system including a CG z-axis 806, a CG y-axis 807, and a CG x-axis 808 (shown in FIG. 2A). The CG z-axis 806 is parallel to the z-axis 206; the CG y-axis 807 is parallel to the y-axis 207; the CG x-axis 808 is parallel to the x-axis 208. As described with reference to U.S. Pat. No. 7,731,603, entitled "GOLF CLUB HEAD," filed Sep. 27, 2007, the moment of inertia (MOI) of any golf club head can be measured about the CG with particular reference to the CG axes as defined herein. $I_{xx}$ is a moment of inertia about the CG x-axis 808; $I_{yy}$ is a moment of inertia about the CG y-axis 807; $I_{zz}$ is a moment of inertia about the CG z-axis 806.

As described elsewhere in this disclosure, particularly low MOI can lead to instability for off-center hits. However, MOI is typically proportioned to particular mass using the length and the magnitude of the mass. One example appears in the equation below:

$$I \propto m \times L^2$$

where I is the moment of inertia, m is the mass, and L is the distance from the axis of rotation to the mass (with a indicating proportionality). As such, distance from the axis of rotation to the mass is of greater importance than magnitude of mass because the moment of inertia varies with the square of the distance and only linearly with respect to the magnitude of mass.

In the current embodiment of the golf club head 1000, the inclusion of multiple mass elements—including mass element 1010 and sole feature 1020—allows mass to be located distal to the center of gravity. As a result, the moment of inertia of the golf club head 1000 is higher than some comparable clubs having similar CG locations. $I_{xx}$ in the current embodiment is about 283 kg·mm$^2$. $I_{zz}$ in the current embodiment is about 380 kg-mm$^2$.

In golf club heads of many prior designs, the main mechanism for increasing MOI was to move a substantial proportion of the golf club head mass as far toward the trailing edge 180 as possible. Although such designs typically achieved high MOI, the projection of the CG onto the TFP was particularly high, reducing performance of the golf club head by negating the benefits of low CG. In one embodiment the golf club head has an Ixx between about 70 kg*mm$^2$ and about 400 kg*mm$^2$, and between about 200 kg*mm$^2$ and about 300 kg*mm$^2$ in another embodiment, and between about 200 kg*mm$^2$ and about 500 kg*mm$^2$ in a further embodiment. Further, in one embodiment the golf club head has an Izz between about 200 kg*mm$^2$ and about 600 kg*mm$^2$, and between about 400 kg*mm$^2$ and about 500 kg*mm$^2$ in another embodiment, and between about 350 kg*mm$^2$ and about 600 kg*mm$^2$ in a further embodiment. Still further, in one embodiment the golf club head has an Iyy between about 200 kg*mm$^2$ and about 400 kg*mm$^2$, and between about 250 kg*mm$^2$ and about 350 kg*mm$^2$. In another embodiment the golf club head has a mass of about 200 g to about 210 g, or about 190 g to about 200 g in another embodiment, and less than about 205 g in a further embodiment. One particular embodiment has an $I_{zz}$ between about 500 kg*mm$^2$ and about 550 kg*mm$^2$, and/or an Iyy between about 320 kg*mm$^2$ and about 370 kg*mm$^2$, and/or an Ixx between about 310 kg*mm$^2$ and about 360 kg*mm$^2$. A further embodiment narrows these ranges to an Izz between about 510 kg*mm$^2$ and about 540 kg*mm$^2$, and/or an Iyy between about 330 kg*mm$^2$ and about 360 kg*mm$^2$, and/or an Ixx between about 320 kg*mm$^2$ and about 350 kg*mm$^2$, while yet another embodiment has an $I_{zz}$ between about 520 kg*mm$^2$ and about 530 kg*mm$^2$, and/or an Iyy between about 340 kg*mm$^2$ and about 350 kg*mm$^2$, and/or an Ixx between about 330 kg*mm$^2$ and about 340 kg*mm$^2$. In one embodiment the CGz distance is −3 mm to −8 mm, and −4 mm to −7 mm in another embodiment, and −5 mm to −6 mm in still a further embodiment. Similarly, in one embodiment the CGy distance is 30 mm to 37 mm, and 31 mm to 36 mm in another embodiment, and 32 mm to 34 mm in still a further embodiment. Likewise, in one embodiment the CGx distance is 3 mm to 9 mm, and 4 mm to 8 mm in another embodiment, and 5 mm to 7 mm in still a further embodiment.

Magnitudes of the mass boxes 1030, 1040 provides some description of the effectiveness of increasing moment of inertia in the golf club head 1000. The vector triangle 1050 provides a description of the effectiveness of increasing MOI while maintaining a low CG in the golf club head 1000. Additionally, the golf club head 1000 can be characterized using ratios of the masses within the mass boxes 1030, 1040 (55.2 g and 30.1 g, respectively) as compared to the mass of the golf club head 1000 outside of the mass boxes (125.2 g). As previously described, low CG provides benefits of a low CG projection onto the TFP. As such, to increase MOI without suffering negative effects of low MOI, multiple masses located low in the golf club head 1000 can produce high stability while allowing the performance gains of a low CG.

One method to quantify the effectiveness of increasing MOI while lowering CG location in the golf club head 1000 is to determine an area of the vector triangle 1050. Area of the vector triangle 1050 is found using the following equation:

$$A=\sqrt{s(s-a)(s-b)(s-c)}$$

where $$s=\frac{a+b+c}{2}$$

Utilizing the area calculation, A of the vector triangle 1050 is about 456 mm$^2$.

One method to quantify the effectiveness of increasing the MOI while lowering CG location in the golf club head 1000 is to provide ratios of the various legs 1087, 1088, 1089 of the vector triangle 1050. In various embodiments, a vector ratio is determined as a ratio of the sum of the distances of the first leg 1087 and second leg 1088 of the vector triangle 1050 as compared to the third leg 1089 of the vector triangle 1050. With reference to the vector triangle 1050, the legs are of the first distance 1057, the second distance 1058, and the third distance 1059, as previously noted. As oriented, the first leg 1087 and the second leg 1088 are both oriented above the third leg 1089. In most embodiments, one leg of the vector triangle 1050 will be larger than the other two legs. In most embodiments, the largest leg of the vector triangle 1050 will be the third leg 1089. In most embodiments, the vector ratio is determined by taking a ratio of the sum of the two minor legs as compared to the major leg. In some embodiments, it is possible that the third leg 1089 is smaller than one of the other two legs, although such embodiments would be rare for driver-type golf club heads. The vector ratio can be found using the formula below:

$$VR=\frac{a+b}{c}$$

where VR is the vector ratio, a is the first distance 1057 as characterizing the first leg 1087, b is the second distance 1058 as characterizing the second leg 1088, and c is the third distance 1059 as characterizing the third leg 1089. In all embodiments, the vector ratio should be at least 1, as mathematical solutions of less than 1 would not indicate that a triangle had been formed. In the current embodiment, the vector ratio is about (24.5+56.2)/76.3=1.0577.

In various embodiments, the largest leg may not be the third leg. In such embodiments, the third distance 1059 should still be utilized as element c in the equation above to maintain the relation of the vector ratio to a low CG and high MOI. In various embodiments, vector triangles may be equilateral (all legs equidistant) or isosceles (two legs equidistant). In the case of an equilateral triangle, the vector ratio will be 2.0000.

In various embodiments, the effectiveness of CG location may be characterized in terms of $CG_Z$ and in terms of the relation of $CG_Z$ to $CG_Y$. In various embodiments, the effectiveness of CG location may be characterized in terms of $\Delta_Z$ and in relation to $CG_Z$. In various embodiments, $CG_Z$ may be combined with MOI to characterize performance. In various embodiments, $CG_Z$ and $CG_Y$ may be combined with MOI to characterize performance. Various relationships disclosed herein may be described in greater detail with reference to additional figures of the current disclosure, but one of skill in the art would understand that no particular representation should be considered limiting on the scope of the disclosure.

In various embodiments, the moment of inertia contribution of mass located inside the mass boxes can be somewhat quantified as described herein. To characterize the contribution to moment of inertia of the mass of the golf club head located within the mass box, a MOI effectiveness summation (hereinafter $MOI_{eff}$) is calculated utilizing the mass within each of the mass boxes 1030, 1040 and the length between the CG and each geometric center 1033, 1043 using the equation below:

$$MOI_{eff}=m_1L_1^2+m_2L_2^2$$

where $m_n$ is the mass within a particular mass box n (such as mass boxes 1030, 1040) and L n is the distance between the CG and the mass box n (distances 1057, 1058, respectively). In the current embodiment, $MOI_{eff}$=(55.2 grams)×(24.5 mm)$^2$+(30.1 grams)×(56.2 mm)$^2$≈128,200 g·mm$^2$=128.2 kg·mm$^2$. Although this is not an exact number for the moment of inertia provided by the mass inside the mass boxes, it does provide a basis for comparison of how the mass in the region of the mass boxes affects MOI in the golf club head such as golf club head 1000.

In various embodiments, an MOI effectiveness summation ratio ($R_{MOI}$) may be useful as the ratio of $MOI_{eff}$ to the overall club head MOI in the y-z plane ($I_{xx}$). In the current embodiment, the $R_{MOI}=MOI_{eff}/I_{xx}$=128.2 kg·mm$^2$/283 kg·mm$^2$≈0.453. As can be seen, the golf club head 1000 and other golf club heads of the current disclosure include adjustable loft sleeves, including loft sleeve 1072. Adjustable loft technology is described in greater detail with reference to U.S. Pat. No. 7,887,431, entitled "GOLF CLUB," filed Dec. 30, 2008, incorporated by reference herein in its entirety, and in additional applications claiming priority to such application. However, in various embodiments, adjustable loft need not be required for the functioning of the current disclosure.

In addition to the features described herein, the embodiment of FIGS. 2A-2D also includes an aerodynamic shape as described in accord with U.S. patent application Ser. No. 13/718,107, entitled "HIGH VOLUME AERODYNAMIC GOLF CLUB HEAD," filed Dec. 18, 2012. Various factors may be modified to improve the aerodynamic aspects of the invention without modifying the scope of the disclosure. In various embodiments, the volume of the golf club head 1000 may be 430 cc to 500 cc. In the current embodiment, there are no inversions, indentations, or concave shaping elements on the crown of the golf club, and, as such, the crown remains convex over its body, although the curvature of the crown may be variable in various embodiments.

Figure 2C:
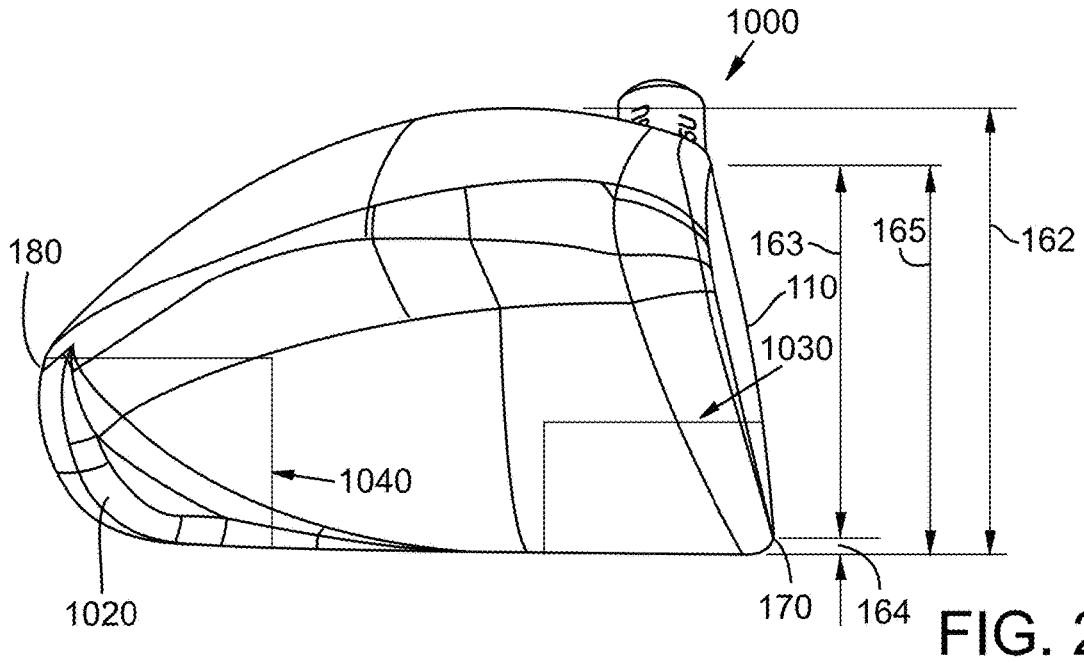
FIG. 2C is a toe side view of the golf club head of FIG. 2A.

As seen with reference to FIG. 2C, the effective face height 163 and crown height 162 are shown. The effective face height 163 is 56.5 mm in the current embodiment. A face height 165 is shown and is about 59.1 mm in the current embodiment. The face height 165 is a combination of the effective face height 163 and the effective face position height 164. The crown height 162 is about 69.4 mm in the current embodiment. As can be seen a ratio of the crown height 162 to the face height 165 is 69.4/59.1, or about 1.17. In various embodiments, the ratio may change and is informed and further described by U.S. patent application Ser. No. 13/718,107, entitled "HIGH VOLUME AERODYNAMIC GOLF CLUB HEAD," filed Dec. 18, 2012. The view of FIG. 2C includes projections of the forward mass box 1030 and the rearward mass box 1040 as seen from the toe side view. It should be noted that portions of the mass boxes 1030, 1040 that fall outside of the golf club head 1000 have been removed from the view of FIG. 2C.

Figure 2D:
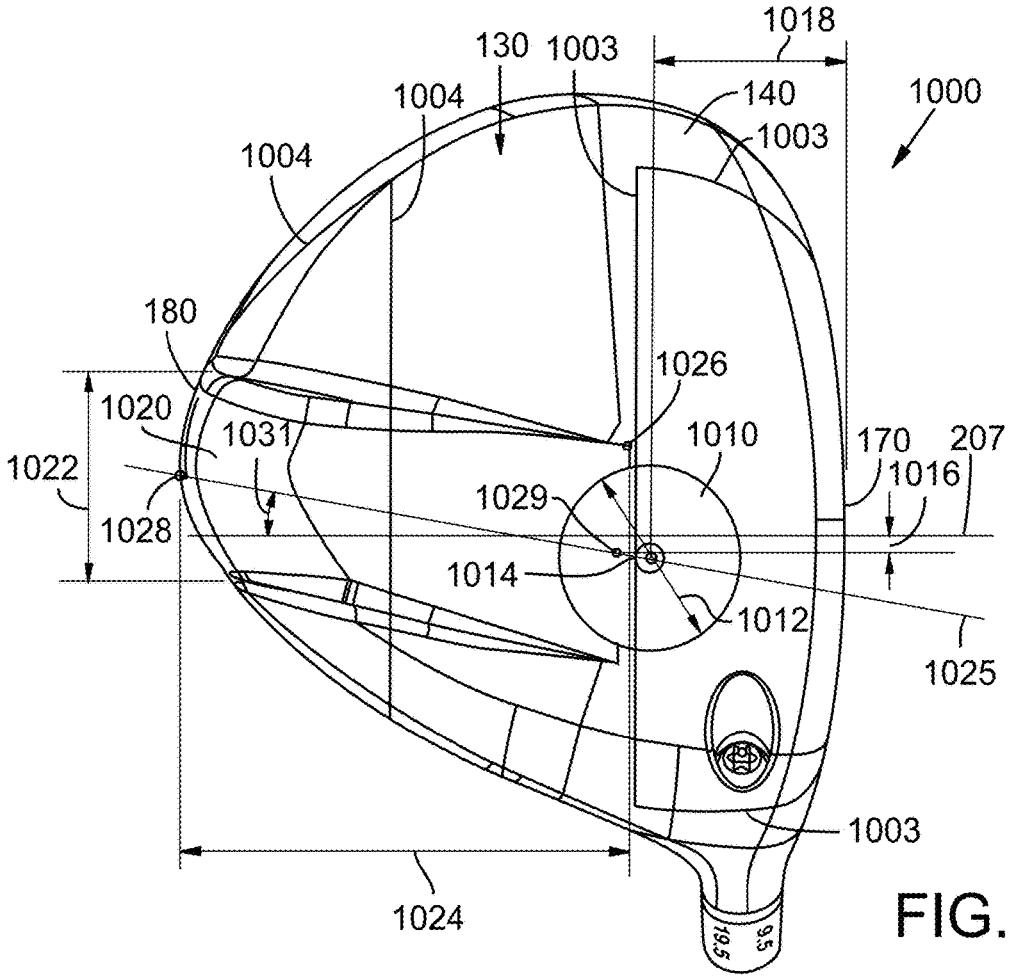
FIG. 2D is a sole side view of the golf club head of FIG. 2A.

As seen with specific reference to FIG. 2D, mass element 1010 is seen in its proximity to the leading edge 170 as well as to the y-axis 207. In the current embodiment, the mass element 1010 is circular with a diameter 1012 of about 30 mm. A center point 1014 of the mass element 1010 is located a distance 1016 from the y-axis 207 as measured in a direction parallel to the x-axis 208 (seen in FIG. 2A). The mass element 1010 of the current embodiment is of tungsten material and weighs about 35 grams, although various sizes, materials, and weights may be found in various embodiments. The center point 1014 of the mass element 1010 is located a distance 1018 from the leading edge 170 as measured parallel to the y-axis 207. In the current embodiment, the distance 1016 is 3.2 mm and the distance 1018 is 32.6 mm.

The sole feature 1020 of the current embodiment is shown to have a width 1022 as measured in a direction parallel to the x-axis 208 of about 36.6 mm. The sole feature 1020 has a length 1024 of about 74.5 mm as measured parallel to the y-axis 207 from a faceward most point 1026 of the sole feature 1020 to a trailing edge point 1028 coincident with the trailing edge 180. Although the sole feature 1020 has some contour and variation along the length 1024, the sole feature 1020 remains about constant width 1022. In the current embodiment, the trailing edge point 1028 is proximate the center of the sole feature 1020 as measured along a direction parallel to the x-axis 208. A first center point 1029 of the sole feature 1020 is located proximate the faceward most point 1026 and identifies an approximate center of the sole feature 1020 at its facewardmost portion. In the current embodiment, the first center point 1029 is located within the mass element 1010, although the first center point 1029 is a feature of the sole feature 1020. A sole feature flow direction 1025 is shown by connecting the first center point 1029 with the trailing edge point 1028. The sole feature flow direction 1025 describes how the sole feature 1020 extends as it continues along the sole 130 of the golf club head 1000. In the current embodiment, the sole feature flow direction 1025 is arranged at an angle 1031 with respect to the y-axis 207 of about 11°. In the current embodiment, the angle 1031 is chosen with arrangement of the angle of approach of the golf club head 1000 during the golf swing to minimize potential air flow drag from interaction of the sole feature 1020 with the air flow around the golf club head 1000.

The view of FIG. 2D displays boundaries 1003, 1004 for the forward mass box 1030 and the rearward mass box 1040, respectively. The boundaries 1003, 1004 display the interaction of the mass boxes 1030, 1040 as being projected through the golf club head 1000 at a certain height from the GP (as shown with reference to FIG. 2B). Because the various surfaces of the golf club head 1000 include various curvatures—for example, along the skirt 140—boundaries 1003, 1004 appear along the curvatures in views other than the view of FIG. 2B. As such, the view of FIG. 2D provides a mapping of portions of the golf club head 1000 that fall within the mass boxes 1030, 1040.

Another embodiment of a golf club head 2000 is seen with reference to FIG. 3A-3D. As seen with specific reference to FIG. 3A, the golf club head 2000 includes an extended trailing edge portion 2025. The extended trailing edge portion 2025 extends the trailing edge 180 and creates an acute shape to a central portion of the trailing edge, the central portion being defined as the portion of the trailing edge 180 proximate the y-axis 207. The golf club head 2000 includes a concavity portion 2027 providing a transition from a portion of the crown 120 proximate a highest crown point 2029 to the trailing edge 180. In the current embodiment, the distance 177 is about 125.1 mm. The crown 120 is concave in shape in the region of the concavity portion 2027. In various embodiments, the concavity portion 2027 may extend to the trailing edge 180 or may transition into a straight portion or a convex portion before the trailing edge 180. In the current embodiment, the golf club head 2000 is of a volume of about 458 CC. A distance 2055 between the origin 205 and the leading edge 170 as measured in the direction of the y-axis 207 is seen in the current view. For golf club head 2000, the distance is about 3.5 mm.

Figure 3A:
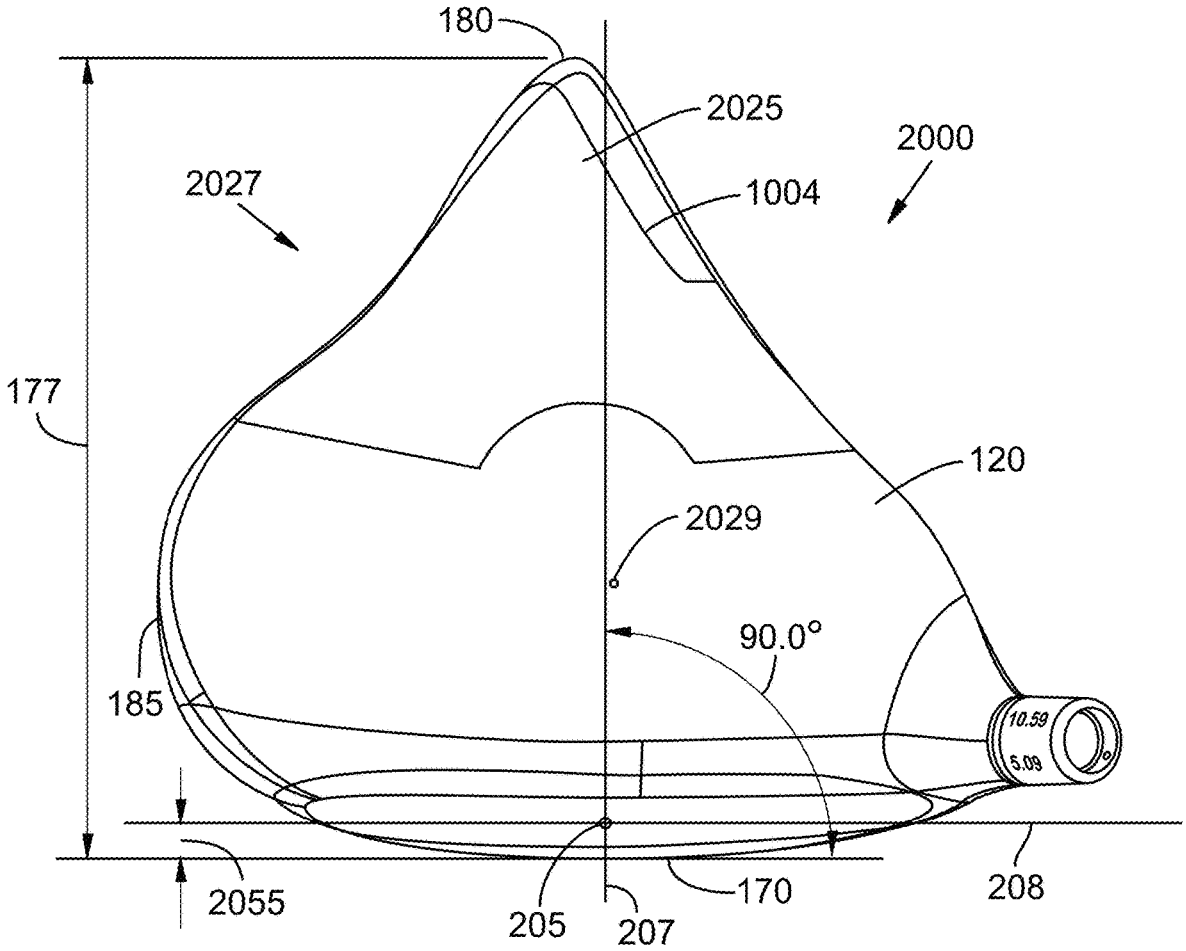
FIG. 3A is a top side view of a golf club head in accord with one embodiment of the current disclosure.
Figure 3B:
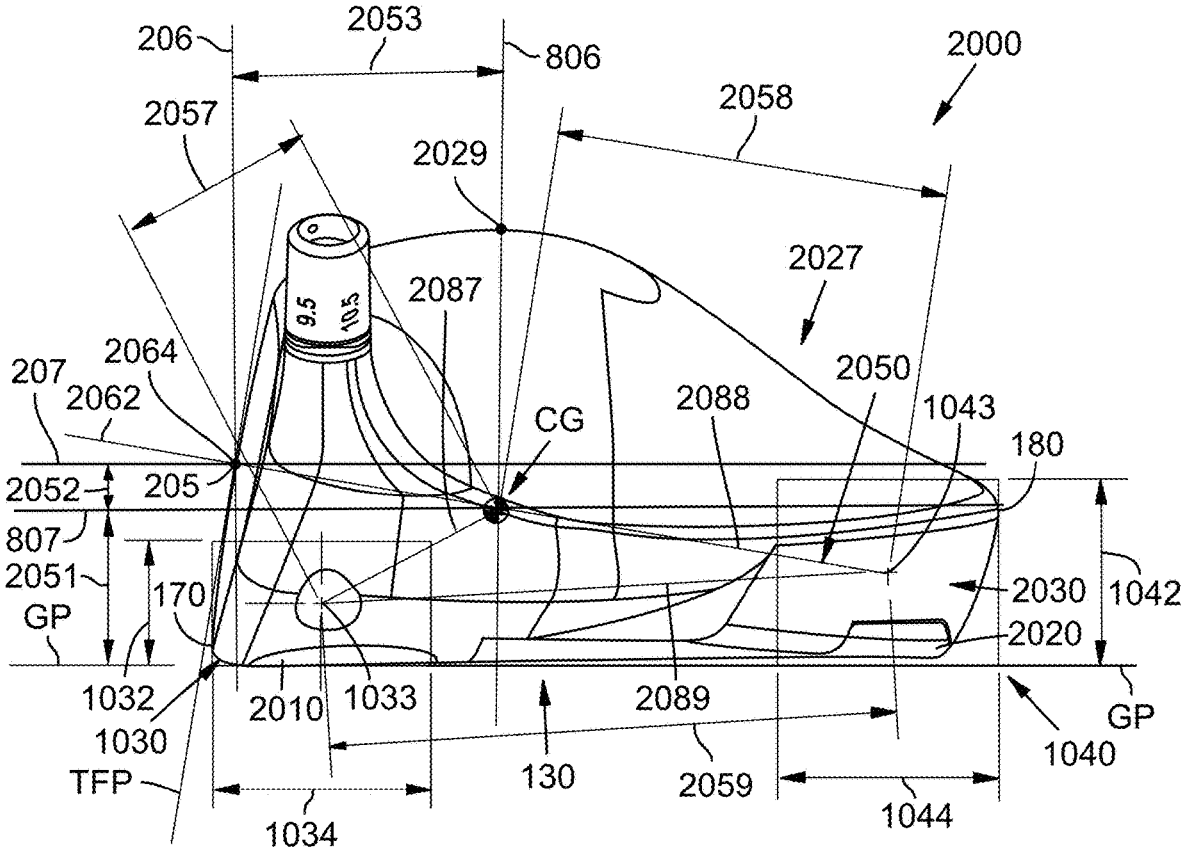
FIG. 3B is a heel side view of the golf club head of FIG. 3A.

As seen with reference to FIG. 3B, the golf club head 2000 includes a first mass element 2010 and a second mass element 2020. In the current embodiment, the first mass element 2010 is about 16 grams and the second mass element 2020 is about 41.5 grams, although various modifications may be found in various embodiments. The mass element 2020 is housed in a sole feature 2021 that is a portion of the golf club head 2000 protruding toward the GP from and including the sole 130. The golf club head 2000 is characterized using the same mass boxes 1030, 1040 defined according to the same procedure as used with respect to golf club head 1000. In the current embodiment, the mass boxes 1030, 1040 remain of the same dimensions themselves but are separated by variations in distances from those of golf club head 1000.

In the current embodiment, the forward mass box 1030 encompasses 46.8 grams and the rearward mass box 1040 encompasses 48.9 grams, although varying embodiments may include various mass elements. Additional mass of the golf club head 2000 is 114.2 grams outside of the mass boxes 1030, 1040.

A CG of the golf club head 2000 is seen as annotated in the golf club head 2000. The overall club head CG includes all components of the club head as shown, including any weights or attachments mounted or otherwise connected or attached to the club body. The CG is located a distance 2051 from the ground plane as measured parallel to the z-axis 206. The distance 2051 is also termed $\Delta_Z$ in various embodiments and may be referred to as such throughout the current disclosure. The CG is located a distance 2052 ($CG_Z$) from the origin 205 as measured parallel to the z-axis 206. In the current embodiment, the $CG_Z$ location is −7.6, which means that the CG is located 7.6 mm below center face as measured perpendicularly to the ground plane. The CG is located a distance 2053 ($CG_Y$) from the origin 205 as measured parallel to the y-axis 207. In the current embodiment, the distance 2051 is 24.6 mm, the distance 2052 is −7.6 mm, and the distance 2053 is 41.9 mm.

A first vector distance 2057 defines a distance as measured in the y-z plane from the geometric center point 1033 of the forward mass box 1030 to the CG. In the current embodiment, the first vector distance 2057 is about 31.6 mm. A second vector distance 2058 defines a distance as measured in the y-z plane from the CG to the geometric center point 1043 of the rearward mass box 1040. In the current embodiment, the second vector distance 2058 is about 63.0 mm. A third vector distance 2059 defines a distance as measured in the y-z plane from the geometric center point 1033 of the forward mass box 1030 to the geometric center point 1043 of the rearward mass box 1040. In the current embodiment, the third vector distance 2059 is about 90.4 mm.

As can be seen, the locations of the CG, the geometric center point 1033, and the geometric center point 1043 form a vector triangle 2050 describing the relationships of the various features. The vector triangle 2050 is for reference and does not appear as a physical feature of the golf club head 2000. The vector triangle 2050 includes a first leg 2087 corresponding to the distance 2057, a second leg 2088 corresponding to the distance 2058, and a third leg 2089 corresponding to the third distance 2059. For calculation of area A and vector ratio VR, distance 2057 is used for a, distance 2058 is used for b, and distance 2059 is used for c in the calculations described above. A of the vector triangle 2050 is 590.75 $mm^2$. VR of the vector triangle 2050 is 1.0465.

A CG projection line 2062 shows the projection of the CG onto the TFP at a CG projection point 2064. The CG projection point 2064 allows for description of the CG in relation to the center face (CF) point at the origin 205. The CG projection point 2064 of the current embodiment is offset from the CF 205. In the current embodiment, the offset distance of the CG projection point 2064 from the CF 205 is about 0.2 mm, meaning that the CG projects about 0.2 mm above center face.

In the current embodiment, $MOI_{eff}$=(46.8 grams)×(31.6 mm)$^2$+(48.9 grams)×(63.0 mm)$^2$≈240,800 g·mm$^2$=240.8 kg·mm$^2$. Although this is not an exact number for the moment of inertia provided by the mass inside the mass boxes, it does provide a basis for comparison of how the mass in the region of the mass boxes affects MOI in the golf club head such as golf club head 2000. In the current embodiment, the $R_{MOI}=MOI_{eff}/I_{xx}$=240.8 kg·mm$^2$/412 kg·mm$^2$≈0.585.

Figure 3C:
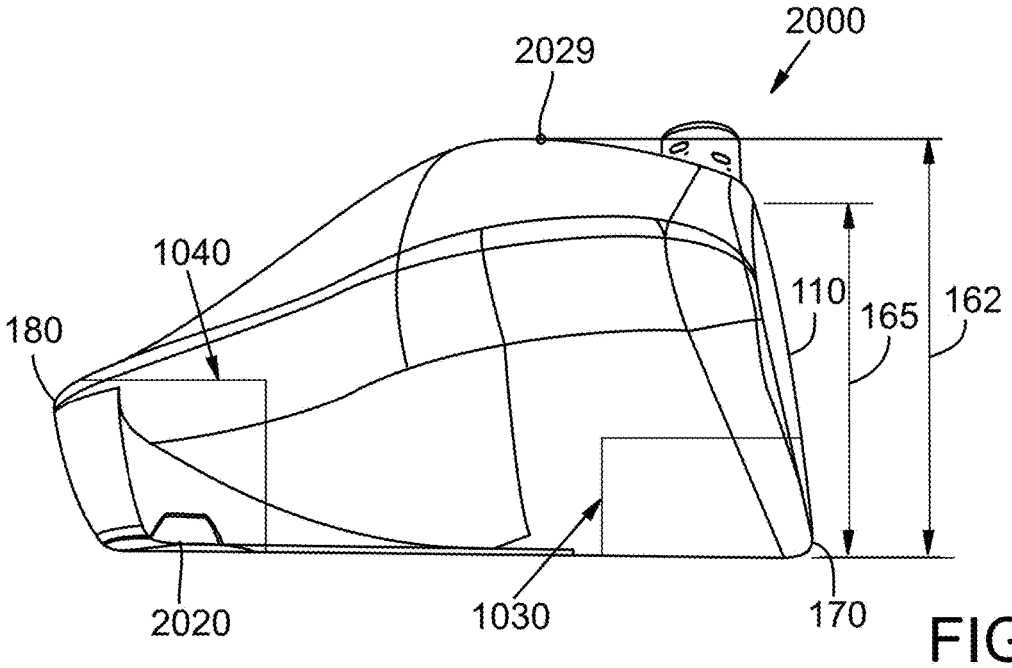
FIG. 3C is a toe side view of the golf club head of FIG. 3A.

The golf club head 2000—as seen with reference to FIG. 3C—includes a face height 165 of about 58.7 mm in the current embodiment. The crown height 162 is about 69.4 mm in the current embodiment. A ratio of the crown height 162 to the face height 165 is 69.4/58.7, or about 1.18.

Figure 3D:
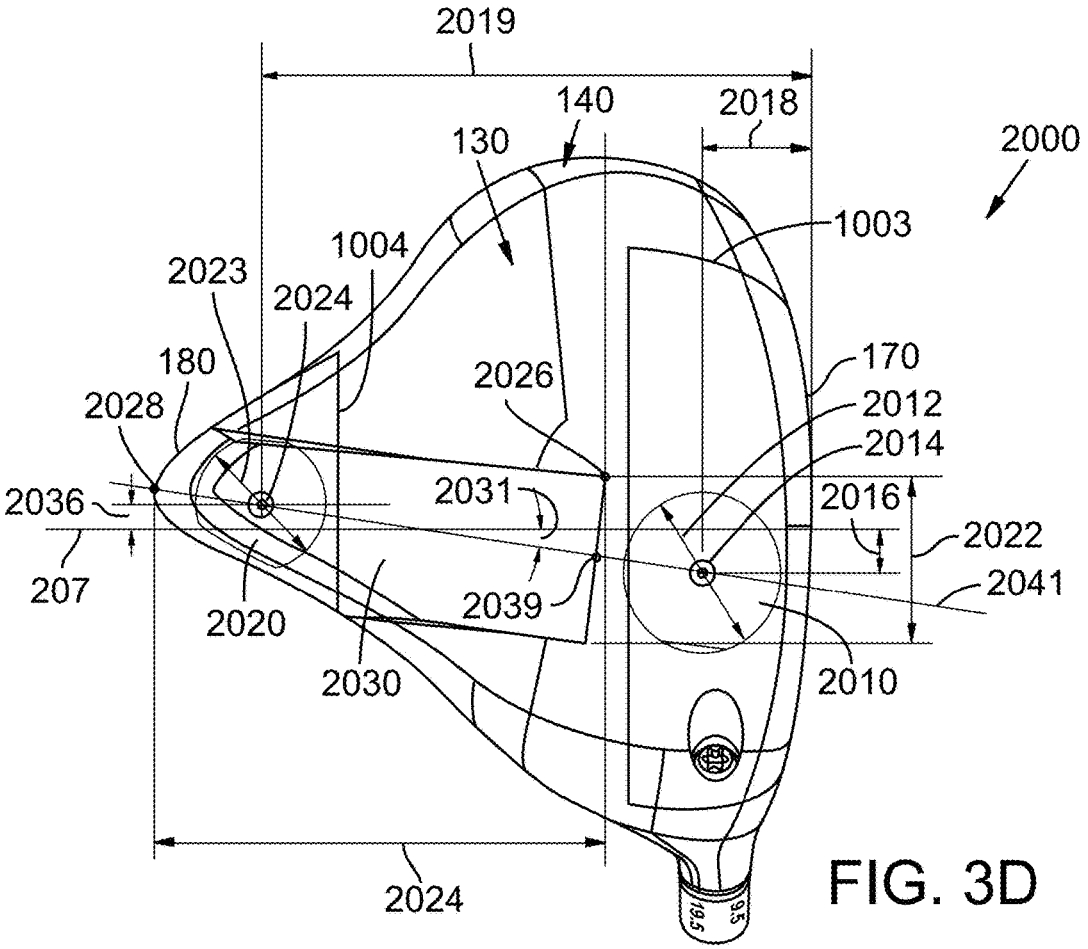
FIG. 3D is a sole side view of the golf club head of FIG. 3A.

As seen with specific reference to FIG. 3D, first mass element 2010 is seen in its proximity to the leading edge 170 as well as to the y-axis 207. In the current embodiment, the first mass element 2010 is circular with a diameter 2012 of about 30 mm. A center point 2014 of the first mass element 2010 is located a distance 2016 from the y-axis 207 as measured in a direction parallel to the x-axis 208 (seen in FIG. 2A). The center point 2014 of the first mass element 2010 is located a distance 2018 from the leading edge 170 as measured parallel to the y-axis 207. In the current embodiment, the distance 2016 is 10.6 mm and the distance 2018 is about 25 mm.

The second mass element 2020 of the current embodiment is also generally circular with truncated sides. The second mass element 2020 has a center point 2024 and a diameter 2023 in the circular portion of the second mass element 2020 of about 25 mm. The center point 2024 of the second mass element 2020 is located a distance 2036 from the y-axis 207 as measured in a direction parallel to the x-axis 208 (seen in FIG. 3A). The center point 2024 of the second mass element 2020 is located a distance 2019 from the leading edge 170 as measured parallel to the y-axis 207. In the current embodiment, the distance 2036 is about 5 mm and the distance 2019 is 104.7 mm.

The sole feature 2030 houses the second mass element 2020 and has a length 2024 as measured parallel to the y-axis 207 from a faceward most point 2026 of the sole feature 2030 to a trailing edge point 2028 coincident with the trailing edge 180. In the current embodiment, the length 2024 is about 85.6 mm.

Although the sole feature 2030 has some variation along the length 2024, the sole feature 2030 remains about constant width 2022 of about 31.8 mm. In the current embodiment, the trailing edge point 2028 is proximate the center of the sole feature 2030 as measured along a direction parallel to the x-axis 208. A first center point 2039 of the sole feature 2030 is located proximate the faceward most point 2026 and identifies an approximate center of the sole feature 2030 at its facewardmost portion. In the current embodiment, the first center point 2039 is located outside of the mass element 2010, in contrast with the golf club head 1000. A sole feature flow direction 2041 is shown by connecting the first center point 2039 with the trailing edge point 2028. The sole feature flow direction 2041 describes how the sole feature 2030 extends as it continues along the sole 130 of the golf club head 2000. In the current embodiment, the sole feature flow direction 2041 is arranged at an angle 2031 with respect to the y-axis 207 of about 9°. In the current embodiment, the angle 2031 is chosen with arrangement of the angle of approach of the golf club head 2000 during the golf swing to minimize potential air flow drag from interaction of the sole feature 2030 with the air flow around the golf club head 2000.

The view of FIG. 3D displays boundaries 1003, 1004 for the forward mass box 1030 and the rearward mass box 1040, respectively. The boundaries 1003, 1004 display the interaction of the mass boxes 1030, 1040 as being projected through the golf club head 2000 at a certain height from the GP (as shown with reference to FIG. 3B). Because the various surfaces of the golf club head 1000 include various curvatures—for example, along the skirt 140—boundaries 1003, 1004 appear along the curvatures in views other than the view of FIG. 3B. As such, the view of FIG. 3D provides a mapping of portions of the golf club head 2000 that fall within the mass boxes 1030, 1040.

Another embodiment of a golf club head 3000 is seen with reference to FIG. 4A-4D. The golf club head 3000 includes mass element 3020. It should be noted that properties and measurements of the golf club head 3000 of the current embodiment are measured in the orientation shown as described with respect to USGA procedure outlined elsewhere in this disclosure. Various measurements may be different for golf club head 3000 in different orientations, and one of skill in the art would understand that the USGA procedure angle of orientation of the golf club head differs from the ideal angle of orientation based on the particular design of golf club head 3000. Accordingly, certain measurements may be slightly variant from the ideal measurement orientation. However, all golf club heads of the current disclosure are analyzed and measured according to standard procedure described herein. In the current embodiment, the variation of orientation accounts for less than 2 mm difference in measurement of CG location, for example. As such, measurement variation may be negligible in certain situations.

Figure 4A:
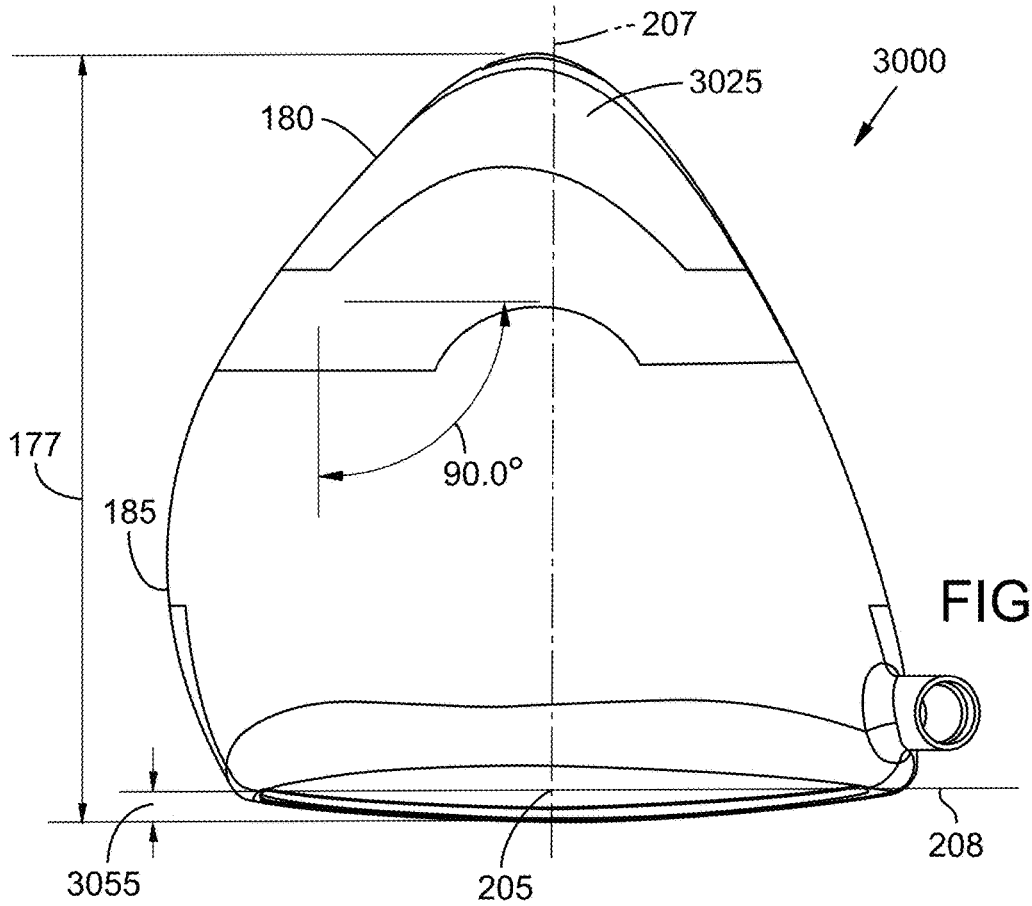
FIG. 4A is a view of a golf club head in accord with one embodiment of the current disclosure.

As seen with specific reference to FIG. 4A, the golf club head 3000 includes an extended trailing edge portion 3025. The extended trailing edge portion 3025 extends the trailing edge 180 and creates an acute shape to a central portion of the trailing edge 180, the central portion being defined as the portion of the trailing edge 180 proximate the y-axis 207. The golf club head 3000 does not include any concavities in the current embodiment (as with the golf club head 2000), although one of skill in the art would understand that this disclosure is not limited to convex shaped golf club heads. In the current embodiment, the distance 177 is about 124.3 mm. In various embodiments, the concavity portion 2027 may extend to the trailing edge 180 or may transition into a straight portion or a convex portion before the trailing edge 180. In the current embodiment, the golf club head 4000 is of a volume of about 469 CC. A distance 3055 between the origin 205 and the leading edge 170 as measured in the direction of the y-axis 207 is seen in the current view. For golf club head 3000, the distance is about 3.4 mm.

Figure 4B:
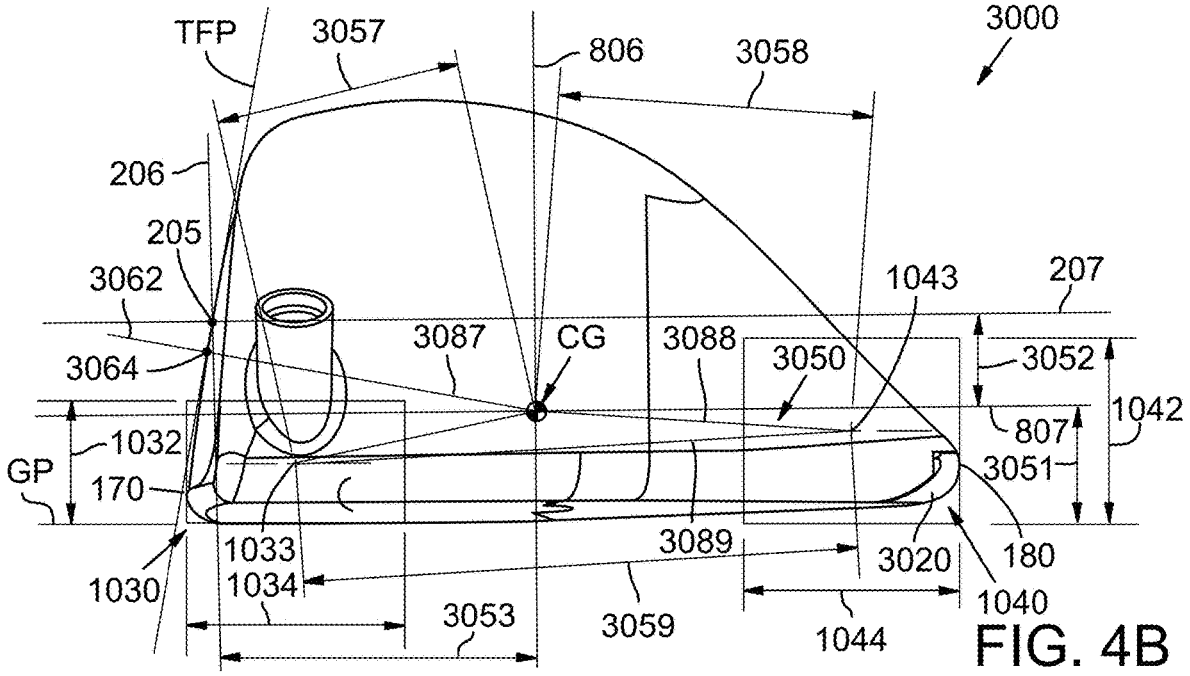
FIG. 4B is a heel side view of the golf club head of FIG. 4A.

As seen with reference to FIG. 4B, the golf club head 3000 includes a mass element 3020 that is external in the current embodiment. In various embodiments, the golf club head 3000 may include various internal mass elements as well as additional external mass elements or may replace various external mass elements with internal mass elements as desired. In the current embodiment, the mass element 3020 is about 58.0 grams, although in various embodiments it may be of various masses. The mass element 3020 is housed in the extended trailing edge portion 3025. The golf club head 3000 is characterized using the same mass boxes 1030, 1040 defined according to the same procedure as used with respect to golf club head 1000. In the current embodiment, the mass boxes 1030, 1040 remain of the same dimensions themselves but are separated by variations in distances from those of golf club heads 1000, 2000.

In the current embodiment, the forward mass box 1030 encompasses 48.9 grams and the rearward mass box 1040 encompasses 74.0 grams, although varying embodiments may include various mass elements. Additional mass of the golf club head 3000 is 87.9 grams outside of the mass boxes 1030, 1040.

A CG of the golf club head 3000 is seen as annotated in the golf club head 3000. The overall club head CG includes all components of the club head as shown, including any weights or attachments mounted or otherwise connected or attached to the club body. The CG is located a distance 3051 from the ground plane as measured parallel to the z-axis 206. The distance 3051 is also termed $\Delta_Z$ in various embodiments and may be referred to as such throughout the current disclosure. The CG is located a distance 3052 ($CG_Z$) from the origin 205 as measured parallel to the z-axis 206. In the current embodiment, the $CG_Z$ location is −3.3, which means that the CG is located 3.3 mm below center face as measured perpendicularly to the ground plane. The CG is located a distance 3053 ($CG_Y$) from the origin 205 as measured parallel to the y-axis 207. In the current embodiment, the distance 3051 is 18.7 mm, the distance 3052 is −13.3 ($CG_Z$) mm, and the distance 3053 is 52.8 mm.

A first vector distance 3057 defines a distance as measured in the y-z plane from the geometric center point 1033 of the forward mass box 1030 to the CG. In the current embodiment, the first vector distance 3057 is about 39.7 mm. A second vector distance 3058 defines a distance as measured in the y-z plane from the CG to the geometric center point 1043 of the rearward mass box 1040. In the current embodiment, the second vector distance 3058 is about 51.0 mm. A third vector distance 3059 defines a distance as measured in the y-z plane from the geometric center point 1033 of the forward mass box 1030 to the geometric center point 1043 of the rearward mass box 1040. In the current embodiment, the third vector distance 3059 is about 89.6 mm.

As can be seen, the locations of the CG, the geometric center point 1033, and the geometric center point 1043 form a vector triangle 3050 describing the relationships of the various features. The vector triangle 3050 is for reference and does not appear as a physical feature of the golf club head 3000. The vector triangle 3050 includes a first leg 3087 corresponding to the distance 3057, a second leg 3088 corresponding to the distance 3058, and a third leg 3089 corresponding to the third distance 3059. For calculation of area A and vector ratio VR, distance 3057 is used for a, distance 3058 is used for b, and distance 3059 is used for c in the calculations described above. A of the vector triangle 3050 is 312.94 $mm^2$. VR of the vector triangle 3050 is 1.0123.

A CG projection line 3062 shows the projection of the CG onto the TFP at a CG projection point 3064. The CG projection point 3064 allows for description of the CG in relation to the center face (CF) point at the origin 205. The CG projection point 3064 of the current embodiment is offset from the CF 205. In the current embodiment, the offset distance of the CG projection point 3064 from the CF 205 is about −3.3 mm, meaning that the CG projects about 3.3 mm below center face.

In the current embodiment, $MOI_{eff}$=(48.9 grams)×(39.7 $mm)^2$+(74.0 grams)×(51.0 $mm)^2$≈269,500 g·$mm^2$=269.5 kg·$mm^2$. Although this is not an exact number for the moment of inertia provided by the mass inside the mass boxes, it does provide a basis for comparison of how the mass in the region of the mass boxes affects MOI in the golf club head such as golf club head 3000. In the current embodiment, the $R_{MOI}=MOI_{eff}/I_{xx}$=269.5 kg·$mm^2$/507 kg·$mm^2$≈0.532.

Figure 4C:
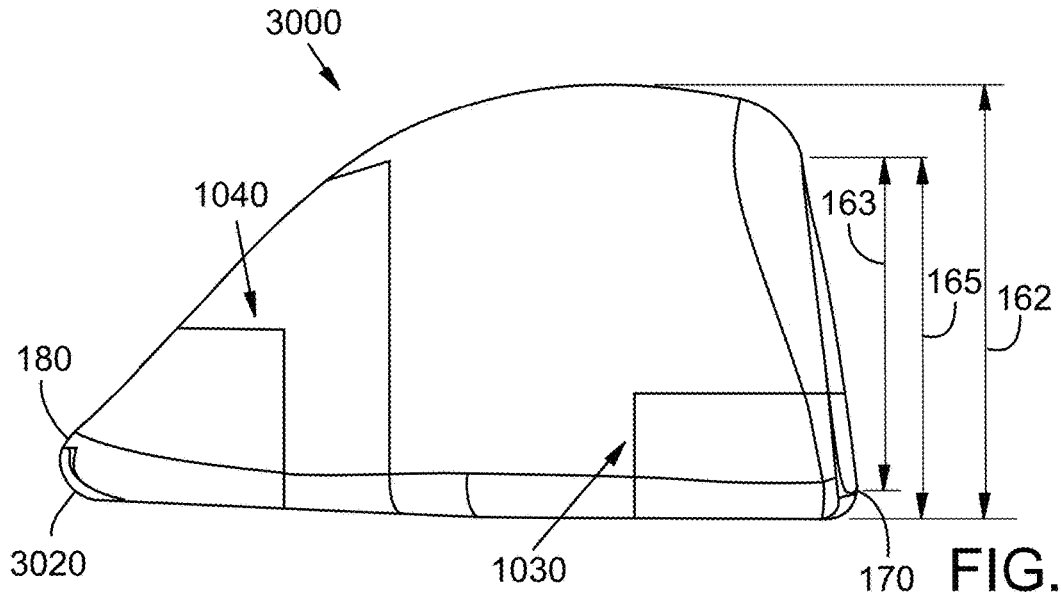
FIG. 4C is a toe side view of the golf club head of FIG. 4A.

The golf club head 3000—as seen with reference to FIG. 4C—includes a face height 165 of about 56.6 mm in the current embodiment. The crown height 162 is about 68.3 mm in the current embodiment. A ratio of the crown height 162 to the face height 165 is 68.3/56.6, or about 1.21. The effective face height 163 is about 53.3 mm.

Figure 4D:
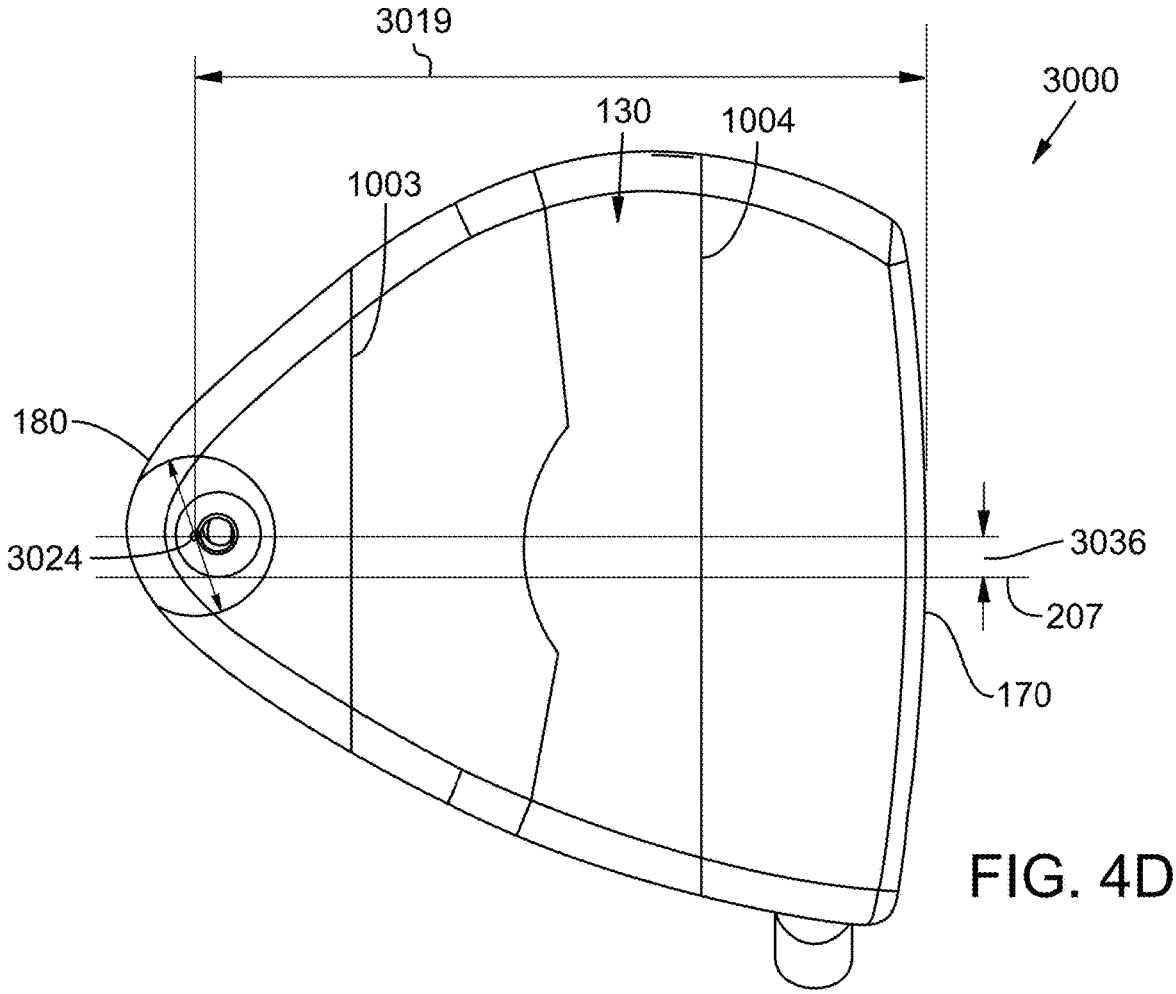
FIG. 4D is a sole side view of the golf club head of FIG. 4A.

As seen with specific reference to FIG. 4D, first mass element 2010 is seen in its proximity to the leading edge 170 as well as to the y-axis 207.

The mass element 3020 of the current embodiment is generally circular with a truncated side. The mass element 3020 has a center point 3024 and a diameter 3023 in the circular portion of the mass element 3020 of about 25 mm. The center point 3024 of the current embodiment is located at a halfway point of the diameter 3023 which is not the same as the geometric center of the mass element 3020 because of the truncated side. In various embodiments, the geometric center of the mass element 3020 may be coincident with the center point 3024. The center point 3024 of the mass element 3020 is located a distance 3036 from the y-axis 207 as measured in a direction parallel to the x-axis 208 (seen in FIG. 4A). The center point 3024 of the mass element 3020 is located a distance 3019 from the leading edge 170 as measured parallel to the y-axis 207. In the current embodiment, the distance 3036 is 2.3 mm and the distance 3019 is 110.2 mm. The mass element 3020 of the current embodiment is partially coincident with and forms the trailing edge 180.

The view of FIG. 4D displays boundaries 1003, 1004 for the forward mass box 1030 and the rearward mass box 1040, respectively. The boundaries 1003, 1004 display the interaction of the mass boxes 1030, 1040 as being projected through the golf club head 2000 at a certain height from the GP (as shown with reference to FIG. 3B). In the current embodiment, the boundaries 1003, 1004 appear flat because the sole 130 is substantially flat in the current embodiment. As such, the view of FIG. 4D provides a mapping of portions of the golf club head 3000 that fall within the mass boxes 1030, 1040.

Figure 5:
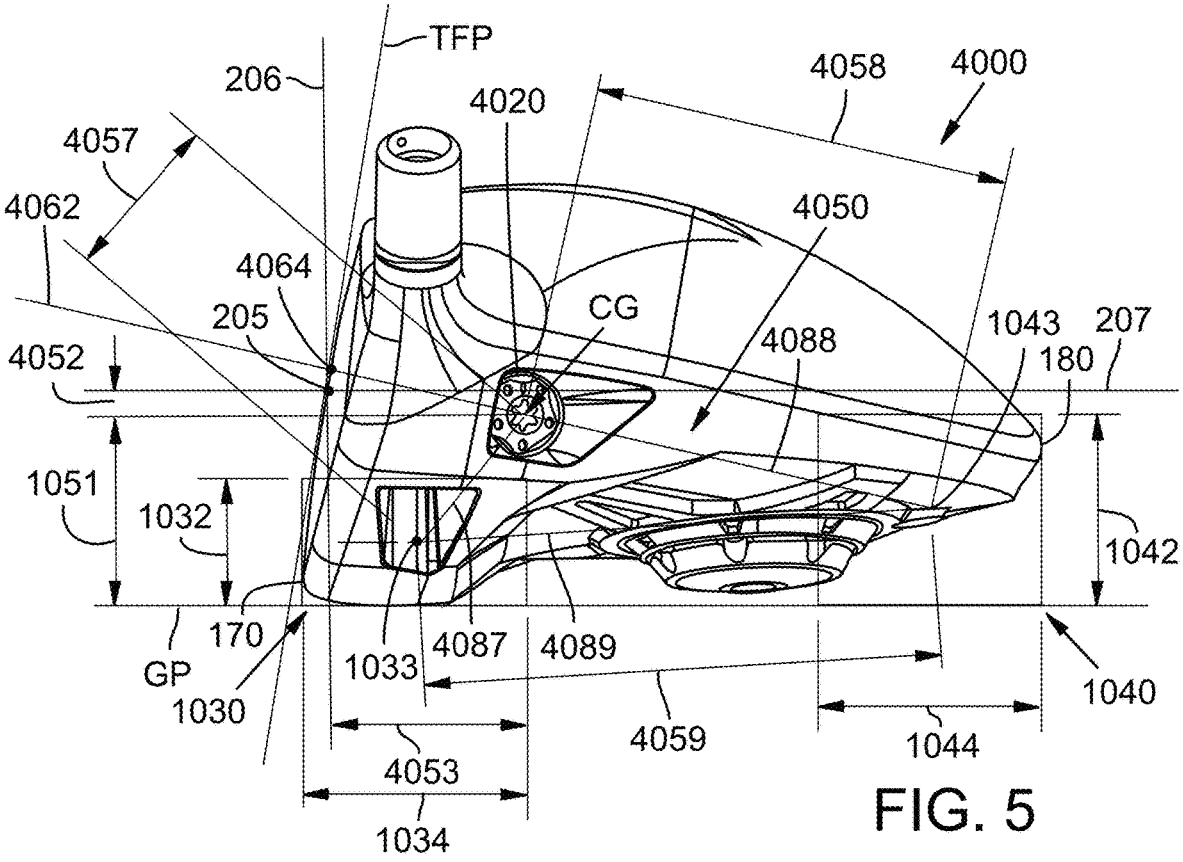
FIG. 5 is a view of a golf club head analyzed according to procedures of the current disclosure.

For comparison, FIG. 5 displays a golf club head 4000. The golf club head 4000 is a production model TaylorMade R1 golf club head. Comparisons for mass boxes 1030, 1040 and moments of inertia, as well as the various other features of the various golf club heads 1000, 2000, 3000 of this disclosure can be made to golf club head 4000, representing a more traditional golf club head design. The golf club head 4000 is of a volume of about 427 CC.

The golf club head 4000 includes a mass element 4020 that is external in the current embodiment. The golf club head 4000 also includes a mass element (not shown) located in a toe portion 185 of the golf club head 4000. The mass element 4020 is 1.3 grams and the mass element in the toe portion 185 is about 10 grams.

The golf club head 4000 is characterized using the same mass boxes 1030, 1040 defined according to the same procedure as used with respect to golf club head 1000. In the current embodiment, the mass boxes 1030, 1040 remain of the same dimensions themselves but are separated by variations in distances from those of golf club heads 1000, 2000, 3000.

In the current embodiment, the forward mass box 1030 encompasses 36.5 grams and the rearward mass box 1040 encompasses 13.2 grams. Additional mass of the golf club head 4000 is 157.7 grams outside of the mass boxes 1030, 1040.

A CG of the golf club head 4000 is seen as annotated in the golf club head 4000. The overall club head CG includes all components of the club head as shown, including any weights or attachments mounted or otherwise connected or attached to the club body. The CG is located a distance 4051 from the ground plane as measured parallel to the z-axis 206. The distance 4051 is also termed $\Delta_Z$ in various embodiments and may be referred to as such throughout the current disclosure. The CG is located a distance 4052 ($CG_Z$) from the origin 205 as measured parallel to the z-axis 206. In the current embodiment, the $CG_Z$ location is −1.9 mm, which means that the CG is located 1.9 mm below center face as measured perpendicularly to the ground plane. The CG is located a distance 4053 ($CG_Y$) from the origin 205 as measured parallel to the y-axis 207. In the current embodiment, the distance 4051 is 29.7 mm, the distance 4052 is −1.9 mm, and the distance 4053 is 31.6 mm.

A first vector distance 4057 defines a distance as measured in the y-z plane from the geometric center point 1033 of the forward mass box 1030 to the CG. In the current embodiment, the first vector distance 4057 is about 26.1 mm. A second vector distance 4058 defines a distance as measured in the y-z plane from the CG to the geometric center point 1043 of the rearward mass box 1040. In the current embodiment, the second vector distance 4058 is about 65.5 mm. A third vector distance 4059 defines a distance as measured in the y-z plane from the geometric center point 1033 of the forward mass box 1030 to the geometric center point 1043 of the rearward mass box 1040. In the current embodiment, the third vector distance 4059 is about 81.2 mm. The effective face height 163 (not shown) of golf club head 4000 is about 54.0 mm. A distance from the leading edge 170 to the center face 205 as measured in the direction of the y-axis 207 is 3.0 mm.

As can be seen, the locations of the CG, the geometric center point 1033, and the geometric center point 1043 form a vector triangle 4050 describing the relationships of the various features. The vector triangle 4050 is for reference and does not appear as a physical feature of the golf club head 4000. The vector triangle 4050 includes a first leg 4087 corresponding to the distance 4057, a second leg 4088 corresponding to the distance 4058, and a third leg 4089 corresponding to the third distance 4059. For calculation of area A and vector ratio VR, distance 4057 is used for a, distance 4058 is used for b, and distance 4059 is used for c in the calculations described above. A of the vector triangle 4050 is 752.47 $mm^2$. VR of the vector triangle 4050 is 1.1281.

A CG projection line 4062 shows the projection of the CG onto the TFP at a CG projection point 4064. The CG projection point 4064 allows for description of the CG in relation to the center face (CF) point at the origin 205. The CG projection point 4064 of the current embodiment is offset from the CF 205. In the current embodiment, the offset distance of the CG projection point 4064 from the CF 205 is about 4.4 mm, meaning that the CG projects about 4.4 mm above center face.

For comparison, for golf club head 4000, $MOI_{eff}$=(36.5 grams)×(26.1 mm) 2+(13.2 grams)×(65.5 mm)$^2$≈81,500 g·$mm^2$=81.5 kg·$mm^2$. Although this is not an exact number for the moment of inertia provided by the mass inside the mass boxes, it does provide a basis for comparison of how the mass in the region of the mass boxes affects MOI in the golf club head such as golf club head 4000. In the current embodiment, the $R_{MOI}=MOI_{eff}/I_{xx}$=81.5 kg·$mm^2$/249 kg·$mm^2$≈0.327.

Figure 6:
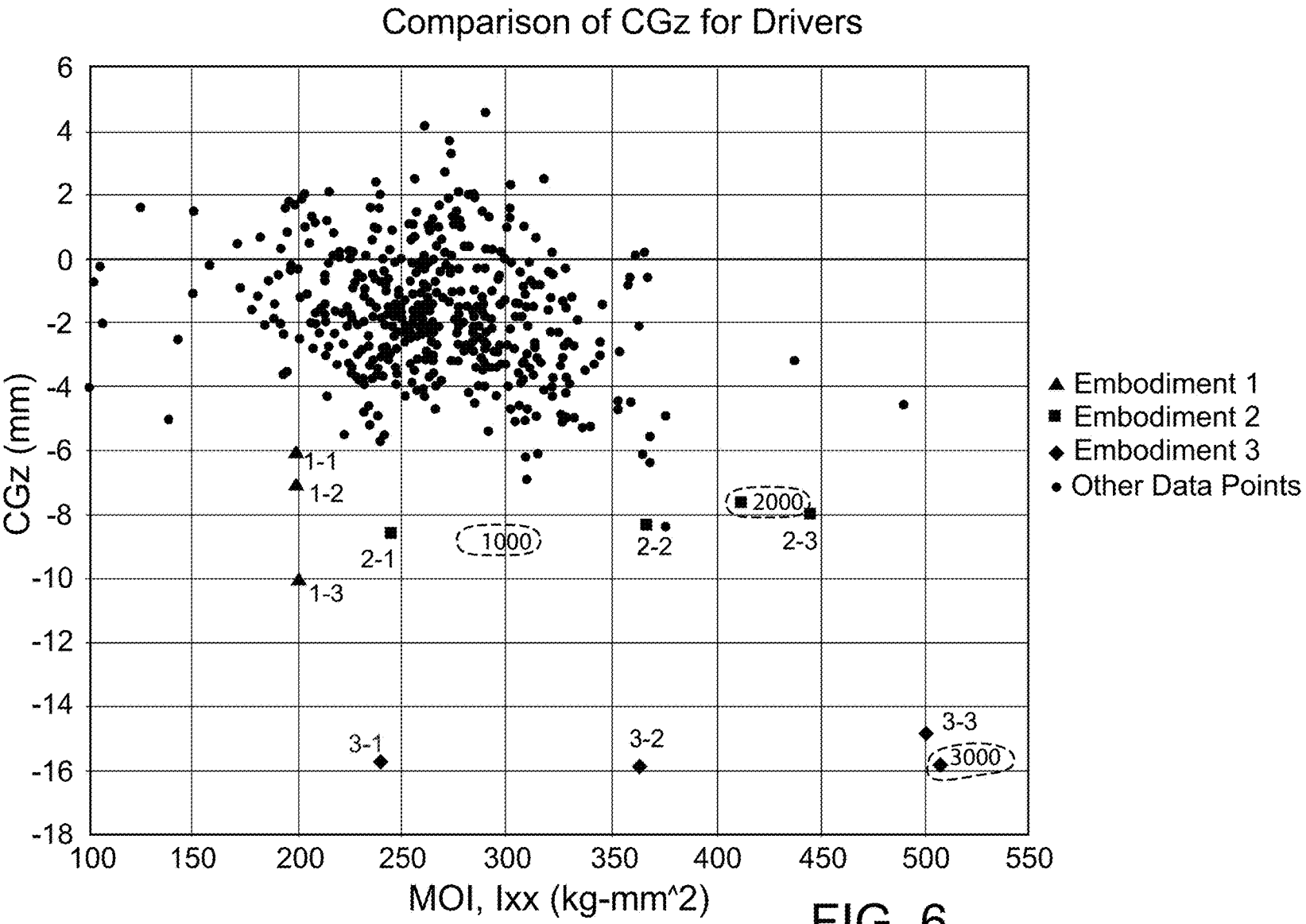
FIG. 6 is a graph displaying features of the golf club heads of the current disclosure as compared to other data points.
Figure 7:
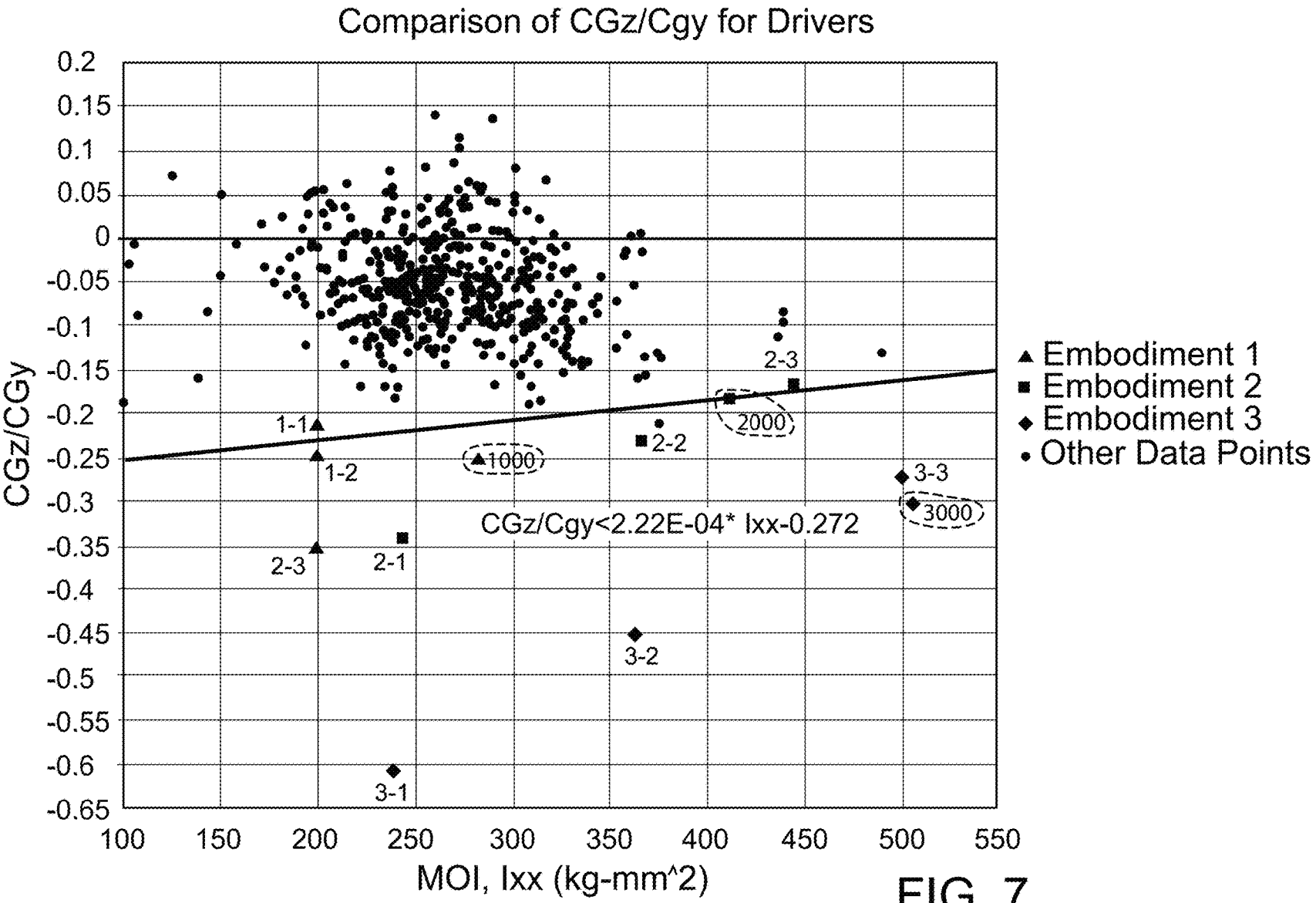
FIG. 7 is a graph displaying features of the golf club heads of the current disclosure as compared to other data points.

For the graphs of FIGS. 6-7, $CG_Y$ is the distance of the center of gravity from the origin of the coordinate system in the direction of the y-axis, which is measured from the center face towards the back of the club orthogonal to the x-axis and the z-axis and parallel to the ground plane when the head is in the address position, as noted elsewhere in this disclosure with respect to specific golf club heads 1000, 2000, 3000, 4000. Data points shown in FIGS. 6-7 include embodiments similar to golf club head 1000 (denoted as Embodiment 1), embodiments similar to golf club head 2000 (denoted as Embodiment 2), embodiments similar to golf club head 3000 (denoted as Embodiment 3), and other data points on golf club heads not within the scope of the current disclosure. As can be see, the specific embodiments of golf club heads 1000, 2000, 3000 are plotted (and included with dotted outlines to illustrate specific data points). Variances with the various versions of Embodiment 1, Embodiment 2, and Embodiment 3 alter CG position within the each embodiment by altering the positioning of mass. For example, with respect to Embodiment 3, point 3-1 includes mass located in a front portion of the golf club head 3000, point 3-2 includes mass distributed in various locations along the golf club head 3000, and point 3-3 includes mass located primarily in the rear of the golf club head 3000. Points 2-1, 2-2, and 2-3 characterize variations of Embodiment 2 similarly to points 3-1, 3-2 and 3-3, respectively.

Points 1-1, 1-2, and 1-3 characterize variations of Embodiment 1. Specifically, points 1-1, 1-2 and 1-3 represent three variations of Embodiment 1 with mass in a low front portion of the club head, whereas the specific embodiment 1000 has mass in a low rear portion of the club head. The CG z value for each variation differs because the club head mass for each variation differs, whereas the MOI value for each variation is approximately the same because the shape of the head is approximately the same.

As can be seen, data points of the current disclosure have a combination of $CG_Z$, $CG_Y$, and MOI that is not found in other data points. With specific reference to FIG. 7, a boundary line is seen distinguishing the golf club heads 1000, 2000, 3000 of the current disclosure (and their respective variations, except for the point 1-1 variation) from other data points. The boundary line indicates that golf club heads 1000, 2000, 3000 of the current disclosure generally include a ratio of $CG_Z/CG_Y<0.000222\times I_{xx}-0.272$. Individual species of golf club heads 1000, 2000, 3000 follow different curves, and the inequality displayed above is intended to indicate a ratio covering most embodiments of the current disclosure.

Figure 8:
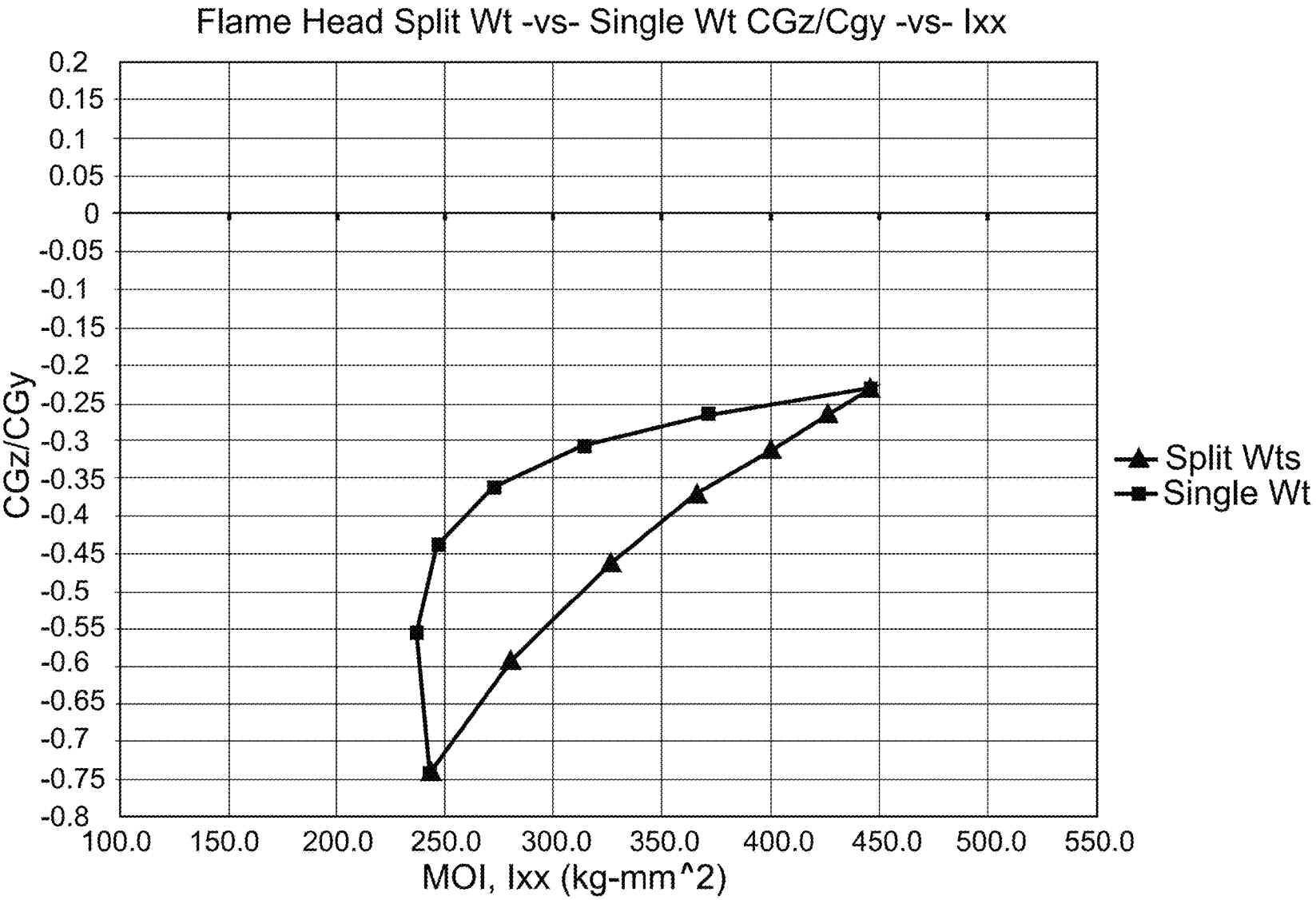
FIG. 8 is a graph illustrating the effectiveness of the golf club heads of the current disclosure.

As illustrated by FIG. 8, $CG_Z/CG_Y$ provides a measure of how low the CG projects on the face of the golf club head. Although $CG_Z/CG_Y$ may be various numbers, the chart of FIG. 8 displays the same golf club head geometry (that of Embodiment 2, similar to golf club head 2000) with one mass and with multiple masses. In the embodiment of the current figure, the multiple masses included two masses, one located proximate the leading edge 170 and one located proximate the trailing edge 180, although various embodiments may include various arrangements of masses. For the single mass, a single mass was varied throughout the golf club head to achieve varying MOIs, from very far forward to very far rearward. With split masses, two masses were placed on the periphery of the golf club head and the amount of mass was varied from all mass at the front to all mass at the back. With such an experiment, the single mass would be capable of achieving similar properties along one of $CG_Z/CG_Y$ or MOI. As can be seen, the single mass and split mass curves approach each other at their ends. This is because, as balance of mass among the split mass embodiments becomes more heavily unbalanced to one end or the other, the mass distribution in the golf club head approaches that of a single mass.

However, it is important to note that, with the multiple mass embodiments, higher MOI can be achieved with a lower $CG_Z/CG_Y$ ratio. Stated differently, although single mass efforts may be capable of producing the same $CG_Z/CG_Y$ ratio, the MOI for the golf club head with a single mass would be lower than the MOI for the golf club head with multiple masses. Stated differently yet again, for the same MOI, the multiple-mass embodiments of the golf club head would be able to achieve a lower $CG_Z/CG_Y$ ratio. Effectively, the result is that CG projection can be moved lower in the golf club head while maintaining relatively high MOI. The effectiveness of this difference will be determined by the specific geometry of each golf club head and the masses utilized.

Knowing $CG_Y$ allows the use of a CG effectiveness product to describe the location of the CG in relation to the golf club head space. The CG effectiveness product is a measure of the effectiveness of locating the CG low and forward in the golf club head. The CG effectiveness product ($CG_{eff}$) is calculated with the following formula and, in the current disclosure, is measured in units of the square of distance ($mm^2$):

$$CG_{eff}=CG_Y\times\Delta_z$$

With this formula, the smaller the $CG_{eff}$, the more effective the club head is at relocating mass low and forward. This measurement adequately describes the location of the CG within the golf club head without projecting the CG onto the face. As such, it allows for the comparison of golf club heads that may have different lofts, different face heights, and different locations of the CF. For golf club head 1000, $CG_Y$ is 33.3 mm and $\Delta_z$ is 24.2 mm. As such, the $CG_{eff}$ of golf club head 1000 is about 806 $mm^2$. For golf club head 2000, $CG_Y$ is 41.9 mm and $\Delta_z$ is 24.6 mm. As such, the $CG_{eff}$ of golf club head 2000 is about 1031 $mm^2$. For golf club head 3000, $CG_Y$ is about 52.8 and $\Delta_z$ is 18.7 mm. As such, the $CG_{eff}$ of golf club head 3000 is about 987 $mm^2$. For comparison, golf club head 4000, $CG_Y$ is 31.6 mm and $\Delta_z$ is 29.7 mm. As such $CG_{eff}$ is about 938.52 $mm^2$.

As described briefly above, loft adjustable loft technology is described in greater detail with reference to U.S. Pat. No. 7,887,431, entitled "GOLF CLUB," filed Dec. 30, 2008, which is incorporated by reference herein in its entirety. An illustration of loft sleeve 1072 is seen with reference to FIG. 9.

Figure 9:
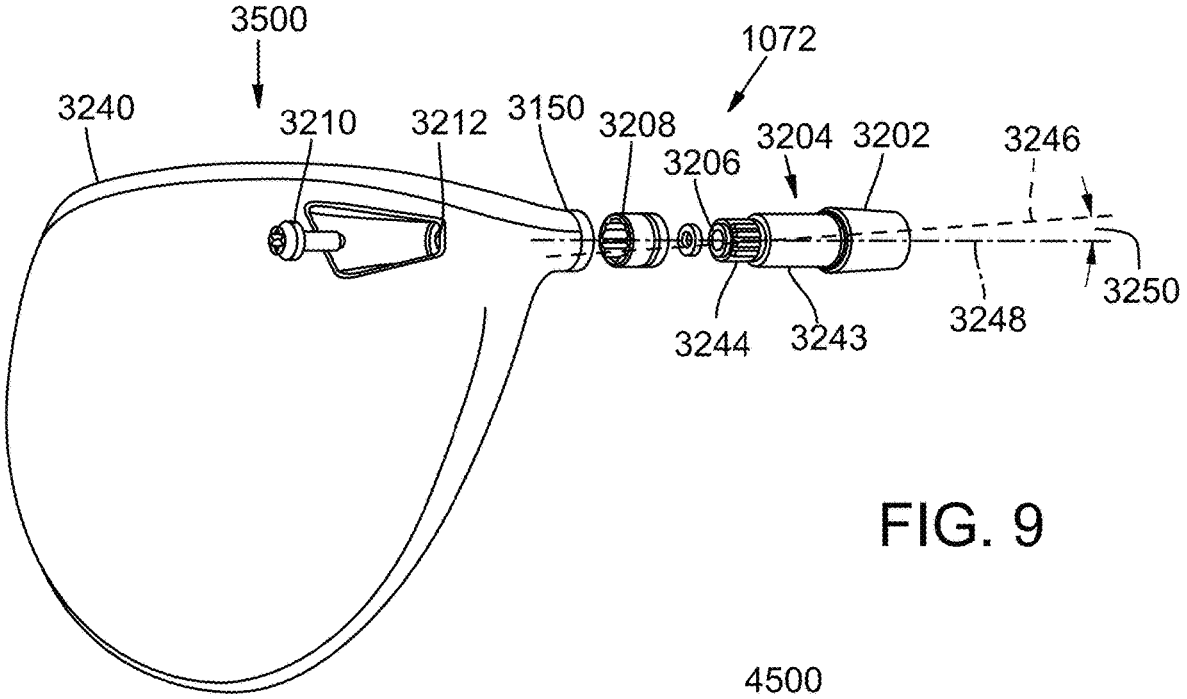
FIG. 9 is an exploded perspective view an adjustable golf club technology in accord with at least one embodiment of the current disclosure.

FIG. 9 illustrates a removable shaft system having a ferrule 3202 having a sleeve bore 3245 (shown in FIG. 2B) within a sleeve 3204. A shaft (not shown) is inserted into the sleeve bore and is mechanically secured or bonded to the sleeve 3204 for assembly into a golf club. The sleeve 3204 further includes an anti-rotation portion 3244 at a distal tip of the sleeve 3204 and a threaded bore 3206 for engagement with a screw 3210 that is inserted into a sole opening 3212 defined in an exemplary golf club head 3500, as the technology described herein may be incorporated in the various embodiments of golf club heads of the current disclosure. In one embodiment, the sole opening 3212 is directly adjacent to a sole non-undercut portion. The anti-rotation portion 3244 of the sleeve 3204 engages with an anti-rotation collar 3208 which is bonded or welded within a hosel 3150 of the exemplary golf club head 3500.

The technology shown in FIG. 9 includes an adjustable loft, lie, or face angle system that is capable of adjusting the loft, lie, or face angle either in combination with one another or independently from one another. For example, a first portion 3243 of the sleeve 3204, the sleeve bore 3242, and the shaft collectively define a longitudinal axis 3246 of the assembly. The sleeve 3204 is effective to support the shaft along the longitudinal axis 3246, which is offset from a longitudinal axis 3248 offset angle 3250. The longitudinal axis 3248 is intended to align with the axis of the hosel 150. The sleeve 3204 can provide a single offset angle 3250 that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees. The sleeve 3204 can be rotated to provide various adjustments the loft, lie, or face angle of the golf club head 3500. One of skill in the art would understand that the system described with respect to the current golf club head 3500 can be implemented with various embodiments of the golf club heads (1000, 2000, 3000) of the current disclosure.

In various embodiments, the golf club heads 1000, 2000, 3000 may include composite face plates, composite face plates with titanium covers, or titanium faces as desired as described with reference to U.S. Pat. No. 7,874,936, entitled "COMPOSITE ARTICLES AND METHODS FOR MAKING THE SAME," filed Dec. 19, 2007. In various embodiments, other materials may be used and would be understood by one of skill in the art to be included within the general scope of the disclosure.

Figure 10:
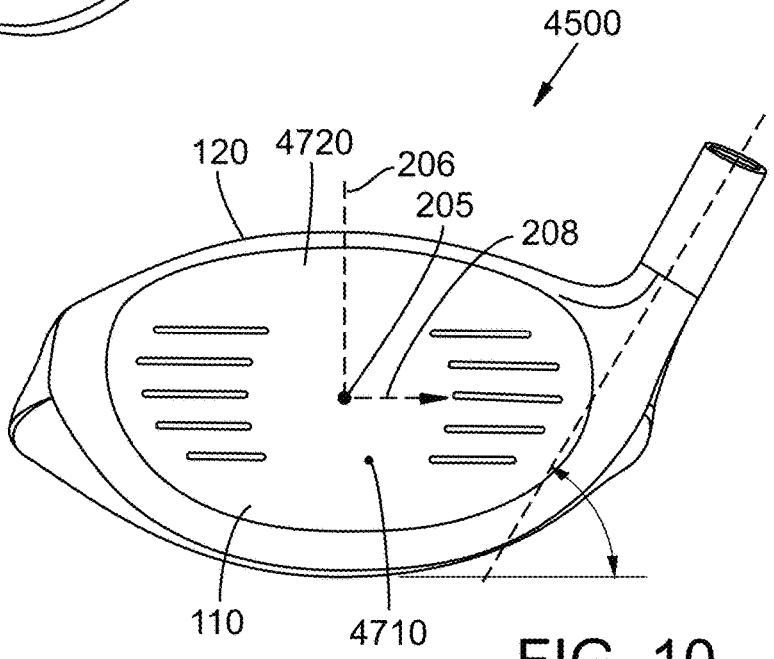
FIG. 10 is a front side view of a golf club head including a composite face plate in accord with at least one embodiment of the current disclosure.

One exemplary composite face plate is included and described with reference to FIG. 10. An exemplary golf club head 4500 includes face 110 that is a composite face plate. The composite face plate includes a striking portion 4710 and a partial crown portion 4720 that allows a portion of the composite face plate to be included in the crown 120 of the golf club head 4500. Such an arrangement can reduce mass in the golf club head 4500 by 10-15 grams in various embodiments. In various embodiments, composite face plates need not include portions along the crown 120 of the golf club head 4500. In various embodiments, the face 110 may be of various materials and arrangements, and no single embodiment should be considered limiting on the scope of the current disclosure.

As used herein, the term "composite" or "composite materials" means a fiber-reinforced polymeric material.

Figure 11:
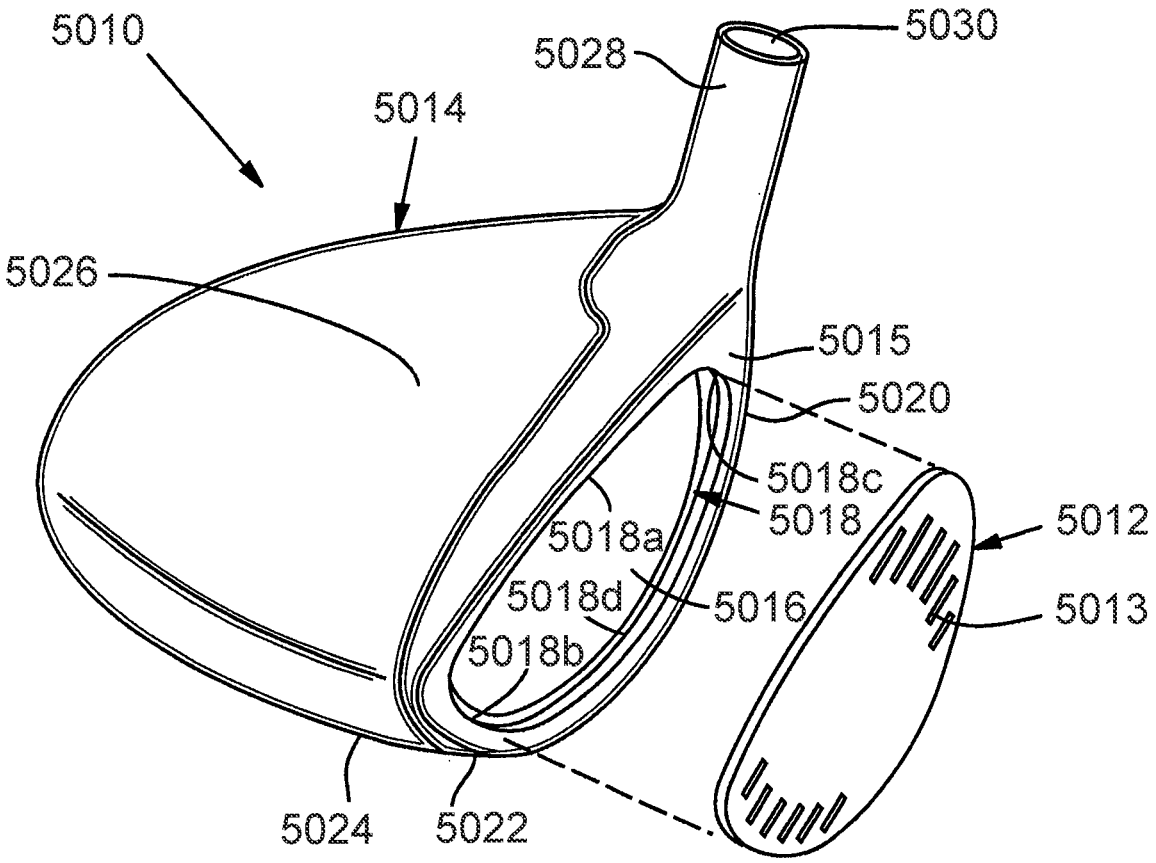
FIG. 11 is a perspective view of a "metal-wood" club-head, showing certain general features pertinent to the instant disclosure.

Now with reference to FIGS. 11-59, the main features of an exemplary hollow "metal-wood" club-head 5010 are depicted in FIG. 11. The club-head 5010 comprises a face plate, strike plate, or striking plate 5012 and a body 5014. The face plate 5012 typically is convex, and has an external ("striking") surface (face) 5013. The body 5014 defines a front opening 5016. A face support 5018 is disposed about the front opening 5016 for positioning and holding the face plate 5012 to the body 5014. The body 5014 also has a heel 5020, a toe 5022, a sole 5024, a top or crown 5026, and a hosel 5028. Around the front opening 5016 is a "transition zone" 5015 that extends along the respective forward edges of the heel 5020, the toe 5022, the sole 5024, and the crown 5026. The transition zone 5015 effectively is a transition from the body 5014 to the face plate 5012. The face support 5018 can comprise a lip or rim that extends around the front opening 5016 and is released relative to the transition zone 5015 as shown. The hosel 5028 defines an opening 5030 that receives a distal end of a shaft (not shown). The opening 5016 receives the face plate 5012, which rests upon and is bonded to the face support 5018 and transition zone 5015, thereby enclosing the front opening 5016. The transition zone 5015 can include a sole-lip region 5018 *d*, a crown-lip region 5018 *a*, a heel-lip region 5018 *c*, and a toe-lip region 5018 *b*. These portions can be contiguous, as shown, or can be discontinuous, with spaces between them.

In a club-head according to one embodiment, at least a portion of the face plate 5012 is made of a composite including multiple plies or layers of a fibrous material (e.g., graphite, or carbon, fiber) embedded in a cured resin (e.g., epoxy). For example, the face plate 5012 can comprise a composite component (e.g., component 40 shown in FIGS. 12-14) that has an outer polymeric layer forming the striking surface 5013. Examples of suitable polymers that can be used to form the outer coating, or cap, are described in detail below. Alternatively, the face plate 5012 can have an outer metallic cap forming the external striking surface 5013 of the face plate, as described in U.S. Pat. No. 7,267,620, which is incorporated herein by reference.

An exemplary thickness range of the composite portion of the face plate is 7.0 mm or less. The composite desirably is configured to have a relatively consistent distribution of reinforcement fibers across a cross-section of its thickness to facilitate efficient distribution of impact forces and overall durability. In addition, the thickness of the face plate 5012 can be varied in certain areas to achieve different performance characteristics and/or improve the durability of the club-head. The face plate 5012 can be formed with any of various cross-sectional profiles, depending on the club-head's desired durability and overall performance, by selectively placing multiple strips of composite material in a predetermined manner in a composite lay-up to form a desired profile.

Attaching the face plate 5012 to the support 5018 of the club-head body 5014 may be achieved using an appropriate adhesive (typically an epoxy adhesive or a film adhesive). To prevent peel and delamination failure at the junction of an all-composite face plate with the body of the club-head, the composite face plate can be recessed from or can be substantially flush with the plane of the forward surface of the metal body at the junction. Desirably, the face plate is sufficiently recessed so that the ends of the reinforcing fibers in the composite component are not exposed.

The composite portion of the face plate is made as a lay-up of multiple prepreg plies. For the plies the fiber reinforcement and resin are selected in view of the club-head's desired durability and overall performance. In order to vary the thickness of the lay-up, some of the prepreg plies comprise elongated strips of prepreg material arranged in one or more sets of strips. The strips in each set are arranged in a cross-cross, overlapping pattern so as to add thickness to the composite lay-up in the region where the strips overlap each other, as further described in greater detail below. The strips desirably extend continuously across the finished composite part; that is, the ends of the strips are at the peripheral edge of the finished composite part. In this manner, the longitudinally extending reinforcing fibers of the strips also can extend continuously across the finished composite part such that the ends of the fibers are at the periphery of the part. Consequently, during the curing process, defects can be shifted toward a peripheral sacrificial portion of the composite lay-up, which sacrificial portion subsequently can be removed to provide a finished part with little or no defects. Moreover, the durability of the finished part is increased because the free ends of the fibers are at the periphery of the finished part, away from the impact zone.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of $g/m^2$.) FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values above 100 $g/m^2$ may be used.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement.

Figure 14:
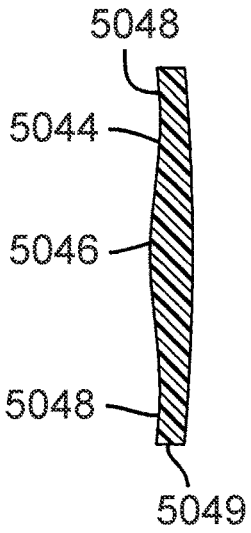
FIG. 14 is a cross-sectional view taken along line 14-14 of FIG. 12.
Figure 12:
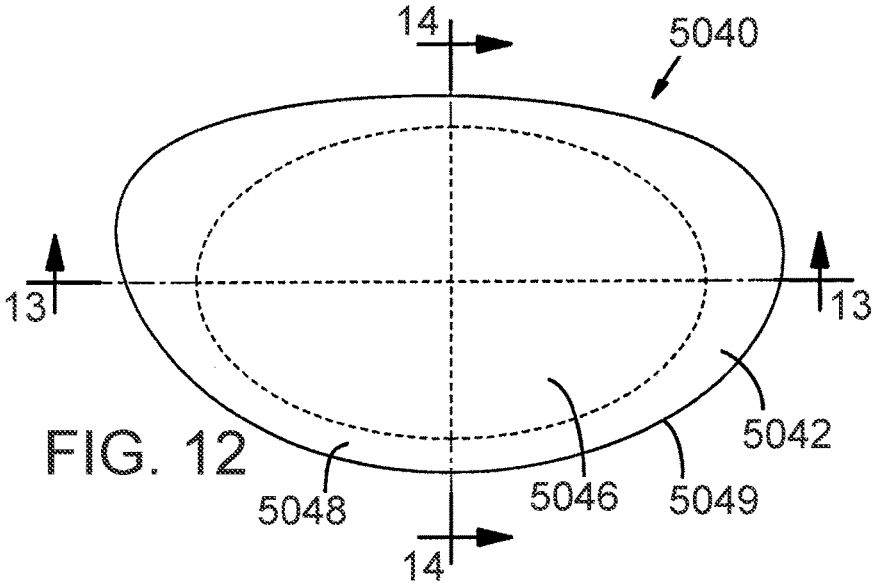
FIG. 12 is a front elevation view of one embodiment of a net-shape composite component used to form the strike plate of a club-head, such as the club-head shown in FIG. 11.
Figure 13:
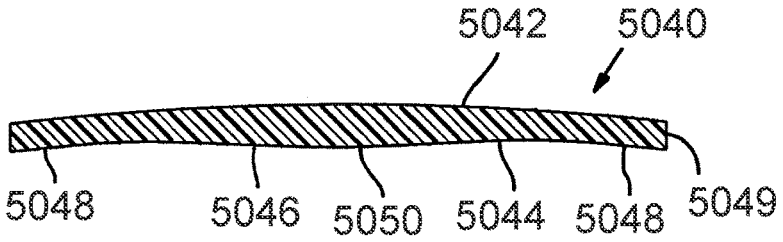
FIG. 13 is a cross-sectional view taken along line 13-13 of FIG. 12.

FIGS. 12-14 show an exemplary embodiment of a finished component 5040 that is fabricated from a plurality of prepreg plies or layers and has a desired shape and size for use as a face plate for a club-head or as part of a face plate for a clubhead. The composite part 5040 has a front surface 5042 and a rear surface 5044. In this example the composite part has an overall convex shape, a central region 5046 of increased thickness, and a peripheral region 5048 having a relatively reduced thickness extending around the central region. The central region 5046 in the illustrated example is in the form of a projection or cone on the rear surface having its thickest portion at a central point 5050 (FIG. 13) and gradually tapering away from the point in all directions toward the peripheral region 5048. The central point 5050 represents the approximate center of the "sweet spot" (optimal strike zone) of the face plate 5012, but not necessarily the geometric center of the face plate. The thicker central region 5046 adds rigidity to the central area of the face plate 5012, which effectively provides a more consistent deflection across the face plate. In certain embodiments, the central region 5046 has a thickness of about 5 mm to about 7 mm and the peripheral region 5048 has a thickness of about 4 mm to about 5 mm.

Figure 15:
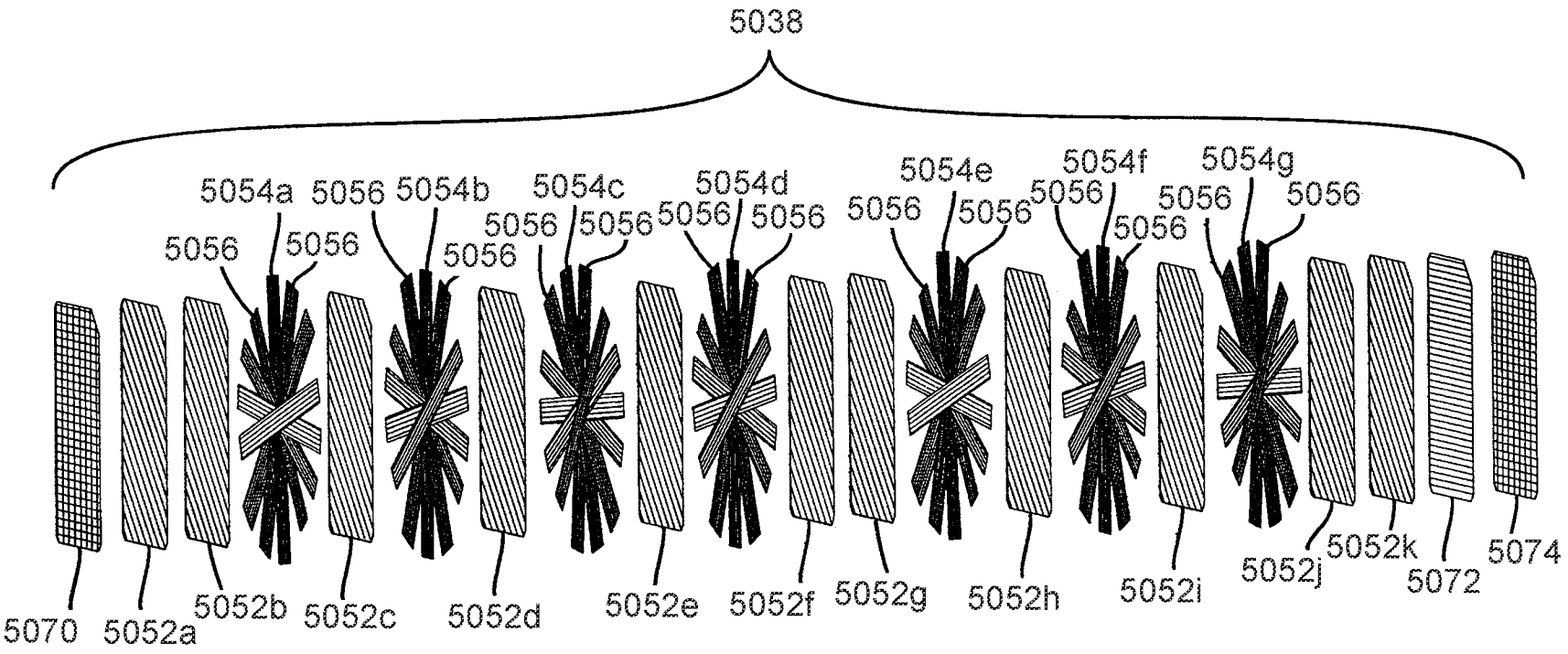
FIG. 15 is an exploded view of one embodiment of a composite lay-up from which the component shown in FIG. 12 can be formed.
Figure 19:
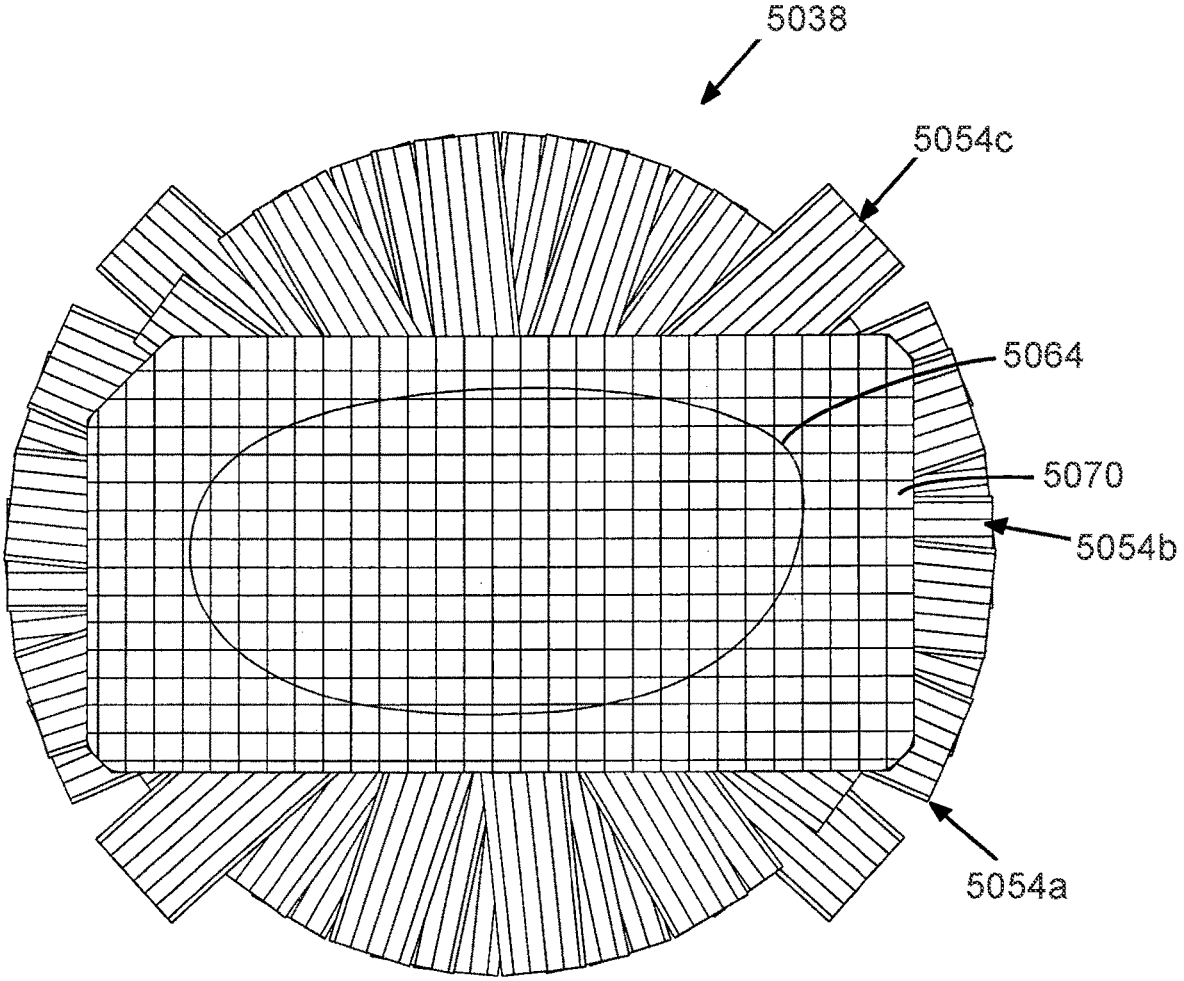
FIG. 19 is a top plan view of the composite lay-up shown in FIG. 15.

In certain embodiments, the composite component 5040 is fabricated by first forming an oversized lay-up of multiple prepreg plies, and then machining a sacrificial portion from the cured lay-up to form the finished part 5040. FIG. 19 is a top plan view of one example of a lay-up 5038 from which the composite component 5040 can be formed. The line 5064 in FIG. 19 represents the outline of the component 5040. Once cured, the portion surrounding the line 5064 can be removed to form the component 5040. FIG. 15 is an exploded view of the lay-up 5038. In the lay-up, each prepreg ply desirably has a prescribed fiber orientation, and the plies are stacked in a prescribed order with respect to fiber orientation.

As shown in FIG. 15, the illustrated lay-up 5038 is comprised of a plurality of sets, or unit-groups, 5052 *a*-5052 *k* of one or more prepreg plies of substantially uniform thickness and one or more sets, or unit-groups, 5054 *a*-5054 *g* of individual plies in the form of elongated strips 5056. For purposes of description, each set 5052 *a*-5052 *k* of one or more plies can be referred to as a composite "panel" and each set 5054 *a*-5054 *g* can be referred to as a "cluster" of elongated strips. The clusters 5054 *a*-5054 *g* of elongated strips 5056 are interposed between the panels 5052 *a*-5052 *k* and serve to increase the thickness of the finished part 5040 at its central region 5046 (FIG. 12). Each panel 5052 *a*-5052 *k* comprises one or more individual prepreg plies having a desired fiber orientation. The individual plies forming each panel 5052 *a*-5052 *k* desirably are of sufficient size and shape to form a cured lay-up from which the smaller finished component 5040 can be formed substantially free of defects. The clusters 5054 *a*-5054 *g* of strips 5056 desirably are individually positioned between and sandwiched by two adjacent panels (i.e., the panels 5052 *a*-5052 *k* separate the clusters 5054 *a*-5054 *g* of strips from each other) to facilitate adhesion between the many layers of prepreg material and provide an efficient distribution of fibers across a cross-section of the part.

In particular embodiments, the number of panels 5052 *a*-5052 *k* can range from 9 to 14 (with eleven panels 5052 *a*-5052 *k* being used in the illustrated embodiment) and the number of clusters 5054 *a*-5054 *g* can range from 1 to 12 (with seven clusters 5054 *a*-5054 *g* being used in the illustrated embodiment). However, in alternative embodiments, the number of panels and clusters can be varied depending on the desired profile and thickness of the part.

The prepreg plies used to form the panels 5052 *a*-5052 *k* and the clusters 5054 *a*-5054 *g* desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR5OS" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is 40%.

Figure 16:
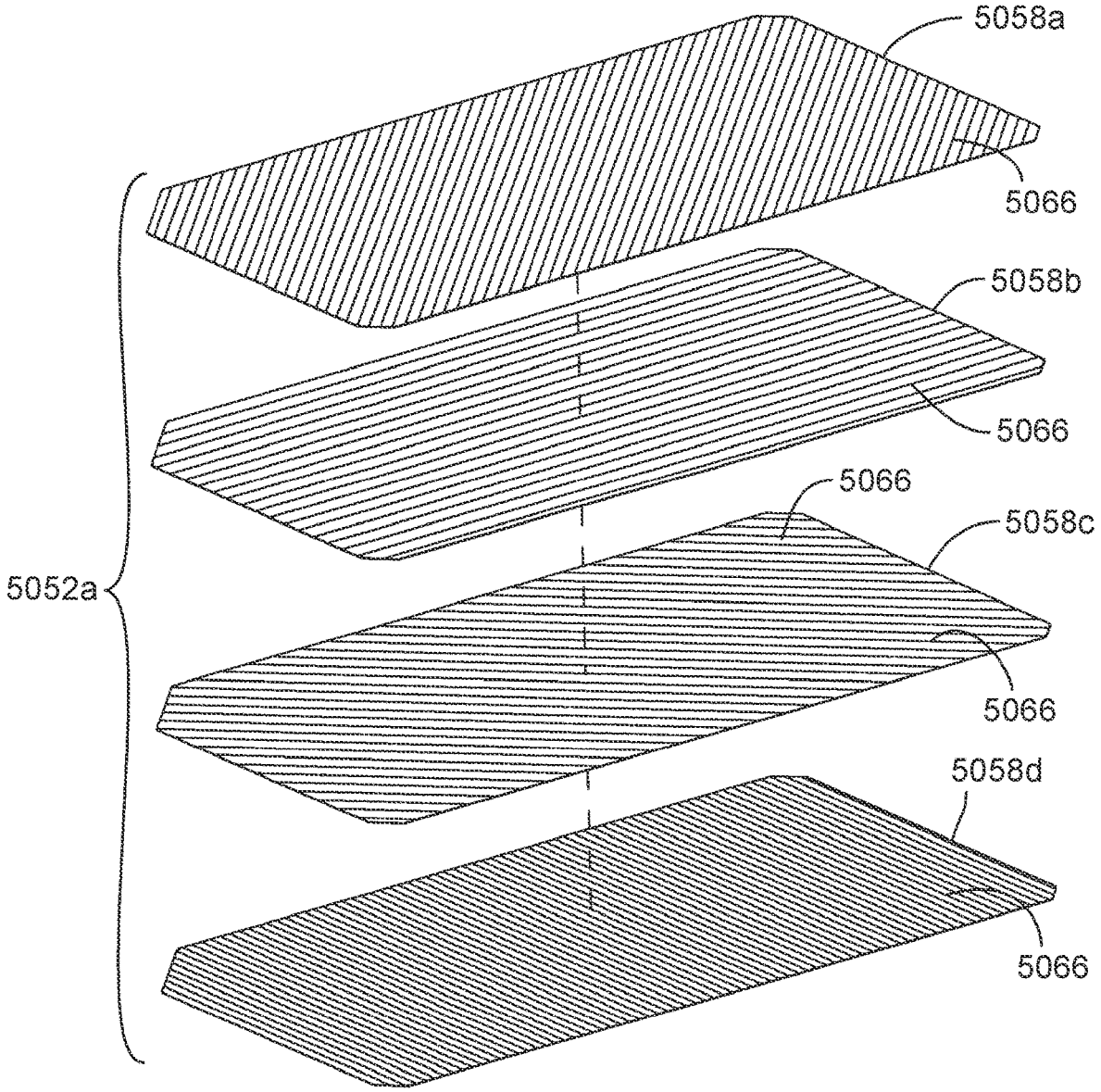
FIG. 16 is an exploded view of a group of prepreg plies of differing fiber orientations that are stacked to form a "quasi-isotropic" composite panel that can be used in the lay-up illustrated in FIG. 15.

FIG. 16 is an exploded view of the first panel 5052 *a*. For convenience of reference, the fiber orientation (indicated by lines 5066) of each ply is measured from a horizontal axis of the club-head's face plane to a line that is substantially parallel with the fibers in the ply. As shown in FIG. 16, the panel 5052 *a* in the illustrated example comprises a first ply 5058 *a* having fibers oriented at +45 degrees, a second ply 5058 *b* having fibers oriented at 0 degrees, a third ply 5058 *c* having fibers oriented at −45 degrees, and a fourth ply 5058 *d* having fibers oriented at 90 degrees. The panel 5052 *a* of plies 5058 *a*-5058 *d* thus form a "quasi-isotropic" panel of prepreg material. The remaining panels 5052 *b*-5052 *k* can have the same number of prepreg plies and fiber orientation as set 5052 *a*.

The lay-up illustrated in FIG. 15 can further include an "outermost" fiberglass ply 5070 adjacent the first panel 5052 *a*, a single carbon-fiber ply 5072 adjacent the eleventh and last panel 5052 *k*, and an "innermost" fiberglass ply 5074 adjacent the single ply 5072. The single ply can have a fiber orientation of 90 degrees as shown. The fiberglass plies 5070, 5074 can have fibers oriented at 0 degrees and 90 degrees. The fiberglass plies 5070, 5074 are essentially provided as sacrificial layers that protect the carbon-fiber plies when the cured lay-up is subjected to surface finishing such as sand blasting to smooth the outer surfaces of the part.

Figure 17:
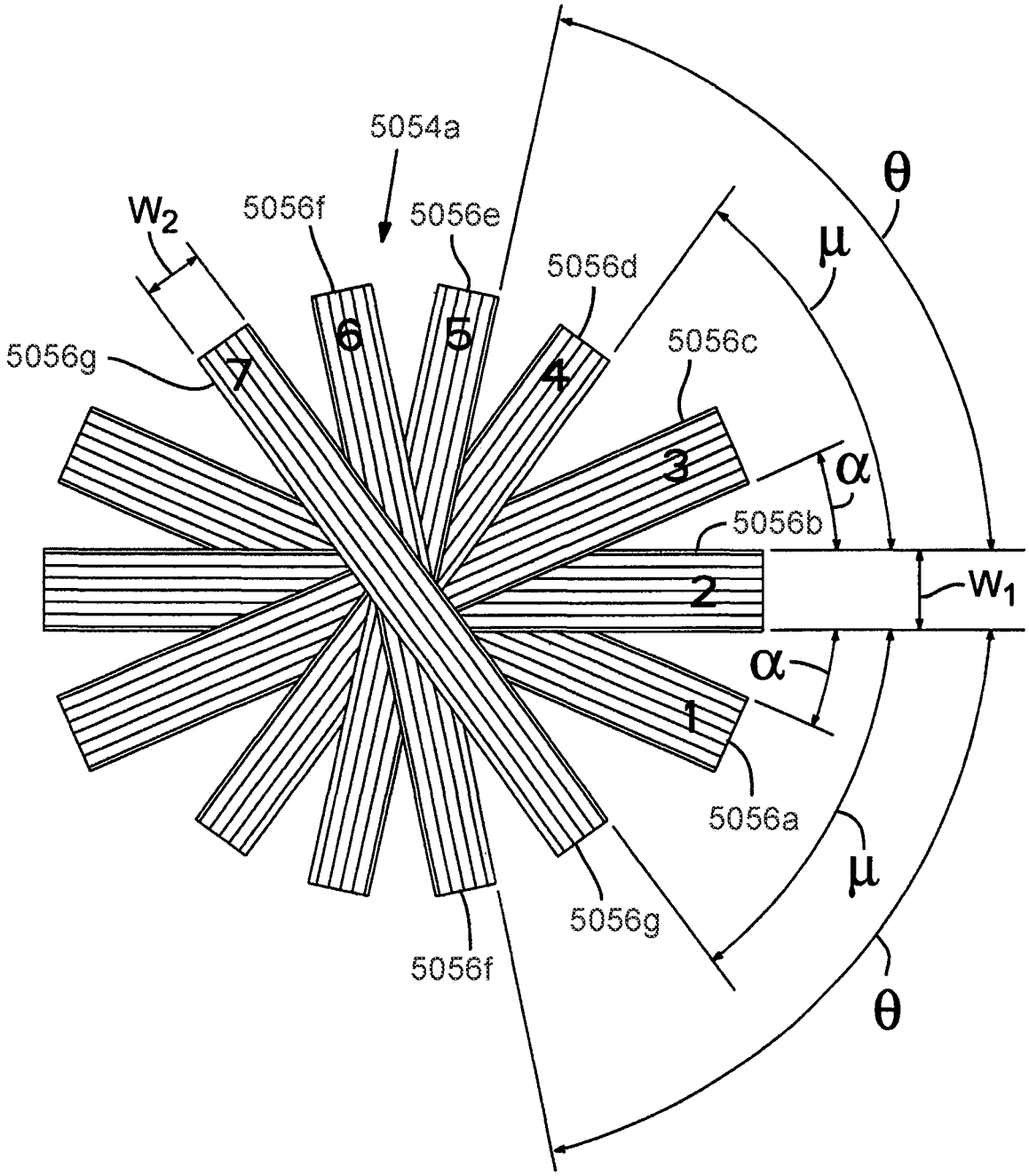
FIG. 17 is a plan view of a group or cluster of elongated prepreg strips that can be used in the lay-up illustrated in FIG. 15.

FIG. 17 is an enlarged plan view of the first cluster 5054 *a* of elongated prepreg strips which are arranged with respect to each other so that the cluster has a variable thickness. The cluster 5054 *a* in the illustrated example includes a first strip 5056 *a*, a second strip 5056 *b*, a third strip 5056 *c*, a fourth strip 5056 *d*, a fifth strip 5056 *e*, a sixth strip 5056 *f*, and a seventh strip 5056 *g*. The strips are stacked in a criss-cross pattern such that the strips overlap each other to define an overlapping region 5060 and the ends of each strip are angularly spaced from adjacent ends of another strip. The cluster 5054 *a* is therefore thicker at the overlapping region 5060 than it is at the ends of the strips. The strips can have the same or different lengths and widths, which can be varied depending on the desired overall shape of the composite part 5040, although each strip desirably is long enough to extend continuously across the finished part 5040 that is cut or otherwise machined from the oversized lay-up.

The strips 5056 *a*-5056 *g* in the illustrated embodiment are of equal length and are arranged such that the geometric center point 5062 of the cluster corresponds to the center of each strip. The first three strips 5056 *a*-5056 *c* in this example have a width w1 that is greater than the width w2 of the last four strips 5056 *d*-5056 *g*. The strips define an angle α between the "horizontal" edges of the second strip 5056 *b* and the adjacent edges of strips 5056 *a* and 5056 *c*, an angle 11 between the edges of strip 5056 *b* and the closest edges of strips 5056 *d* and 5056 *g*, and an angle θ between the edges of strip 5056 *b* and the closest edges of strips 5056 *e* and 5056 *f*. In a working embodiment, the width w1 is about 20 mm, the width w2 is about 15 mm, the angle α is about 24 degrees, the angle μ is about 54 degrees, and the angle θ is about 78 degrees.

Figure 18A:
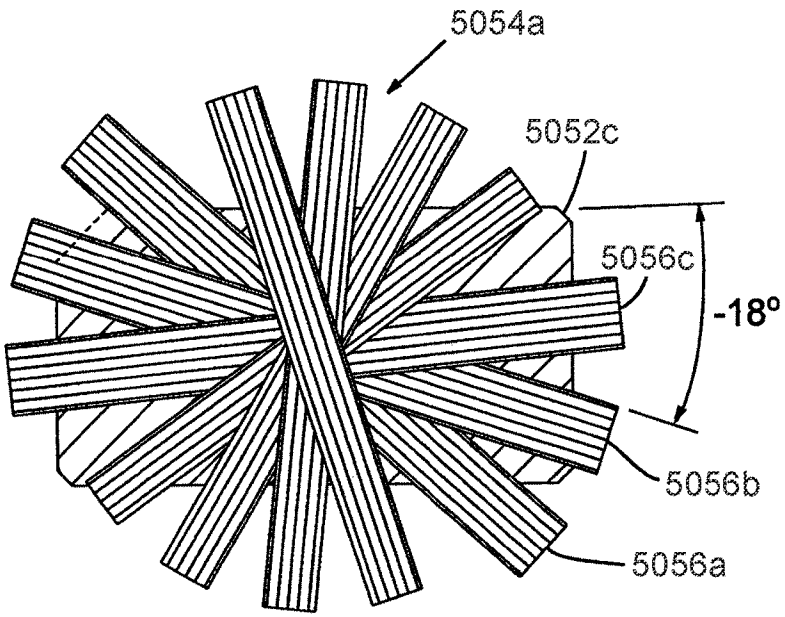
FIG. 18A-18B are plan views illustrating the manner in which clusters of prepreg strips can be oriented at different rotational positions relative to each other in a composite lay-up to create an angular offset between the strips of adjacent clusters.
Figure 18B:
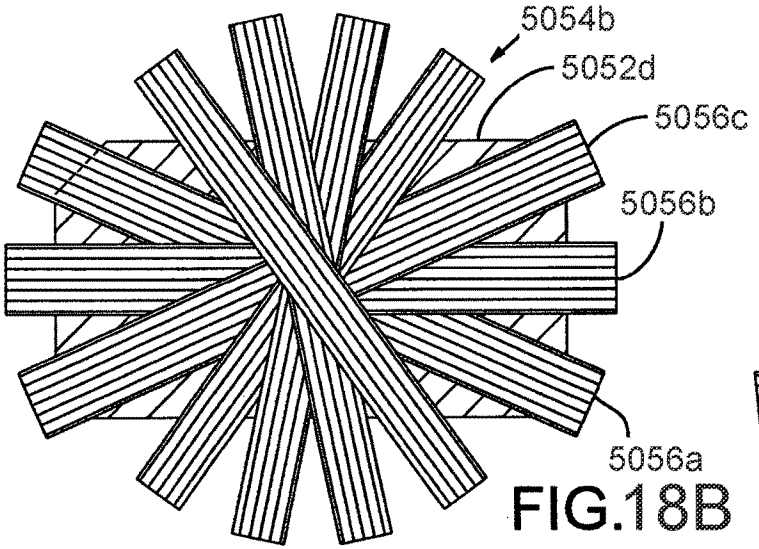
Figure 18C:
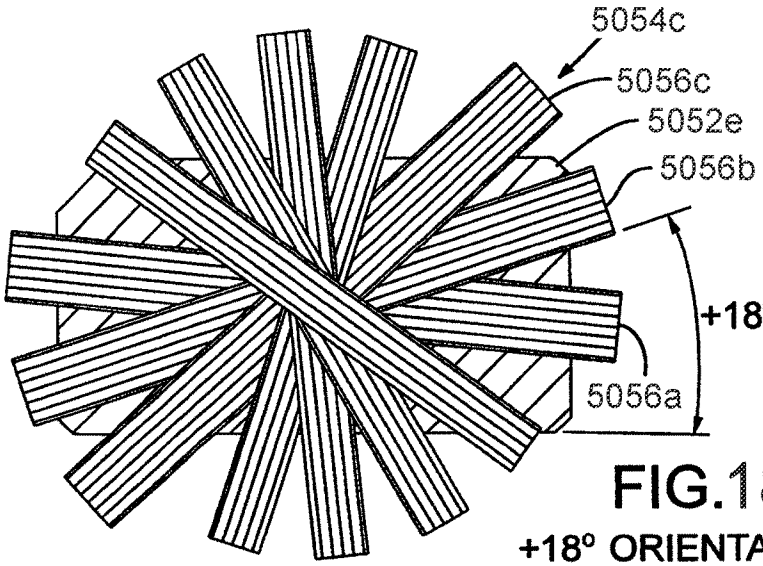

Referring again to FIG. 15, each cluster 5054 *a*-5054 *g* desirably is rotated slightly or angularly offset with respect to an adjacent cluster so that the end portions of each strip in a cluster are not aligned with the end portions of the strips of an adjacent cluster. In this manner, the clusters can be arranged relative to each other in the lay-up to provide a substantially uniform thickness in the peripheral region 5048 of the composite part (FIG. 13). In the illustrated embodiment, for example, the first cluster 5054 *a* has an orientation of −18 degrees, meaning that the "upper" edge of the second strip 5056 *b* extends at a −18 degree angle with respect to the "upper" horizontal edge of the adjacent unit-group 5052 *c* (as best shown in FIG. 18A). The next successive cluster 5054 *b* has an orientation of 0 degrees, meaning that the second strip 5056 *b* is parallel to the "upper" horizontal edge of the adjacent unit-group 5052 *d* (as best shown in FIG. 8B). The next successive cluster 5054 *c* has an orientation of +18 degrees, meaning that the "lower" edge of the respective second strip 5056 *b* of cluster 5054 *c* extends at a +18 degree angle with respect to the "lower" edge of the adjacent unit-group 5052 *e*. Clusters 5054 *d*, 5054 e, 5054 *f*, and 5054 *g* (FIG. 15) can have an orientation of 0 degrees, −18 degrees, 0 degrees, and +18 degrees, respectively.

When stacked in the lay-up, the overlapping regions 5060 of the clusters are aligned in the direction of the thickness of the lay-up to increase the thickness of the central region 5046 of the part 5040 (FIG. 13), while the "spokes" (the strips 5056 *a*-5056 *g*) are "fanned" or angularly spaced from each other within each cluster and with respect to spokes in adjacent clusters. Prior to curing/molding, the lay-up has a cross-sectional profile that is similar to the finished part 5040 (FIGS. 12-14) except that the lay-up is flat, that is, the lay-up does not have an overall convex shape. Thus, in profile, the rear surface of the lay-up has a central region of increased thickness and gradually tapers to a relatively thinner peripheral region of substantially uniform thickness surrounding the central region. In a working embodiment, the lay-up has a thickness of about 5 mm at the center of the central region and a thickness of about 3 mm at the peripheral region. A greater or fewer number of panels and/or clusters of strips can be used to vary the thickness at the central region and/or peripheral region of the lay-up.

To form the lay-up, according to one specific approach, formation of the panels 5052 *a*-5052 *k* may be done first by stacking individual precut, prepreg plies 5058 *a*-5058 *d* of each panel. After the panels are formed, the lay-up is built up by laying the second panel 5052 *b* on top of the first panel 5052 *a*, and then forming the first cluster 5054 *a* on top of the second panel 5052 *b* by laying individual strips 5056 *a*-5056 *g* in the prescribed manner. The remaining panels 5052 *c*-5052 *k* and clusters 5054 *b*-5054 *g* are then added to the lay-up in the sequence shown in FIG. 15, followed by the single ply 5072. The fiberglass plies 5070, 5074 can then be added to the front and back of the lay-up.

The fully-formed lay-up can then be subjected to a "debulking" or compaction step (e.g., using a vacuum table) to remove and/or reduce air trapped between plies. The lay-up can then be cured in a mold that is shaped to provide the desired bulge and roll of the face plate. An exemplary curing process is described in detail below. Alternatively, any desired bulge and roll of the face plate may be formed during one or more debulking or compaction steps performed prior to curing. To form the bulge or roll, the debulking step can be performed against a die panel having the final desired bulge and roll. In either case, following curing, the cured lay-up is removed from the mold and machined to form the part 5040.

The following aspects desirably are controlled to provide composite components that are capable of withstanding impacts and fatigue loadings normally encountered by a club-head, especially by the face plate of the club-head. These three aspects are: (a) adequate resin content; (b) fiber straightness; and (c) very low porosity in the finished composite. These aspects can be controlled by controlling the flow of resin during curing, particularly in a manner that minimizes entrapment of air in and between the prepreg layers. Air entrapment is difficult to avoid during laying up of prepreg layers. However, air entrapment can be substantially minimized by, according to various embodiments disclosed herein, imparting a slow, steady flow of resin for a defined length of time during the laying-up to purge away at least most of the air that otherwise would become occluded in the lay-up. The resin flow should be sufficiently slow and steady to retain an adequate amount of resin in each layer for adequate inter-layer bonding while preserving the respective orientations of the fibers (at different respective angles) in the layers. Slow and steady resin flow also allows the fibers in each ply to remain straight at their respective orientations, thereby preventing the "wavy fiber" phenomenon. Generally, a wavy fiber has an orientation that varies significantly from its naturally projected direction.

As noted above, the prepreg strips 5056 desirably are of sufficient length such that the fibers in the strips extend continuously across the part 5040; that is, the ends of each fiber are located at respective locations on the outer peripheral edge 5049 of the part 5040 (FIGS. 12-14). Similarly, the fibers in the prepreg panels 5052 *a*-5052 *k* desirably extend continuously across the part between respective locations on the outer peripheral edge 5049 of the part. During curing, air bubbles tend to flow along the length of the fibers toward the outer peripheral (sacrificial) portion of the lay-up. By making the strips sufficiently long and the panels larger than the final dimensions of the part 5040, the curing process can be controlled to remove substantially all of the entrapped air bubbles from the portion of the lay-up that forms the part 5040. The peripheral portion of the lay-up is also where wavy fibers are likely to be formed. Following curing, the peripheral portion of the lay-up is removed to provide a net-shape part (or near net-shape part if further finishing steps are performed) that has a very low porosity as well as straight fibers in each layer of prepreg material.

In working examples, parts have been made without any voids, or entrapped air, and with a single void in one of the prepreg plies of the lay-up (either a strip or a panel-size ply). Parts in which there is a single void having its largest dimension equal to the thickness of a ply (about 0.1 mm) have a void content, or porosity, of about $1.7\times10^{-6}$ percent or less by volume.

Figure 20A:
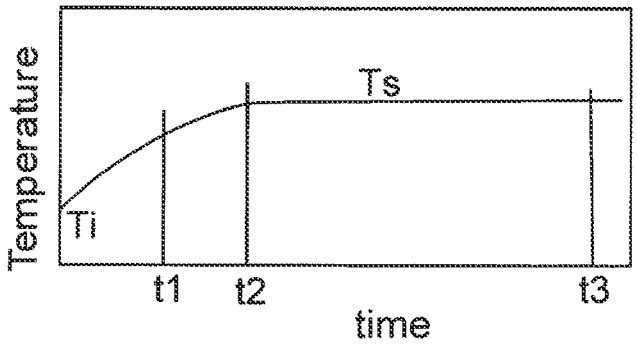
FIGS. 20A-20C are plots of temperature, viscosity, and pressure, respectively, versus time in a representative embodiment of a process for forming composite components.
Figure 20B:
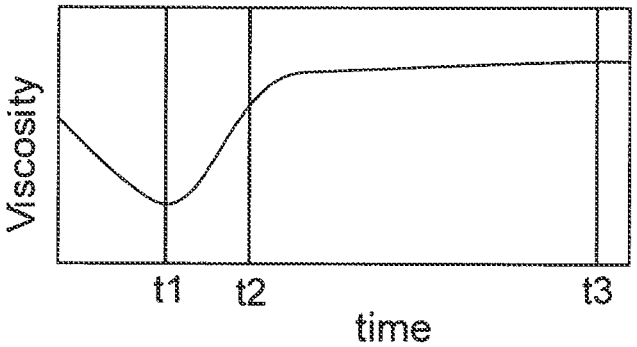
Figure 20C:
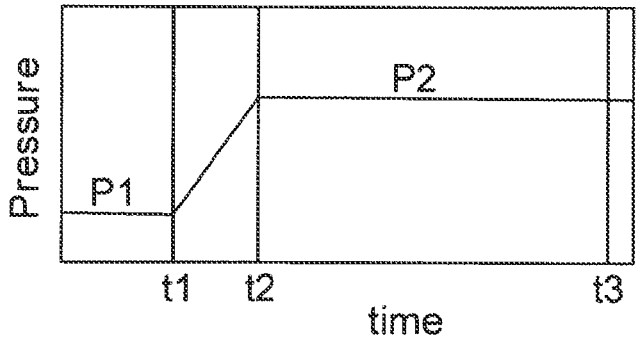
Figure 21A:
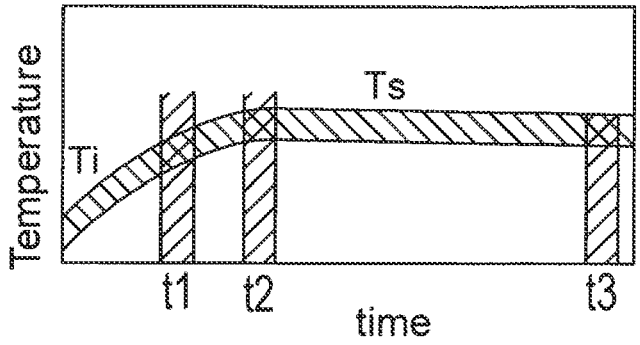
FIGS. 21A-21C are plots of temperature, viscosity, and pressure, respectively, versus time in a representative embodiment of a process in which each of these variables can be within a specified respective range (hatched areas).
Figure 21B:
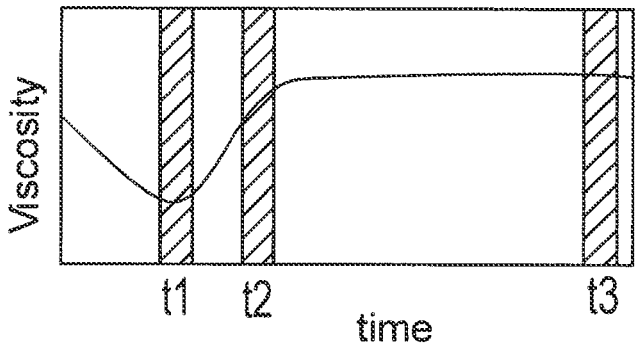
Figure 21C:
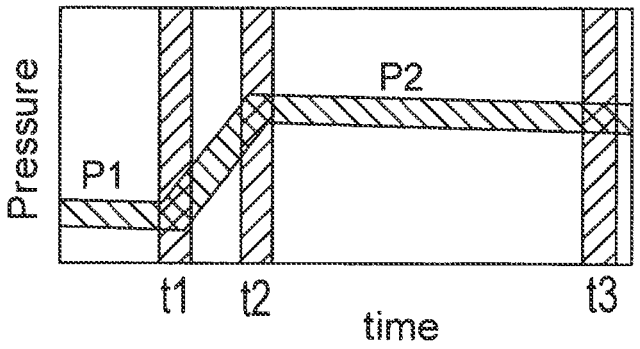

FIGS. 20A-20C depict an embodiment of a process (pressure and temperature as functions of time) in which slow and steady resin flow is performed with minimal resin loss. FIG. 20A shows temperature of the lay-up as a function of time. The lay-up temperature is substantially the same as the tool temperature. The tool is maintained at an initial tool temperature Ti, and the uncured prepreg lay-up is placed or formed in the tool at an initial pressure P1 (typically atmospheric pressure). The tool and uncured prepreg is then placed in a hot-press at a tool-set temperature Ts, resulting in an increase in the tool temperature (and thus the lay-up temperature) until the tool temperature eventually reaches equilibrium with the set temperature Ts of the hot-press. As the temperature of the tool increases from Ti to Ts, the hot-press pressure is kept at P1 for t=0 to t=t1. At t=t1, the hot-press pressure is ramped from P1 to P2 such that, at t=t2, P=P2. Between Ti and Ts, the temperature increase of the tool and lay-up is continuous. Exemplary rates of change of temperature and pressure are: ΔT≈30-60° C./minute up to t1, and ΔP≈50 psi/minute from t1 to t2.

As the tool temperature increases from Ti to T5, the viscosity of the resin first decreases to a minimum, at time t1, before the viscosity rises again due to cross-linking of the resin (FIG. 20B). At time t1, resin flows relatively easily. This increased flow poses an increased risk of resin loss, especially if the pressure in the tool is elevated. Elevated tool pressure at this stage also causes other undesirable effects such as a more agitated flow of resin. Hence, tool pressure should be maintained relatively low at and around t1 (see FIG. 20C). After t1, cross-linking of the resin begins and progresses, causing a progressive rise in resin viscosity (FIG. 20B), so tool pressure desirably is gradually increased in the time span from t1 to t2 to allow (and to encourage) adequate and continued (but nevertheless controlled) resin flow. The rate at which pressure is increased should be sufficient to reach maximum pressure P2 slightly before the end of rapid increase in resin viscosity. Again, a desired rate of change is ΔP≈50 psi/minute from t1 to t2. At time t2 the resin viscosity desirably is approximately 80% of maximum.

Curing continues after time t2 and follows a schedule of relatively constant temperature Ts and constant pressure P2. Note that resin viscosity exhibits some continued increase (typically to approximately 90% of maximum) during this phase of curing. This curing (also called "pre-cure") ends at time t3 at which the component is deemed to have sufficient rigidity (approximately 90% of maximum) and strength for handling and removal from the tool, although the resin may not yet have reached a "full-cure" state (at which the resin exhibits maximum viscosity). A post-processing step typically follows, in which the components reach a "full cure" in a batch heating mode or other suitable manner.

Thus, important parameters of this specific process are: (a) Ts, the tool-set temperature (or typical resin-cure temperature), established according to manufacturer's instructions; (b) Ti, the initial tool temperature, usually set at approximately 50% of Ts (in ° F. or ° C.) to allow an adequate time span (t2) between Ti and Ts and to provide manufacturing efficiency; (c) P1, the initial pressure that is generally slightly higher than atmospheric pressure and sufficient to hold the component geometry but not sufficient to "squeeze" resin out, in the range of 20-50 psig for example; (d) P2, the ultimate pressure that is sufficiently high to ensure dimensional accuracy of components, in the range of 200-300 psig for example; (e) t1, which is the time at which the resin exhibits a minimal viscosity, a function of resin properties and usually determined by experiment, for most resins generally in the range of 5-10 minutes after first forming the lay-up; (f) t2, the time of maximum pressure, also a time delay from t1, where resin viscosity increases from minimum to approximately 80% of a maximum viscosity (i.e., viscosity of fully cured resin), appears to be related to the moment when the tool reaches Ts; and (g) t3, the time at the end of the pre-cure cycle, at which the components have reached handling strength and resin viscosity is approximately 90% of its maximum.

Many variations of this process also can be designed and may work equally as well. Specifically, all seven parameters mentioned above can be expressed in terms of ranges instead of specific quantities. In this sense, the processing parameters can be expressed as follows (see FIGS. 21A-21C):

Ts: recommended resin cure temperature±ΔT, where ΔT=20, 50, 75° F.

Ti: initial tool temperature (or Ts/2)±ΔT.

P1: 0-100 psig±ΔP, where ΔP=5, 10, 15, 25, 35, 50 psi.

P2: 200-500 psig±ΔP.

t1: t (minimum±Δx viscosity)±Δt, where Δx=1, 2, 5, 10, 25% and Δt=1, 2, 5, 10 min.

t2: t (80%±Δx maximum viscosity)±Δt.

t3: t (90%±Δx maximum viscosity)±Δt.

After reaching full-cure, the components are subjected to manufacturing techniques (machining, forming, etc.) that achieve the specified final dimensions, size, contours, etc., of the components for use as face plates on club-heads. Conventional CNC trimming can be used to remove the sacrificial portion of the fully-cured lay-up (e.g., the portion surrounding line 5064 in FIG. 19). However, because the tool applies a lateral cutting force to the part (against the peripheral edge of the part), it has been found that such trimming can pull fibers or portions thereof out of their plies and/or induce horizontal cracks on the peripheral edge of the part. These defects can cause premature delamination or other failure.

In certain embodiments, the sacrificial portion of the fully-cured lay-up is removed by water-jet cutting. In water-jet cutting, the cutting force is applied in a direction perpendicular to the prepreg plies (in a direction normal to the front and rear surfaces of the lay-up), which minimizes the occurrence of cracking and fiber pull out. Consequently, water-jet cutting can be used to increase the overall durability of the part.

The potential mass "savings" obtained from fabricating at least a portion of the face plate of composite, as described above, is about 10-30 g, or more, relative to a 2.7-mm thick face plate formed from a titanium alloy such as Ti-6Al-4V, for example. In a specific example, a mass savings of about 15 g relative to a 2.7-mm thick face plate formed from a titanium alloy such as Ti-6Al-4V can be realized. As mentioned above, this mass can be allocated to other areas of the club, as desired.

Figure 22:
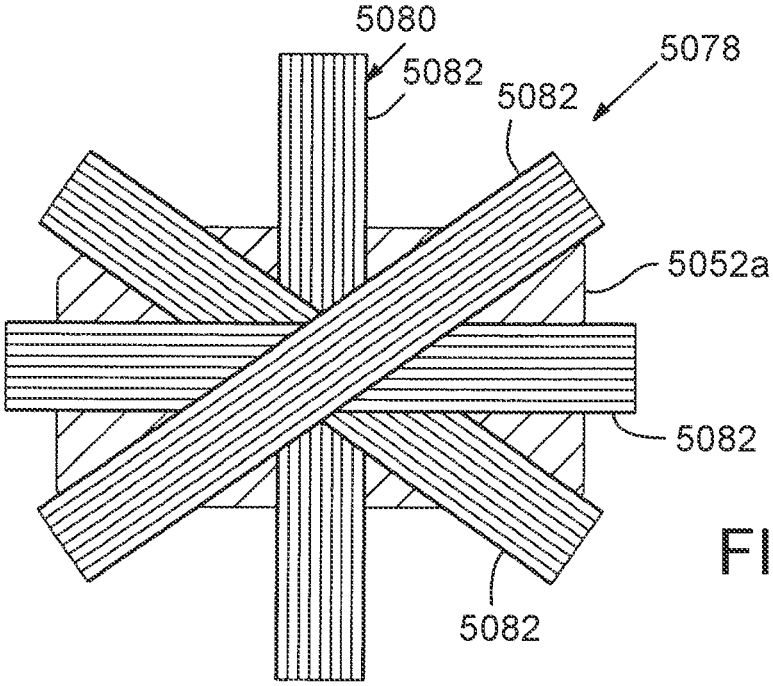
FIG. 22 is a plan view of a simplified lay-up of composite plies from which the component shown in FIG. 12 can be formed.

FIG. 22 shows a portion of a simplified lay-up 5078 that can be used to form the composite part 5040 (FIGS. 12-14). The lay-up 5078 in this example can include multiple prepreg panels (e.g., panels 5052 *a*-5052 *k*) and one or more clusters 5080 of prepreg strips 5082. The illustrated cluster 5080 comprises only four strips 5082 of equal width arranged in a criss-cross pattern and which are equally angularly spaced or fanned with respect to each other about the center of the cluster. Although the figure shows only one cluster 5080, the lay-up desirably includes multiple clusters 5080 (e.g., 1 to 12 clusters, with 7 clusters in a specific embodiment). Each cluster is rotated or angularly offset with respect to an adjacent cluster to provide an angular offset between strips of one cluster with the strips of an adjacent cluster, such as described above, in order to form the reduced-thickness peripheral portion of the lay-up.

Figure 25:
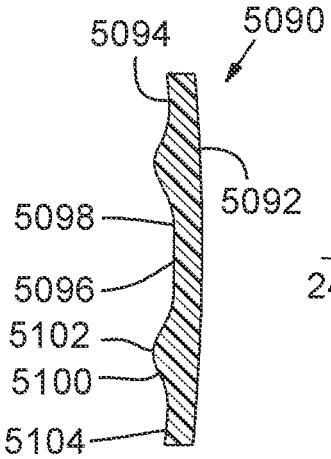
FIG. 25 is a cross-sectional view taken along line 25-25 of FIG. 23.
Figure 23:
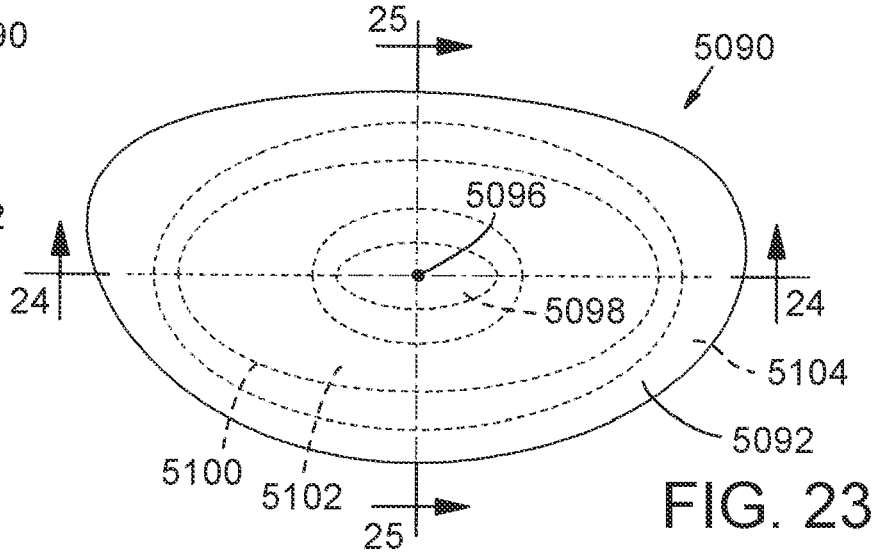
FIG. 23 is a front elevation view of another net-shape composite component that can be used to form the strike plate of a club-head.
Figure 24:
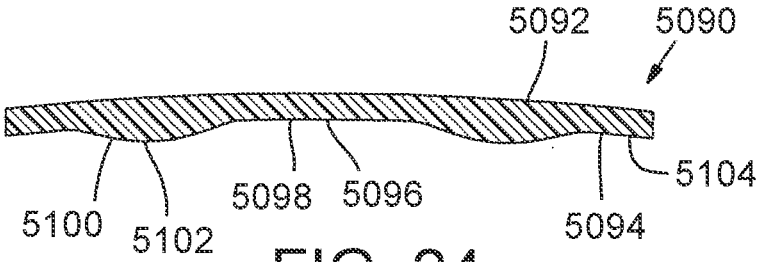
FIG. 24 is a cross-sectional view taken along line 24-24 of FIG. 23.

The embodiments described thus far provide a face plate having a projection or cone at the sweet spot. However, various other cross-sectional profiles can be achieved by selective placement of prepreg strips in the lay-up. FIGS. 23-25, for example, show a composite component 5090 for use as a face plate for a club-head (either by itself or in combination with a polymeric or metal outer layer). The composite component 5090 has a front surface 5092, a rear surface 5094, and an overall slightly convex shape. The reverse surface 5094 defines a point 5096 situated in a central recess 5098. The point 5096 represents the approximate center of the sweet spot of the face plate, not necessarily the center of the face plate, and is located in the approximate center of the recess 5098. The central recess 5098 is a "dimple" having a spherical or otherwise radiused sectional profile in this embodiment (see FIGS. 24 and 25), and is surrounded by an annular ridge 5100. At the point 5096 the thickness of the component 5090 is less than at the "top" 5102 of the annular ridge 5100. The top 5102 is normally the thickest portion of the component. Outward from the top 5102, the thickness of the component gradually decreases to form a peripheral region 5104 of substantially uniform thickness surrounding the ridge 5100. Hence, the central recess 5098 and surrounding ridge 5100 have a cross-sectional profile that is reminiscent of a "volcano." Generally speaking, an advantage of this profile is that thinner central region is effective to provide a larger sweet spot, and therefore a more forgiving club-head.

Figure 26:
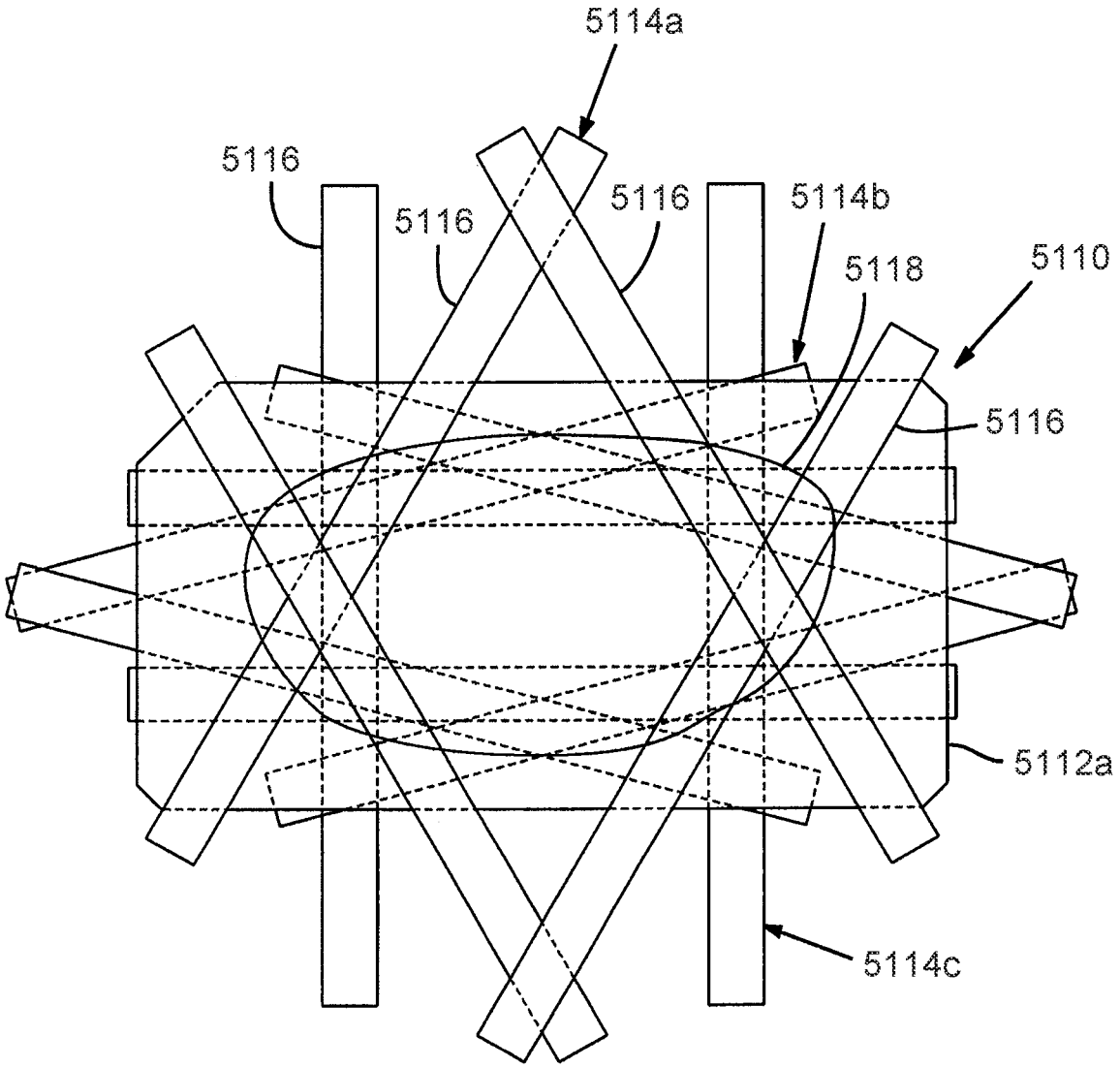
FIG. 26 is a top plan view of one embodiment of a lay-up of composite plies from which the component shown in FIG. 23 can be formed.
Figure 27:
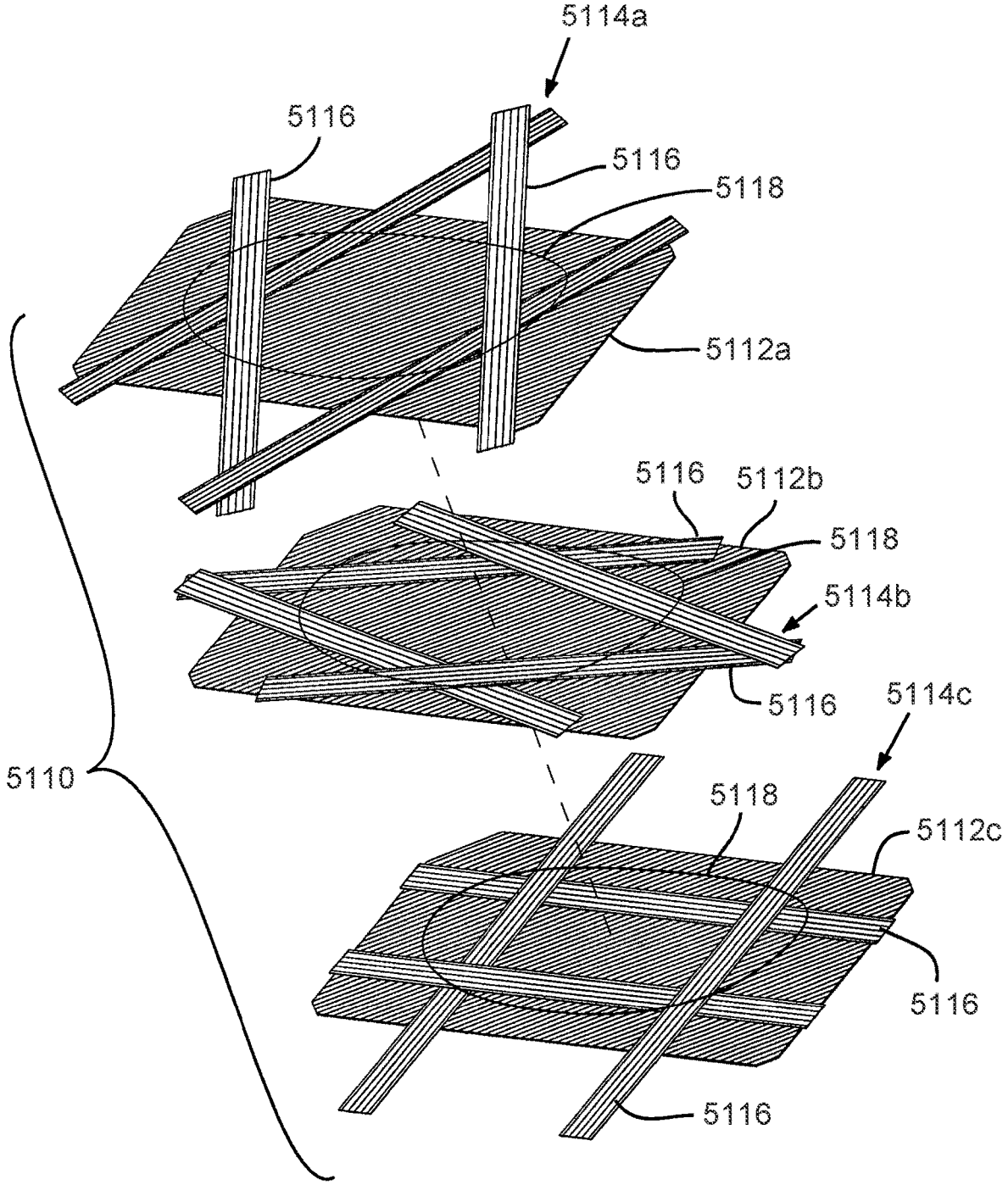
FIG. 27 is an exploded view of the first few groups of composite plies that are used to form the lay-up shown in FIG. 26.

FIG. 26 is a plan view of a lay-up 5110 of multiple prepreg plies that can be used to fabricate the composite component 5090. FIG. 27 shows an exploded view of a few of the prepreg layers that form the lay-up 5110. As shown, the lay-up 5110 includes multiple panels 5112 *a*, 5112 *b*, 5112 *c* of prepreg material and sets, or clusters, 5114 *a*, 5114 *b*, 5114 *c* of prepreg strips interspersed between the panels. The panels 5112 *a*-5112 *c* can be formed from one or more prepreg plies and desirably comprise four plies having respective fibers orientations of +45 degrees, 0 degrees, −45 degrees, and 90 degrees, in the manner described above. The line 5118 in FIGS. 26 and 27 represent the outline of the composite component 5090 and the portion surrounding the line 5118 is a sacrificial portion. Once the lay-up 5110 is cured, the sacrificial portion surrounding the line 5118 can be removed to form the component 5090.

Each cluster 5114 *a*-5114 *c* in this embodiment comprises four criss-cross strips 5116 arranged in a specific shape. In the illustrated embodiment, the strips of the first cluster 5114 *a* are arranged to form a parallelogram centered on the center of the panel 5112 *a*. The strips of the second cluster 5114 *b* also are arranged to form a parallelogram centered on the center of the panel 5112 *b* and rotated 90 degrees with respect to the first cluster 5114 *a*. The strips of the third cluster 5114 *c* are arranged to form a rectangle centered on the center of panel 5112 *c*. When stacked in the lay-up, as best shown in FIG. 26, the strips 5116 of clusters 5114 *a*-5114 *c* overlay one another so as to collectively form an oblong, annular area of increased thickness corresponding to the annular ridge 5100 (FIG. 24). Hence, the fully-formed lay-up has a rear surface having a central recess and a surrounding annular ridge of increased thickness formed collectively by the build up of strip clusters 5114 *a*-5114 *c*. Additional panels 5112 *a*-5112 *c* and strip clusters 5114 *a*-5114 *c* may be added to lay-up to achieve a desired thickness profile.

It can be appreciated that the number of strips in each cluster can vary and still form the same profile. For example, in the another embodiment, clusters 5114 *a*-5114 *c* can be stacked immediately adjacent each other between adjacent panels 5112 (i.e., effectively forming one cluster of twelve strips 5116).

The lay-up 5110 may be cured and shaped to remove the sacrificial portion of the lay-up (the portion surrounding the line 5118 in FIG. 26 representing the finished part), as described above, to form a net shape part. As in the previous embodiments, each strip 5116 is of sufficient length to extend continuously across the part 5090 so that the free ends of the fibers are located on the peripheral edge of the part. In this manner, the net shape part can be formed free of any voids, or with an extremely low void content (e.g., about $1.7\times10^{-6}$ percent or less by volume) and can have straight fibers in each layer of prepreg material.

As mentioned above, any of various cross-sectional profiles can be achieved by arranging strips of prepreg material in a predetermined manner. Examples of other face plate profiles that can be formed by the techniques described herein are disclosed in U.S. Pat. Nos. 6,800,038, 6,824,475, 6,904,663, and 7,066,832, all of which are incorporated herein by reference.

As mentioned above, the face plate 5012 (FIG. 11) can include a composite plate and a metal cap covering the front surface of the composite plate. One such embodiment is shown, for example, in the partial section depicted in FIG. 28, in which the face plate 5012 comprises a metal "cap" 5130 formed or placed over a composite plate 5040 to form the strike surface 5013. The cap 5130 includes a peripheral rim 5132 that covers the peripheral edge 5134 of the composite plate 5040. The rim 5132 can be continuous or discontinuous, the latter comprising multiple segments (not shown).

The metal cap 5130 desirably is bonded to the composite plate 5040 using a suitable adhesive 5136, such as an epoxy, polyurethane, or film adhesive. The adhesive 5136 is applied so as to fill the gap completely between the cap 5130 and the composite plate 5040 (this gap usually in the range of about 0.05-0.2 mm, and desirably is approximately 0.1 mm). The face plate 5012 desirably is bonded to the body 5014 using a suitable adhesive 5138, such as an epoxy adhesive, which completely fills the gap between the rim 5132 and the adjacent peripheral surface 5140 of the face support 5018 and the gap between the rear surface of the composite plate 5040 and the adjacent peripheral surface 5142 of the face support 5018.

A particularly desirable metal for the cap 5130 is titanium alloy, such as the particular alloy used for fabricating the body (e.g., Ti-6Al-4V). For a cap 5130 made of titanium alloy, the thickness of the titanium desirably is less than about 1 mm, and more desirably less than about 0.3 mm. The candidate titanium alloys are not limited to Ti-6Al-4V, and the base metal of the alloy is not limited to Ti. Other materials or Ti alloys can be employed as desired. Examples include commercially pure (CP) grade Ti, aluminum and aluminum alloys, magnesium and magnesium alloys, and steel alloys.

Surface roughness can be imparted to the composite plate 5040 (notably to any surface thereof that will be adhesively bonded to the body of the club-head and/or to the metal cap 5130). In a first approach, a layer of textured film is placed on the composite plate 5040 before curing the film (e.g., "top" and/or "bottom" layers discussed above). An example of such a textured film is ordinary nylon fabric. Conditions under which the adhesives 5136, 5138 are cured normally do not degrade nylon fabric, so the nylon fabric is easily used for imprinting the surface topography of the nylon fabric to the surface of the composite plate. By imparting such surface roughness, adhesion of urethane or epoxy adhesive, such as 3M® DP 460, to the surface of the composite plate so treated is improved compared to adhesion to a metallic surface, such as cast titanium alloy.

In a second approach, texture can be incorporated into the surface of the tool used for forming the composite plate 5040, thereby allowing the textured area to be controlled precisely and automatically. For example, in an embodiment having a composite plate joined to a cast body, texture can be located on surfaces where shear and peel are dominant modes of failure.

Figure 28:
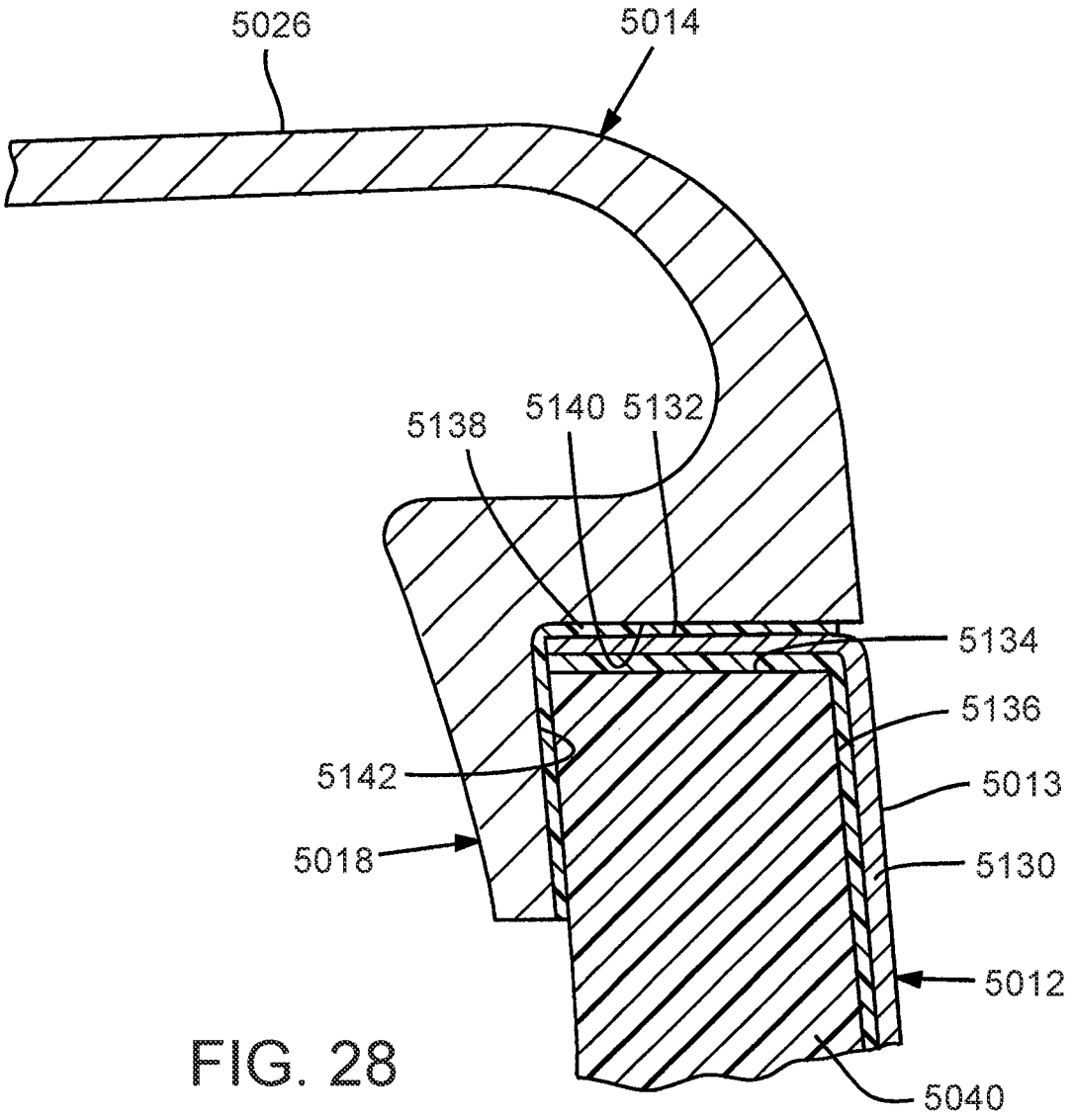
FIG. 28 is a partial sectional view of the upper lip region of an embodiment of a club-head of which the face plate comprises a composite plate and a metal cap.
Figure 29:
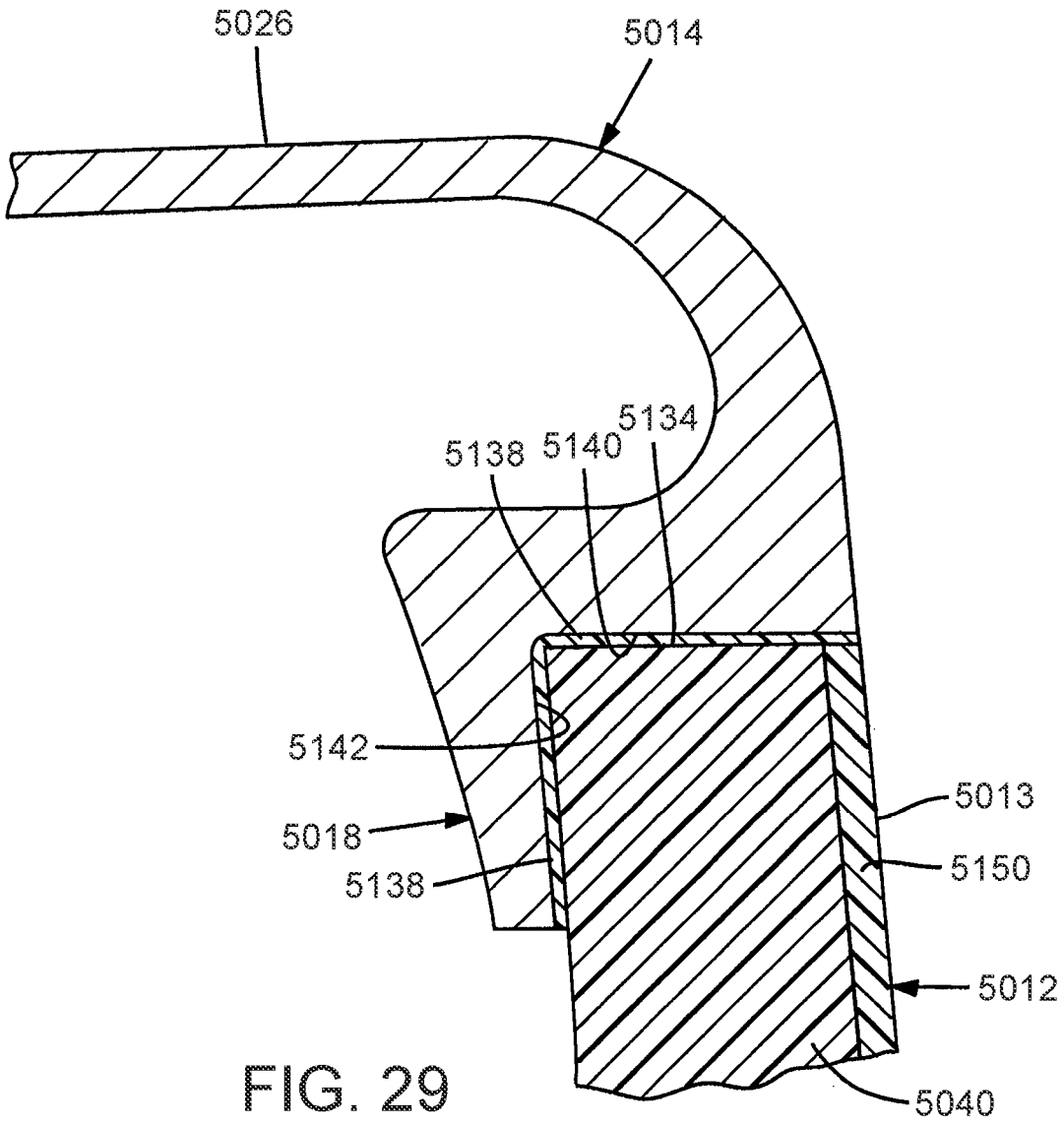
FIG. 29 is a partial sectional view of the upper lip region of an embodiment of a club-head of which the face plate comprises a composite plate and a polymeric outer layer.
Figure 31:
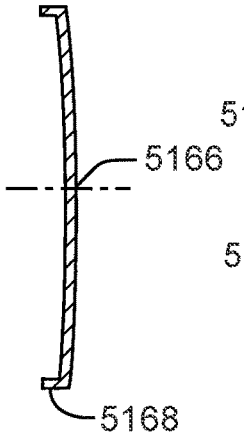
FIGS. 30-33 illustrate a metallic cover for a composite face plate.

FIG. 29 shows an embodiment similar to that shown in FIG. 28, with one difference being that in the embodiment of FIG. 19, the face plate 5012 includes a polymeric outer layer, or cap, 5150 on the front surface of the composite plate 5040 forming the striking surface 5013. The outer layer 5150 desirably completely covers at least the entire front surface of the composite plate 5040. A list of suitable polymers that can be used as an outer layer on a face plate is provide below. A particularly desirable polymer is urethane. For an outer layer 5150 made of urethane, the thickness of the layer desirably is in the range of about 0.2 mm to about 1.2 mm, with about 0.4 mm being a specific example. As shown, the face plate 5012 can be adhesively secured to the face support 5018 by an adhesive 5138 that completely fills the gap between the peripheral edge 5134 and the adjacent peripheral surface 5140 of the face support 5018 and the gap between the rear surface of the composite plate 5040 and the adjacent peripheral surface 5142 of the face support 5018.

The composite face plate as described above need not be coextensive (dimensions, area, and shape) with a typical face plate on a conventional club-head. Alternatively, a subject composite face plate can be a portion of a full-sized face plate, such as the area of the "sweet spot." Both such composite face plates are generally termed "face plates" herein. Further, the composite plate 5040 itself (without additional layers of material bonded or formed on the composite plate) can be used as the face plate 5012.

Example 1

In this example, a number of composite strike plates were formed using the strip approach described above in connection with FIGS. 12-19. A number of strike plates having a similar profile were formed using the partial ply approach described above. Five plates of each batch were sectioned and optically examined for voids. Table 1 below reports the yield of the examined parts. The yield is the percentage of parts made that did not contain any voids. As can be seen, the strip approach provided a much greater yield of parts without voids than the partial ply approach. The remaining parts of each batch were then subjected to endurance testing during which the parts were subjected to 3600 impacts at a ball speed of 50 m/s. As shown in Table 1, the parts made by the strip approach yielded a much higher percentage of parts that survived 3600 impacts than the parts made by the partial ply approach (72.73% vs. 52%). Table 1 also shows the average characteristic time (CT) (ball contact time with the strike plate) measured during the endurance test.

TABLE 1

| | Average Weight (g) | Yield (%) | CT (μs) | Pieces Tested | Number of Passing Parts | % of Passing Parts | Maximum Shots |
|---|---|---|---|---|---|---|---|
| Strip | 21.9 | 81 | 255 | 11 | 8 | 71.73 | 3600 |
| Partial Ply | 21.6 | 57.5 | 259 | 25 | 13 | 52 | 3600 |

Example 2

In this example, a number of composite strike plates were formed using the strip approach described above in connection with FIGS. 2-9. A number of strike plates having a similar profile were formed using the partial ply approach above. Five plates of each batch were sectioned and optically examined for voids. Table 2 below reports the yield of the parts formed by both methods. As in Example 1, the strip approach provided a much greater yield of parts without voids than the partial ply approach (90% vs. 70%). The remaining parts of each batch were then subjected to endurance testing during which the parts were subjected to 3600 impacts at a ball speed of 42 m/s. At this lower speed, all of the tested parts survived 3600 impacts.

TABLE 2

| | Average Weight (g) | Yield (%) | CT (μs) | Pieces Tested | Number of Passing Parts | % of Passing Parts | Maximum Shots |
|---|---|---|---|---|---|---|---|
| Strip | 22 | 90 | 255 | 11 | 11 | 100 | 3600 |
| Partial Ply | 21.5 | 70 | 258 | 16 | 16 | 100 | 3600 |

The methods described above provide improved structural integrity of the face plates and other club-head components manufactured according to the methods, compared to composite component manufactured by prior-art methods.

These methods can be used to fabricate face plates for any of various types of clubs, such as (but not limited to) irons, wedges, putter, fairway woods, etc., with little to no process-parameter changes.

The subject methods are especially advantageous for manufacturing face plates because face plates are the most severely loaded components in golf club-heads. If desired, conventional (and generally less expensive) composite-processing techniques (e.g., bladder-molding, etc.) can be used to make other parts of a club-head not subject to such severe loads.

Moreover, the methods for fabricating composite parts described herein can be used to make various other types of composite parts, and in particular, parts that are subject to high impact loads and/or repetitive loads. Some examples of such parts include, without limitation, a hockey stick (e.g., the blade of a stick), a bicycle frame, a baseball bat, and a tennis racket, to name a few.

Example 3

Figure 30:
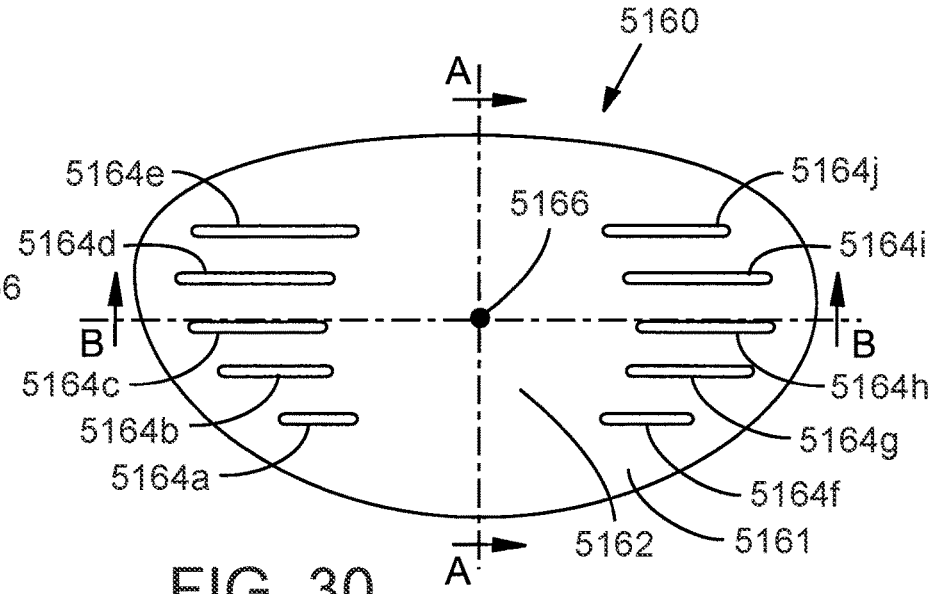
Figure 32:
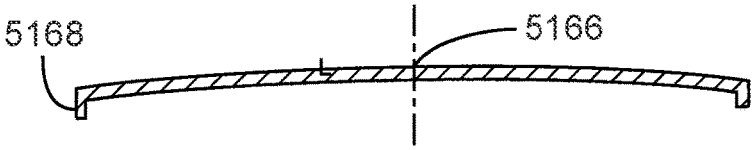

As shown in FIGS. 28-29, a metallic cover can be provided so that a golf club striking plate includes a composite face plate and a metallic striking surface that tends to be wear resistant. A representative metallic cover 5160 is illustrated in detail in FIGS. 30-33. Referring to FIG. 30, the metallic cover 5160 provides a striking surface 5161 that includes a central striking region 5162 and a plurality of contrasting scorelines 5164 *a*-5164 *j* that are associated with respective dents, depressions, or indentations in the metallic cover that are generally filled with a contrasting pigment or paint such as white paint. Scorelines generally extend along an axis parallel to a toe-to-heel direction. In a representative example, scorelines have lengths of between about 6 mm and 14 mm, with scoreline lengths larger toward a golf club crown. The scorelines are spaced about 6-7 mm apart in a top-to-bottom direction. The arrangement of FIG. 30 is one example, and other arrangements can be used.

The metallic cover 5160 is generally made of a titanium alloy or other metal such as those mentioned above, and has a bulge/roll center 5166 for bulge and roll curvatures that are provided to control club performance. Centers of curvature for bulge/roll curvatures are typically situated on an axis that is perpendicular to the striking surface 5161 at the bulge/roll center 5166. In this example, innermost edges of the scorelines 5164 *a*-5164 *j* are situated along a circumference of a circle having a diameter of about 40-50 mm that is centered at the bulge/roll center 5166. As shown in the sectional view of FIG. 31, a "roll" radius of curvature (a top-to-bottom radius of curvature) is about 300 mm and is symmetric about the bulge/roll center. As shown in the sectional view of FIG. 32, a "bulge" radius of curvature (a toe-to-heel radius of curvature) is about 410 mm and is symmetric about the bulge/roll center 5166. Bulge and roll curvatures can be spherical or circular curvatures, but other curvatures such as elliptical, oval, or other curvatures can be provided. In this example, a rim 5168 is provided and is intended to at least partially cover an edge of a composite faceplate to which the metallic cover 5160 is attached.

Figure 33:
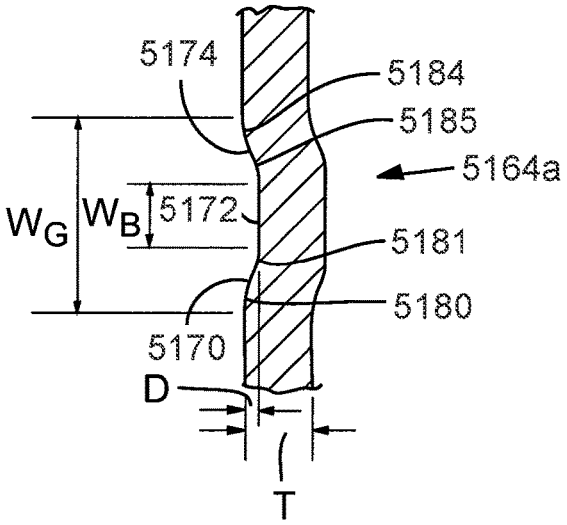
Figure 34:
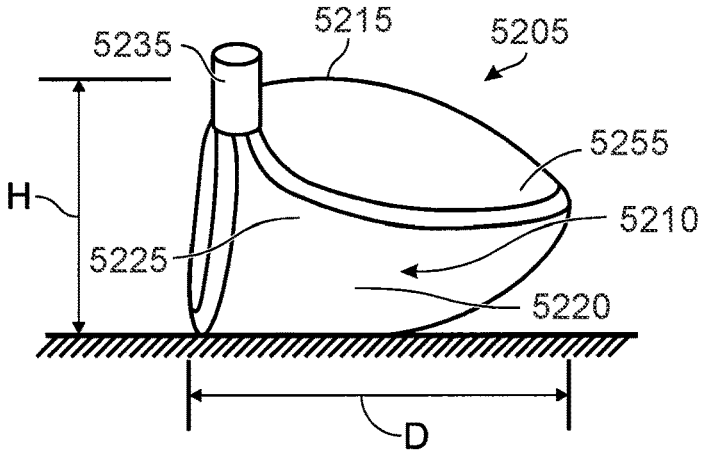
FIG. 34 is a side perspective view of a wood-type golf club head.
Figure 35:
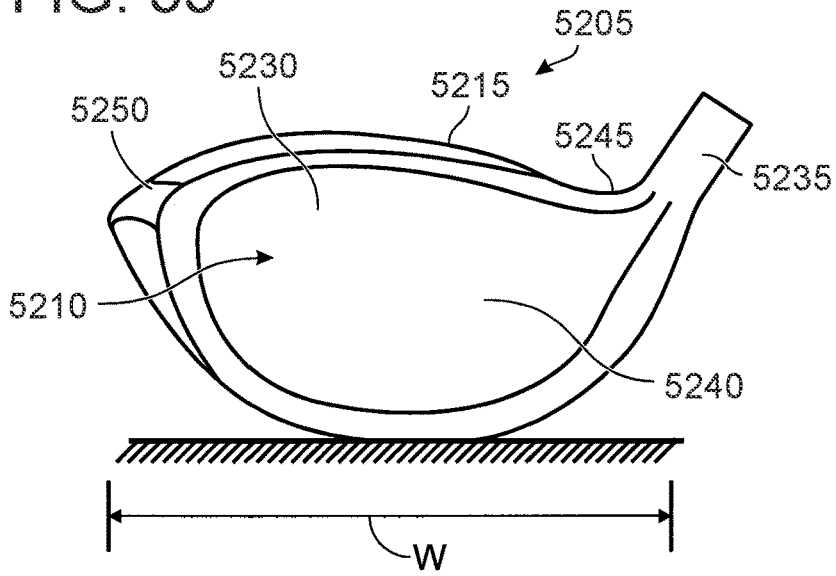
FIG. 35 is a front perspective view of a wood-type golf club head.
Figure 36:
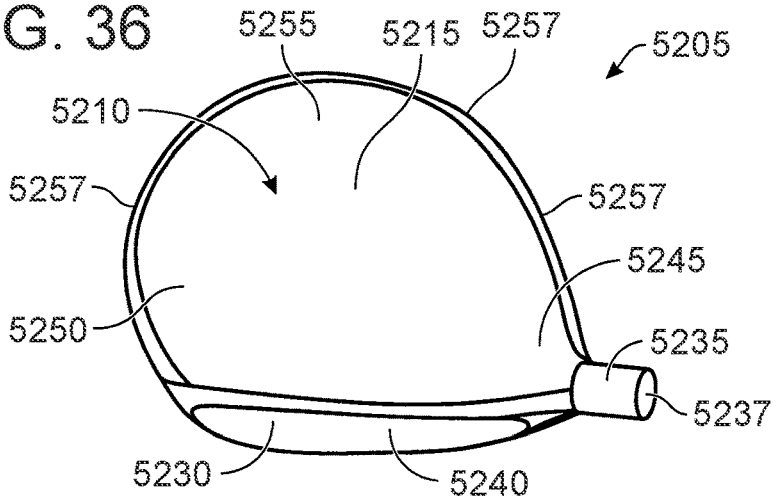
FIG. 36 is a top perspective view of a wood-type golf club head.
Figure 37:
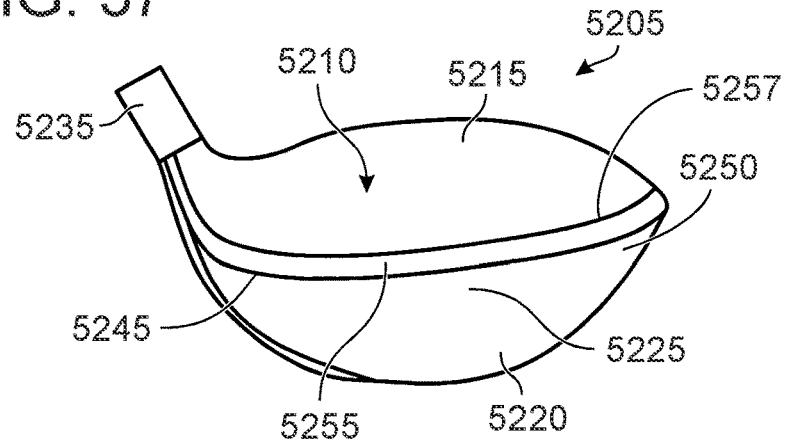
FIG. 37 is a back perspective view of a wood-type golf club head.

The striking region 5162 can be roughened by sandblasting, bead blasting, sanding, or other abrasive process or by a machining or other process. The scorelines 5164 *a*-5164 *j* are situated outside of the intended striking region 5162 and are generally provided for visual alignment and do not typically contribute to ball trajectory. A cross-section of a representative scoreline 5164 *a* is shown in FIG. 33 (paint or other pigment is not shown). The scoreline 5164 *a* is provided as an indentation in the cover 5160 and includes transition portions 5170, 5174 and a bottom portion 5172. For a thin cover plate (thickness less than about 1.0 mm, 0.5 mm, 0.3 mm, or 0.2 mm), the scoreline 5164 *a* can be formed by pressing a correspondingly shaped tool against a sheet of a selected cover plate material. An overall curvature for the cover 5160 can also be provided in the same manner based on a bulge and roll of a face plate such as a composite face plate to which the cover 5160 is to be applied. For a typical cover thickness, indented scorelines are associated with corresponding protruding features on a rear surface 5176 of the cover 5160. In this example, the scoreline 5164 *a* has a depth D of about 0.07 mm in a cover having a thickness T of about 0.30 mm. A width WB of the bottom portion 5172 is about 0.29 mm, and a width WG of the entire indent is about 0.90 mm. The transition portions 5170, 5174 have inner and outer radiused regions 5181, 5185 and 5180, 5184, respectively, having respective radii of curvature of about 0.40 mm and 0.30 mm.

In other examples, a cover can be between about 0.10 mm and 1.0 mm thick, between about 0.2 mm and 0.8 mm thick, or between about 0.3 mm and 0.5 mm thick. Indentation depths between about 0.02 mm and 0.12 mm or about 0.06 mm and 0.10 mm are generally preferred for scoreline definition. Impact resistant cover plates with scorelines generally have scoreline depths D and cover plate thicknesses T such that a ratio D/T is less than about 0.4, 0.3, 0.25, or 0.20. A ratio WB/T is typically between about 0.5 and 1.5, 0.75 and 1.25, or 0.9 and 1.1. A ratio WG/T is typically between about 1 and 5, 2 and 4, or 2.5 and 3.5. A ratio of transition region radii of curvature R to cover thickness T is typically between about 0.5 and 1.5, 0.67 and 1.33, or 0.75 and 1.33. While it is convenient to provide scorelines based on common indentation depths, scorelines on a single cover can be based on indentations of one or more depths.

For wood-type golf clubs, an impact area is based on areas associated with inserts used in traditional wood golf clubs. For irons, an impact area is a portion of the striking surface within 20 mm on either side of a vertical centerline, but does not include 6.35 mm wide strips at the top and bottom of the striking surface. For wood-type golf clubs, scorelines are generally provided in a cover so as to be situated exterior to an impact region. The disclosed covers with scorelines are sufficiently robust for placement within or without an impact region for either wood or iron type golf clubs.

A cover is generally formed from a sheet of cover stock that is processed so as to have a bulge/roll region that includes the necessary arrangement of scoreline dents. The formed cover stock is then trimmed to fit an intended face plate, and attached to the face plate with an adhesive. Typically a glue layer is situated between the cover and the face plate, and the cover and face plate are urged together so as to form an adhesive layer of a suitable thickness. For typical adhesives, layer thicknesses between about 0.05 mm and 0.10 mm are preferred. Once a suitable layer thickness is achieved, the adhesive can be cured or allowed to set. In some cases, the cover includes a cover lip or rim as well so as to cover a face plate perimeter. The scoreline indentations are generally filled with paint of a color that contrasts with the remainder of the striking surface.

Although the scorelines are provided to realize a particular appearance in a finished product, the indentations used to define the scorelines also serve to control adhesive thickness. As a cover plate and a face plate are urged together in a gluing operation, the rear surface protrusions associated with the indentations tend to approach the face plate and thus regulate an adhesive layer thickness. Accordingly, indentation depth can be selected not only to retain paint or other pigment on a striking face, but can also based on a preferred adhesive layer thickness. In some examples, protruding features of indentations in a cover plate are situated at distances of less than about 0.10 mm, 0.05 mm, 0.03 mm, and 0.01 mm from a face plate surface as an adhesive layer thickness is established.

In other examples, the indent-based scorelines shown in FIGS. 30-33 can be replaced with grooves that are punched, machined, etched or otherwise formed in a cover plate sheet. Indentations are generally preferable as gluing operations based on indented plates are not generally associated with adhesive transfer to the striking surface. In addition, striking plates made with dented metallic covers tend to be more stable in long term use than cover plates that have been machined or punched. Scoreline or indent dimensions (length, depth, and transition region dimensions and curvatures) as well as scoreline or indentation location on a striking surface are preferably selected based on a selected cover material or cover material thickness. Fabrication methods (such as punching, machining) tend to produce cover plates that are more likely to show wear under impact endurance testing in which a finished striking plate is subject to the forces associated with 3000 shots by, for example, forming a club head with a striking plate under test, and making 3000 shots with the club head. A cover that performs successfully under such testing without degradation is referred as an impact-resistant cover plate.

In alternative embodiments, a cover includes a plurality of slots situated around a striking region. A suitably colored adhesive can be used to secure the cover layer to a face plate so that the adhesive fills the slots or is visible through the slots so to provide visible orientation guides on the striking plate surface.

Example 4

Polymer or other surface coatings or surface layers can be provided to composite or other face plates to provide performance similar to that of conventional irons and metal type woods. Such surface layers, methods of forming such layers, and characterization parameters for such layers are described below.

Surface Texture and Roughness

Surface textures or roughness can be conveniently characterized based a surface profile, i.e., a surface height as a function of position on the surface. A surface profile is typically obtained by interrogating a sample surface with a stylus that is translated across the surface. Deviations of the stylus as a function of position are recorded to produce the surface profile. In other examples, a surface profile can be obtained based on other contact or non-contact measurements such as with optical measurements. Surface profiles obtained in this way are often referred to as "raw" profiles. Alternatively, surface profiles for a golf club striking surface can be functionally assessed based on shot characteristics produced when struck with surfaces under wet conditions.

For convenience, a control layer is defined as a striking face cover layer configured so that shots are consistent under wet and dry playing conditions. Generally, satisfactory roughened or textured striking surfaces (or other control surfaces) provide ball spins of at least about 2000 rpm, 2500 rpm, 3000 rpm, or 3500 rpm under wet conditions when struck with club head speeds of between about 75 mph and 120 mph. Such control surfaces thus provide shot characteristics that are substantially the same as those obtained with conventional metal woods. Stylus or other measurement based surface roughness characterizations for such control surfaces are described in detail below.

A surface profile is generally processed to remove gradual deviations of the surface from flatness. For example, a wood-type golf club striking face generally has slight curvatures from toe-to-heel and crown-to-sole to improve ball trajectory, and a "raw" surface profile of a striking surface or a cover layer on the striking surface can be processed to remove contributions associated with these curvatures. Other slow (i.e., low spatial frequency) contributions can also be removed by such processing. Typically features of size of about 1 mm or greater (or spatial frequencies less than about 1/mm) can be removed by processing as the contributions of these features to ball spin about a horizontal or other axis tend to be relatively small. A raw (unprocessed) profile can be spatially filtered to enhance or suppress high or low spatial frequencies. Such filtering can be required in some measurements to conform to various standards such as DIN or other standards. This filtering can be performed using processors configured to execute a Fast Fourier Transform (FFT).

Generally, a patterned roughness or texture is applied to a substantial portion of a striking surface or at least to an impact area. For wood-type golf clubs, an impact area is based on areas associated with inserts used in traditional wood golf clubs. For irons, an impact area is a portion of the striking surface within 20 mm on either side of a vertical centerline, but does not include 6.35 mm wide strips at the top and bottom of the striking surface. Generally, such patterned roughness need not extend across the entire striking surface and can be provided only in a central region that does not extend to a striking surface perimeter. Typically for hollow metal woods, at least some portions of the striking surface at the striking surface perimeter lack pattern roughness in order to provide an area suitable for attachment of the striking plate to the head body.

Striking surface roughness can be characterized based on a variety of parameters. A surface profile is obtained over a sampling length of the striking surface and surface curvatures removed as noted above. An arithmetic mean Ra is defined a mean value of absolute values of profile deviations from a mean line over a sampling length of the surface. For a surface profile over the sampling length that includes N surface samples each of which is associated with a mean value of deviations Yi, from the mean line, the arithmetic mean Ra is:

$$R_a = \frac{1}{N}\sum_{i=1}^{N}|Y_i|,$$

wherein i is an integer i=1, . . . , N. The sampling length generally extends along a line on the striking surface over a substantial portion or all of the striking area, but smaller samples can be used, especially for a patterned roughness that has substantially constant properties over various sample lengths. Two-dimensional surface profiles can be similarly used, but one dimensional profiles are generally satisfactory and convenient. For convenience, this arithmetic mean is referred to herein as a mean surface roughness.

A surface profile can also be further characterized based on a reciprocal of a mean width Sm of the profile elements. This parameter is used and described in one or more standards set forth by, for example, the German Institute for Standardization (DIN) or the International Standards Organization (ISO). In order to establish a value for Sm, an upper count level (an upward surface deviation associated with a peak) and a lower count level (a downward surface deviation associated with a valley) are defined. Typically, the upper count level and the lower count level are defined as values that are 5% greater than the mean line and 5% less than the mean line, but other count levels can be used. A portion of a surface profile projecting upward over the upper count level is called a profile peak, and a portion projecting downward below the given lower count level is called a profile valley. A width of a profile element is a length of the segment intersecting with a profile peak and the adjacent profile valley. Sm is a mean of profile element widths Smi within a sampling length:

$$S_m = \frac{1}{K}\sum_{i=1}^{K} S_{mi}$$

For convenience, this mean is referred to herein as a mean surface feature width.

In determining Sm, the following conditions are generally satisfied: 1) Peaks and valleys appear alternately; 2) An intersection of the profile with the mean line immediately before a profile element is the start point of a current profile element and is the end point of a previous profile element; and 3) At the start point of the sampling length, if either of the profile peak or profile valley is missing, the profile element width is not taken into account. Rpc is defined as a reciprocal of the mean width Sm and is referred to herein as mean surface feature frequency.

Another surface profile characteristic is a surface profile kurtosis Ku that is associated with an extent to which profile samples are concentrated near the mean line. As used herein, a the profile kurtosis Ku is defined as:

$$Ku = \frac{1}{R_q^4} \square \frac{1}{N}\sum_{i=1}^{N}(Y_i)^4,$$

wherein Rq a square root of the arithmetic mean of the squares of the profile deviations from the mean line, i.e., $$R_q = \left(\frac{1}{N}\sum_{i=1}^{N} Y_i^2\right)^{1/2}.$$

Profile kurtosis is associated with an extent to which surface features are pointed or sharp. For example, a triangular wave shaped surface profile has a kurtosis of about 0.79, a sinusoidal surface profile has a kurtosis of about 1.5, and a square wave surface profile has a kurtosis of about 1.

Other parameters that can be used to characterize surface roughness include Rz which is based on a sum of a mean of a selected number of heights of the highest peaks and a mean of a corresponding number of depths of the lowest valleys.

One or more values or ranges of values can be specified for surface kurtosis Ku, mean surface feature width Sm, and arithmetic mean deviation Ra (mean surface roughness) for a particular golf club striking surface. Superior results are generally obtained with Ra≤5 μm, Rpc≥30/cm, and Ku≥2.0.

Wood-Type Club Heads

For convenient illustration, representative examples of striking plates and cover layers for such striking plates are set forth below with reference to wood-type golf clubs. In other examples, such striking plates can be used in iron-type golf clubs. In some examples, face plate cover layers are formed on a surface of a face plate in a molding process, but in other examples surface layers are provided as caps that are formed and then secured to a face plate.

As illustrated in FIGS. 34-37, a typical wood type (i.e., driver or fairway wood) golf club head 5205 includes a hollow body 5210 delineated by a crown 5215, a sole 5220, a skirt 5225, a striking plate 5230, and a hosel 5235. The striking plate 5230 defines a front surface, or striking face 5240 adapted for impacting a golf ball (not shown). The hosel 5235 defines a hosel bore 5237 adapted to receive a golf club shaft (not shown). The body 5210 further includes a heel portion 5245, a toe portion 5250 and a rear portion 5255. The crown 5215 is defined as an upper portion of the club head 5005 extending above a peripheral outline 5257 of the club head as viewed from a top-down direction and rearwards of the topmost portion of the striking face 5240. The sole 5220 is defined as a lower portion of the club head 5205 extending in an upwardly direction from a lowest point of the club head approximately 50% to 60% of the distance from the lowest point of the club head to the crown 5215. The skirt 5225 is defined as a side portion of the club head 5205 between the crown 5215 and the sole 5220 extending immediately below the peripheral outline 5257 of the club head, excluding the striking face 5240, from the toe portion 5250, around the rear portion 5255, to the heel portion 5245. The club head 5205 has a volume, typically measured in cubic-centimeters ($cm^3$), equal to the volumetric displacement of the club head 5205.

Figure 38:
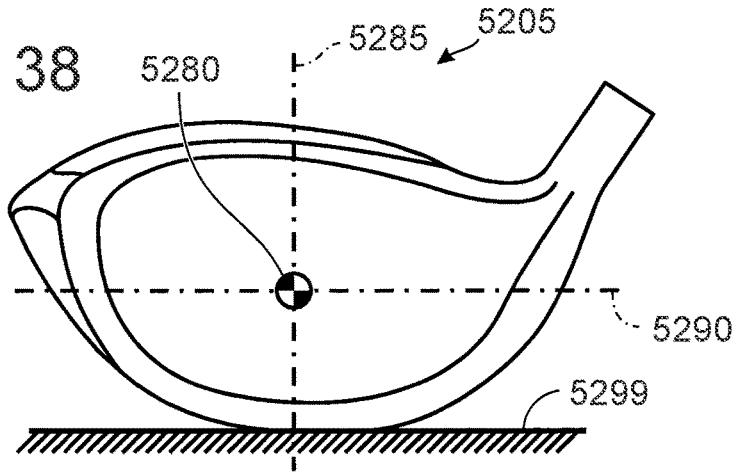
FIG. 38 is a front perspective view of a wood-type golf club head showing a golf club head center of gravity coordinate system.
Figure 39:
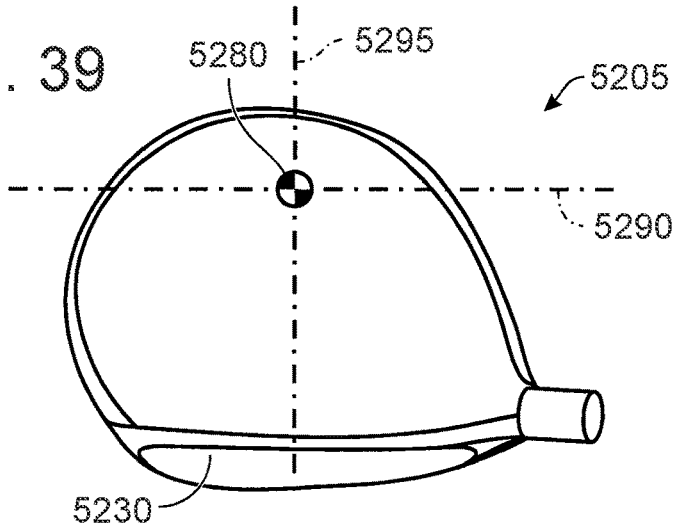
FIG. 39 is a top perspective view of a wood-type golf club head showing a golf club head center of gravity coordinate system.
Figure 40:
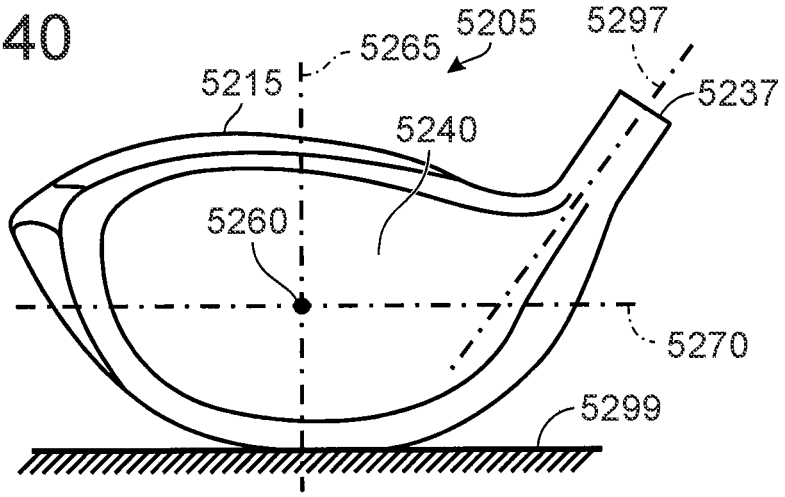
FIG. 40 is a front perspective view of a wood-type golf club head showing a golf club head origin coordinate system.
Figure 41:
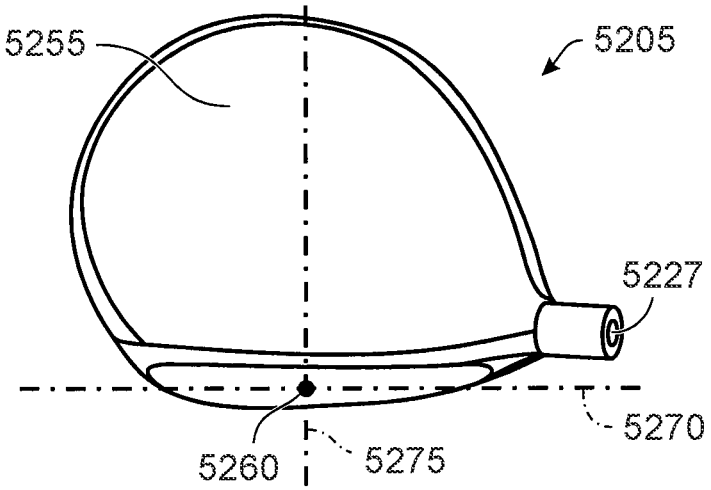
FIG. 41 is a top perspective view of a wood-type golf club head showing a golf club head origin coordinate system.

Referencing FIGS. 38-39, club head coordinate axes can be defined with respect to a club head center-of-gravity (CG) 5280. A $CG_Z$-axis 5285 extends through the CG 5280 in a generally vertical direction relative to the ground 5299 when the club head 5205 is at address position. A CGx-axis 5290 extends through the CG 5280 in a heel-to-toe direction generally parallel to the striking face 5240 and generally perpendicular to the $CG_Z$-axis 5285. A $CG_Y$-axis 5095 extends through the CG 5280 in a front-to-back direction and generally perpendicular to the CGx-axis 5290 and the $CG_Z$-axis 5285. The CGx-axis 5290 and the $CG_Y$-axis 5295 both extend in a generally horizontal direction relative to the ground when the club head 5005 is at address position. The polymer coated or capped striking plates described herein generally provide 2-15 g of additional distributable mass so that placement of the CG 5280 can be selected using this mass.

A club head origin coordinate system can also be used. Referencing FIGS. 40-41, a club head origin 5260 is represented on club head 5205. The club head origin 5260 is positioned at an approximate geometric center of the striking face 5240 (i.e., the intersection of the midpoints of the striking face's height and width, as defined by the USGA "Procedure for Measuring the Flexibility of a Golf Clubhead," Revision 2.0).

The head origin coordinate system, with head origin 5260, includes three axes: a z-axis 5265 extending through the head origin 5260 in a generally vertical direction relative to the ground 5100 when the club head 5205 is at address position; an x-axis 5270 extending through the head origin 5060 in a heel-to-toe direction generally parallel to the striking face 5240 and generally perpendicular to the z-axis 5265; and a y-axis 5275 extending through the head origin 5260 in a front-to-back direction and generally perpendicular to the x-axis 5270 and the z-axis 5265. The x-axis 5270 and the y-axis 5275 both extend in a generally horizontal direction relative to the ground 5299 when the club head 5205 is at address position. The x-axis 5270 extends in a positive direction from the origin 5260 to the toe 5250 of the club head 5205; the y-axis 5275 extends in a positive direction from the origin 5260 towards the rear portion 5255 of the club head 5205; and the z-axis 5265 extends in a positive direction from the origin 5260 towards the crown 5215.

In a club-head according to one embodiment, a striking plate includes a face plate and a cover layer. In addition, in some examples, at least a portion of the face plate is made of a composite including multiple plies or layers of a fibrous material (e.g., graphite, or carbon, fiber) embedded in a cured resin (e.g., epoxy). Examples of suitable polymers that can be used to form the cover layer include, without limitation, urethane, nylon, SURLYN ionomers, or other thermoset, thermoplastic, or other materials. The cover layer defines a striking surface that is generally a patterned, roughened, and/or textured surface as described in detail below. Striking plates based on composites typically permit a mass reduction of between about 5 g and 20 g in comparison with metal striking plates so that this mass can be redistributed.

Figure 44:
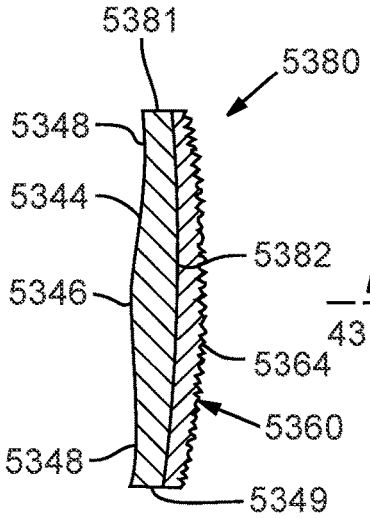
FIGS. 42-44 illustrate a striking plate that includes a face plate and a cover layer having a striking surface with a patterned roughness.
Figure 42:
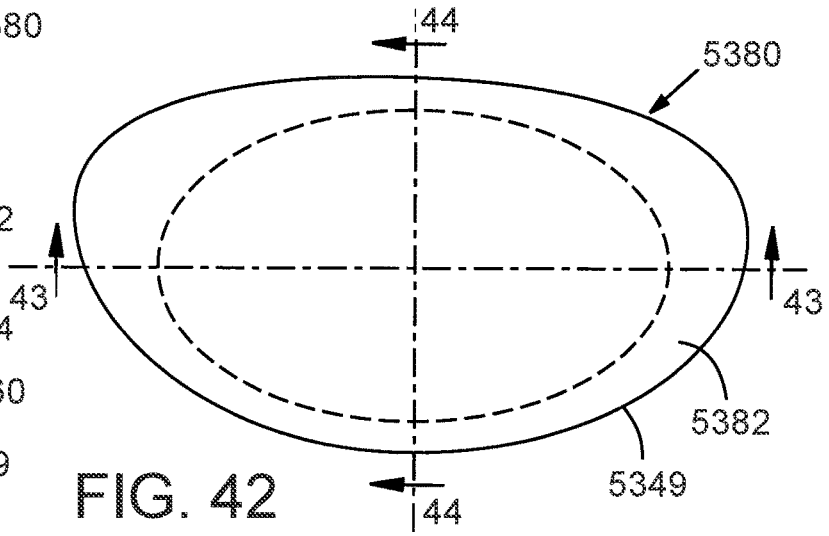
Figure 43:
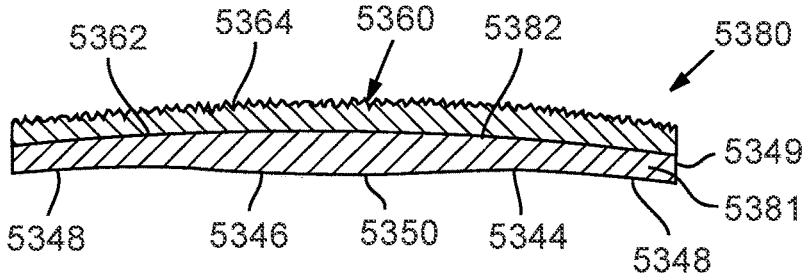

In the example shown in FIGS. 42-44, a striking plate 5380 includes a face plate 5381 fabricated from a plurality of prepreg plies or layers and has a desired shape and size for use in a club-head. The face plate 5381 has a front surface 5382 and a rear surface 5344. In this example, the face plate 5381 has a slightly convex shape, a central region 5346 of increased thickness, and a peripheral region 5348 having a relatively reduced thickness extending around the central region 5346. The central region 5346 in the illustrated example is in the form of a projection or cone on the rear surface having its thickest portion at a central point 5350 and gradually tapering away from the point in all directions toward the peripheral region 5348. The central point 5350 represents the approximate center of the "sweet spot" (optimal strike zone) of the striking plate 5380, but not necessarily the geometric center of the face plate 5381. The thicker central region 5348 adds rigidity to the central area of the face plate 5381, which effectively provides a more consistent deflection across the face plate. In certain embodiments, the face plate 5381 is fabricated by first forming an oversized a lay-up of multiple prepreg plies that are subsequently trimmed or otherwise machined.

As shown in FIGS. 43-44, a cover layer 5360 is situated on the front surface 5382 of the face plate 5381. The cover layer 5360 includes a rear surface 5362 that is typically conformal with and bonded to the front surface 5382 of the face plate 5381, and a striking surface 5364 that is typically provided with patterned roughness so as to control or select a shot characteristic so as to provide performance similar to that obtained with conventional club construction. The cover layer 5360 can be formed of a variety of polymers such as, for example, SURLYN ionomers, urethanes, or others. Representative polymers are disclosed in U.S. patent application Ser. No. 11/685,335, filed Mar. 13, 2007 and patent application Ser. No. 11/809,432, filed May 31, 2007 that are incorporated herein by reference. These polymers are discussed with reference to golf balls, but are also suitable for use in striking plates as described herein. In some examples, the cover layer 5360 can be co-cured with the prepreg layers that form the face plate 5381. In other examples, the cover layer 5360 is formed separately and then bonded or glued to the face plate 5381. The cover layer 5362 can be selected to provide wear resistance or ultraviolet protection for the face plate 5381, or to include a patterned striking surface that provides consistent shot characteristics during play in both wet and dry conditions. Typically, surface textures and/or patterning are configured so as to substantially duplicate the shot characteristics achieved with conventional wood clubs or metal wood type clubs with metallic striking plates. To enhance wear resistance, a Shore D hardness of the cover layer 5360 is preferably sufficient to provide a striking face effective hardness with the polymer layer applied of at least about 75, 80, or 85. In typical examples, a thickness of the cover layer 5360 is between about 0.1 mm and 3.0 mm, 0.15 mm and 2.0 mm, or 0.2 mm and 1.2 mm. In some examples, the cover layer 5360 is about 0.4 mm thick.

Club face hardness or striking face hardness is generally measured based on a force required to produce a predetermined penetration of a probe of a standard size and/or shape in a selected time into a striking face of the club, or a penetration depth associated with a predetermined force applied to the probe. Based on such measurements, an effective Shore D hardness can be estimated. For the club faces described herein, the Shore D hardness scale is convenient, and effective Shore D hardnesses of between about 75 and 90 are generally obtained. In general, measured Shore D values decrease for longer probe exposures. Club face hardnesses as described herein are generally based on probe penetrations sufficient to produce an effective hardness estimate (an effective Shore D value) that can be associated with shot characteristics substantially similar to conventional wood or metal wood type golf clubs. The effective hardness generally depends on faceplate and polymer layer thicknesses and hardnesses.

Figure 45:
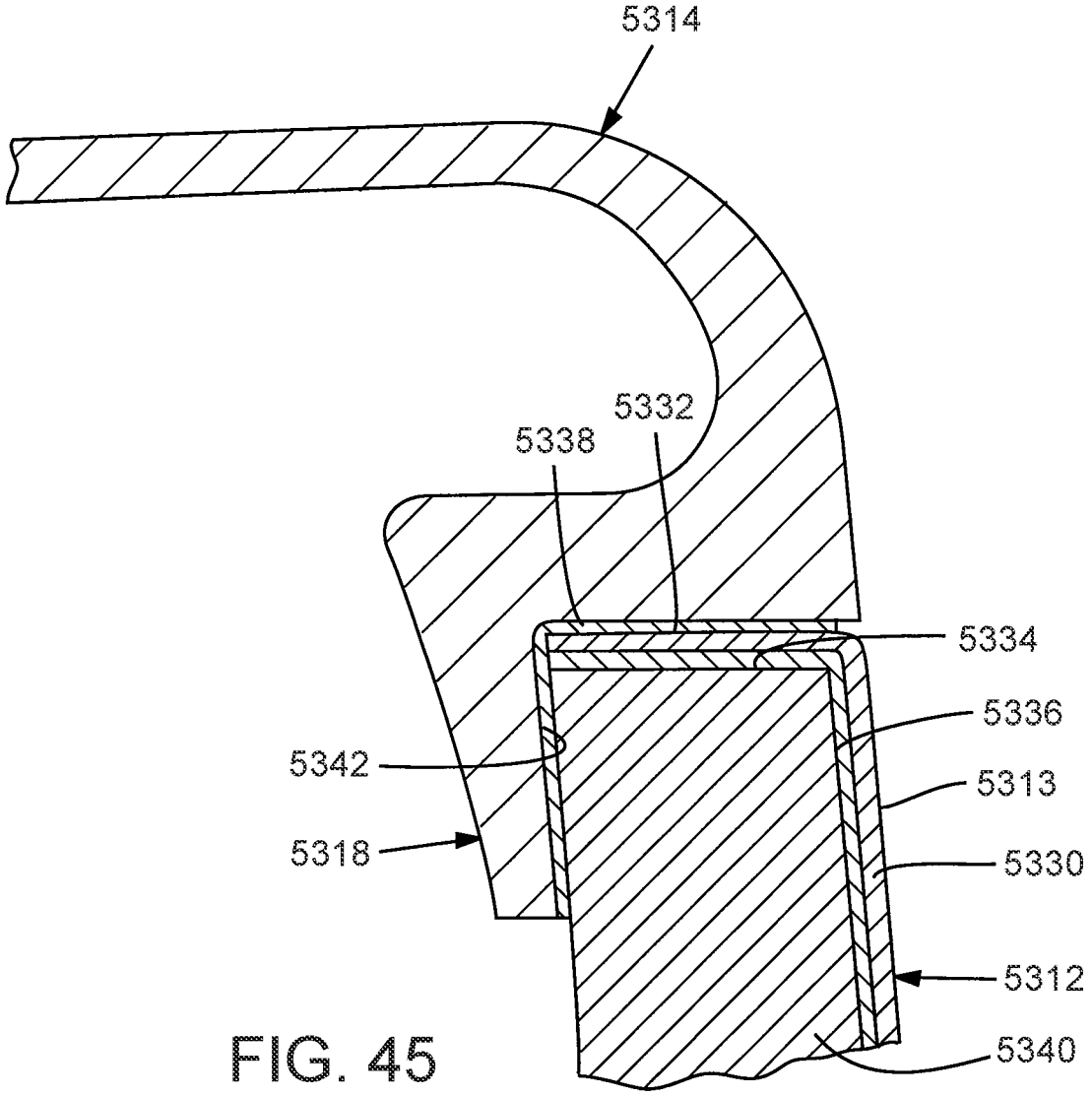
FIG. 45 illustrates attachment of a striking plate comprising a face plate and a cover layer to a club body.

As shown in FIG. 45, a striking plate 5312 comprises a cover layer 5330 formed or placed over a composite face plate 5340 to form a striking surface 5313. In other examples, the cover layer 5330 can include a peripheral rim that covers a peripheral edge 5334 of the composite face plate 5340. The rim 5332 can be continuous or discontinuous, the latter comprising multiple segments (not shown). The cover layer 5330 can be bonded to the composite plate 5340 using a suitable adhesive 5336, such as an epoxy, polyurethane, or film adhesive, or otherwise secured. The adhesive 5336 is applied so as to fill the gap completely between the cover layer 5330 and the composite plate 5340 (this gap is usually in the range of about 0.05-0.2 mm, and desirably is less than approximately 0.05 mm). Typically the cover layer 5330 is formed directly on the face plate, and the adhesive 5336 is omitted. The striking plate 5312 desirably is bonded to a club body 5314 using a suitable adhesive 5338, such as an epoxy adhesive, which completely fills the gap between the rim 5332 and the adjacent peripheral surface 5338 of the face support 5318 and the gap between the rear surface of the composite plate 5340 and the adjacent peripheral surface 5342 of the face support 5318. In the example of FIG. 45, the cover layer 5330 extends at least partially around a faceplate edge, but in other examples, a cover layer is situated only on an external surface of the face plate. As used herein, an external surface of a face plate is a face plate surface directed towards a ball in normal address position. In conventional metallic striking plates that consist only of a metallic face plate, the external surface is the striking surface.

Cover layers such as the cover layer 5330 can be formed and secured to a face plate using various methods. In one example, a striking surface of a cover layer is patterned with a mold. A selected roughness pattern is etched, machined, or otherwise transferred to a mold surface. The mold surface is then used to shape the striking surface of the cover layer for subsequent attachment to a composite face plate or other face plate. Such cover layers can be bonded with an adhesive to the face plate. Alternatively, the mold can be used to form the cover layer directly on the composite part. For example, a layer of a thermoplastic material (or pellets or other portions of such a material) can be situated on an external surface of a face plate, and the mold pressed against the thermoplastic material and the face plate at suitable temperatures and pressures so as to impress the roughness pattern on a thermoplastic layer, thereby forming a cover layer with a patterned surface. In another example, a thermoset material can be deposited on the external surface of the cover plate, and the mold pressed against the thermoset material and the face plate to provide a suitable cover layer thickness. The face plate, the thermoset material, and the mold are then raised to a suitable temperature so as to cure or otherwise fix the shape and thickness of the cover layer. These methods are examples only, and other methods can be used as may be convenient for various cover materials.

In another method, a layer of a so-called "peel ply" fabric is bonded to an exterior surface of a composite face plate (preferably as the face plate is fabricated) or to a striking surface on a polymer cover layer. In some examples, a thermoset material is used for the cover layer, while in other examples thermoplastic materials are used. With either type of material, the peel ply fabric is removably bonded to the cover layer (or to the face plate). The peel ply fabric is removed from the cover layer, leaving a textured or roughened striking surface. A striking surface texture can be selected based upon peel ply fabric texture, fabric orientation, and fiber size so as to achieve surface characteristics comparable to conventional metal woods and irons.

A representative peel ply based process is illustrated in FIGS. 50-52. A portion of a peel ply fabric 5602 is oriented so the woven fibers in the fabric are along an x-axis 5604 and a z-axis 5606 based on an eventual striking plate orientation in a finished club. In other examples, different orientations can be used. Peel ply fabric weave is not generally or necessarily the same along the warp and the weft directions, and in some examples, the warp and weft are aligned preferentially along selected directions. As shown in FIG. 51, a resulting striking plate 5610 includes a face plate 5612 and a cover layer 5614 that has a textured striking surface 5616. A portion of the textured striking surface 5616 is shown in FIG. 52 to illustrate the surface texture based on surface peaks 5618 that are separated by about 0.27 mm and having a height H of about 0.03 mm. In the example of FIGS. 50-52, the cover layer 5610 is about 0.5 mm thick.

Figure 53:
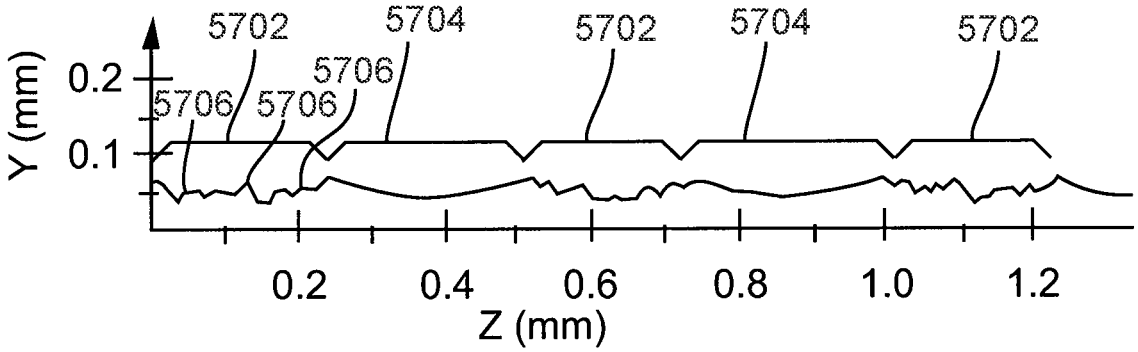
FIGS. 53-54 are surface profiles of a representative textured striking surface of polymer layer produced with a peel ply fabric.
Figure 54:
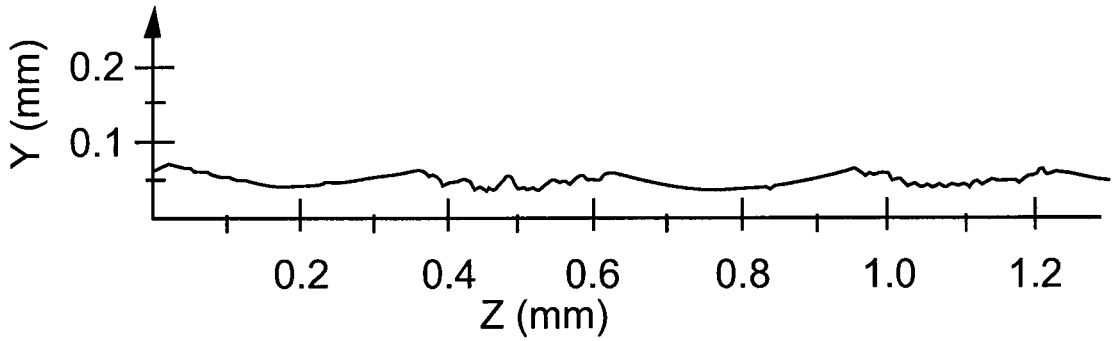
Figure 55:
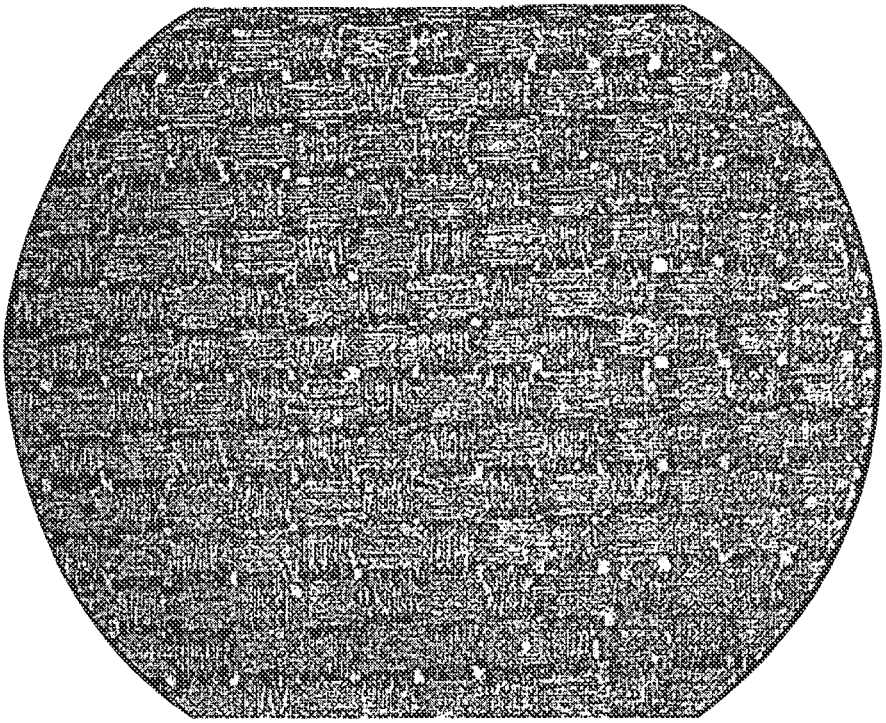
FIG. 55 is a photograph of a portion of a peel ply fabric textured surface.

Representative surface profiles of peel ply based striking surfaces are shown in FIGS. 53-54. FIG. 53 is portion of a toe-to-heel surface profile scan performed with a stylus-based surface profilometer as described further detail above. Relatively rough profile portions 5702 are separated by profile portions 5704 that correspond to more gradual surface curvatures. A plurality of peaks 5706 in the rough profile portions 5702 appear to correspond to a stylus crossing over features defined by individual peel ply fabric fibers. The smoother portions 5704 appear to correspond to stylus scanning along a feature that is defined along a fiber direction. Surface peaks have a periodic separation of about 0.5 mm and a height of about 20-30 μm. FIG. 54 is a portion of a similar scan to that of FIG. 53 but along a top-to-bottom direction. Relatively smooth and rough areas alternate, and peak spacing is about 0.6 mm, slightly larger than that in the toe-to-heel direction, likely due to differing fiber spacings in peel ply fabric warp and weft. FIG. 55 is a photograph of a portion of a striking surface formed with a peel ply fabric.

Figure 56:
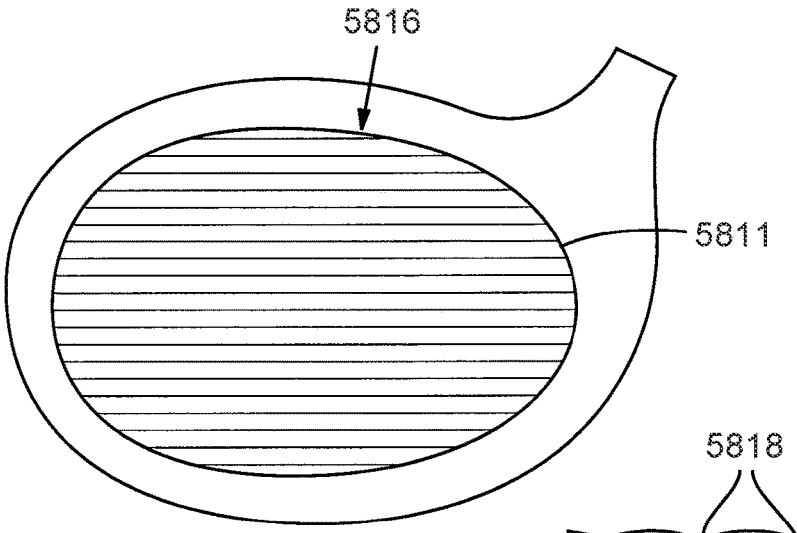
FIGS. 56-58 illustrate another representative striking plate that includes a cover layer having a roughened striking surface.
Figure 57:
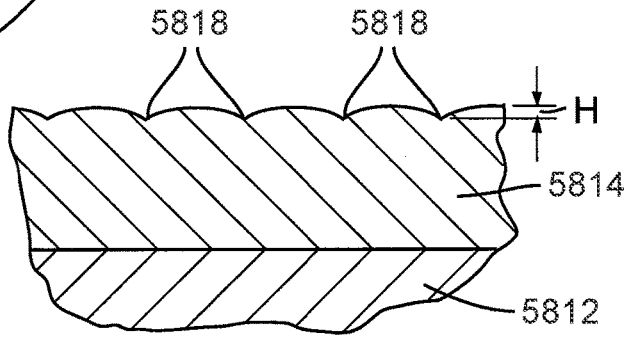
Figure 58:
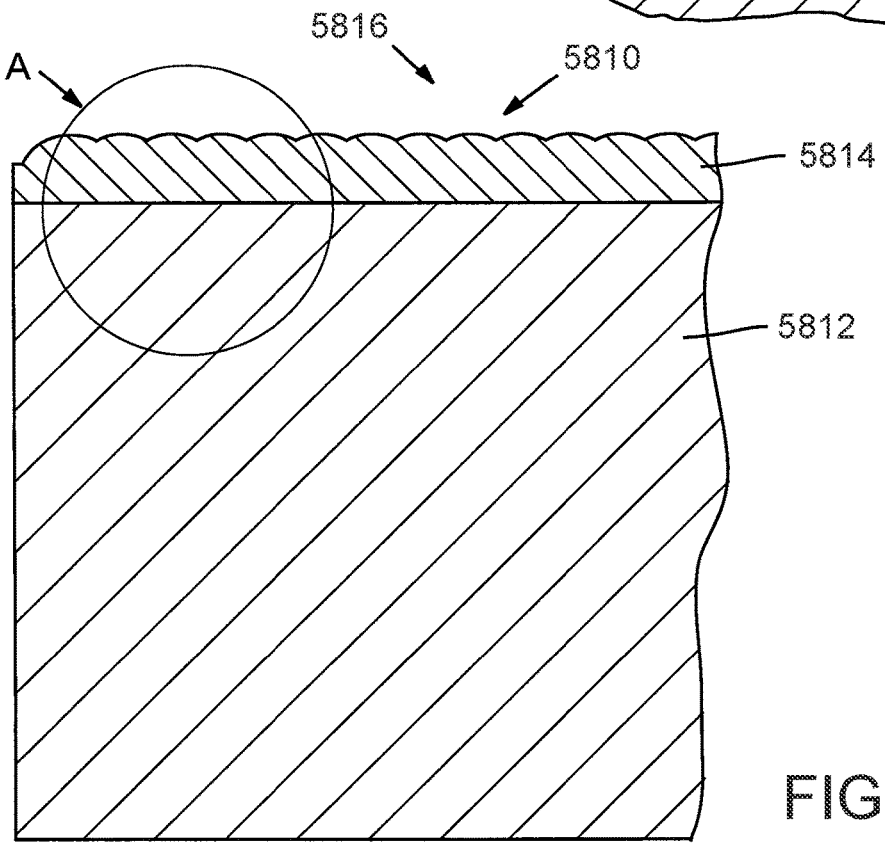
Figure 59:
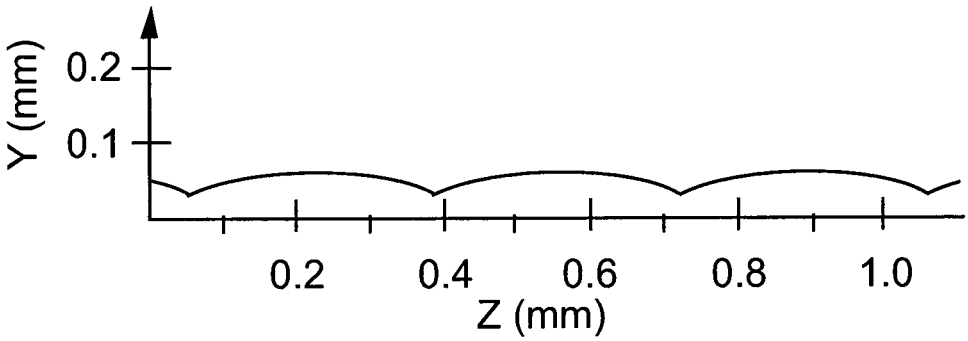
FIG. 59 is a surface profile of the roughened surface of FIGS. 46-48.
Figure 60:
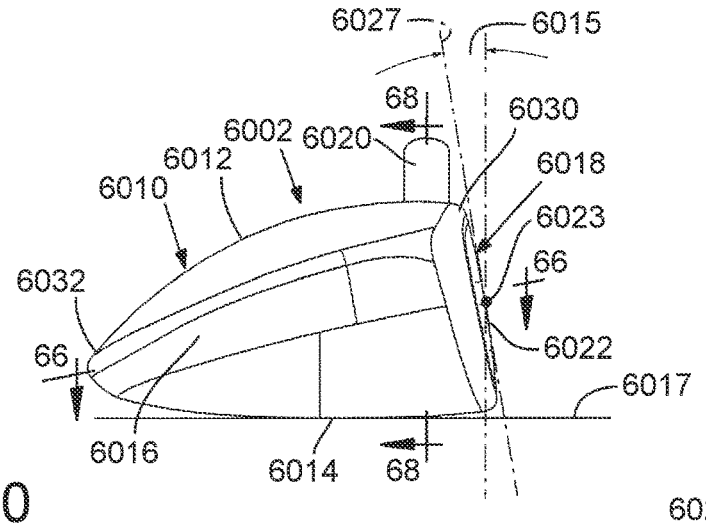
FIG. 60 is a side elevation view of a golf club head according to a first embodiment.
Figure 61:
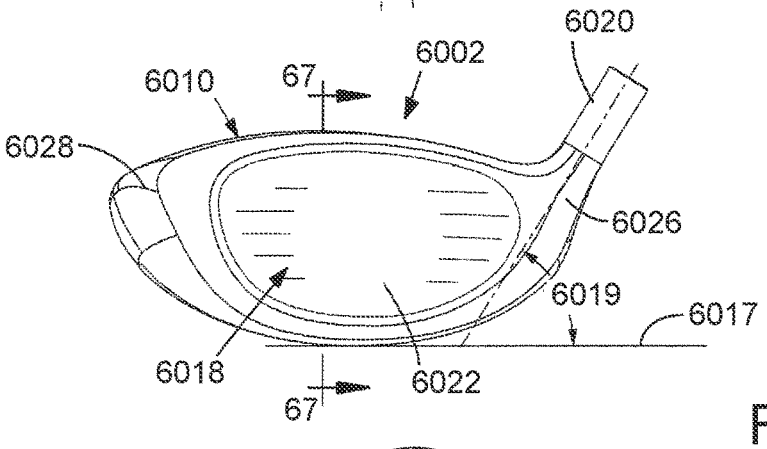
FIG. 61 is a front elevation view of the golf club head of FIG. 60.
Figure 62:
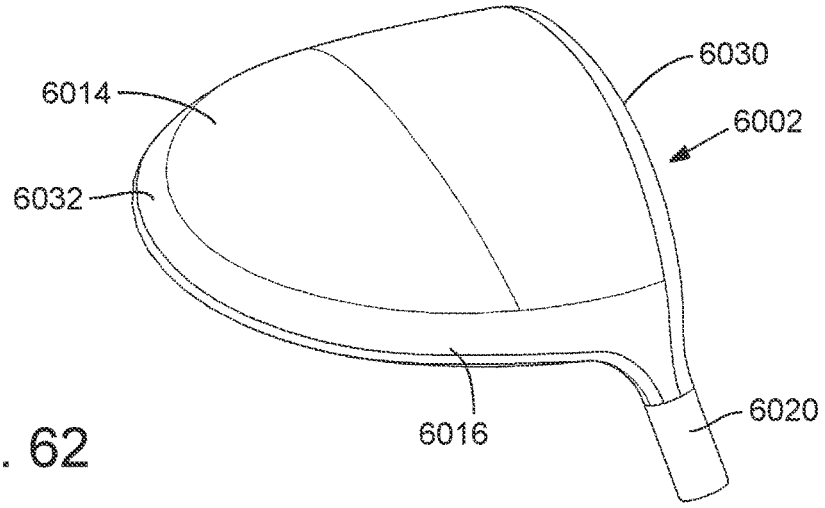
FIG. 62 is a bottom perspective view of the golf club head of FIG. 60.

An example striking plate 5810 based on a machined or other mold is shown in FIGS. 56-58. In this example, a surface texture 5811 provided to a striking surface 5816 is aligned with respect to a club and a club head substantially along an x-axis as shown in FIG. 56. FIGS. 57-58 illustrate the texture 5811 of the striking surface 5816 that is formed as a surface of a cover layer 5814 that is situated on a face plate 5812. As shown in FIG. 58, the cover layer 814 is about 0.5 mm thick, and the texture includes a plurality of valleys 5818 separated by about 0.34 mm and about 40 μm deep. FIG. 59 includes a portion of a stylus-based top-to-bottom surface scan of a representative polymer surface showing bumps having a center to center spacing of about 0.34 mm.

The following table summarize surface roughness parameters associated with the scans of FIGS. 53-54 and 59. In typical examples, measured surface roughness is greater than about 0.1 μm, 1 μm, 2 μm, or 2.5 μm and less than about 20 μm, 10 μm, 5 μm, 4.5 μm, or 4 μm.

| Parameter | Toe-to-Heel Scan (Tooled Mold) | Toe-to-Heel Scan (Peel Ply Shaped) | Top-to-Bottom Scan (Peel Ply Shaped) |
|---|---|---|---|
| Ra | 6.90 μm | 8.31 μm | 7.07 μm |
| Rz | 29.4 μm | 49.0 μm | 48.7 μm |
| Rp | 9.9 μm | 26.9 μm | 27.4 μm |
| RPc | 29.7/cm | 44.4/cm | 37.6/cm |
| Ku | 2.41 | | |

Figure 46:
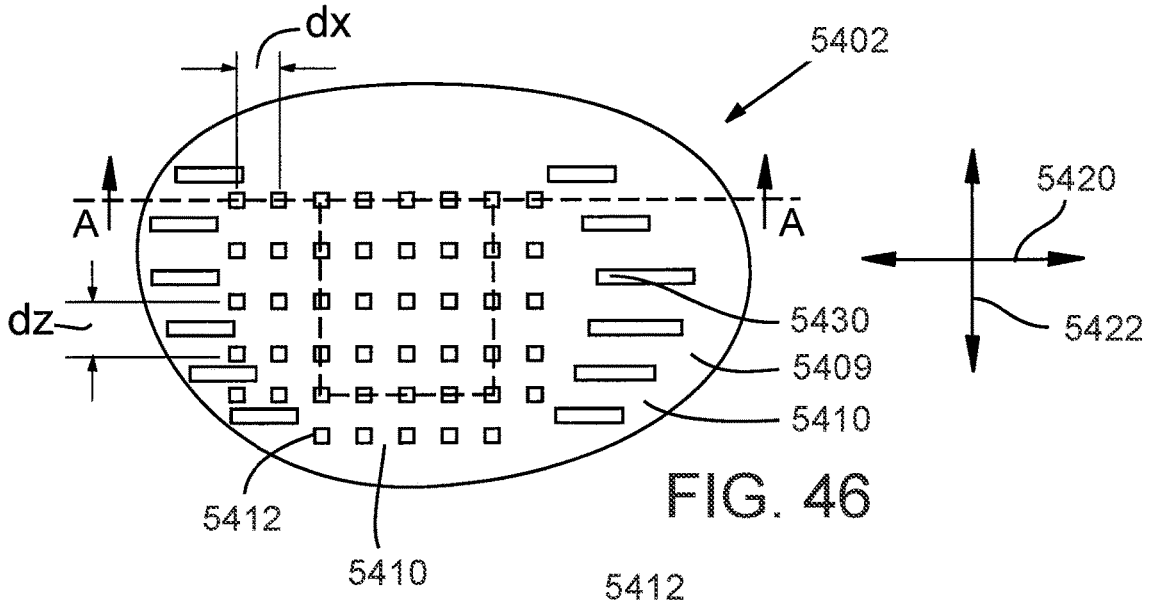
FIGS. 46-47 illustrate a representative striking plate that includes a cover layer having a roughened striking surface.
Figure 47:
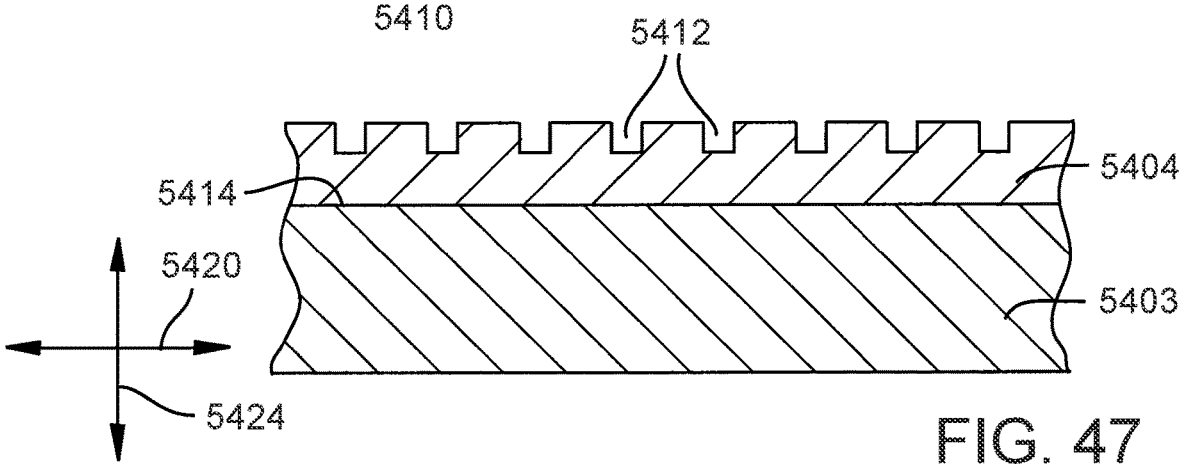

A striking surface of a cover layer can be provided with a variety of other roughness patterns some examples of which are illustrated in FIGS. 46-49. Typically these patterns extend over substantially the entire striking surface, but in some illustrated examples only a portion of the striking surface is shown for convenient illustration. Referring to FIGS. 46-47, a striking plate 5402 includes a composite face plate 5403 and a cover layer 5404. A striking surface 5409 of the cover layer includes a patterned area 5410 that includes a plurality of pattern features 5412 that are arranged in a two dimensional array. As shown in FIGS. 46-47, the pattern features 5412 are rectangular or square depressions formed in the cover layer 5404 and that extend along a +y-direction (i.e., inwardly towards an external surface 5414 of the face plate 5403). A horizontal spacing (along an x-axis 5420) of the pattern features is dx and a vertical spacing (along a z-axis 5422) is dz. These spacings can be the same or different, and the features 5412 can be inwardly or outwardly directed and can be columns or depressions having square, circular, elliptical, polygonal, oval, or other cross-sections in an xz-plane. In addition, for cross-sectional shapes that are asymmetric, the pattern features can be arbitrarily aligned with respect to the x-axis 5420 and the z-axis 5422. The pattern features 5412 can be located in a regular array, but the orientation of each of the pattern features can be arbitrary, or the pattern features can be periodically arranged along the x-axis 5420, the z-axis 5422, or another axis in the xz-plane. As shown in FIG. 46, a plurality of scorelines 5430 are provided and are typically colored so as to provide a high contrast. A maximum depth dy of the pattern features 5512 along the y-axis is between about 10 μm and 100 μm, between about 5 μm and 50 μm, or about 2 μm and 25 μm. The horizontal and vertical spacings are typically between about 0.025 mm and 0.500 mm While the pattern features 5412 may have substantially constant cross-sectional dimensions in one or more planes perpendicular the xz-plane (i.e. vertical cross-sections), these vertical cross-sections can vary along a y-axis 5424 or as a function of an angle of a cross-sectional plane with respect to the x-axis, the y-axis, or the z-axis. For example, columnar protrusions can have bases that taper outwardly, inwardly, or a combination thereof along the y-axis 5424, and can be tilted with respect to the y-axis 5424.

Figure 48:
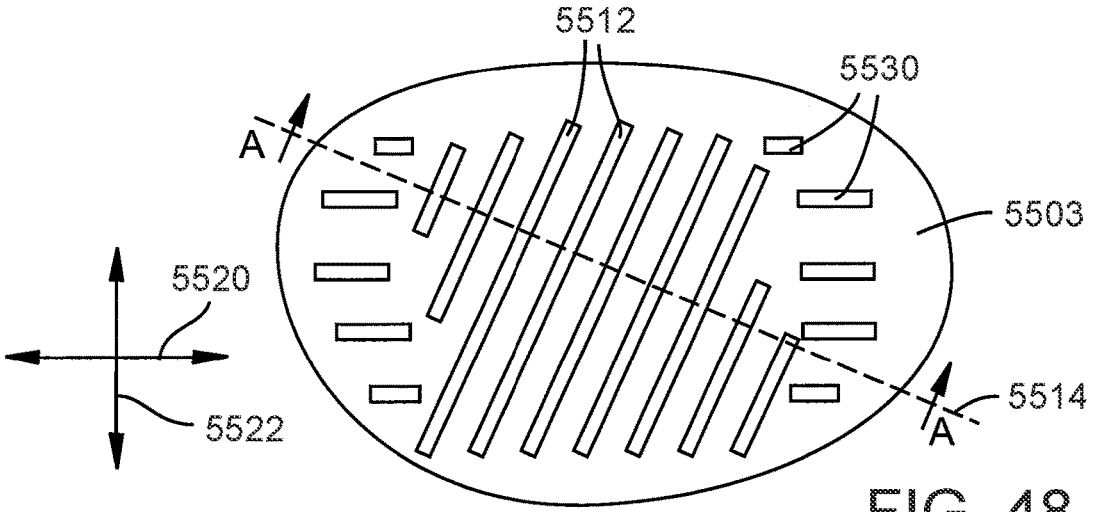
FIGS. 48-49 illustrate a representative striking plate that includes a cover layer having a roughened striking surface.
Figure 49:
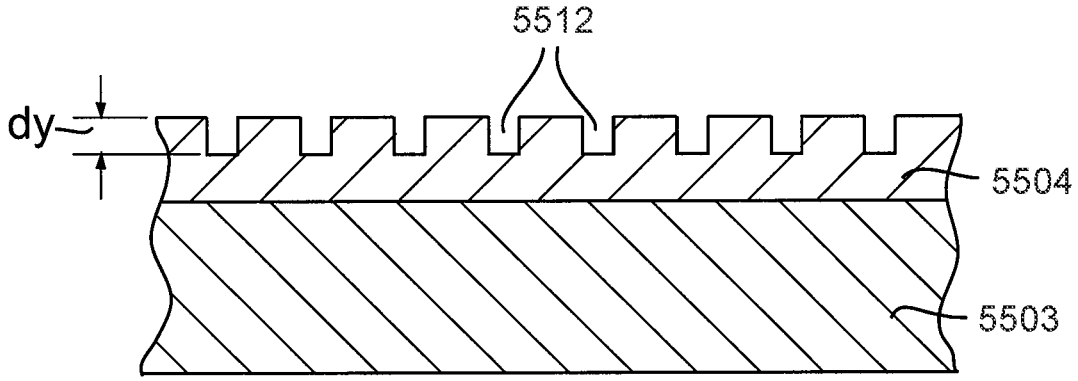

In an example shown in FIGS. 48-49, a cover layer 5504 includes a plurality of pattern features 5512 that are periodically situated along an axis 5514 that is tilted with respect to an x-axis 5520 and a z-axis 5522. The pattern features 5512 are periodic in one dimension, but in other examples, pattern features periodic along one more axes that are tilted (or aligned with) x- and z-axes can be provided. A plurality of scorelines 5530 are provided (generally in a face plate) and are colored so as to provide a high contrast. As shown in FIG. 49, the cover layer 5504 is secured to a face plate 5503 and the pattern features 5512 have a depth dy.

In other examples, pattern features can be periodic, aperiodic, or partially periodic, or randomly situated. Spatial frequencies associated with pattern features can vary, and pattern feature size and orientation can vary as well. In some examples, a roughened surface is defined as series of features that are randomly situated and sized.

Similar striking plates can be provided for iron-type golf clubs. While striking plates for wood-type golf clubs generally have top-to-bottom and toe-to-heel curvatures (commonly referred to as bulge and roll), striking plates for irons are typically flat. Composite-based striking plates for iron-type clubs typically include a polymer cover layer selected to protect the underlying composite face plate. In some examples, similar striking surface textures to those described above can be provided. In addition, one or more conventional grooves are generally provided on the striking surface. Such striking plates can be secured to iron-type golf club bodies with various adhesives or otherwise secured.

Representative Polymer Materials

Representative polymer materials suitable for face plate covers or caps are described herein.

Definitions

The term "bimodal polymer" as used herein refers to a polymer comprising two main fractions and more specifically to the form of the polymer's molecular weight distribution curve, i.e., the appearance of the graph of the polymer weight fraction as a function of its molecular weight. When the molecular weight distribution curves from these fractions are superimposed onto the molecular weight distribution curve for the total resulting polymer product, that curve will show two maxima or at least be distinctly broadened in comparison with the curves for the individual fractions. Such a polymer product is called bimodal. The chemical compositions of the two fractions may be different.

The term "chain extender" as used herein is a compound added to either a polyurethane or polyurea prepolymer, (or the prepolymer starting materials), which undergoes additional reaction but at a level sufficiently low to maintain the thermoplastic properties of the final composition The term "conjugated" as used herein refers to an organic compound containing two or more sites of unsaturation (e.g., carbon-carbon double bonds, carbon-carbon triple bonds, and sites of unsaturation comprising atoms other than carbon, such as nitrogen) separated by a single bond.

The term "curing agent" or "curing system" as used interchangeably herein is a compound added to either polyurethane or polyurea prepolymer, (or the prepolymer starting materials), which imparts additional crosslinking to the final composition to render it a thermoset.

The term "(meth)acrylate" is intended to mean an ester of methacrylic acid and/or acrylic acid.

The term "(meth)acrylic acid copolymers" is intended to mean copolymers of methacrylic acid and/or acrylic acid.

The term "polyurea" as used herein refers to materials prepared by reaction of a diisocyanate with a polyamine.

The term "polyurethane" as used herein refers to materials prepared by reaction of a diisocyanate with a polyol.

The term "prepolymer" as used herein refers to any material that can be further processed to form a final polymer material of a manufactured golf ball, such as, by way of example and not limitation, a polymerized or partially polymerized material that can undergo additional processing, such as crosslinking.

The term "thermoplastic" as used herein is defined as a material that is capable of softening or melting when heated and of hardening again when cooled. Thermoplastic polymer chains often are not cross-linked or are lightly cross-linked using a chain extender, but the term "thermoplastic" as used herein may refer to materials that initially act as thermoplastics, such as during an initial extrusion process or injection molding process, but which also may be cross-linked, such as during a compression molding step to form a final structure.

The term "thermoplastic polyurea" as used herein refers to a material prepared by reaction of a prepared by reaction of a diisocyanate with a polyamine, with optionally addition of a chain extender.

The "thermoplastic polyurethane" as used herein refers to a material prepared by reaction of a diisocyanate with a polyol, with optionally addition of a chain extender.

The term "thermoset" as used herein is defined as a material that crosslinks or cures via interaction with as crosslinking or curing agent. The crosslinking may be brought about by energy in the form of heat (generally above 200 degrees Celsius), through a chemical reaction (by reaction with a curing agent), or by irradiation. The resulting composition remains rigid when set, and does not soften with heating. Thermosets have this property because the long-chain polymer molecules cross-link with each other to give a rigid structure. A thermoset material cannot be melted and re-molded after it is cured thus thermosets do not lend themselves to recycling unlike thermoplastics, which can be melted and re-molded.

The term "thermoset polyurethane" as used herein refers to a material prepared by reaction of a diisocyanate with a polyol, and a curing agent.

The term "thermoset polyurea" as used herein refers to a material prepared by reaction of a diisocyanate with a polyamine, and a curing agent.

The term "urethane prepolymer" as used herein is the reaction product of diisocyante and a polyol.

The term "urea prepolymer" as used herein is the reaction product of a diisocyanate and a polyamine.

The term "unimodal polymer" refers to a polymer comprising one main fraction and more specifically to the form of the polymer's molecular weight distribution curve, i.e., the molecular weight distribution curve for the total polymer product shows only a single maximum.

Materials

Polymeric materials generally considered useful for making the golf club face cap according to the present invention include both synthetic or natural polymers or blend thereof including without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, unimodal ionomers, bimodal ionomers, modified unimodal ionomers, modified bimodal ionomers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamer, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic copolymers, functionalized styrenic copolymers, functionalized styrenic terpolymers, styrenic terpolymers, cellulosic polymers, liquid crystal polymers (LCP), ethylene-propylene-diene terpolymers (EPDM), ethylene-vinyl acetate copolymers (EVA), ethylene-propylene copolymers, ethylene vinyl acetates, polyureas, and polysiloxanes and any and all combinations thereof.

One preferred family of polymers for making the golf club face cap of the present invention are the thermoplastic or thermoset polyurethanes and polyureas made by combination of a polyisiocyanate and a polyol or polyamine respectively. Any isocyanate available to one of ordinary skill in the art is suitable for use in the present invention including, but not limited to, aliphatic, cycloaliphatic, aromatic aliphatic, aromatic, any derivatives thereof, and combinations of these compounds having two or more isocyanate (NCO) groups per molecule.

Any polyol available to one of ordinary skill in the polyurethane art is suitable for use according to the invention. Polyols suitable for use include, but are not limited to, polyester polyols, polyether polyols, polycarbonate polyols and polydiene polyols such as polybutadiene polyols.

Any polyamine available to one of ordinary skill in the polyurea art is suitable for use according to the invention. Polyamines suitable for use include, but are not limited to, amine-terminated hydrocarbons, amine-terminated polyethers, amine-terminated polyesters, amine-terminated polycaprolactones, amine-terminated polycarbonates, amine-terminated polyamides, and mixtures thereof.

The previously described diisocyante and polyol or polyamine components may be previously combined to form a prepolymer prior to reaction with the chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, LFG640D.

One preferred prepolymer is a toluene diisocyanate prepolymer with polypropylene glycol. Such polypropylene glycol terminated toluene diisocyanate prepolymers are available from Uniroyal Chemical Company of Middlebury, Conn., under the trade name ADIPRENE® LFG963A and LFG640D. Most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

Polyol chain extenders or curing agents may be primary, secondary, or tertiary polyols. Diamines and other suitable polyamines may be added to the compositions of the present invention to function as chain extenders or curing agents. These include primary, secondary and tertiary amines having two or more amines as functional groups.

Depending on their chemical structure, curing agents may be slow- or fast-reacting polyamines or polyols. As described in U.S. Pat. Nos. 6,793,864, 6,719,646 and copending U.S. Patent Publication No. 2004/0201133 A1, (the contents of all of which are hereby incorporated herein by reference).

Suitable curatives for use in the present invention are selected from the slow-reacting polyamine group include, but are not limited to, 3,5-dimethylthio-2,4-toluenediamine; 3,5-dimethylthio-2,6-toluenediamine; N,N'-dialkyldiamino diphenyl methane; trimethylene-glycol-di-p-aminobenzoate; polytetramethyleneoxide-di-p-aminobenzoate, and mixtures thereof. Of these, 3,5-dimethylthio-2,4-toluenediamine and 3,5-dimethylthio-2,6-toluenediamine are isomers and are sold under the trade name ETHACURE® 300 by Ethyl Corporation. Trimethylene glycol-di-p-aminobenzoate is sold under the trade name POLACURE 740M and polytetramethyleneoxide-di-p-aminobenzoates are sold under the trade name POLAMINES by Polaroid Corporation. N,N'-dialkyldiamino diphenyl methane is sold under the trade name UNILINK® by UOP. Suitable fast-reacting curing agent can be used include diethyl-2,4-toluenediamine, 4,4"-methylenebis-(3-chloro,2,6-diethyl)-aniline (available from Air Products and Chemicals Inc., of Allentown, Pa., under the trade name LONZACURE®), 3,3'-dichlorobenzidene; 3,3'-dichloro-4,4'-diaminodiphenyl methane (MOCA); N,N,N',N'-tetrakis(2-hydroxypropyl)ethylenediamine and Curalon L, a trade name for a mixture of aromatic diamines sold by Uniroyal, Inc. or any and all combinations thereof. A preferred fast-reacting curing agent is diethyl-2,4-toluene diamine, which has two commercial grades names, Ethacure® 100 and Ethacure® 100LC commercial grade has lower color and less by-product. Blends of fast and slow curing agents are especially preferred. In another preferred embodiment the polyurethane or polyurea is prepared by combining a diisocyanate with either a polyamine or polyol or a mixture thereof and one or more dicyandiamides. In a preferred embodiment the dicyandiamide is combined with a urethane or urea prepolymer to form a reduced-yellowing polymer composition as described in U.S. Patent Application No. 60/852,582 filed on Oct. 17, 2006, the entire contents of which are herein incorporated by reference in their entirety. Another preferred family of polymers for making the golf club face cap of the present invention are thermoplastic ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer". The incorporated carboxylic acid groups are then neutralized by a basic metal ion salt, to form the ionomer. The metal cations of the basic metal ion salt used for neutralization include Li+, Na+, K+, Zn2+, Ca2+, Co2+, Ni2+, Cu2+, Pb2+, and Mg2+, with the Li+, Na+, Ca2+, Zn2+, and Mg2+ being preferred. The basic metal ion salts include those derived by neutralization of for example formic acid, acetic acid, nitric acid, and carbonic acid. The salts may also include hydrogen carbonate salts, metal oxides, metal hydroxides, and metal alkoxides.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf club component such as a cover layer that provides a striking surface. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a C3 to C8 α,β ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said ionomeric polymer are partially neutralized with a metal selected from the group consisting of lithium, sodium, potassium, magnesium, calcium, barium, lead, tin, zinc or aluminum, and combinations thereof.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights In addition to the unimodal and bimodal ionomers, also included are the so-called "modified ionomers" examples of which are described in U.S. Pat. Nos. 6,100,321, 6,329,458 and 6,616,552 and U.S. Patent Publication U.S. 2003/0158312 A1, the entire contents of all of which are herein incorporated by reference. An example of such a modified ionomer polymer is DuPont® HPF-1000 available from E. I. DuPont de Nemours and Co. Inc.

Also useful for making the golf club face cap of the present invention is a blend of an ionomer and a block copolymer. A preferred block copolymer is SEPTON HG-252. Such blends are described in more detail in commonly-assigned U.S. Pat. No. 6,861,474 and U.S. Patent Publication No. 2003/0224871 both of which are incorporated herein by reference in their entireties.

In a further embodiment, the golf club face cap of the present invention can comprise a composition prepared by blending together at least three materials, identified as Components A, B, and C, and melt-processing these components to form in-situ, a polymer blend composition incorporating a pseudo-crosslinked polymer network. Such blends are described in more detail in commonly-assigned U.S. Pat. No. 6,930,150, to Kim et al., the content of which is incorporated by reference herein in its entirety.

Component A is a monomer, oligomer, prepolymer or polymer that incorporates at least five percent by weight of at least one type of an acidic functional group. Examples of such polymers suitable for use as include, but are not limited to, ethylene/(meth)acrylic acid copolymers and ethylene/(meth)acrylic acid/alkyl(meth)acrylate terpolymers, or ethylene and/or propylene maleic anhydride copolymers and terpolymers.

As discussed above, Component B can be any monomer, oligomer, or polymer, preferably having a lower weight percentage of anionic functional groups than that present in Component A in the weight ranges discussed above, and most preferably free of such functional groups. Preferred materials for use as Component B include polyester elastomers marketed under the name PEBAX and LOTADER marketed by ATOFINA Chemicals of Philadelphia, Pa.; HYTREL, FUSABOND, and NUCREL marketed by E.I. DuPont de Nemours & Co. of Wilmington, Del.; SKYPEL and SKYTHANE by S.K. Chemicals of Seoul, South Korea; SEPTON and HYBRAR marketed by Kuraray Company of Kurashiki, Japan; ESTHANE by Noveon; and KRATON marketed by Kraton Polymers. A most preferred material for use as Component B is SEPTON HG-252. Component C is a base capable of neutralizing the acidic functional group of Component A and is a base having a metal cation. These metals are from groups IA, IB, IIA, IIB, IIIA, IIIB, IVA, IVB, VA, VB, VILA, VIIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal oxides, metal carbonates, or metal acetates. The composition preferably is prepared by mixing the above materials into each other thoroughly, either by using a dispersive mixing mechanism, a distributive mixing mechanism, or a combination of these.

In a further embodiment, the golf club face cap of the present invention can comprise a polyamide. Specific examples of suitable polyamides include polyamide 6; polyamide 11; polyamide 12; polyamide 4,6; polyamide 6,6; polyamide 6,9; polyamide 6,10; polyamide 6,12; polyamide MXD6; PA12, CX; PA12, IT; PPA; PA6, IT; and PA6/PPE.

The polyamide may be any homopolyamide or copolyamide. One example of a group of suitable polyamides is thermoplastic polyamide elastomers. Thermoplastic polyamide elastomers typically are copolymers of a polyamide and polyester or polyether. For example, the thermoplastic polyamide elastomer can contain a polyamide (Nylon 6, Nylon 66, Nylon 11, Nylon 12 and the like) as a hard segment and a polyether or polyester as a soft segment. In one specific example, the thermoplastic polyamides are amorphous copolyamides based on polyamide (PA 12). Suitable amide block polyethers include those as disclosed in U.S. Pat. Nos. 4,331,786; 4,115,475; 4,195,015; 4,839,441; 4,864,014; 4,230,848 and 4,332,920.

One type of polyetherester elastomer is the family of Pebax, which are available from Elf-Atochem Company. Preferably, the choice can be made from among Pebax 2533, 3533, 4033, 1205, 7033 and 7233. Blends or combinations of Pebax 2533, 3533, 4033, 1205, 7033 and 7233 can also be prepared, as well. Some examples of suitable polyamides for use include those commercially available under the trade names PEBAX, CRISTAMID and RILSAN marketed by Atofina Chemicals of Philadelphia, Pa., GRIVORY and GRILAMID marketed by EMS Chemie of Sumter, S.C., TROGAMID and VESTAMID available from Degussa, and ZYTEL marketed by E.I. DuPont de Nemours & Co., of Wilmington, Del.

The polymeric compositions used to prepare the golf club face cap of the present invention also can incorporate one or more fillers. Such fillers are typically in a finely divided form, for example, in a size generally less than about 20 mesh, preferably less than about 100 mesh U.S. standard size, except for fibers and flock, which are generally elongated. Filler particle size will depend upon desired effect, cost, ease of addition, and dusting considerations. The appropriate amounts of filler required will vary depending on the application but typically can be readily determined without undue experimentation.

The filler preferably is selected from the group consisting of precipitated hydrated silica, limestone, clay, talc, asbestos, barytes, glass fibers, aramid fibers, mica, calcium metasilicate, barium sulfate, zinc sulfide, lithopone, silicates, silicon carbide, diatomaceous earth, carbonates such as calcium or magnesium or barium carbonate, sulfates such as calcium or magnesium or barium sulfate, metals, including tungsten, steel, copper, cobalt or iron, metal alloys, tungsten carbide, metal oxides, metal stearates, and other particulate carbonaceous materials, and any and all combinations thereof. Preferred examples of fillers include metal oxides, such as zinc oxide and magnesium oxide. In another preferred embodiment the filler comprises a continuous or non-continuous fiber. In another preferred embodiment the filler comprises one or more so called nanofillers, as described in U.S. Pat. No. 6,794,447 and copending U.S. patent application Ser. No. 10/670,090 filed on Sep. 24, 2003 and copending U.S. patent application Ser. No. 10/926,509 filed on Aug. 25, 2004, the entire contents of each of which are incorporated herein by reference.

Another particularly well-suited additive for use in the compositions of the present invention includes compounds having the general formula:

$$(R2N)m—R'—(X(O)nORy)m,$$

wherein R is hydrogen, or a C1-C20 aliphatic, cycloaliphatic or aromatic systems; R' is a bridging group comprising one or more C1-C20 straight chain or branched aliphatic or alicyclic groups, or substituted straight chain or branched aliphatic or alicyclic groups, or aromatic group, or an oligomer of up to 12 repeating units including, but not limited to, polypeptides derived from an amino acid sequence of up to 12 amino acids; and X is C or S or P with the proviso that when X=C, n=1 and y=1 and when X=S, n=2 and y=1, and when X=P, n=2 and y=2. Also, m=1-3. These materials are more fully described in copending U.S. patent application Ser. No. 11/182,170, filed on Jul. 14, 2005, the entire contents of which are incorporated herein by reference. Most preferably the material is selected from the group consisting of 4,4'-methylene-bis-(cyclohexylamine)-carbamate (commercially available from R.T. Vanderbilt Co., Norwalk Conn. under the tradename Diak® 4), 11-aminoundecanoicacid, 12-aminododecanoic acid, epsilon-caprolactam; omega-caprolactam, and any and all combinations thereof.

If desired, the various polymer compositions used to prepare the golf club face cap of the present invention can additionally contain other conventional additives such as, antioxidants, or any other additives generally employed in plastics formulation. Agents provided to achieve specific functions, such as additives and stabilizers, can be present. Examplary suitable ingredients include plasticizers, pigments colorants, antioxidants, colorants, dispersants, U.V. absorbers, optical brighteners, mold releasing agents, processing aids, fillers, and any and all combinations thereof. UV stabilizers, or photo stabilizers such as substituted hydroxphenyl benzotriazoles may be utilized in the present invention to enhance the UV stability of the final compositions. An example of a commercially available UV stabilizer is the stabilizer sold by Ciba Geigy Corporation under the tradename TINUVIN.

Now with reference to FIGS. 60-91, as specifically as illustrated in FIGS. 60-68, a wood-type (e.g., driver or fairway wood) golf club head, such as golf club head 6002, includes a hollow body 6010. The body 6010 includes a crown 6012, a sole 6014, a skirt 6016, a striking face, or face portion, 6018 defining an interior cavity 6079 (see FIGS. 66-68). The body 6010 can include a hosel 6020, which defines a hosel bore 6024 adapted to receive a golf club shaft (see FIG. 65). The body 6010 further includes a heel portion 6026, a toe portion 6028, a front portion 6030, and a rear portion 6032. The club head 6002 also has a volume, typically measured in cubic-centimeters ($cm^3$), equal to the volumetric displacement of the club head 6002. In some implementations, the golf club head 6002 has a volume between approximately 420 $cm^3$ and approximately 480 $cm^3$, and a total mass between approximately 190 g and approximately 210 g. Referring to FIG. 89, in one specific implementation, the golf club head 6002 has a volume of approximately 458 $cm^3$ and a total mass of approximately 200 g.

Figure 65:
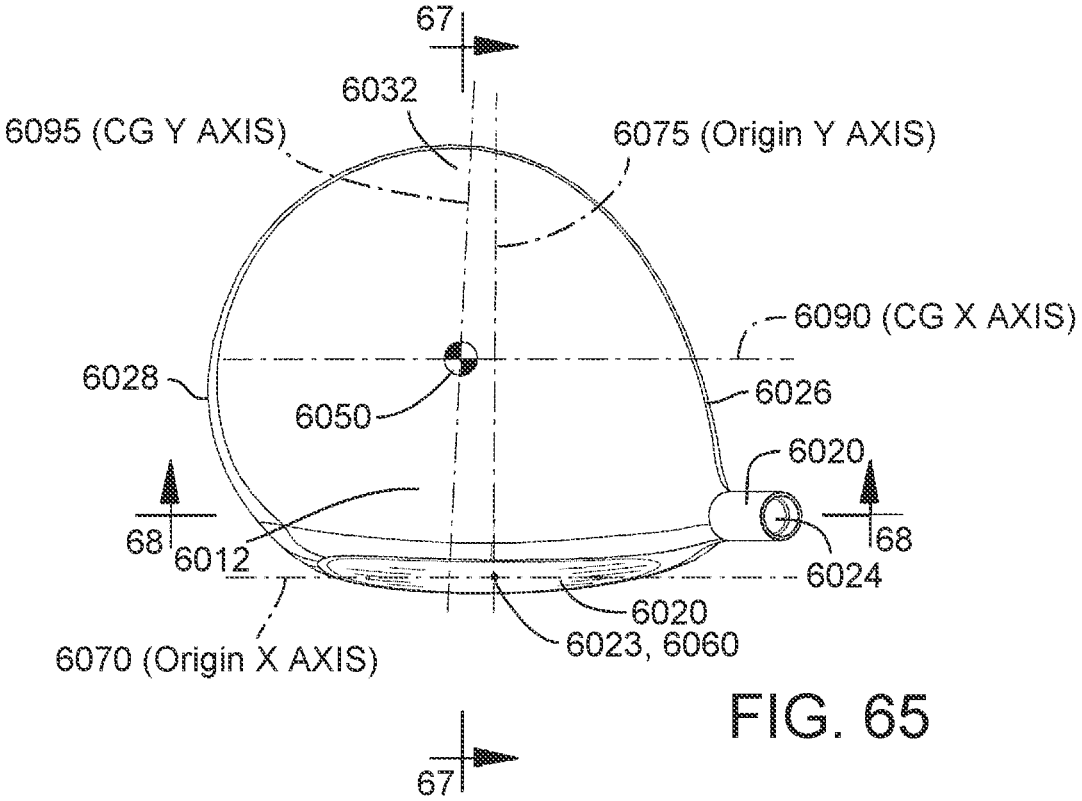
FIG. 65 is a top plan view of the golf club head of FIG. 60.

The crown 6012 is defined as an upper portion of the club head (1) above a peripheral outline 6034 of the club head as viewed from a top-down direction; and (2) rearwards of the topmost portion of a ball striking surface 6022 of the striking face 6018 (see FIG. 65). The striking surface 6022 is defined as a front or external surface of the striking face 6018 and is adapted for impacting a golf ball (not shown). In several embodiments, the striking face or face portion 6018 can be a striking plate attached to the body 6010 using conventional attachment techniques, such as welding, as will be described in more detail below. In some embodiments, the striking surface 6022 can have a bulge and roll curvature. For example, referring to FIG. 89, the striking surface 6022 can have a bulge and roll each with a radius of approximately 305 mm.

The sole 6014 is defined as a lower portion of the club head 6002 extending upwards from a lowest point of the club head when the club head is ideally positioned, i.e., at a proper address position relative to a golf ball on a level surface. In some implementations, the sole 6014 extends approximately 50% to 60% of the distance from the lowest point of the club head to the crown 6012, which in some instances, can be approximately 15 mm for a driver and between approximately 10 mm and 12 mm for a fairway wood.

A golf club head, such as the club head 6002, is at its proper address position when angle 6015 (see FIG. 60) is approximately equal to the golf club head loft and when the golf club head lie angle 6019 (see FIG. 61) is approximately equal to 60 degrees. Angle 6015 is the angle defined between a face plane 6027, defined as the plane tangent to an ideal impact location 6023 on the striking surface 6022, and a vertical plane 6029 relative to the ground 6017. Lie angle 6019 is the angle defined between a longitudinal axis 6021 of the hosel 6020 or shaft and the ground 6017. The ground, as used herein, is assumed to be a level plane.

The skirt 6016 includes a side portion of the club head 6002 between the crown 6012 and the sole 6014 that extends across a periphery 6034 of the club head, excluding the striking surface 6022, from the toe portion 6028, around the rear portion 6032, to the heel portion 6026.

Figure 63:
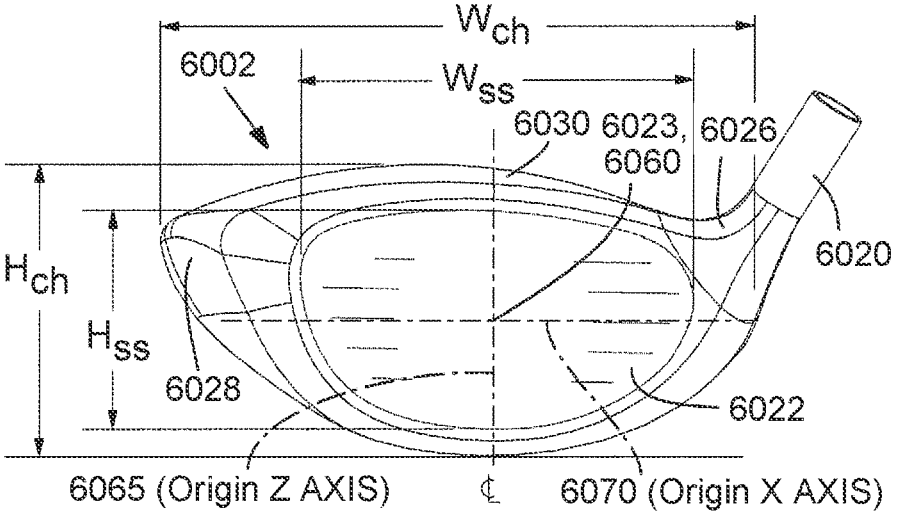
FIG. 63 is a front elevation view of the golf club head of FIG. 60 showing a golf club head origin coordinate system.

In the illustrated embodiment, the ideal impact location 6023 of the golf club head 6002 is disposed at the geometric center of the striking surface 6022 (see FIG. 63). The striking surface 6022 is typically defined as the intersection of the midpoints of a height (Hss) and width (Wss) of the striking surface. See USGA "Procedure for Measuring the Flexibility of a Golf Clubhead," Revision 2.0. In some implementations, the golf club head 6002 has a height (Hss) between approximately 50 mm and approximately 65 mm, and a width (Wss) between approximately 80 mm and approximately 100 mm. Referring to FIG. 89, in one specific implementation, the golf club head 6002 has a height (Hss) of approximately 58.6 mm, width (Wss) of approximately 90.6 mm, and total striking surface area of approximately 3,929 $mm^2$.

In some embodiments, the striking face 6018 is made of a composite material such as described in U.S. Patent Application Publication Nos. 2005/0239575 and 2004/0235584, U.S. patent application Ser. No. 11/642,310, and U.S. Provisional Patent Application No. 60/877,336, which are incorporated herein by reference. In other embodiments, the striking face 6018 is made from a metal alloy (e.g., titanium, steel, aluminum, and/or magnesium), ceramic material, or a combination of composite, metal alloy, and/or ceramic materials. Further, the striking face 6018 can be a striking plate having a variable thickness such as described in U.S. Pat. No. 6,997,820, which is incorporated herein by reference.

The crown 6012, sole 6014, and skirt 6016 can be integrally formed using techniques such as molding, cold forming, casting, and/or forging and the striking face 18 can be attached to the crown, sole and skirt by means known in the art. For example, the striking face 6018 can be attached to the body 6010 as described in U.S. Patent Application Publication Nos. 2005/0239575 and 2004/0235584. The body 6010 can be made from a metal alloy (e.g., titanium, steel, aluminum, and/or magnesium), composite material, ceramic material, or any combination thereof. The wall 6072 of the golf club head 6002 can be made of a thin-walled construction, such as described in U.S. application Ser. No. 11/067,475, filed Feb. 25, 2005, which is incorporated herein by reference. For example, in some implementations, the wall can have a thickness between approximately 0.65 mm and approximately 0.8 mm. In one specific implementation, the wall 6072 of the crown 6012 and skirt 6016 has a thickness of approximately 0.65 mm, and the wall of the sole 6014 has a thickness of approximately 0.8 mm.

Figure 64:
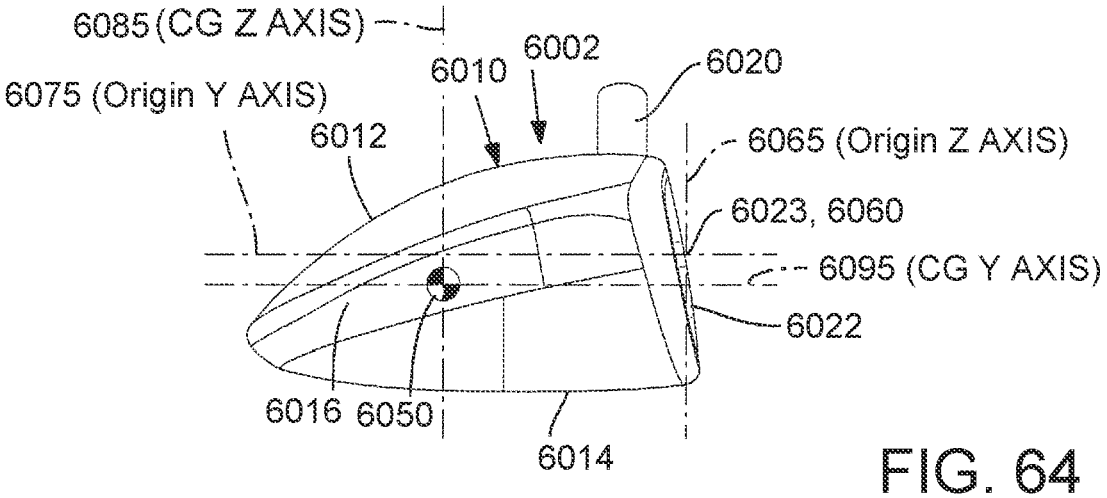
FIG. 64 is a side elevation view of the golf club head of FIG. 60 showing a center of gravity coordinate system.

A club head origin coordinate system may be defined such that the location of various features of the club head (including, e.g., a club head center-of-gravity (CG) 6050 (see FIGS. 64 and 65)) can be determined. Referring to FIGS. 63-65, a club head origin 6060 is represented on club head 6002. The club head origin 6060 is positioned at the ideal impact location 6023, or geometric center, of the striking surface 6022.

Referring to FIGS. 64 and 65, the head origin coordinate system, as defined with respect to the head origin 6060, includes three axes: a z-axis 6065 extending through the head origin 6060 in a generally vertical direction relative to the ground 6017 when the club head 6002 is at the address position; an x-axis 6070 extending through the head origin 6060 in a toe-to-heel direction generally parallel to the striking surface 6022, i.e., generally tangential to the striking surface 6022 at the ideal impact location 6023, and generally perpendicular to the z-axis 6065; and a y-axis 6075 extending through the head origin 6060 in a front-to-back direction and generally perpendicular to the x-axis 6070 and to the z-axis 6065. The x-axis 6070 and the y-axis 6075 both extend in generally horizontal directions relative to the ground 6017 when the club head 6002 is at the address position. The x-axis 6070 extends in a positive direction from the origin 6060 to the heel 6026 of the club head 6002. The y-axis 6075 extends in a positive direction from the origin 6060 towards the rear portion 6032 of the club head 6002. The z-axis 6065 extends in a positive direction from the origin 6060 towards the crown 6012.

In one embodiment, the golf club head can have a CG with an x-axis coordinate between approximately −2 mm and approximately 6 mm, a y-axis coordinate between approximately 33 mm and approximately 41 mm, and a z-axis coordinate between approximately −7 mm and approximately 1 mm. Referring to FIG. 89, in one specific implementation, the CG x-axis coordinate is approximately 1.8 mm, the CG y-axis coordinate is approximately 37.1 mm, and the CG z-axis coordinate is approximately −3.26 mm.

Referring to FIG. 63, club head 6002 has a maximum club head height (Hch) defined as the distance between the lowest and highest points on the outer surface of the body 6010 measured along an axis parallel to the z-axis when the club head 6002 is at proper address position; a maximum club head width (Wch) defined as the distance between the maximum extents of the heel and toe portions 6026, 6028 of the body measured along an axis parallel to the x-axis when the club head 6002 is at proper address position; and a maximum club head depth (Dch), or length, defined as the distance between the forwardmost and rearwardmost points on the surface of the body 6010 measured along an axis parallel to the y-axis when the club head 6002 is at proper address position. The height and width of club head 6002 is measured according to the USGA "Procedure for Measuring the Clubhead Size of Wood Clubs" Revision 1.0. In some implementations, the golf club head 6002 has a height (Hch) between approximately 55 mm and approximately 75 mm, a width (Wch) between approximately 110 mm and approximately 130 mm, and a depth (Dch) between approximately 110 mm and approximately 130 mm. Referring to FIG. 89, in one specific implementation, the golf club head 6002 has a height (Hch) of approximately 60.7 mm, width (Wch) of approximately 120.5 mm, and depth (Dch) of approximately 115 mm.

In certain embodiments, the club head 6002 includes a rib 6082 extending along an interior surface of the sole 6014 and skirt 6016 generally parallel to the striking face 6018. In some instances, the rib 6082 provides structural rigidity to the club head 6002 and vibrational dampening. Although club head 6002 includes a single rib 6082, in some implementations, the club head 6002 includes multiple ribs 6082. Further, in some implementations, the rib 6082 extends along only the sole 6014 or includes two spaced-apart portions each extending along the skirt 6016 on separate sides of the club head.

Referring to FIGS. 64 and 65, golf club head moments of inertia are typically defined about three axes extending through the golf club head CG 6050: (1) a CG z-axis 6085 extending through the CG 6050 in a generally vertical direction relative to the ground 6017 when the club head 6002 is at address position; (2) a CG x-axis 6090 extending through the CG 6050 in a heel-to-toe direction generally parallel to the striking surface 6022 and generally perpendicular to the CG z-axis 6085; and (3) a CG y-axis 6095 extending through the CG 6050 in a front-to-back direction and generally perpendicular to the CG x-axis 6090 and the CG z-axis 6085. The CG x-axis 6090 and the CG y-axis 6095 both extend in a generally horizontal direction relative to the ground 6017 when the club head 6002 is at the address position.

A moment of inertia about the golf club head CG x-axis 6090 is calculated by the following equation $$Ixx=\int(y^2+z^2)dm$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis 6090 and the golf club head CG z-axis 6085. The CG xy-plane is a plane defined by the golf club head CG x-axis 6090 and the golf club head CG y-axis 6095.

A moment of inertia about the golf club head CG z-axis 6085 is calculated by the following equation $$Izz=\int(y^2+z^2)dm$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis 6095 and the golf club head CG z-axis 6085.

As the moment of inertia about the CG z-axis (Izz) is an indication of the ability of a golf club head to resist twisting about the CG z-axis, the moment of inertia about the CG x-axis (Ixx) is an indication of the ability of the golf club head to resist twisting about the CG x-axis. The higher the moment of inertia about the CG x-axis (Ixx), the greater the forgiveness of the golf club head on high and low off-center impacts with a golf ball. In other words, a golf ball hit by a golf club head on a location of the striking surface 6018 above the ideal impact location 6023 causes the golf club head to twist upwardly and the golf ball to have a higher launch angle and lower spin than desired. Similarly, a golf ball hit by a golf club head on a location of the striking surface 6018 below the ideal impact location 6023 causes the golf club head to twist downwardly and the golf ball to have a lower launch angle and higher spin than desired. Both high and low off-center hits also cause loss of ball speed compared to centered hits. Increasing the moment of inertia about the CG x-axis (Ixx) reduces upward and downward twisting of the golf club head to reduce the negative effects of high and low off-center impacts.

As discussed above, many conventional golf club heads are designed to achieve a moment of inertia about the CG z-axis (Izz) that approaches the maximum moment of inertia allowable by the USGA in order to increase straightness of the shot and reduce ball speed-loss, i.e., forgiveness on heel and toe off-center hits. However, few, if any, conventional golf club heads are designed to achieve a high moment of inertia about the CG x-axis (Ixx) in conjunction with a high moment of inertia about the CG z-axis (Izz). Moreover, the prior art does not recognize the need to, nor the advantages associated with, configuring a golf club head to have an increased moment of inertia about the CG x-axis (Ixx) while maintaining a specific ratio of the moment of inertia about the CG x-axis (Ixx) to the moment of inertia about the CG z-axis, i.e., Ixx/Izz.

Increasing the moment of inertia about the CG x-axis (Ixx) typically does not involve distributing additional mass away from the hosel and shaft. Accordingly, the moment of inertia about the CG x-axis (Ixx) can be increased without significantly affecting the ability of a golfer to square the club head at impact. Therefore, a golf club head can have a moderately high moment of inertia about the CG z-axis (Izz) and an increased moment of inertia about the CG x-axis (Ixx) to provide a golf club head with a high forgiveness on high, low, heel and toe off-center impacts without negatively impacting a golfer's ability to square the golf club head. Further, a given head design offers only so much discretionary mass that can be used to achieve specific moments of inertia, e.g., moment of inertia about the CG x-axis (Ixx) and/or moment of inertia about the CG z-axis (Izz). Thus, it is often not desirable to utilize all or most of the discretionary mass to achieve a selected moment of inertia about the CG z-axis (Izz), in part because increases in moment of inertia about the CG z-axis (Izz) beyond about 500 $kg{\cdot}mm^2$ accrue proportionately less benefit. In such instances, it is often desirable to maintain moment of inertia about the CG z-axis (Izz) and redistribute mass to achieve an increase in moment of inertia about the CG x-axis (Ixx) and thus an increase in the ratio of moment of inertia about the CG x-axis (Ixx) to moment of inertia about the CG z-axis (Izz).

As moments of inertia are proportional to the square of the distance of the mass away from an axis of rotation, according to several embodiments, golf club heads described herein can include one or more localized or discrete mass elements positioned at strategic locations about the golf club head to affect the moments of the inertia of the head without increasing the bulk of the golf club head. Further, in some embodiments, using localized or discrete mass elements in conjunction with body a made of a thin-walled construction can provide desirable mass properties without the need for composite materials, which can lead to increased material and manufacturing costs.

Figure 66:
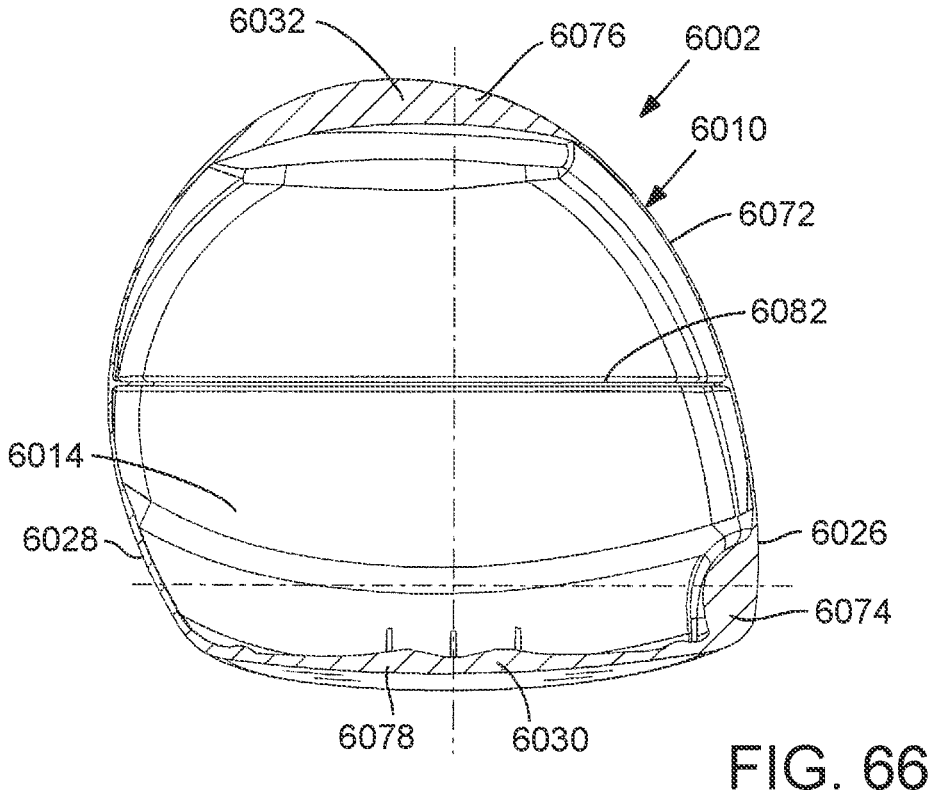
FIG. 66 is a cross-sectional view of the golf club head of FIG. 60 taken along the line 66-66 of FIG. 60.
Figure 67:
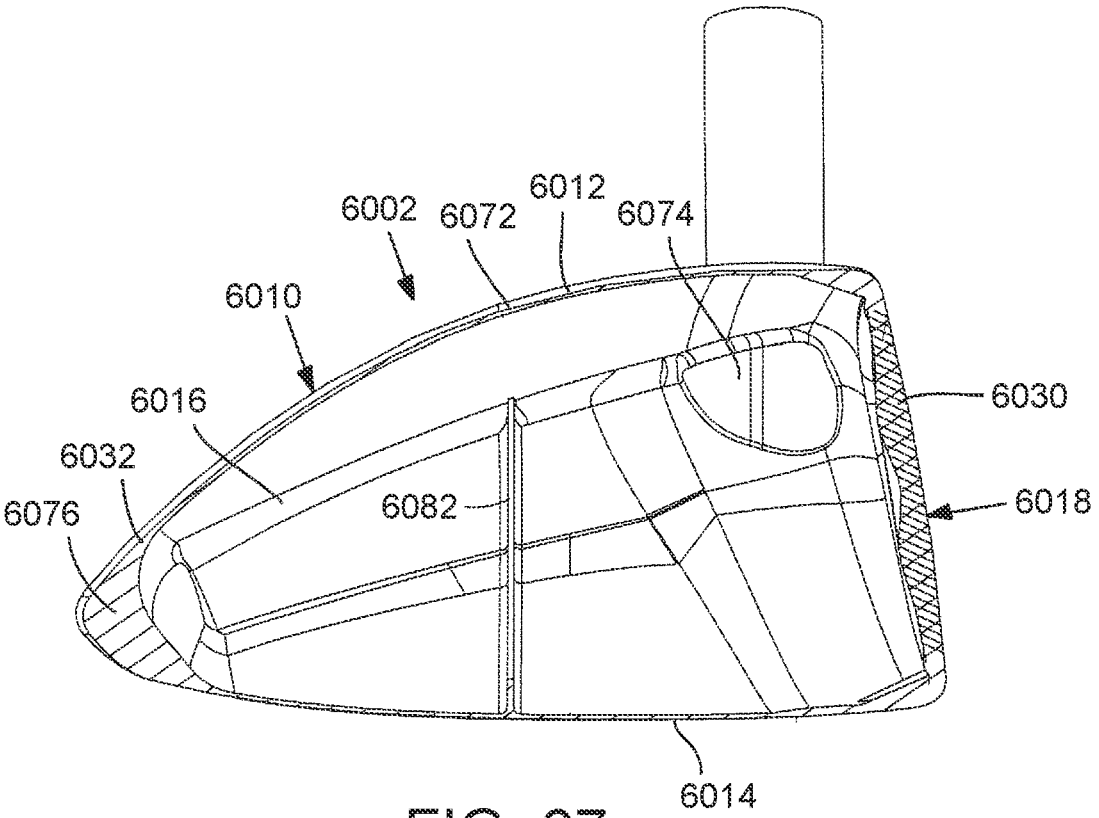
FIG. 67 is a cross-sectional side view of the golf club head of FIG. 60 taken along the line 67-67 of FIG. 61 and shown without the hosel.
Figure 68:
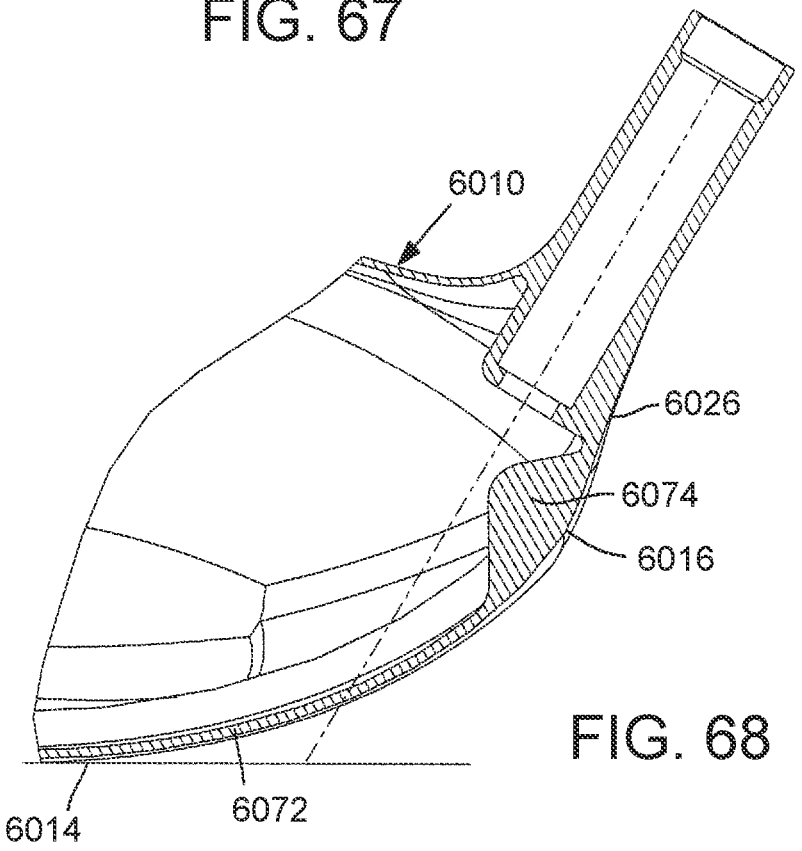
FIG. 68 is a cross-sectional detailed view of the golf club head of FIG. 60 taken along the line 68-68 of FIG. 60 showing a heel mass element.
Figure 69:
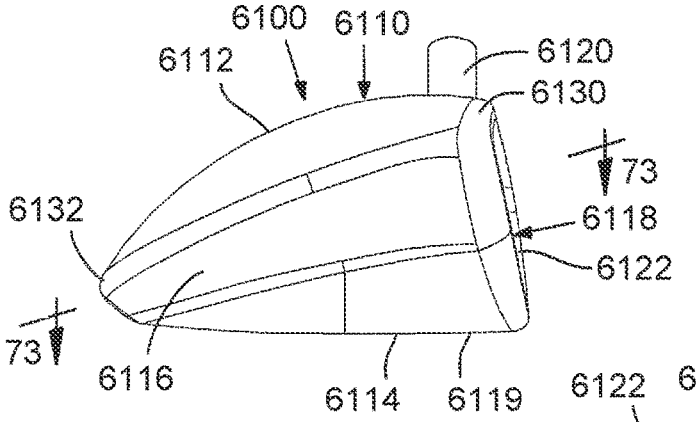
FIG. 69 is a side elevation view of a golf club head according to a second embodiment.
Figure 70:
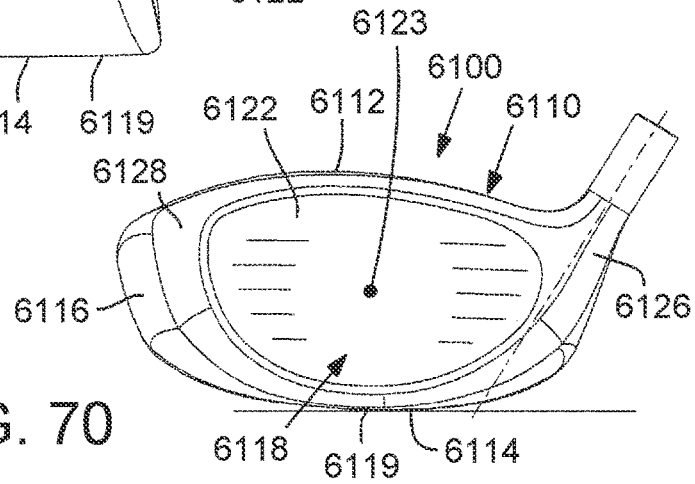
FIG. 70 is a front elevation view of the golf club head of FIG. 69.
Figure 71:
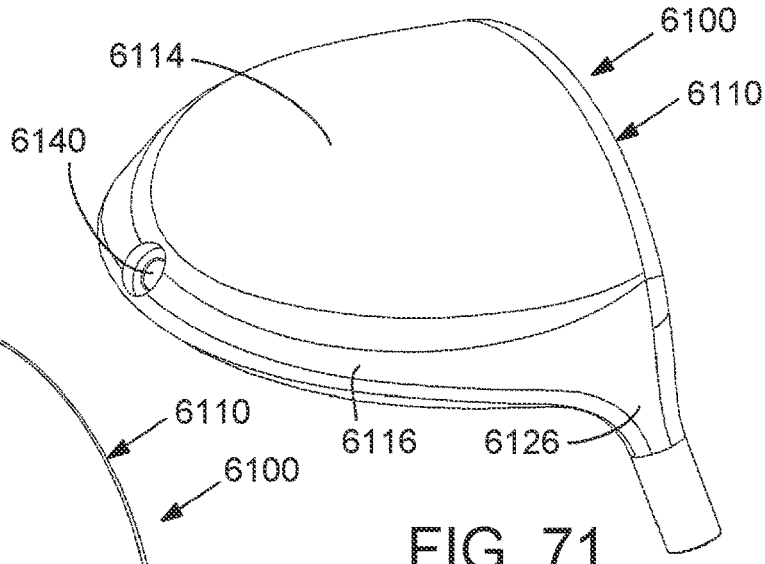
FIG. 71 is a bottom perspective view of the golf club head of FIG. 69.
Figure 72:
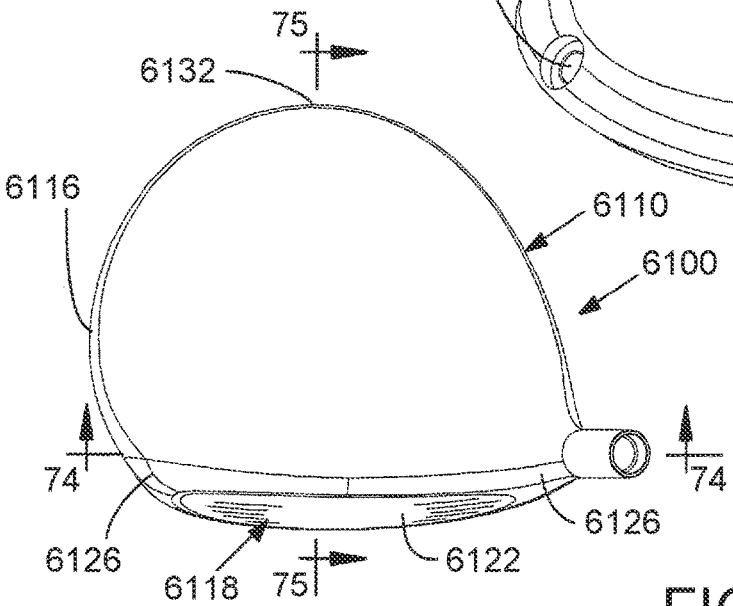
FIG. 72 is a top plan view of the golf club head of FIG. 69.

Referring to FIGS. 66-68, golf club 6002 includes a localized heel mass element 6074 and rear mass element 6076. A mass element can be defined as an individual structure having a mass, or a plurality of localized structures each having a mass, secured to a wall of a golf club head or integrally formed as a one-piece construction with and extending from the wall of a golf club head. Although an integrally formed mass element can be described as a build-up of wall thickness, a portion of the built-up wall thickness contiguous with, and having the same general thickness as, the wall surrounding the mass element does not form part of the mass element, and thus is not included in the mass or center of gravity determination of the mass element.

The mass elements 6074, 6076 can be positioned within the interior cavity 6079 and secured to, or be formed integrally with, respective inner surfaces of wall 6072 or striking face 6018. As shown, the mass elements 6074, 6076 are formed integrally with, and extend inwardly from, wall 6072 or striking face 6018 of body 6010 to form a localized area of increased or built-up wall thickness. The heel mass element 6074 is positioned on the skirt 6014 at the heel portion 6026 of the golf club head 6002 proximate the front portion 6030.

The rear mass element 6076 extends inwardly from the sole 6014, skirt 6016, and crown 6012 and is positioned proximate the rear portion 6032 of the golf club head 6002.

The location of each mass element 6074, 6076 on the golf club head can be defined as the location of the center of gravity of the mass element relative to the club head origin coordinate system. For example, in some implementations, the heel mass element 6074 has an origin x-axis coordinate between approximately 35 mm and approximately 65 mm, an origin y-axis coordinate between approximately 0 mm and approximately 30 mm, and an origin z-axis coordinate between approximately −20 mm and approximately 10 mm. In one specific implementation, the heel mass element 6074 has an origin x-axis coordinate of approximately 50 mm, an origin y-axis coordinate of approximately 15 mm, and an origin z-axis coordinate of approximately −3 mm. Similarly, in some implementations, the rear mass element 6076 has an origin x-axis coordinate between approximately −20 mm and approximately 10 mm, an origin y-axis coordinate between approximately 90 mm and approximately 120 mm, and an origin z-axis coordinate between approximately −20 mm and approximately 10 mm. In one specific implementation, the rear mass element 6076 has an origin x-axis coordinate of approximately −7 mm, an origin y-axis coordinate of approximately 106 mm, and an origin z-axis coordinate of approximately −3 mm.

Further, the mass elements 6074, 6076 can have any one of various masses. For example, in some implementations, the heel mass element 6074 has a mass between about 3 g and about 23 g and the rear mass element 6076 has a mass between about 15 g and about 35 g. In one specific implementation, the heel mass element 6074 has a mass of approximately 6 g and the rear mass element 6076 has a mass of approximately 24 g.

The configuration of the golf club head 6002, including the locations and mass of the mass elements 6074, 6076, can, in some implementations, result in the club head 6002 having a moment of inertia about the CG z-axis (Izz) between about 450 kg·mm$^2$ and about 600 kg·mm$^2$, and a moment of inertia about the CG x-axis (Ixx) between about 280 kg·mm$^2$ and about 400 kg·mm$^2$. In one specific implementation having the mass element locations and masses indicated in FIG. 89, club head 6002 has a moment of inertia about the CG z-axis (Izz) of approximately 528 kg·mm$^2$ and a moment of inertia about the CG x-axis (Ixx) of approximately 339 kg·mm$^2$. In this implementation, then, the ratio of Ixx/Izz is approximately 0.64. However, in other implementations, the ratio of Ixx/Izz is between about 0.5 kg·mm$^2$ and about 0.9 kg·mm$^2$.

Referring to FIGS. 69-75, and according to another exemplary embodiment, golf club head 6100 has a body 6110 with a crown 6112, sole 6114, skirt 6116, and striking face 6118 defining an interior cavity 6157. The body 6110 further includes a hosel 6120, heel portion 6126, a toe portion 6128, a front portion 6130, a rear portion 6132, and an internal rib 6182. The striking face 6118 includes an outwardly facing ball striking surface 6122 having an ideal impact location at a geometric center 6123 of the striking surface. In some implementations, the golf club head 6100 has a volume between approximately 420 cm$^3$ and approximately 480 cm$^3$, and a total mass between approximately 190 g and approximately 210 g. Referring to FIG. 89, in one specific implementation, the golf club head 100 has a volume of approximately 454 cm$^3$ and a total mass of approximately 202.8 g.

Unless otherwise noted, the general details and features of the body 6110 of golf club head 6100 can be understood with reference to the same or similar features of the body 6010 of golf club head 6002.

The sole 6114 extends upwardly from the lowest point of the golf club head 6100 *a* shorter distance than the sole 6014 of golf club head 6002. For example, in some implementations, the sole 6114 extends upwardly approximately 20% to 40% of the distance from the lowest point of the club head 6100 to the crown 6112, which in some instances, can be approximately 15 mm for a driver and between approximately 10 mm and approximately 12 mm for a fairway wood. Further, the sole 6114 comprises a substantially flat portion 6119 extending horizontal to the ground 6117 when in proper address position. In some implementations, the bottommost portion of the sole 6114 extends substantially parallel to the ground 6117 between approximately 70% and approximately 40% of the depth (Dch) of the golf club head 6100.

Because the sole 6114 of golf club head 6100 is shorter than the sole 6012 of golf club head 6002, the skirt 6116 is taller, i.e., extends a greater approximately vertical distance, than the skirt 6016 of golf club head 6002. In at least one implementation, the golf club head 6100 includes a weight port 6140 formed in the skirt 6116 proximate the rear portion 6132 of the club head (see FIG. 71). The weight port 6140 can have any of a number of various configurations to receive and retain any of a number of weights or weight assemblies, such as described in U.S. patent application Ser. Nos. 11/066,720 and 11/065,772, which are incorporated herein by reference.

In some implementations, the striking surface 6122 golf club head 6100 has a height (Hss) between approximately 50 mm and approximately 65 mm, and a width (Wss) between approximately 80 mm and approximately 100 mm. Referring to FIG. 89, in one specific implementation, the golf club head 6100 has a height (Hss) of approximately 59.6 mm, width (Wss) of approximately 90.6 mm, and total striking surface area of approximately 4,098 mm$^2$.

In one embodiment, the golf club head 6100 has a CG with an x-axis coordinate between approximately −2 mm and approximately 6 mm, a y-axis coordinate between approximately 33 mm and approximately 41 mm, and a z-axis coordinate between approximately −8 mm and approximately 0 mm. Referring to FIG. 89, in one specific implementation, the CG x-axis coordinate is approximately 2.0 mm, the CG y-axis coordinate is approximately 37.9 mm, and the CG z-axis coordinate is approximately −4.67 mm.

In some implementations, the golf club head 6100 has a height (Hch) between approximately 55 mm and approximately 75 mm, a width (Wch) between approximately 110 mm and approximately 130 mm, and a depth (Dch) between approximately 110 mm and approximately 130 mm. Referring to FIG. 89, in one specific implementation, the golf club head 6100 has a height (Hch) of approximately 62.2 mm, width (Wch) of approximately 119.3 mm, and depth (Dch) of approximately 110.7 mm.

Figure 73:
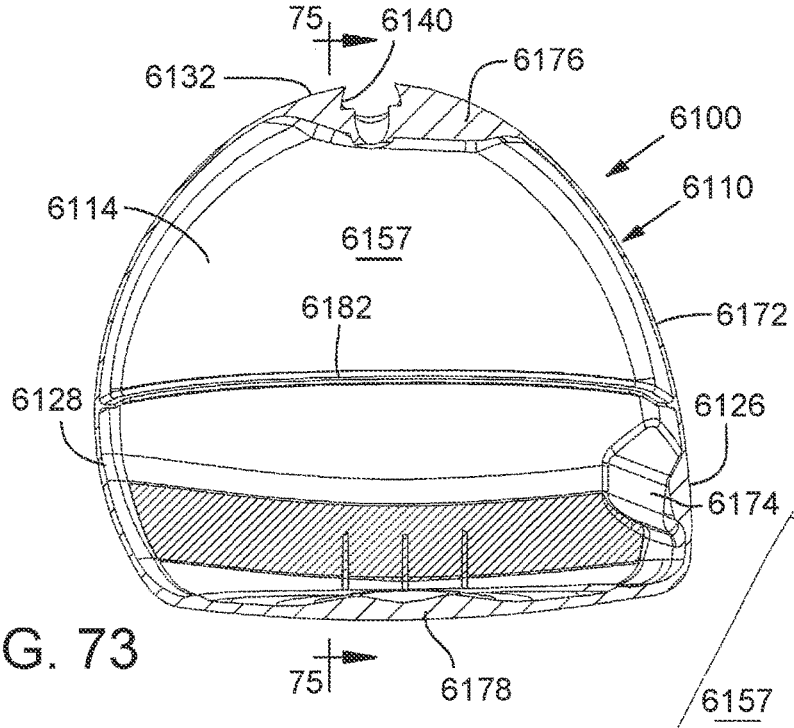
FIG. 73 is a cross-sectional view of the golf club head of FIG. 69 taken along the line 73-73 of FIG. 69.
Figure 74:
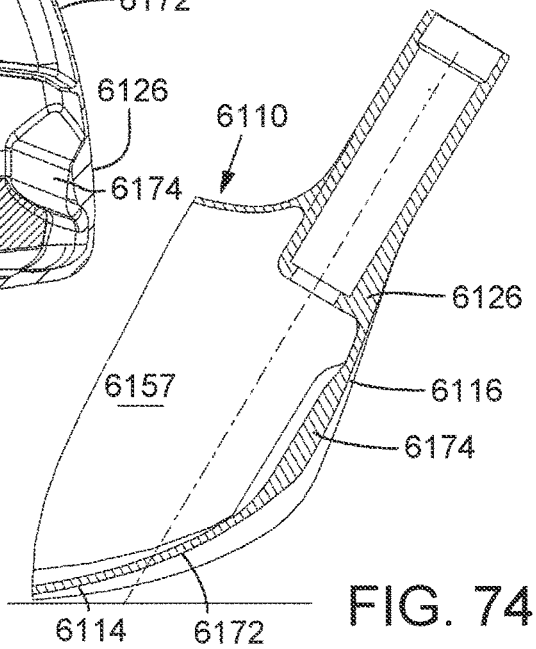
FIG. 74 is a cross-sectional detailed view of the golf club head of FIG. 69 taken along the line 74-74 of FIG. 72.
Figure 75:
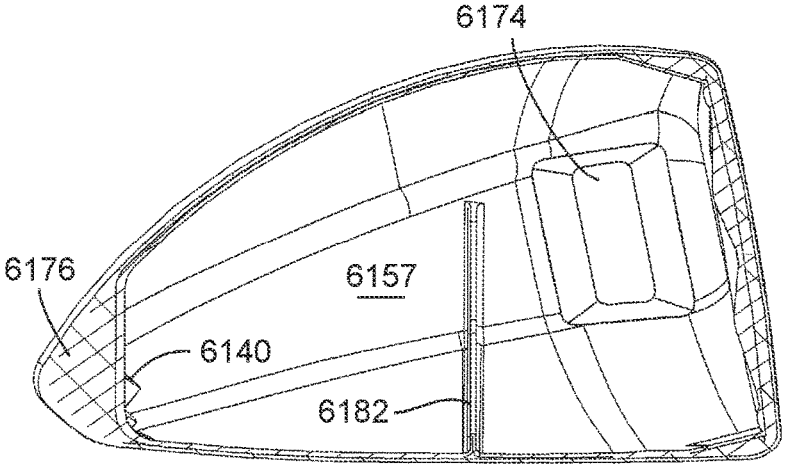
FIG. 75 is a cross-sectional side view of the golf club head of FIG. 60 taken along the line 75-75 of FIG. 72 and shown without the hosel.
Figure 76:
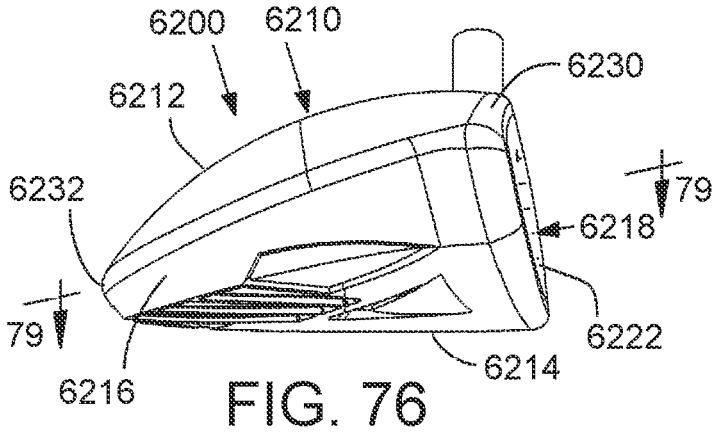
FIG. 76 is a side elevation view of a golf club head according to a third embodiment.

Referring to FIGS. 73-75, golf club head 6100 includes a localized heel mass element 6174 and rear mass element 6176. In some implementations, the heel mass element 6174 has an origin x-axis coordinate between approximately 35 mm and approximately 65 mm, an origin y-axis coordinate between approximately 10 mm and approximately 40 mm, and an origin z-axis coordinate between approximately −25 mm and approximately 5 mm. In one specific implementation, the heel mass element 6174 has an origin x-axis coordinate of approximately 50 mm, an origin y-axis coordinate of approximately 25 mm, and an origin z-axis coordinate of approximately −10 mm. Similarly, in some implementations, the rear mass element 6176 has an origin x-axis coordinate between approximately −15 mm and approximately 15 mm, an origin y-axis coordinate between approximately 90 mm and approximately 120 mm, and an origin z-axis coordinate between approximately −20 mm and approximately 10 mm. In one specific implementation, the rear mass element 6176 has an origin x-axis coordinate of approximately 0 mm, an origin y-axis coordinate of approximately 103 mm, and an origin z-axis coordinate of approximately −4 mm.

Like mass elements 6074, 6076, the mass elements 6174, 6176 can have any one of various masses. For example, in some implementations, the heel mass element 6174 has a mass between about 3 g and about 23 g and the rear mass element 6176 has a mass between about 10 g and about 30 g. In one specific implementation, the heel mass element 6174 has a mass of approximately 6 g and the rear mass element 6176 has a mass of approximately 19 g.

The configuration of the golf club head 6100, including the locations and mass of the mass elements 6174, 6176, can, in some implementations, result in the club head having a moment of inertia about the CG z-axis (Izz) between about 450 kg·mm$^2$ and about 600 kg·mm$^2$, and a moment of inertia about the CG x-axis (Ixx) between about 280 kg·mm$^2$ and about 400 kg·mm$^2$. In one specific implementation having mass element locations and masses indicated in FIG. 89, club head 6100 has a moment of inertia about the CG z-axis (Izz) of approximately 498 kg·mm$^2$ and a moment of inertia about the CG x-axis (Ixx) of approximately 337 kg·mm$^2$. In this implementation, then, the ratio of Ixx/Izz is approximately 0.68. However, in other implementations, the ratio of Ixx/Izz is between about 0.5 and about 0.9.

Referring to FIGS. 76-80, and according to another exemplary embodiment, golf club head 6200 has a body 6210 with a low skirt similar to body 6110 of golf club head 6100. The body 6210 includes a crown 6212, a sole 6214, a skirt 6216, a striking face 6218 defining an interior cavity 6257. The body 6210 further includes a hosel 6220, heel portion 6226, toe portion 6228, front portion 6230, and rear portion 6232. The striking face 6218 includes an outwardly facing ball striking surface 6222 having an ideal impact location at a geometric center 6223 of the striking surface. In some implementations, the golf club head 6200 has a volume between approximately 420 cm$^3$ and approximately 480 cm$^3$, and a total mass between approximately 190 g and approximately 210 g. Referring to FIG. 89, in one specific implementation, the golf club head 6200 has a volume of approximately 454 cm$^3$ and a total mass of approximately 202.8 g.

Unless otherwise noted, the general details and features of the body 6210 of golf club head 6200 can be understood with reference to the same or similar features of the body 6010 of golf club head 6002 and body 6110 of golf club head 6100.

Like sole 6114 of golf club head 6100, the sole 6214 extends upwardly approximately 20% to 40% of the distance from the lowest point of the club head 6200 to the crown 6212. Therefore, the skirt 6216 is taller, i.e., extends a greater approximately vertical distance, than the skirt 6016 of golf club head 6002.

Figure 77:
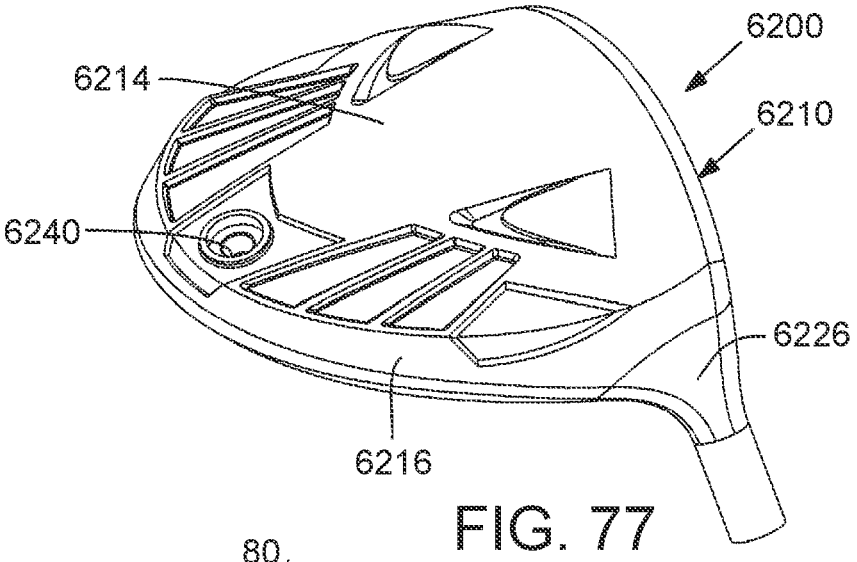
FIG. 77 is a bottom perspective view of the golf club head of FIG. 76.
Figure 78:
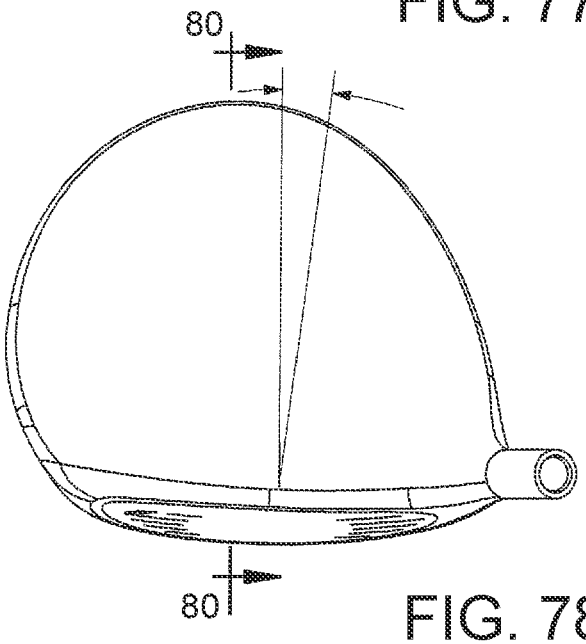
FIG. 78 is a top plan view of the golf club head of FIG. 76.
Figure 80:
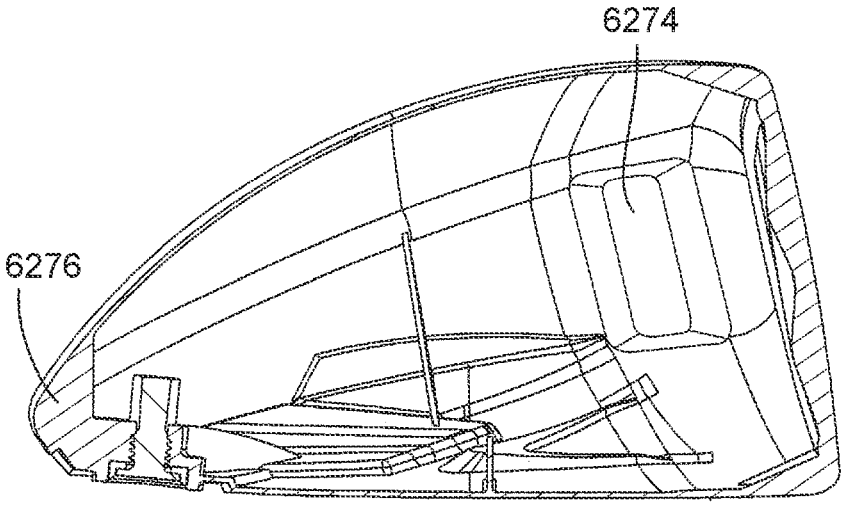
FIG. 80 is a cross-sectional side view of the golf club head of FIG. 76 taken along the line 80-80 of FIG. 78 and shown without the hosel.
Figure 81:
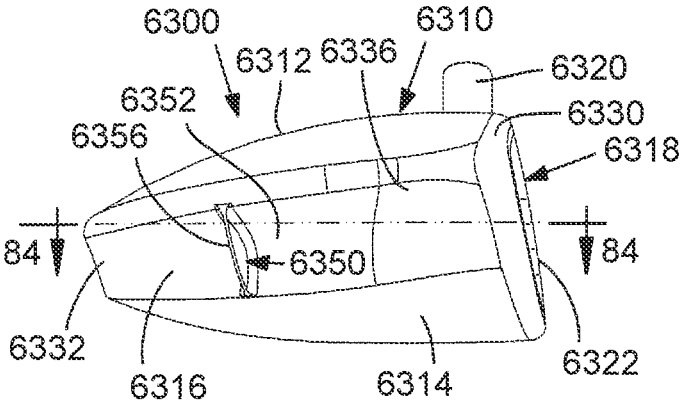
FIG. 81 is a side elevation view of a golf club head according to a fourth embodiment.
Figure 82:
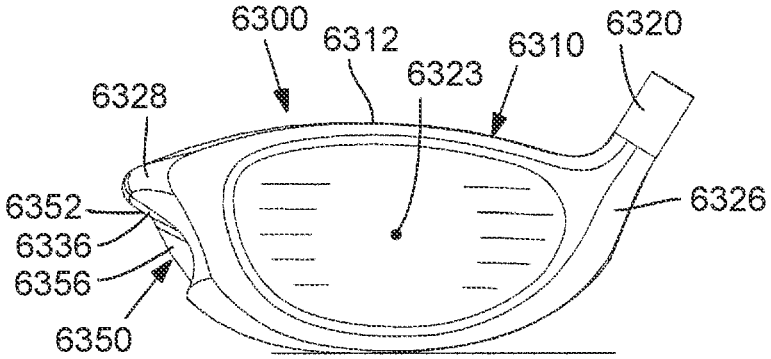
FIG. 82 is a front elevation view of the golf club head of FIG. 81.
Figure 83:
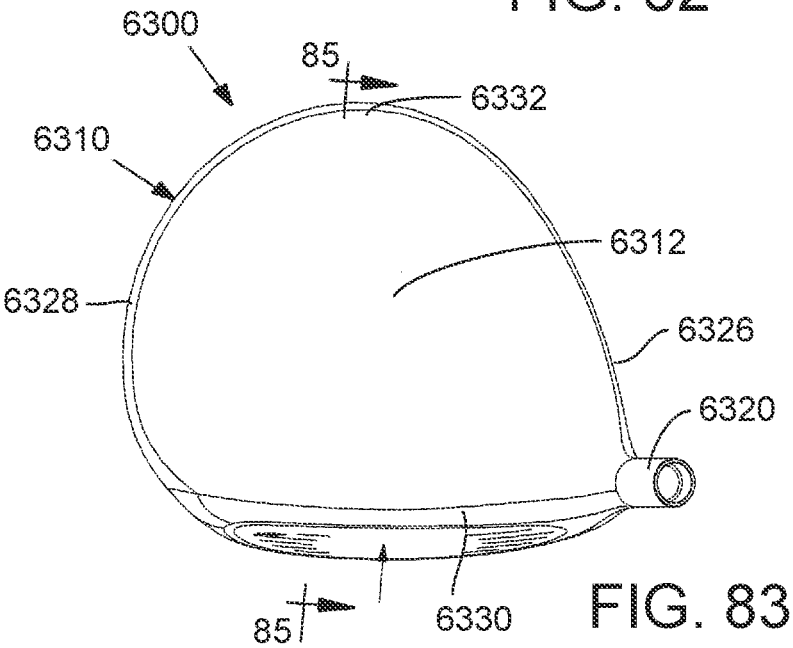
FIG. 83 is a top plan view of the golf club head of FIG. 81.

In at least one implementation, and shown in FIGS. 77 and 80, the golf club head 6200 includes a weight port 6240 formed in the sole 6114 proximate the rear portion 6232 of the club head. The weight port 6240 can have any of a number of various configurations to receive and retain any of a number of weights or weight assemblies. For example, as shown, the weight port 6240 extends substantially vertically from the wall 6272 of the body 6210 upwardly into the interior cavity 6257.

In some implementations, the striking surface 6222 golf club head 6200 has a height (Hss) between approximately 50 mm and approximately 65 mm, and a width (Wss) between approximately 80 mm and approximately 100 mm. Referring to FIG. 89, in one specific implementation, the golf club head 6200 has a height (Hss) of approximately 56.8 mm, width (Wss) of approximately 92.3 mm, and total striking surface area of approximately 4,100 mm$^2$.

In one embodiment, the golf club head 6200 has a CG with an x-axis coordinate between approximately −2 mm and approximately 6 mm, a y-axis coordinate between approximately 33 mm and approximately 41 mm, and a z-axis coordinate between approximately −8 mm and approximately 0 mm. Referring to FIG. 89, in one specific implementation, the CG x-axis coordinate is approximately 2.3 mm, the CG y-axis coordinate is approximately 36.7 mm, and the CG z-axis coordinate is approximately −4.65 mm.

In some implementations, the golf club head 6200 has a height (Hch) between approximately 55 mm and approximately 75 mm, a width (Wch) between approximately 110 mm and approximately 130 mm, and a depth (Dch) between approximately 110 mm and approximately 130 mm. Referring to FIG. 89, in one specific implementation, the golf club head 6200 has a height (Hch) of approximately 61.5 mm, width (Wch) of approximately 122.8 mm, and depth (Dch) of approximately 113.5 mm.

Figure 79:
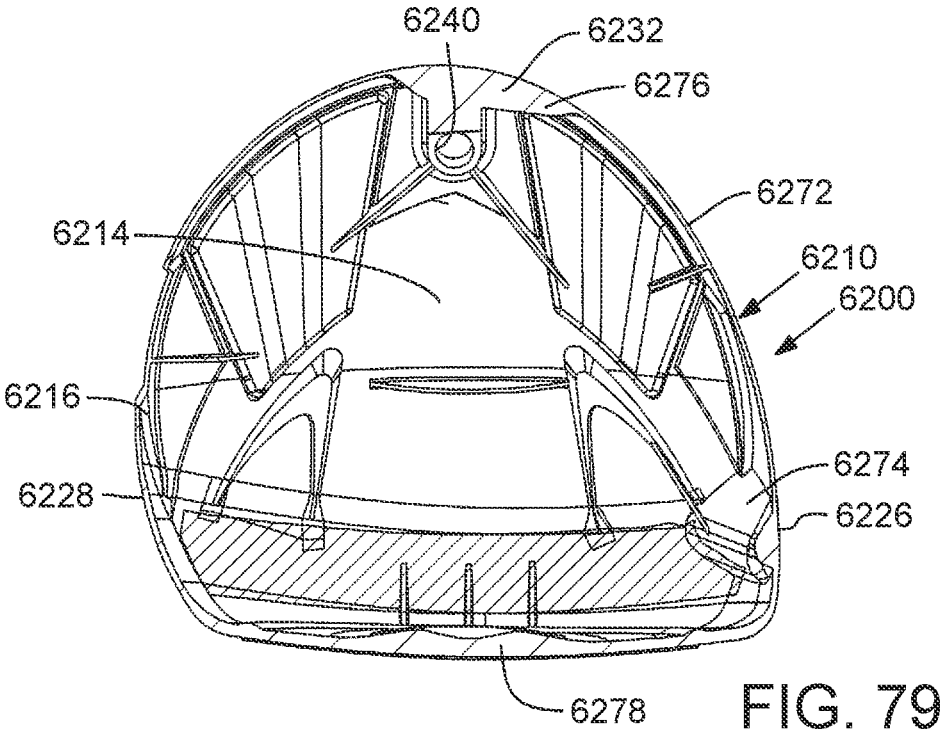
FIG. 79 is a cross-sectional view of the golf club head of FIG. 76 taken along the line 79-79 of FIG. 76.

Referring to FIGS. 79 and 80, golf club head 6200 includes a localized heel mass element 6274 and rear mass element 6276. In some implementations, the heel mass element 6274 has an origin x-axis coordinate between approximately 35 mm and approximately 65 mm, an origin y-axis coordinate between approximately 10 mm and approximately 40 mm, and an origin z-axis coordinate between approximately −15 mm and approximately 5 mm. In one specific implementation, the heel mass element 6274 has an origin x-axis coordinate of approximately 50 mm, an origin y-axis coordinate of approximately 21 mm, and an origin z-axis coordinate of approximately −11 mm. Similarly, in some implementations, the rear mass element 6276 has an origin x-axis coordinate between approximately −15 mm and approximately 15 mm, an origin y-axis coordinate between approximately 95 mm and approximately 125 mm, and an origin z-axis coordinate between approximately −30 mm and approximately 0 mm. In one specific implementation, the rear mass element 6276 has an origin x-axis coordinate of approximately −1 mm, an origin y-axis coordinate of approximately 106 mm, and an origin z-axis coordinate of approximately −18 mm.

Like mass elements 6074, 6076, the mass elements 6274, 6276 can have any one of various masses or weights. For example, in some implementations, the heel mass element 6274 has a mass between about 3 g and about 23 g and the rear mass element 6276 has a mass between about 5 g and about 25 g. In one specific implementation, the heel mass element 6274 has a mass of approximately 5 g and the rear mass element 6276 has a mass of approximately 8 g.

The configuration of the golf club head 6200, including the locations and mass of the mass elements 6274, 6276, can, in some implementations, result in the club head having a moment of inertia about the CG z-axis (Izz) between about 450 kg·mm$^2$ and about 600 kg·mm$^2$, and a moment of inertia about the CG x-axis (Ixx) between about 280 kg·mm$^2$ and about 400 kg·mm$^2$. In one specific implementation having mass element locations and masses indicated in FIG. 89, club head 6200 has a moment of inertia about the CG z-axis (Izz) of approximately 495 kg·mm$^2$ and a moment of inertia about the CG x-axis (Ixx) of approximately 333 kg·mm$^2$. In this implementation, then, the ratio of Ixx/Izz is approximately 0.67. However, in other implementations, the ratio of Ixx/Izz is between about 0.5 and about 0.9.

Referring to FIGS. 81-85, and according to another exemplary embodiment, golf club head 6300 has a body 6310 that includes a crown 6312, a sole 6314, a skirt 6316, a striking face 6318 defining an interior cavity 6357. The body 6310 further includes a hosel 6320, heel portion 6326, toe portion 6328, front portion 6330, and rear portion 6332. The striking face 6318 includes an outwardly facing ball striking surface 6322 having an ideal impact location at a geometric center 6323 of the striking surface. The club head 6300 also has a volume, typically measured in cubic-centimeters (cm$^3$), equal to the volumetric displacement of the club head 6300. In some implementations, the golf club head 6300 has a volume between approximately 420 $cm^3$ and approximately 480 $cm^3$, and a total mass between approximately 190 g and approximately 210 g. Referring to FIG. 89, in one specific implementation, the golf club head 300 has a volume of approximately 453 $cm^3$ and a total mass of approximately 202.3 g.

Unless otherwise noted, the general details and features of the body 6310 of golf club head 6300 can be understood with reference to the same or similar features of the body 6010 of golf club head 6002, body 6110 of golf club head 6100 and body 6210 of golf club head 6200.

Like soles 6114, 6214, the sole 6314 extends upwardly approximately 20% to 40% of the distance from the lowest point of the club head 6300 to the crown 6312. Like skirts 6116, 6216, the skirt 6316 is taller, i.e., extends a greater approximately vertical distance, than the skirt 6016 of golf club head 6002. However, unlike, skirts 6116, 6216, skirt 6316 includes an inverted portion 6352 having a substantially concave outer surface 6336 extending about at least a substantial portion of the toe portion 6328 of the golf club head 6300.

Similar to the golf club head described in U.S. patent application Ser. No. 11/565,485, which is incorporated herein by reference, golf club head 6300 includes a rib 6350 that has an external portion 6356 and two internal portions 6358, 6360 (see FIGS. 83 and 84). The external portion 6356 is positioned along and projects from the external surface 6336 of the concave portion 6330. The internal portions 6358, 6360 are positioned within the internal cavity 6357 of the body 6302 and project from an internal surface 6338 of the body. The external portion 6356 is positioned between the first and second internal portions 6358, 6360 and is coupled to the internal portions via respective first and second rib transition regions (not shown) formed in a wall 6372 of the body 6310. Rib 6350 extends generally parallel to a striking surface 6322 of striking face 6318 of the golf club head 6300 along the toe portion 6328 of the body 6310. More specifically, the rib 6350 extends along the toe potion 6328 of the body 6310 upwardly from the sole 6314, along the skirt 6316, to the crown 6312.

In some implementations, the striking surface 6322 golf club head 6300 has a height (Hss) between approximately 50 mm and approximately 65 mm, and a width (Wss) between approximately 80 mm and approximately 100 mm. Referring to FIG. 89, in one specific implementation, the golf club head 6300 has a height (Hss) of approximately 57.2 mm, width (Wss) of approximately 90.6 mm, and total striking surface area of approximately 3,929 $mm^2$.

In one embodiment, the golf club head 6300 has a CG with an x-axis coordinate between approximately −2 mm and approximately 6 mm, a y-axis coordinate between approximately 33 mm and approximately 41 mm, and a z-axis coordinate between approximately −6 mm and approximately 2 mm. Referring to FIG. 89, in one specific implementation, the CG x-axis coordinate is approximately 3.3 mm, the CG y-axis coordinate is approximately 30.1 mm, and the CG z-axis coordinate is approximately −0.09 mm.

In some implementations, the golf club head 6300 has a height (Hch) between approximately 53 mm and approximately 73 mm, a width (Wch) between approximately 105 mm and approximately 125 mm, and a depth (Dch) between approximately 105 mm and approximately 125 mm. Referring to FIG. 89, in one specific implementation, the golf club head 6300 has a height (Hch) of approximately 59 mm, width (Wch) of approximately 117.2 mm, and depth (Dch) of approximately 117.2 mm.

Figure 84:
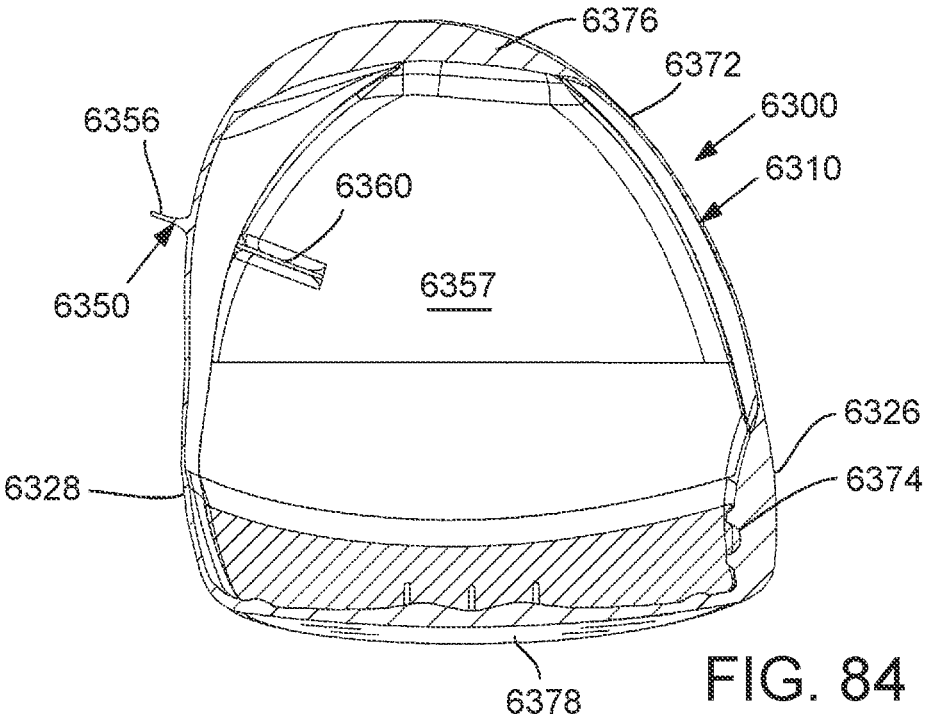
FIG. 84 is a cross-sectional view of the golf club head of FIG. 81 taken along the line 84-84 of FIG. 81.
Figure 85:
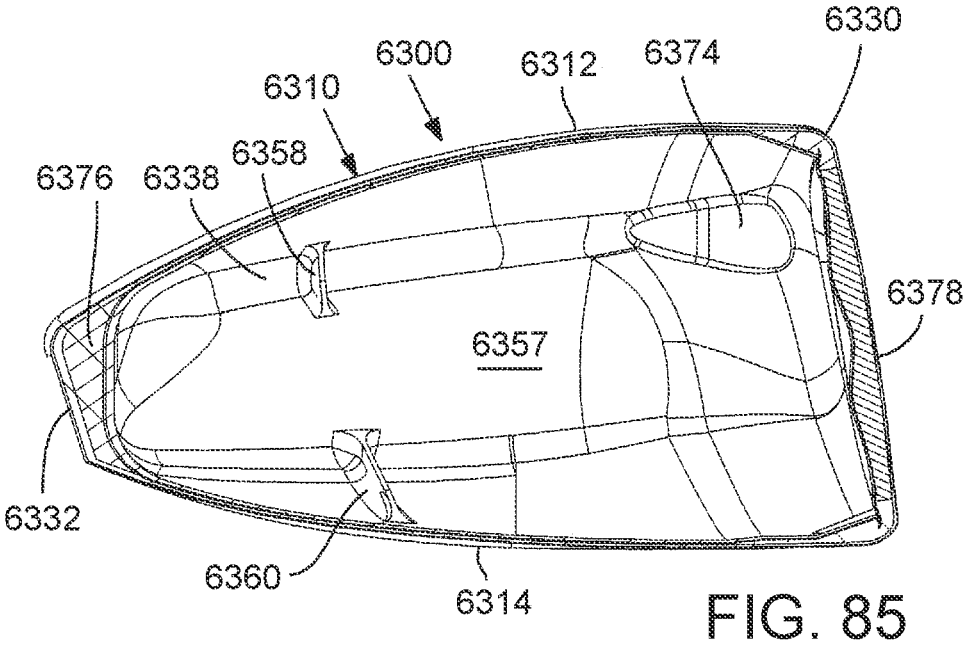
FIG. 85 is a cross-sectional side view of the golf club head of FIG. 81 taken along the line 85-85 of FIG. 83 and shown without the hosel.

Referring to FIGS. 84 and 85, golf club head 6300 includes a localized heel mass element 6374, rear mass element 6376 and toe mass element 6378. The toe mass element 6378 is similar to the heel mass element 6374, but positioned on the skirt 6314 at the toe portion 6328 of the golf club head 6310 proximate the front portion 6330.

In some implementations, the heel mass element 6374 has an origin x-axis coordinate between approximately 35 mm and approximately 65 mm, an origin y-axis coordinate between approximately 10 mm and approximately 40 mm, and an origin z-axis coordinate between approximately 0 mm and approximately 20 mm. In one specific implementation, the heel mass element 6374 has an origin x-axis coordinate of approximately 53 mm, an origin y-axis coordinate of approximately 21 mm, and an origin z-axis coordinate of approximately 7 mm. Similarly, in some implementations, the rear mass element 6376 has an origin x-axis coordinate between approximately −25 mm and approximately 5 mm, an origin y-axis coordinate between approximately 90 mm and approximately 120 mm, and an origin z-axis coordinate between approximately −5 mm and approximately 25 mm. In one specific implementation, the rear mass element 6376 has an origin x-axis coordinate of approximately −10 mm, an origin y-axis coordinate of approximately 109 mm, and an origin z-axis coordinate of approximately 10 mm.

Like mass elements 6074, 6076, the mass elements 6374, 6376 can have any one of various masses or weights. For example, in some implementations, the heel mass element 6374 has a mass between about 5 g and about 25 g and the rear mass element 6376 has a mass between about 10 g and about 30 g. In one specific implementation, the heel mass element 6374 has a mass of approximately 11 g and the rear mass element 6376 has a mass of approximately 21 g.

The configuration of the golf club head 6300, including the locations and mass of the mass elements 6374, 6376, can, in some implementations, result in the club head having a moment of inertia about the CG z-axis (Izz) between about 450 $kg \cdot mm^2$ and about 600 $kg \cdot mm^2$, and a moment of inertia about the CG x-axis (Ixx) between about 280 $kg \cdot mm^2$ and about 400 $kg \cdot mm^2$. In one specific implementation having mass element locations and masses indicated in FIG. 89, club head 6300 has a moment of inertia about the CG z-axis (Izz) of approximately 536 $kg \cdot mm^2$ and a moment of inertia about the CG x-axis (Ixx) of approximately 336 $kg \cdot mm^2$. In this implementation, then, the ratio of Ixx/Izz is approximately 0.63. However, in other implementations, the ratio of Ixx/Izz is between about 0.5 and about 0.9.

Figure 86:
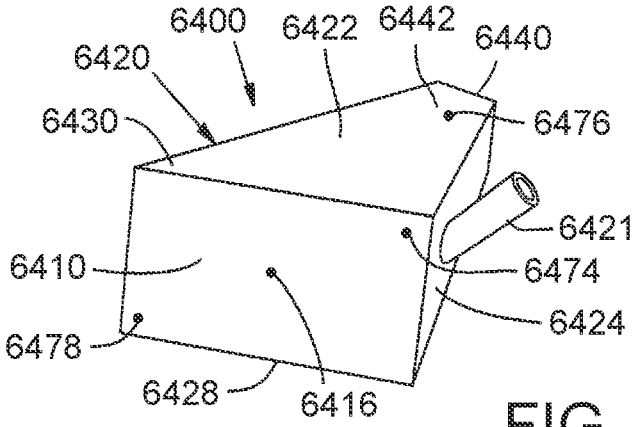
FIG. 86 is a perspective view of a golf club head according to a fifth embodiment.
Figure 87:
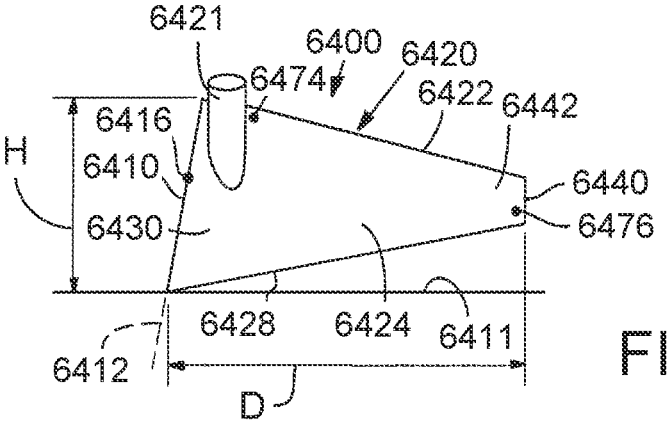
FIG. 87 is a side elevation view of the golf club head of FIG. 86.
Figure 88:
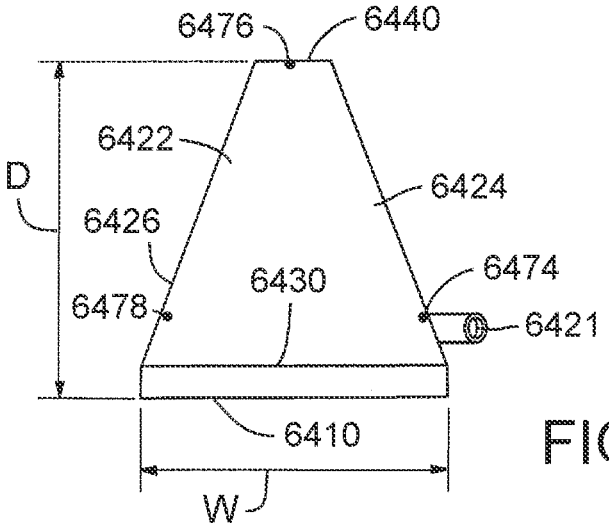
FIG. 88 is a top plan view of the golf club head of FIG. 86.

One specific exemplary implementation of a golf club head 6400 having a generally rectangular ball striking face with a corresponding rectangular ball striking surface 6410 is shown in FIGS. 86-88. The golf club head 6400 includes a body 6420 having a hosel 6421 and four generally planar sides, i.e., top side 6422, right side 6424, left side 6426, and bottom side 6428. The sides 6422, 6424, 6426, 6428 extend in a tapering manner from the ball striking surface 6410 at a forward portion 6430 of the golf club head and converging at a generally square end 6440 at a rearward portion 6442 of the golf club head. Accordingly, the surface area of the ball striking surface 6410 is larger than the cross-sectional surface areas of the body 6420 along planes parallel to the striking surface. The golf club head 6400 includes a club head origin 6416 positioned at the geometric center of the striking surface 6410. The origin 6416 acts as the origin of a golf club head coordinate system, similar to that described above, of the golf club head 6400.

In the illustrated embodiment, the edges, or intersections, between the sides 6422, 6424, 6426, 6428, striking surface 6410 and end 6440 appear relatively sharp. Of course, any one or more of the sharp edges between the sides, striking surface and end can be eased or radiused without departing from the general relationships. In general, the golf club head 6400 has a generally pyramidal, prismatic, pyramidal frustum, or prismatic frustum shape. When viewed from above, or in plan view, the golf club head has a generally triangular or trapezoidal shape.

In one specific implementation, for optimum forgiveness and playability, the ball striking surface 6410 has the maximum allowable surface area under current USGA dimensional constraints for golf club heads. In other words, the ball striking surface 6410 has a maximum height (H) of approximately 71 mm (2.8 inches) and a maximum width (W) of approximately 125 mm (5 inches). Accordingly, the ball striking surface 6410 has an area of approximately 8,875 $mm^2$. In other embodiments, the ball striking surface 6410 may have a maximum height (H) between about 67 mm to about 71 mm, a maximum width (W) between about 118 mm to about 125 mm, and a corresponding ball striking surface area of between about 7,900 $mm^2$ to about 8,875 $mm^2$.

In certain implementations, the golf club head 6400 has a maximum depth (D) equal to the maximum allowable depth under current USGA dimensional constraints, i.e., approximately 125 mm. In other embodiments, the golf club head 6400 may have a maximum depth (D) between about 118 mm to about 125 mm. In some implementations, the golf club head 6400 has a volume equal to the maximum allowable volume under current USGA dimensional constraints, i.e., approximately 460 $cm^3$. The area of the square end 6440 may range from about 342 $mm^2$ to about 361 $mm^2$.

The golf club head 6400 includes one or more discrete mass elements. For example, in the illustrated embodiments, the golf club head 6400 includes three discrete mass elements: heel mass element 6474, rear mass element 6476 and toe mass element 6478. Each mass element 6474, 6476, 6478 is defined by its location about the golf club head 6400 and mass. The location of the mass elements about the golf club head are described according to the coordinates of the mass element CG on the golf club head origin coordinate system.

The golf club head 6400 can be configured according to any one of various configurations, e.g., golf club head configurations 6400A-6400G, each having a unique mass element location and weight to achieve specific moments of inertia Ixx and Izz, and a specific Ixx/Izz ratio. The body 6420 of each configuration 6400A-6400G is constructed of a composite material and the total mass of the golf club head 6400 of each configuration 6400A-6400G is approximately 203 g.

Referring to FIG. 90, the locations and masses of the heel mass element 6474, rear mass element 6476 and toe mass element 6478, as well as the resulting moments of inertia characteristics, for golf club head configurations 6400A-6400G are shown. As shown, for each golf club head configuration 6400A-6400G, the moment of inertia about the CG x-axis (Ixx) is between approximately 427 $kg \cdot mm^2$ and approximately 525 $kg \cdot mm^2$, the moment of inertia about the CG z-axis (Izz) is between approximately 447 $kg \cdot mm^2$ and approximately 702 $kg \cdot mm^2$, and the Ixx/Izz ratio is between approximately 0.66 and approximately 0.96.

As indicated in FIG. 90, the location and weight of the three concentrated mass elements has a significant impact on the Ixx/Izz ratio for a given moment of inertia about the CG z-axis (Izz) or CG x-axis (Ixx). For example, golf club head configuration 6400A has a moment of inertia about the CG x-axis (Ixx) of approximately 427 $kg \cdot mm^2$ and a moment of inertia about the CG z-axis (Izz) of approximately 645 $kg \cdot mm^2$ to achieve an Ixx/Izz ratio of approximately 0.66. Although the moments of inertia about the CG x-axis (Ixx) and z-axis (Izz) provide high forgiveness on high/low and left/right off-center hits, respectively, the moment of inertia about the CG z-axis (Izz) for this configuration may make it difficult for a golfer to square the club head prior to impact with a golf ball.

As perhaps a more preferable configuration compared to configuration 6400A, golf club head configuration 6400B can be accomplished by configuring the golf club head to have a toe mass element 6478 that is closer to the heel mass element 6474 than configuration 6400A. The resultant golf club head configuration 6400B has the same moment of inertia about the CG x-axis (Ixx) as configuration 6400A, but has a moment of inertia about the CG z-axis (Izz), i.e., approximately 593 $kg \cdot mm^2$, that is less than configuration 6400A to achieve a slightly higher Ixx/Izz ratio of approximately 0.72. Although golf club head configuration 6400B has a lower moment of inertia about the CG z-axis (Izz) than configuration 6400B, the moment of inertia is still sufficiently high to provide high forgiveness for left/right off-center hits, while allowing a golfer to more easily square the golf club head prior to impact.

For more ease in squaring the golf club head prior to impact, configuration 6400C includes heel and toe mass elements 6474, 6478 that are closer to each other than configuration 6400B to reduce the moment of inertia about the CG z-axis (Izz) and maintain the moment of inertia about the CG x-axis (Ixx) compared to configuration 400C. Accordingly, configuration 6400C maintains a very high moment of inertia about the CG x-axis (Ixx) for alleviating the negative effects of high/low impacts and achieves a high moment of inertia about the CG z-axis (Izz) for alleviating the negative effects of right/left impacts. The resultant Ixx/Izz ratio of configuration 6400C of approximately 0.96 is significantly higher than the ratio of configuration 6400B.

Configuration 6400D has a moment of inertia about its z-axis (Izz) and an Ixx/Izz ratio that falls between configuration 6400B and configuration 6400C.

Configurations 6400E-6400G follow a similar pattern compared to configurations 6400B-6400D. More specifically, configuration 6400F has a moment of inertia about its z-axis (Izz) and an Ixx/Izz ratio that falls between configuration 6400E and configuration 6400G. However, the configurations 6400E-6400G differ from configurations 6400B-6400D in several respects. Most significantly, the heel and toe mass elements 6474, 6478 of respective configurations 6400E-6400G have less weight than the heel and toe mass elements 6474, 6478 of respective configurations 6400B-6400D. Additionally, the rear mass elements 6476 of respective configurations 6400E-6400G have more weight than the rear mass elements 6476 of respective configurations 6400B-6400D. In other words, more weight is concentrated in the rear of configurations 6400E-6400G than in configurations 6400B-6400D. The result is that the configurations 6400E-6400G have moments of inertia about respective CG x-axes (Ixx) that are significantly higher than the same moments of inertia achieved by configurations 6400B-6400C, while the Ixx/Izz ratios of corresponding configurations remain proportionally similar.

Figure 91:
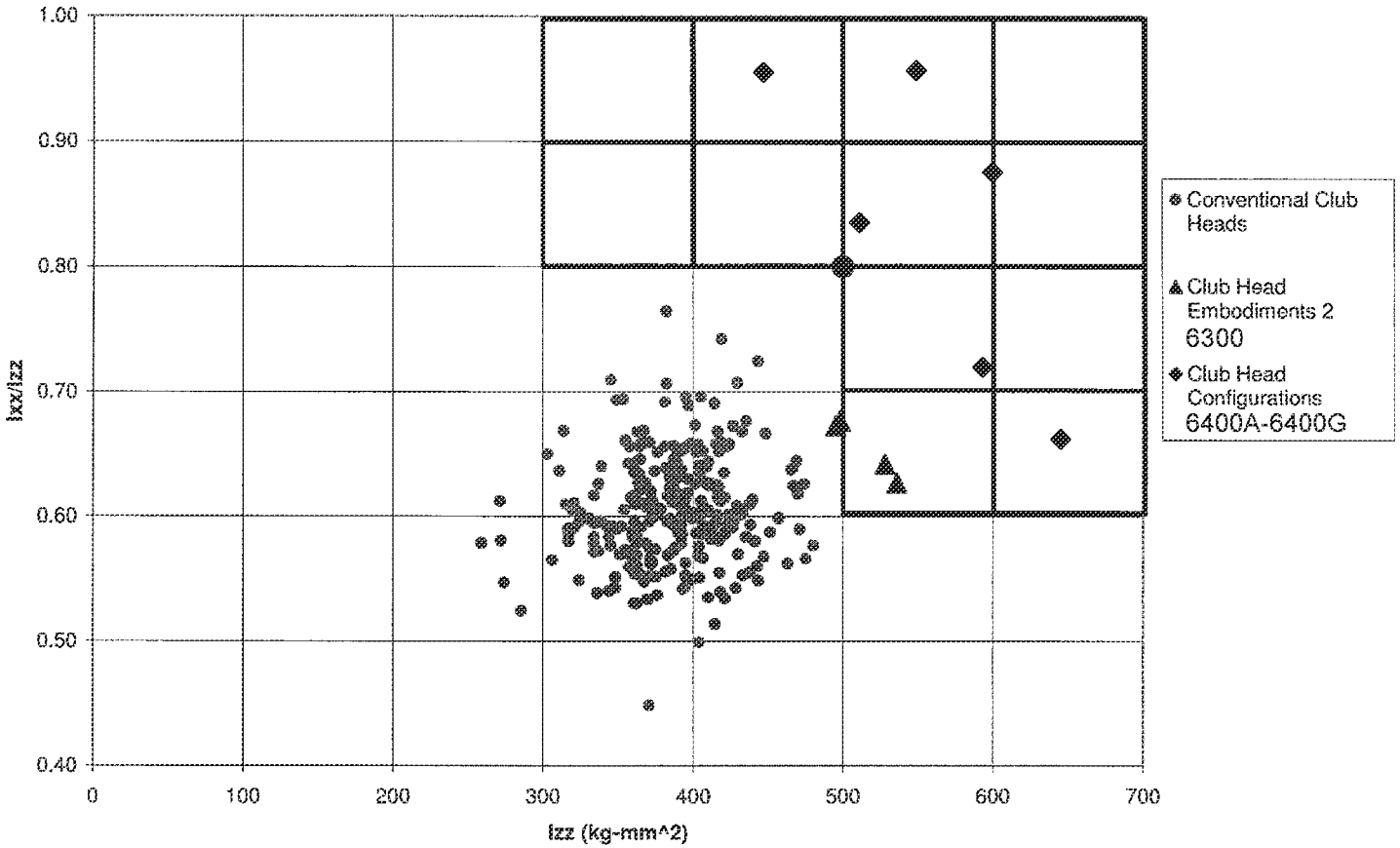
FIG. 91 is a graph showing the ratio of the moment of inertia about the center of gravity x-axis to the moment of inertia about the center of gravity z-axis versus the moment of inertia about the center of gravity z-axis for the first thru fifth golf club head embodiments and various conventional golf club heads.

Referring to FIG. 91, the Ixx/Izz ratio verses the moment of inertia about the z-axis (Izz) for each of the various golf club head embodiments described above is shown. Also shown is the Ixx/Izz ratio verses the moment of inertia about the z-axis (Izz) for a plurality of conventional golf club heads. The conventional golf club heads shown have moments of inertia about their respective CG z-axes (Izz) between about 250 kg·mm 2 and 480 kg·mm$^2$, and Ixx/Izz ratios between approximately 0.45 and 0.78. However, no individual conventional golf club head has (1) a moment of inertia about its CG z-axis (Izz) greater than approximately 480 kg·mm$^2$ and an Ixx/Izz ratio greater than approximately 0.6; or (2) a moment of inertia about its CG z-axis (Izz) greater than approximately 440 kg·mm$^2$ and an Ixx/Izz ratio greater than 0.8.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

The invention claimed is:

1. A golf club head comprising:

a club body including a leading edge, a trailing edge, a crown, a sole, a skirt disposed between and connecting the crown and the sole, a length from the leading edge to the trailing edge is 110.8-140 mm, and a maximum club head height is between 55 mm and 75 mm;

an adjustable head-shaft connection assembly coupled to the club body and operable to adjust at least one of a loft angle or a lie angle of a golf club formed when the golf club head is attached to a golf club shaft via the head-shaft connection assembly;

a face portion at a front end of the club body, the face portion including a geometric center defining an origin of a coordinate system when the golf club head is ideally positioned, the coordinate system including:

an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis;

the golf club head defining a center of gravity (CG), the CG being a distance $CG_Y$ from the origin as measured along the y-axis and a distance $CG_Z$ from the origin as measured along the z-axis, the CG located a distance $\Delta_Z$ from a ground plane, the ground plane being defined as a plane in contact with the sole of the golf club head in an ideal address position;

wherein the golf club head has a moment of inertia (Ixx) about a CG x-axis of 280-550 kg·mm$^2$, the CG x-axis being parallel to the x-axis and passing through the CG of the golf club head, a moment of inertia (Iyy) about a CG y-axis of 250-400 kg·mm$^2$ and less than Ixx, the CG y-axis being parallel to the y-axis and passing through the CG of the golf club head, and a moment of inertia (Izz) about a CG z-axis that is greater than Ixx and greater than Iyy, the CG z-axis being parallel to the z-axis and passing through the CG of the golf club head;

wherein there is a face-to-crown transition where the face portion connects to the crown near the front end of the club body and a skirt-to-crown transition where the skirt connects to the crown;

an imaginary rearward mass box (IRMB) located at a rearward portion of the club head having a constant IRMB rectangular cross-section with a IRMB first side, a IRMB second side, a IRMB third side, and a IRMB fourth side, wherein:

the IRMB first side is adjacent and perpendicular to the IRMB second side and connects to the IRMB second side at a IRMB first vertex, the IRMB third side is adjacent and perpendicular to the IRMB second side and connects to the IRMB second side at a IRMB second vertex, the IRMB third side is adjacent and perpendicular to the IRMB fourth side and connects to the IRMB fourth side at a IRMB third vertex, and the IRMB first side is adjacent and perpendicular to the IRMB fourth side and connects to the IRMB fourth side at a IRMB fourth vertex;

the IRMB fourth side of the constant IRMB rectangular cross-section is parallel to the z-axis and extends from the ground plane to a point tangent to the trailing edge, the IRMB first side of the constant IRMB rectangular cross-section is coincident with the ground plane and extends from the IRMB fourth side forward in a negative y-direction, and the IRMB second side of the constant IRMB rectangular cross-section extends upward in a positive z-direction;

the constant IRMB rectangular cross-section having a IRMB height of 30 mm as measured parallel to the z-axis and between the IRMB first side and the IRMB third side, and a IRMB width of 35 mm as measured parallel to the y-axis and between the IRMB second side and the IRMB fourth side;

the imaginary rearward mass box extends parallel to the x-axis from a heel-ward most portion of the golf club head to a toe-ward most portion of the golf club head encompassing all club head mass within the imaginary rearward mass box, and the imaginary rearward mass box encompasses at least 30.1 grams;

the imaginary rearward mass box includes an imaginary rearward mass box geometric center point which is defined as a point in a y-z plane passing through the origin located one-half a distance from the IRMB first side to the IRMB third side of the imaginary rearward mass box and one-half a distance from the IRMB second side to the IRMB fourth side of the imaginary rearward mass box;

a rearward mass box vector distance (V2) is defined as a distance as measured in the y-z plane passing through the origin from the imaginary rearward mass box geometric center point to a y-z plane CG projection that is a projection, parallel to the x-axis, of the CG onto the y-z plane passing through the origin; and a MOI effectiveness of the rearward mass box is defined as the mass within the imaginary rearward mass box multiplied by the square of the rearward mass box vector distance (V2);

an imaginary forward mass box (IFMB) located at a forward portion of the club head having a constant IFMB rectangular cross-section having a IFMB first side, a IFMB second side, a IFMB third side, and a IFMB fourth side, wherein:

the IFMB first side is adjacent and perpendicular to the IFMB second side and connects to the IFMB second side at a first IFMB vertex, the IFMB third side is adjacent and perpendicular to the IFMB second side and connects to the IFMB second side at a second IFMB vertex, the IFMB third side is adjacent and perpendicular to the IFMB fourth side and connects to the IFMB fourth side at a third IFMB vertex, and the IFMB first side is adjacent and perpendicular to the IFMB fourth side and connects to the IFMB fourth side at a fourth IFMB vertex;

an offset forward origin is positioned at the intersection of an offset forward origin x-axis, an offset forward origin y-axis, and an offset forward origin z-axis, with the offset forward origin z-axis extending parallel to the z-axis and tangent to the leading edge of the golf club head, the offset forward origin y-axis extending parallel to the y-axis and coincident with the ground plane, and the offset forward origin x-axis extending parallel to the x-axis and perpendicular to both the offset forward origin y-axis and the offset forward origin z-axis;

the first IFMB vertex is aligned with the offset forward origin such that the IFMB first side of the constant IFMB rectangular cross-section is coincident with the ground plane and extends from the offset forward origin rearward in a positive y-direction and the IFMB second side of the constant IFMB rectangular cross-section extends from the offset forward origin upward in the positive z-direction along the offset forward origin z-axis;

the constant IFMB rectangular cross-section having a IFMB height of 20 mm as measured along the offset forward origin z-axis and between the IFMB first side and the IFMB third side, and a IFMB width of 35 mm as measured along the offset forward origin y-axis and between the IFMB second side and the IFMB fourth side;

the imaginary forward mass box extends parallel to the x-axis from the heel-ward most portion of the golf club head to the toe-ward most portion of the golf club head encompassing all club head mass within the imaginary forward mass box, and the imaginary forward mass box encompasses no more than 55.2 grams;

the imaginary forward mass box includes an imaginary forward mass box geometric center point which is defined as a point in the y-z plane passing through the origin located one-half the distance from the IFMB first side to the IFMB third side of the imaginary forward mass box and one-half the distance from the IFMB second side to the IFMB fourth side of the imaginary forward mass box;

a forward mass box vector distance (V1) is defined as a distance as measured in the y-z plane passing through the origin from the imaginary forward mass box geometric center point to the y-z plane CG projection, and the forward mass box vector distance (V1) is at least 24.5 mm; and a MOI effectiveness of the forward mass box is defined as the mass within the imaginary forward mass box multiplied by the square of the forward mass box vector distance (V1);

at least one external mass element attached to the club body and at least partially within the imaginary rearward mass box;

wherein a CG effectiveness product (CGeff) for the golf club head is defined as CGeff=CGy×Δz, and the CGeff is at least 806 $mm^2$;

wherein the CGy is 31.6-52.8 mm;

wherein the Δz is 24.2-29.7 mm;

wherein a MOI effectiveness summation is defined as the sum of the MOI effectiveness of the forward mass box and the MOI effectiveness of the rearward mass box, and a ratio of the MOI effectiveness summation to the Ixx moment of inertia is least 0.453; and wherein the golf club head has a volume of 430-500 cc, and a total mass of the club head is no more than 210.7 grams.

2. The golf club head of claim 1, wherein an Ixx/Izz ratio of the Ixx moment of inertia to the Izz moment of inertia is 0.60-0.90.

3. The golf club head of claim 2, wherein the CGz distance is between −8 mm and 0 mm, a maximum club head width is between 110 mm and 130 mm, and the Izz moment of inertia is greater than 500 kg·$mm^2$ and less than 702 kg·$mm^2$.

4. The golf club head of claim 3, wherein the Ixx moment of inertia is at least 310 kg·$mm^2$, and the Ixx/Izz ratio is 0.63-0.88.

5. The golf club head of claim 4, wherein the rearward mass box vector distance (V2) is at least 51.0 mm, and the Ixx/Izz ratio is no more than 0.84.

6. The golf club head of claim 3, wherein a portion of the at least one external mass element is located at least 110.2 mm from the leading edge.

7. The golf club head of claim 6, wherein at least 20.75 grams of the club head's total mass is located within a rearmost 12.5 mm of the length, the Ixx moment of inertia is at least 310 kg·$mm^2$, and the Ixx/Izz ratio is 0.63-0.88.

8. The golf club head of claim 7, wherein at least 29 grams of the club head's total mass is located within the rearmost 12.5 mm of the length, the length is at least 115 mm, the maximum club head width is at least 120.5 mm, and the Ixx/Izz ratio is greater than 0.66.

9. The golf club head of claim 8, wherein the Ixx/Izz ratio is greater than 0.68, the CGy is at least 41.9 mm, and at least one external mass element is entirely within the imaginary rearward mass box.

10. The golf club head of claim 9, wherein the Ixx/Izz ratio is greater than 0.70, and the CGz distance is between −8 mm and −3 mm.

11. The golf club head of claim 9, wherein the Ixx/Izz ratio is no more than 0.75, and the external mass element located entirely within the imaginary rearward mass box is also below the origin, and Ixx moment of inertia is at least 427 kg·mm$^2$.

12. The golf club head of claim 8, wherein the imaginary rearward mass box encompasses no more than 74.0 grams, and the Ixx/Izz ratio is no more than 0.84.

13. The golf club head of claim 12, wherein the at least one external mass element is 35-58 grams.

14. The golf club head of claim 8, wherein the CGy is at least 41.9 mm, and the Iyy moment of inertia is 320-370 kg·mm$^2$.

15. The golf club head of claim 8, wherein the CGy is at least 41.9 mm, and the Izz moment of inertia is no more than 190 kg·mm$^2$ greater than the Ixx moment of inertia, and the Izz moment of inertia is at least 528 kg·mm$^2$.

16. The golf club head of claim 15, wherein the Izz moment of inertia is at least 140 kg·mm$^2$ greater than the Ixx moment of inertia, the imaginary forward mass box encompasses at least 36.5 grams, a total mass of the club head outside the imaginary forward mass box and the imaginary rearward mass box is 87.9-157.7 grams, and the Izz moment of inertia is at least 536 kg·mm$^2$.

17. The golf club head of claim 8, wherein the ratio of the MOI effectiveness summation to the Ixx moment of inertia is no more than 0.585.

18. The golf club head of claim 8, further including a second external mass element attached to the club body and at least partially located within the imaginary forward mass box.

19. The golf club head of claim 18, wherein a portion of the second external mass element intersects the y-z plane passing through the origin.

20. The golf club head of claim 19, wherein the CGy is at least 41.9 mm, the rearward mass box vector distance (V2) is at least 51.0 mm, and the CGz distance is between −8 mm and −3 mm.

21. The golf club head of claim 2, wherein the face portion includes a non-metal insert attached directly to the body via adhesive, and the non-metal insert contacts a golf ball at impact.

22. The golf club head of claim 21, wherein the non-metal insert includes a face plate comprising a plurality of composite prepreg plies.

23. The golf club head of claim 22, wherein the plurality of composite prepreg plies includes a plurality of prepreg plies and at least one cluster comprising a plurality of prepreg strips.

24. The golf club head of claim 23, wherein at least one cluster is located between adjacent prepreg plies.

25. The golf club head of claim 23, wherein the plurality of prepreg strips overlap each other.

26. The golf club head of claim 23, wherein at least one of the plurality of prepreg strips extend continuously in a straight line from a first point on a perimeter of the insert to a second point on the perimeter of the insert.

27. The golf club head of claim 21, wherein the non-metal insert includes a face plate comprising a polymer cover layer having a cover layer thickness of 0.1-3.0 mm.

28. The golf club head of claim 21, wherein the non-metal insert includes a plurality of surface features that contact the golf ball at impact.

29. The golf club head of claim 21, wherein the plurality of surface features have a peak through height of 2-25 μm.

30. The golf club head of claim 28, wherein the plurality of surface features are formed in a polymer cover layer having a cover layer thickness of 0.2-1.2 mm.

31. The golf club head of claim 21, wherein the non-metal insert includes a face plate comprising a thermoplastic material.

32. The golf club head of claim 21, wherein the non-metal insert has an effective Shore D hardness of 75-90.

33. The golf club head of claim 21, wherein the non-metal insert has a mean surface roughness of 2.5-5 μm.

34. The golf club head of claim 1, wherein:

the CGy is no less than 41.9; and the ratio of the MOI effectiveness summation to the Ixx moment of inertia is at least 0.532.

35. The golf club head of claim 34, wherein:

the imaginary rearward mass box encompasses at least 48.9 grams with at least 20.75 grams located in a rearmost 12.5 mm of the length; and at least a portion of the external mass element is located at least 104.7 mm from the leading edge.

36. The golf club head of claim 34, wherein at least a portion of the external mass element is located at least 110.2 mm from the leading edge, at least 29 grams of the club head's total mass is located within a rearmost 12.5 mm of the length, and an Ixx/Izz ratio of the Ixx moment of inertia to the Izz moment of inertia is 0.60-0.90.

37. The golf club head of claim 36, wherein at least a portion of the external mass element is toe-ward of the y-z plane, and a maximum club head width is between 110 mm and 130 mm.

38. The golf club head of claim 37, wherein at least a portion of the external mass element is heel-ward of the y-z plane, and the Ixx moment of inertia is at least 310 kg·mm$^2$, and the Ixx/Izz ratio is 0.63-0.88.

39. The golf club head of claim 38, wherein the external mass element is entirely within the imaginary rearward mass box, the rearward mass box vector distance (V2) is at least 51.0 mm, and the Ixx/Izz ratio is no more than 0.84.

40. The golf club head of claim 39, wherein the external mass element is entirely below the origin.

41. The golf club head of claim 38, wherein the length is at least 115 mm, the maximum club head width is at least 120.5 mm, and the Ixx/Izz ratio is greater than 0.66.

42. The golf club head of claim 41, wherein the external mass element comprises tungsten and has a maximum dimension measured in the y-axis direction of no more than 25 mm, and the Ixx/Izz ratio is greater than 0.68.

43. The golf club head of claim 41, wherein the imaginary rearward mass box encompasses no more than 74.0 grams, and the Ixx/Izz ratio is no more than 0.84.

44. The golf club head of claim 41, wherein the at least one external mass element is 33.6-58 grams.

45. The golf club head of claim 41, wherein the Izz moment of inertia is at least 140 kg·mm$^2$ greater than the Ixx moment of inertia and the Izz moment of inertia is no more than 190 kg·mm$^2$ greater than the Ixx moment of inertia.

46. The golf club head of claim 45, wherein the Iyy moment of inertia is 320-370 kg·mm$^2$.

47. The golf club head of claim 45, wherein a non-mass box mass is the amount of the total mass of the club head not contained within the imaginary rearward mass box and the imaginary forward mass box, and the non-mass box mass is 87.9-125.2 grams.

48. The golf club head of claim 47, further including a second external mass element attached to the club body and at least partially located within the imaginary forward mass box.

49. The golf club head of claim 48, wherein a portion of the second external mass element intersects the y-z plane passing through the origin.

50. The golf club head of claim 1, wherein:

the imaginary rearward mass box encompasses at least 48.9 grams with at least 29 grams located in a rearmost 12.5 mm of the length; and at least a portion of the external mass element is located at least 104.7 mm from the leading edge; and the rearward mass box vector distance (V2) is at least 51.0 mm, and the Ixx/Izz ratio is no more than 0.84.

51. The golf club head of claim 1, wherein a non-mass box mass is the amount of the total mass of the club head not contained within the imaginary rearward mass box and the imaginary forward mass box, and the non-mass box mass is 87.9-125.2 grams.

52. The golf club head of claim 51, wherein:

the imaginary rearward mass box encompasses at least 48.9 grams;

at least a portion of the external mass element is located at least 104.7 mm from the leading edge;

and an Ixx/Izz ratio of the Ixx moment of inertia to the Izz moment of inertia is 0.60-0.90.

53. The golf club head of claim 52, wherein at least a portion of the external mass element is toe-ward of the y-z plane, the Ixx moment of inertia is 283-507 kg·mm$^2$, and the Izz moment of inertia is 380-606 kg·mm$^2$, and the Ixx/Izz ratio is 0.63-0.88.

54. A golf club head comprising:

a club body including a leading edge, a trailing edge, a crown, a sole, a skirt disposed between and connecting the crown and the sole, a length from the leading edge to the trailing edge is 110.8-125.1 mm, and a volume of 430-500 cc;

an adjustable head-shaft connection assembly coupled to the club body and operable to adjust at least one of a loft angle or a lie angle of a golf club formed when the golf club head is attached to a golf club shaft via the head-shaft connection assembly;

a face portion at a front end of the club body, the face portion including a geometric center defining an origin of a coordinate system when the golf club head is ideally positioned, the coordinate system including:

an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis;

the golf club head defining a center of gravity (CG), the CG being a distance CGy from the origin as measured along the y-axis and a distance CGz from the origin as measured along the z-axis, the CG located a distance Δz from a ground plane, the ground plane being defined as a plane in contact with the sole of the golf club head in an ideal address position;

wherein the golf club head has a moment of inertia (Ixx) about a CG x-axis, the CG x-axis being parallel to the x-axis and passing through the CG of the golf club head, a moment of inertia (Iyy) about a CG y-axis, the CG y-axis being parallel to the y-axis and passing through the CG of the golf club head, and a moment of inertia (Izz) about a CG z-axis, the CG z-axis being parallel to the z-axis and passing through the CG of the golf club head;

wherein there is a face-to-crown transition where the face connects to the crown near the front end of the club body and a skirt-to-crown transition where the skirt connects to the crown;

an imaginary rearward mass box (IRMB) located at a rearward portion of the club head having a constant IRMB rectangular cross-section with a IRMB first side, a IRMB second side, a IRMB third side, and a IRMB fourth side, wherein:

the IRMB first side is adjacent and perpendicular to the IRMB second side and connects to the IRMB second side at a IRMB first vertex, the IRMB third side is adjacent and perpendicular to the IRMB second side and connects to the IRMB second side at a IRMB second vertex, the IRMB third side is adjacent and perpendicular to the IRMB fourth side and connects to the IRMB fourth side at a IRMB third vertex, and the IRMB first side is adjacent and perpendicular to the IRMB fourth side and connects to the IRMB fourth side at a IRMB fourth vertex;

the IRMB fourth side of the constant IRMB rectangular cross-section is parallel to the z-axis and extends from the ground plane to a point tangent to the trailing edge, the IRMB first side of the constant IRMB rectangular cross-section is coincident with the ground plane and extends from the IRMB fourth side forward in a negative y-direction, and the IRMB second side of the constant IRMB rectangular cross-section extends upward in a positive z-direction;

the constant IRMB rectangular cross-section having a IRMB height of 30 mm as measured parallel to the z-axis and between the IRMB first side and the IRMB third side, and a IRMB width of 35 mm as measured parallel to the y-axis and between the IRMB second side and the IRMB fourth side;

the imaginary rearward mass box extends parallel to the x-axis from a heel-ward most portion of the golf club head to a toe-ward most portion of the golf club head encompassing all club head mass within the imaginary rearward mass box, and the imaginary rearward mass box encompasses at least 48.9 grams with at least 29 grams located in a rearmost 12.5 mm of the length;

the imaginary rearward mass box includes an imaginary rearward mass box geometric center point which is defined as a point in a y-z plane passing through the origin located one-half a distance from the IRMB first side to the IRMB third side of the imaginary rearward mass box and one-half a distance from the IRMB second side to the IRMB fourth side of the imaginary rearward mass box;

a rearward mass box vector distance (V2) is defined as a distance as measured in the y-z plane passing through the origin from the imaginary rearward mass box geometric center point to a y-z plane CG projection that is a projection, parallel to the x-axis, of the CG onto the y-z plane passing through the origin; and a MOI effectiveness of the rearward mass box is defined as the mass within the imaginary rearward mass box multiplied by the square of the rearward mass box vector distance (V2) is at least 51 mm;

an imaginary forward mass box (IFMB) located at a forward portion of the club head having a constant IFMB rectangular cross-section having a IFMB first side, a IFMB second side, a IFMB third side, and a IFMB fourth side, wherein:

the IFMB first side is adjacent and perpendicular to the IFMB second side and connects to the IFMB second side at a first IFMB vertex, the IFMB third side is adjacent and perpendicular to the IFMB second side and connects to the IFMB second side at a second IFMB vertex, the IFMB third side is adjacent and perpendicular to the IFMB fourth side and connects to the IFMB fourth side at a third IFMB vertex, and the IFMB first side is adjacent and perpendicular to the IFMB fourth side and connects to the IFMB fourth side at a fourth IFMB vertex;

an offset forward origin is positioned at the intersection of an offset forward origin x-axis, an offset forward origin y-axis, and an offset forward origin z-axis, with the offset forward origin z-axis extending parallel to the z-axis and tangent to the leading edge of the golf club head, the offset forward origin y-axis extending parallel to the y-axis and coincident with the ground plane, and the offset forward origin x-axis extending parallel to the x-axis and perpendicular to both the offset forward origin y-axis and the offset forward origin z-axis;

the first IFMB vertex is aligned with the offset forward origin such that the IFMB first side of the constant IFMB rectangular cross-section is coincident with the ground plane and extends from the offset forward origin rearward in a positive y-direction and the IFMB second side of the constant IFMB rectangular cross-section extends from the offset forward origin upward in the positive z-direction along the offset forward origin z-axis;

the constant IFMB rectangular cross-section having a IFMB height of 20 mm as measured along the offset forward origin z-axis and between the IFMB first side and the IFMB third side, and a IFMB width of 35 mm as measured along the offset forward origin y-axis and between the IFMB second side and the IFMB fourth side;

the imaginary forward mass box extends parallel to the x-axis from the heel-ward most portion of the golf club head to the toe-ward most portion of the golf club head encompassing all club head mass within the imaginary forward mass box, and the imaginary forward mass box encompasses no more than 48.9 grams;

the imaginary forward mass box includes an imaginary forward mass box geometric center point which is defined as a point in the y-z plane passing through the origin located one-half the distance from the IFMB first side to the IFMB third side of the imaginary forward mass box and one-half the distance from the IFMB second side to the IFMB fourth side of the imaginary forward mass box;

a forward mass box vector distance (V1) is defined as a distance as measured in the y-z plane passing through the origin from the imaginary forward mass box geometric center point to the y-z plane CG projection, and the forward mass box vector distance (V1) is at least 31.6 mm; and a MOI effectiveness of the forward mass box is defined as the mass within the imaginary forward mass box multiplied by the square of the forward mass box vector distance (V1); and at least one external mass element, having a mass of 33.6-58 grams, attached to the club body and at least partially within the imaginary rearward mass box with at least a portion of the external mass element is located at least 104.7 mm from the leading edge;

wherein a CG effectiveness product (CGeff) for the golf club head is defined as $CGeff=CGy\times\Delta z$, and the $CG_{eff}$ is at least 987 $mm^2$;

wherein the CGy is 41.9-52.8 mm; and wherein the $\Delta z$ is 24.2-29.7 mm, and a total mass of the club head is no more than 210.7 grams.

* * * * *